US007189501B2

(12) United States Patent
Makuta et al.

(10) Patent No.: US 7,189,501 B2
(45) Date of Patent: Mar. 13, 2007

(54) SILVER HALIDE COLOR PHOTOGRAPHIC PHOTOSENSITIVE MATERIAL

(75) Inventors: Toshiyuki Makuta, Minami-ashigara (JP); Hiroyuki Yoneyama, Minami-ashigara (JP); Nobuo Seto, Minami-ashigara (JP); Kiyoshi Takeuchi, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/746,296

(22) Filed: Dec. 29, 2003

(65) Prior Publication Data

US 2005/0074710 A1 Apr. 7, 2005

(30) Foreign Application Priority Data

Dec. 27, 2002 (JP) ..... 2002-382505
Mar. 31, 2003 (JP) ..... 2003-097156
Mar. 31, 2003 (JP) ..... 2003-097255

(51) Int. Cl.
*G03C 1/08* (2006.01)

(52) U.S. Cl. ..... 430/551; 430/543; 430/556; 430/557; 430/558; 430/599; 430/600; 430/601; 430/602; 430/603; 430/604; 430/605; 430/607; 430/609; 430/610; 430/627; 430/631; 430/931

(58) Field of Classification Search ..... 430/557, 430/556, 551, 599–605, 607, 609, 610, 627, 430/631, 931
See application file for complete search history.

(56) References Cited

U.S. PATENT DOCUMENTS 3,841,880 A 10/1974 Kertel
5,212,055 A 5/1993 Morigaki et al.
5,451,501 A 9/1995 Mizukawa et al.
6,677,110 B2 * 1/2004 Takeuchi et al. ..... 430/558
6,727,053 B2 * 4/2004 Takeuchi et al. ..... 430/558
2003/0073047 A1 4/2003 Takeuchi et al.

FOREIGN PATENT DOCUMENTS

EP 0 336 411 A2 10/1989
JP 52-082423 A 7/1977
JP 01-302249 A 12/1989
JP 2001-242606 A 9/2001

* cited by examiner

*Primary Examiner*—Geraldina Visconti
(74) *Attorney, Agent, or Firm*—Sughrue Mion, PLLC

(57) ABSTRACT

A silver halide color photographic photosensitive material that has, on a support, at least one yellow color-forming photosensitive silver halide emulsion layer, at least one magenta color-forming photosensitive silver halide emulsion layer, and at least one cyan color-forming photosensitive silver halide emulsion layer, wherein at least one specific yellow or magenta dye-forming coupler and at least one compound represented by formula (Ph) are contained in the same layer:

Formula (Ph)

wherein $R_{b1}$ represents a specific functional group; and $R_{b2}$ to $R_{b5}$ each independently represent a hydrogen or halogen atom, or a specific functional group.

23 Claims, No Drawings

SILVER HALIDE COLOR PHOTOGRAPHIC PHOTOSENSITIVE MATERIAL

FIELD OF THE INVENTION

The present invention relates to a silver halide color photographic photosensitive material. In particular, it relates to a silver halide color photographic photosensitive material that is excellent in rapid processing suitability, color forming properties, color reproduction, and image fastness after processing. Further, the present invention relates to a silver halide color photographic photosensitive material that is excellent in processing stability when processed with a running solution.

Further, the present invention relates to a silver halide color photographic photosensitive material that is excellent in fastness to light, especially, in yellow dye image areas and the white background area.

BACKGROUND OF THE INVENTION

In silver halide photographic photosensitive materials (hereinafter also referred to simply as "photosensitive material") for subtractive color photography, a color image is formed by dyes of three primary colors of yellow, magenta, and cyan. In the color photography that uses current p-phenylenediamine-series color-developing agents, acylacetanilide-series compounds are used as a yellow coupler. However, the hue of yellow dyes obtained from these yellow couplers is reddish, due to an inferior sharpness of a peak of the absorption curve at the longer wavelength side (that is, on the absorption curve, the peak in interest has subsidiary absorption at its foot portion at the longer wavelength side), and it is difficult to obtain a yellow hue with high purity. Further, the above-mentioned dyes are sometimes easily decomposed under conditions of high temperature and high humidity, or of irradiation of light, and thus they have insufficient image storability after development processing. Further, because the molecular extinction coefficient of the dye is low, large quantities of the coupler and silver halide are needed to obtain a desired color density, which results in an increase in the film thickness of the photosensitive material. Such increased film thickness sometimes reduces sharpness of the dye image, and also becomes a serious hindrance to the rapid processing that has been strongly utilized in recent years. In this situation, improvement of these performances has been desired.

In order to solve these problems, improvement of acyl groups and anilido groups were proposed on the couplers. Recently, as improved couplers of the conventional acylacetanilide-series couplers, there were proposed, for example, 1-alkylcyclopropanecarbonyl acetanilide-series compounds, cyclomalondiamide-type couplers, pyrrole-2- or 3-yl- or indole-2- or 3-yl-carbonylacetanilide-series couplers. The dyes formed from these couplers were improved in terms of both hue and molecular extinction coefficient of dyes formed, compared with the conventional ones. However, they are not satisfactory in image storability still. Further, owing to their complicated chemical structure, the synthesis route became longer, and consequently cost of the couplers became higher, causing a practical problem. In addition, U.S. Pat. No. 3,841,880, JP-A-52-82423 ("JP-A" means unexamined published Japanese patent application) and JP-A-2-28645 propose acetic ester-series and acetanilide-series couplers to which 1,2,4-benzothiadiazine-1,1-dioxide is bonded. However, these couplers are low in color-forming property, and they are inferior in sharpness of a peak of the absorption curve owing to the subsidiary absorption at the foot portion on the longer wavelength side. European Patent Publication No. 1246006A discloses couplers that have improved color-developing property and bottom definition of the absorption in the longer wavelength side of the aforementioned acetic ester-series and acetic anilide-series couplers to which 1,2,4-benzothiadiazine-1,1-dioxide is bonded, as described in U.S. Pat. No. 3,841,880, JP-A-52-82423 and JP-A-2-28645. These couplers described in European Patent Publication No. 1246006A give dyes having high coloring property (color-forming property) and excellent absorption characteristics. However, dyes obtained from these couplers are insufficient in fastness to light at low-density areas, under conditions of storage at high temperature. As a situation in which a photograph is exposed to an ambient light under conditions of storage at high temperature, for example, a display in a commercial photo studio can be imagined. Further, because a low density of yellow is used in forming an image of a human face, the fastness of yellow in such a density region is important. In this situation, there is a demand for further improvement of the yellow image in the low-density region. The bisphenol compounds used in Examples of the above-mentioned European Patent Publication No. 1246006A are not always sufficient to improve the fastness to light under the above-described storage conditions. In particular, there has been known no effective means for improving photo stain. Therefore, further improvement has been desired.

Further, in the color photography using current p-phenylenediamine-series color-developing agents, as magenta dye-forming couplers (hereinafter sometimes referred to simply as "magenta coupler"), pyrazoloazole-series magenta couplers have been preferably employed, from the view points of absorption characteristics and fastness to light. Of these couplers, 1H-pyrazolo[1,5-b][1,2,4]triazole-series magenta couplers having a tertiary alkyl group in the 6-position, and a phenylene group in the 2-position, as described in JP-A-1-302249, give a dye image having excellent fastness to light and heat. However, the couplers that are specifically disclosed in the aforementioned JP-A-1-302249 have a sulfonamido group in the meta-position of the phenylene group in the 2-position. In the spectral absorption characteristics of dyes obtained from such couplers having a substituent in the meta-position of the phenylene group in the 2-position, it has been found that the absorption at the foot portion is large and broadens. In view of color reproduction, there has been a demand for further improvement in the spectral absorption characteristics of these dyes. Further, it has been found that a photosensitive material containing the above-said coupler has problems in storability after exposure of the photosensitive material to development, such as fluctuation of photographic performances. In addition, there is a demand for photosensitive materials having minimized fluctuation of photographic performances against changes in compositions of processing solutions. A major factor of the change in the composition of a processing solution is increased contamination and accumulation of components from other processing-solutions, during running processing or intermittent continuous processing with an automatic processor. This phenomenon is significant when a replenisher amount is reduced, thereby resulting in reduction of the replenishment rate of a tank solution, or when use is made of a processing solution that has a longer workable period. The above "contamination of other processing solutions" is caused by a splash of a nearby solution, or by so-called back contamination in which components of the solution directly after the development step are carried into a color-developing solution, by a conveying leader or belt, a hanger hanging down a film, and so on. When the photosensitive material containing the coupler described in the aforementioned JP-A-1-302249 is processed with a color-developing solution contaminated by a fixing agent, which is one of these accumulating contamination components, the fluctuation of its photographic properties is great. Accordingly, further improvement in fluctuation has been desired.

Further, it has been found that photosensitive materials containing a coupler having a methyl group in the ortho-position of the phenylene group in the 2-position of the coupler, which said coupler is described in JP-A-3-48845, also has a problem that the color-forming property is low, in addition to the above-mentioned problems. Accordingly, further improvement of these couplers has been desired.

To solve these problems, further studies in improving of couplers were made. Such couplers were disclosed, for example, in JP-A-6-43611 and JP-A-2001-242606. However, 1H-pyrazolo[1,5-b][1,2,4]triazole-series magenta couplers, including these couplers, do not give satisfactory fastness to light in low-density portions. In particular, the low-density portion of magenta is an important density area in reproducing an image of a human face.

Further, for color papers, processing by means of a mini-lab has become predominant in recent years. Mini-labs are required not only high finished quality and stability but also so-called rapid processing suitability meaning the ability to process a great number of photographic papers in a small installation area.

The particular bisphenol compounds that are used in the aforementioned JP-A-6-43611 have the problem that the said bisphenol compound itself acts as a competing compound to a coupler, resulting in a reduction of developed color density in rapid processing.

In view of this situation, development of technologies that realize high fastness to light in the low-density area and high developed color density even in rapid processing, has been desired.

SUMMARY OF THE INVENTION

The present invention resides in a silver halide color photographic photosensitive material comprising, on a support, at least one yellow color-forming photosensitive silver halide emulsion layer, at least one magenta color-forming photosensitive silver halide emulsion layer, and at least one cyan color-forming photosensitive silver halide emulsion layer, wherein at least one yellow dye-forming coupler represented by formula (I) set forth below or at least one magenta dye-forming coupler, represented by any one of formulae (M-I) to (M-X) set forth below is included in the same layer as at least one compound represented by formula (Ph) set forth below:

Formula (I)

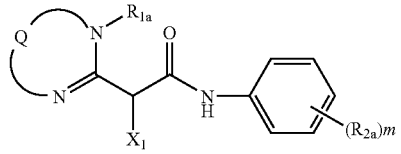

wherein, in formula (I), Q represents a group of non-metal atoms that forms a 5- to 7-membered ring in combination with the —N═C—N($R_{1a}$)—; $R_{1a}$ represents a substituent; $R_{2a}$ represents a substituent; m represents an integer of 0 or more and 5 or less; when m is 2 or more, $R_{2a}$s may be the same or different, and they may combine together to form a ring; and $X_1$ represents a hydrogen atom, or a group capable of being split-off upon a coupling reaction with an oxidized product of a developing agent;

Formula (M-I)

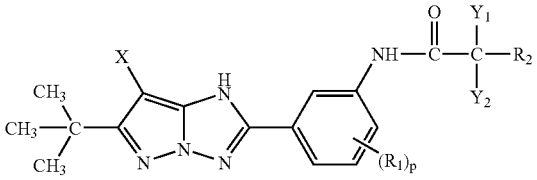

wherein, in formula (M-I), $Y_1$ and $Y_2$ each independently represent a hydrogen atom, an alkyl group, a cycloalkyl group, an aryl group, a heterocyclic group, an alkoxy group, a cycloalkoxy group, or a heterocyclic oxy group; $R_1$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, a ureido group, an acyl group, an acyloxy group, an amido group, a carbamoyl group, a sulfinyl group, a sulfonyl group, an amino group, a cyano group, a nitro group, or a hydroxyl group; $R_2$ represents a substituted or unsubstituted, alkyl group, alkenyl group, cycloalkyl group, aryl group, or heterocyclic group; when $R_2$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, an amido group, a sulfinyl group, a sulfonyl group, an amino group and a hydroxyl group, each of which may be further substituted; X represents a halogen atom; p represents 0, 1, or 2; and when p is 2, a plurality of $R_1$s may be the same or different;

Formula (M-II)

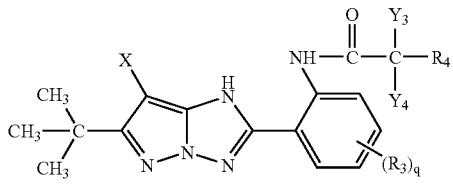

wherein, in formula (M-II), $Y_3$ and $Y_4$ each independently represent a hydrogen atom, an alkyl group, a cycloalkyl group, an aryl group, a heterocyclic group, an alkoxy group, a cycloalkoxy group, an aryloxy group, or a heterocyclic oxy group; $R_3$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_4$ represents a substituted or unsubstituted, alkyl group, alkenyl group, cycloalkyl group, aryl group, or heterocyclic group; when $R_4$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; q represents 0, 1, or 2; and when q is 2, a plurality of $R_3$s may be the same or different;

Formula (M-III)

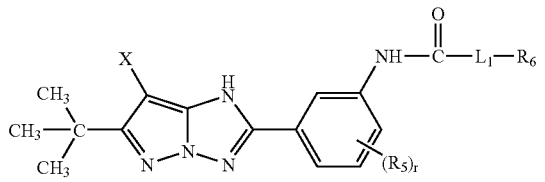

wherein, in formula (M-III), $L_1$ represents —$NR_7$— or —O—; $R_5$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_6$ represents a substituted or unsubstituted, alkyl group, alkenyl group, cycloalkyl group, aryl group, or heterocyclic group; $R_7$ represents a hydrogen atom, or a substituted or unsubstituted, alkyl group, alkenyl group, cycloalkyl group, aryl group, or heterocyclic group; when $R_6$ and $R_7$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; r represents 0, 1, or 2; and when r is 2, a plurality of $R_5$s may be the same or different;

Formula (M-IV)

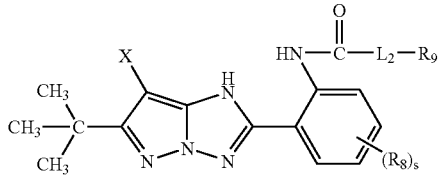

wherein, in formula (M-IV), $L_2$ represents —$NR_{10}$— or —O—; $R_8$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_9$ represents a substituted or unsubstituted, alkyl group, alkenyl group, cycloalkyl group, aryl group, or heterocyclic group; $R_{10}$ represents a hydrogen atom, or a substituted or unsubstituted, alkyl group, alkenyl group, cycloalkyl group, aryl group, or heterocyclic group; when $R_9$ and $R_{10}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; s represents 0, 1, or 2; and when s is 2, a plurality of $R_8$s may be the same or different;

Formula (M-V)

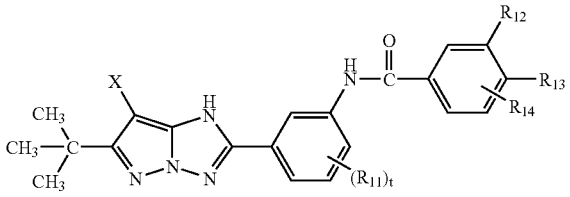

wherein, in formula (M-V), $R_{11}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{12}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; $R_{13}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfonyl group, an amino group, a sulfinyl group, or a hydroxyl group; $R_{14}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; t represents 0, 1, or 2; and when t is 2, a plurality of $R_{11}$s may be the same or different;

Formula (M-VI)

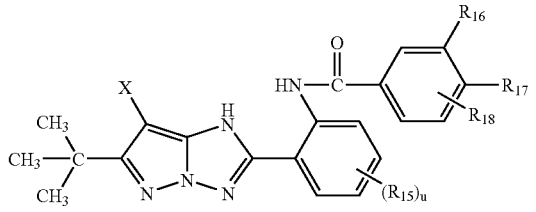

wherein, in formula (M-VI), $R_{15}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{16}$, $R_{17}$, and $R_{18}$ each independently represent a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; u represents 0, 1, or 2; and when u is 2, a plurality of $R_{15}$s may be the same or different;

Formula (M-VII)

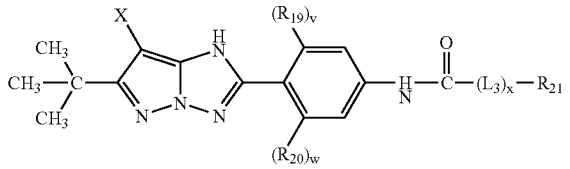

wherein, in formula (M-VII), $R_{19}$ and $R_{20}$ each independently represent an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; v and w each independently represent 0 or 1, but both v and w are not 0s at the same time; $L_3$ represents —$NR_{22}$— or —O—; X represents 0 or 1; $R_{21}$ represents a substituted or unsubstituted, alkyl group, alkenyl group, cycloalkyl group, aryl group, or heterocyclic group; $R_{22}$ represents a hydrogen atom, or a substituted or unsubstituted, alkyl group, alkenyl group, cycloalkyl group, aryl group, or heterocyclic group; when $R_{21}$ and $R_{22}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-VIII)

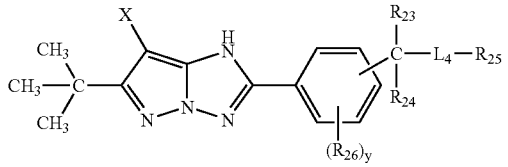

wherein, in formula (M-VIII), $R_{23}$ and $R_{24}$ each independently represent a hydrogen atom, an alkyl group, a cycloalkyl group, an aryl group, or a heterocyclic group; $R_{25}$ represents a substituted or unsubstituted, alkyl group, alkenyl group, cycloalkyl group, aryl group, or heterocyclic group; $R_{26}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; y represents 0, 1, or 2; when y is 2, a plurality of $R_{26}$s may be the same or different; $L_4$ represents a divalent linking group selected from —(C=O)—, —(C=O)—O—, —O—(C=O)—, —(C=O)—$NR_{27}$—, —$NR_{27}$—(C=O)—, —$NR_{27}$—(C=O)—$NR_{27}$—, —O—(C=O)—$NR_{27}$—, —$NR_{27}$—(C=O)—O—, —O—, —S—, —SO—, —$SO_2$—, and —$NR_{27}$—; $R_{27}$ represents a hydrogen atom, or a substituted or unsubstituted, alkyl group, alkenyl group, cycloalkyl group, aryl group, or heterocyclic group; when $R_{25}$ and $R_{27}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-IX)

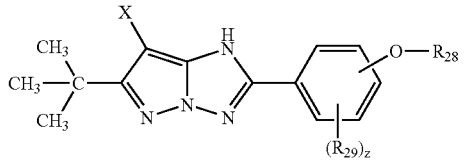

wherein, in formula (M-IX), $R_{28}$ represents a substituted or unsubstituted, alkyl group, alkenyl group, cycloalkyl group, aryl group, or heterocyclic group; when $R_{28}$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; $R_{29}$ represents an alkyl group, a cycloalkyl group, an alkenyl group, an alkynyl group, an aryl group, a heterocyclic group, a halogen atom, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; X represents a halogen atom; z represents 0, 1, or 2; and when z is 2, a plurality of $R_{29}$s may be the same or different;

Formula (M-X)

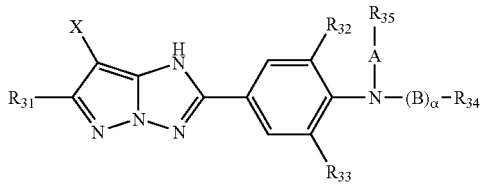

wherein, in formula (M-X), $R_{31}$ represents a tertiary alkyl group; $R_{32}$ and $R_{33}$ each independently represent a hydrogen atom or a substituent; X represents a hydrogen atom, a halogen atom, or an aryloxy group; A and B each independently represent —CO— or —$SO_2$—; α represents 0 or 1; $R_{34}$ represents a hydrogen atom, an alkyl group or an aryl group; $R_{35}$ represents an alkyl group, an aryl group, an alkoxy group, an alkylamino group or an arylamino group; and $R_{34}$ and $R_{35}$ may bond with each other to form a 5- to 7-membered ring;

Formula (Ph)

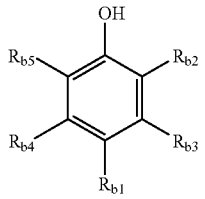

wherein, in formula (Ph), $R_{b1}$ represents an aliphatic group, an aryl group, a carbamoyl group, an acylamino group, a carbonyl group, or a sulfonyl group; and $R_{b2}$ to $R_{b5}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group.

Other and further features and advantages of the invention will appear more fully from the following description.

DETAILED DESCRIPTION OF THE INVENTION

According to the present invention, there are provided the following means:

(1) A silver halide color photographic photosensitive material comprising, on a support, at least one yellow color-forming photosensitive silver halide emulsion layer, at least one magenta color-forming photosensitive silver halide emulsion layer, and at least one cyan color-forming photosensitive silver halide emulsion layer, wherein at least one yellow dye-forming coupler represented by formula (I) set forth below or at least one magenta dye-forming coupler, represented by any one of formulae (M-I) to (M-X) set forth below is included in the same layer as at least one compound represented by formula (Ph) set forth below:

Formula (I)

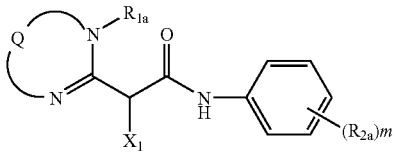

wherein, in formula (I), Q represents a group of non-metal atoms that forms a 5- to 7-membered ring in combination with the —N=C—N($R_{1a}$)—; $R_{1a}$ represents a substituent; $R_{2a}$ represents a substituent; m represents an integer of 0 or more and 5 or less; when m is 2 or more, $R_{2a}$s may be the same or different, and they may combine together to form a ring; and $X_1$ represents a hydrogen atom, or a group capable of being split-off upon a coupling reaction with an oxidized product of a developing agent;

Formula (M-I)

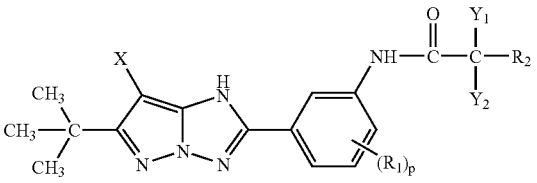

wherein, in formula (M-I), $Y_1$ and $Y_2$ each independently represent a hydrogen atom, an alkyl group, a cycloalkyl group, an aryl group, a heterocyclic group, an alkoxy group, a cycloalkoxy group, or a heterocyclic oxy group; $R_1$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, a ureido group, an acyl group, an acyloxy group, an amido group, a carbamoyl group, a sulfinyl group, a sulfonyl group, an amino group, a cyano group, a nitro group, or a hydroxyl group; $R_2$ represents a substituted or unsubstituted, alkyl group, alkenyl group, cycloalkyl group, aryl group, or heterocyclic group; when $R_2$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, an amido group, a sulfinyl group, a sulfonyl group, an amino group and a hydroxyl group, each of which may be further substituted; X represents a halogen atom; p represents 0, 1, or 2; and when p is 2, a plurality of $R_1$s may be the same or different;

Formula (M-II)

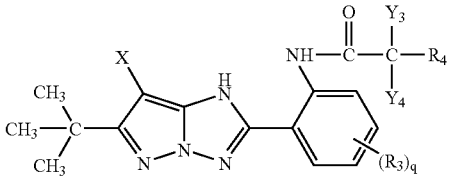

wherein, in formula (M-II), $Y_3$ and $Y_4$ each independently represent a hydrogen atom, an alkyl group, a cycloalkyl group, an aryl group, a heterocyclic group, an alkoxy group, a cycloalkoxy group, an aryloxy group, or a heterocyclic oxy group; $R_3$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_4$ represents a substituted or unsubstituted, alkyl group, alkenyl group, cycloalkyl group, aryl group, or heterocyclic group; when $R_4$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; q represents 0, 1, or 2; and when q is 2, a plurality of $R_3$s may be the same or different;

Formula (M-III)

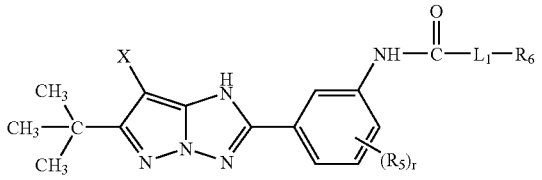

wherein, in formula (M-III), $L_1$ represents —$NR_7$— or —O—; $R_5$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_6$ represents a substituted or unsubstituted, alkyl group, alkenyl group, cycloalkyl group, aryl group, or heterocyclic group; $R_7$ represents a hydrogen atom, or a substituted or unsubstituted, alkyl group, alkenyl group, cycloalkyl group, aryl group, or heterocyclic group; when $R_6$ and $R_7$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; r represents 0, 1, or 2; and when r is 2, a plurality of $R_5$s may be the same or different;

Formula (M-IV)

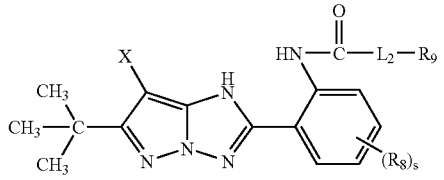

wherein, in formula (M-IV), $L_2$ represents —$NR_{10}$— or —O—; $R_8$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_9$ represents a substituted or unsubstituted, alkyl group, alkenyl group, cycloalkyl group, aryl group, or heterocyclic group; $R_{10}$ represents a hydrogen atom, or a substituted or unsubstituted, alkyl group, alkenyl group, cycloalkyl group, aryl group, or heterocyclic group; when $R_9$ and $R_{10}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; s represents 0, 1, or 2; and when s is 2, a plurality of $R_8$s may be the same or different;

Formula (M-V)

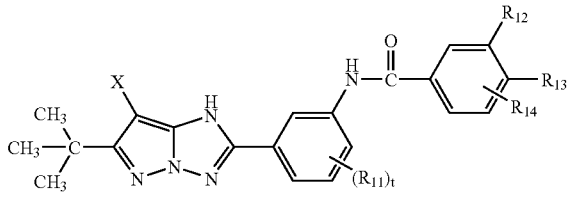

wherein, in formula (M-V), $R_{11}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{12}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; $R_{13}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfonyl group, an amino group, a sulfinyl group, or a hydroxyl group; $R_{14}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; t represents 0, 1, or 2; and when t is 2, a plurality of $R_{11}$s may be the same or different;

Formula (M-VI)

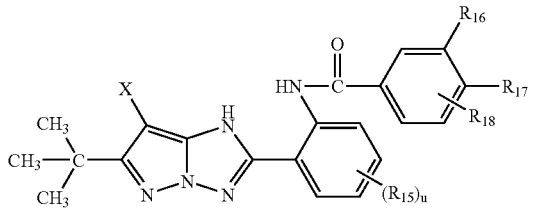

wherein, in formula (M-VI), $R_{15}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{16}$, $R_{17}$, and $R_{18}$ each independently represent a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; u represents 0, 1, or 2; and when u is 2, a plurality of $R_{15}$s may be the same or different;

Formula (M-VII)

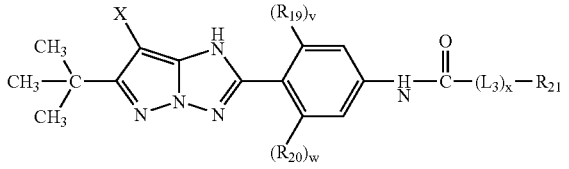

wherein, in formula (M-VII), $R_{19}$ and $R_{20}$ each independently represent an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; v and w each independently represent 0 or 1, but both v and w are not 0s at the same time; $L_3$ represents —$NR_{22}$— or —O—; X represents 0 or 1; $R_{21}$ represents a substituted or unsubstituted, alkyl group, alkenyl group, cycloalkyl group, aryl group, or heterocyclic group; $R_{22}$ represents a hydrogen atom, or a substituted or unsubstituted, alkyl group, alkenyl group, cycloalkyl group, aryl group, or heterocyclic group; when $R_{21}$ and $R_{22}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-VIII)

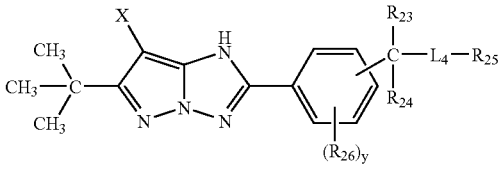

wherein, in formula (M-VIII), $R_{23}$ and $R_{24}$ each independently represent a hydrogen atom, an alkyl group, a cycloalkyl group, an aryl group, or a heterocyclic group; $R_{25}$ represents a substituted or unsubstituted, alkyl group, alkenyl group, cycloalkyl group, aryl group, or heterocyclic group; $R_{26}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; y represents 0, 1, or 2; when y is 2, a plurality of $R_{26}$s may be the same or different; $L_4$ represents a divalent linking group selected from —(C=O)—, —(C=O)—O—, —O—(C=O)—, —(C=O)—$NR_{27}$—, —$NR_{27}$—(C=O)—, —$NR_{27}$—(C=O)—$NR_{27}$—, —O—(C=O)—$NR_{27}$—, —$NR_{27}$—(C=O)—O—, —O—, —S—, —SO—, —$SO_2$—, and —$NR_{27}$—; $R_{27}$ represents a hydrogen atom, or a substituted or unsubstituted, alkyl group, alkenyl group, cycloalkyl group, aryl group, or heterocyclic group; when $R_{25}$ and $R_{27}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-IX)

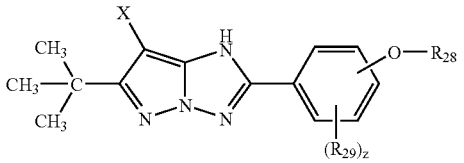

wherein, in formula (M-IX), $R_{28}$ represents a substituted or unsubstituted, alkyl group, alkenyl group, cycloalkyl group, aryl group, or heterocyclic group; when $R_{28}$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; $R_{29}$ represents an alkyl group, a cycloalkyl group, an alkenyl group, an alkynyl group, an aryl group, a heterocyclic group, a halogen atom, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; X represents a halogen atom; z represents 0, 1, or 2; and when z is 2, a plurality of $R_{29}$s may be the same or different;

Formula (M-X)

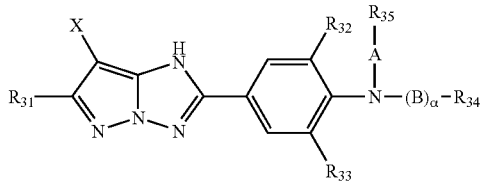

wherein, in formula (M-X), $R_{31}$ represents a tertiary alkyl group; $R_{32}$ and $R_{33}$ each independently represent a hydrogen atom or a substituent; X represents a hydrogen atom, a halogen atom, or an aryloxy group; A and B each independently represent —CO— or —$SO_2$—; α represents 0 or 1; $R_{34}$ represents a hydrogen atom, an alkyl group or an aryl group; $R_{35}$ represents an alkyl group, an aryl group, an alkoxy group, an alkylamino group or an arylamino group; and $R_{34}$ and $R_{35}$ may bond with each other to form a 5- to 7-membered ring;

Formula (Ph)

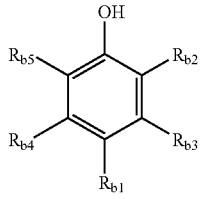

wherein, in formula (Ph), $R_{b1}$ represents an aliphatic group, an aryl group, a carbamoyl group, an acylamino group, a carbonyl group, or a sulfonyl group; and $R_{b2}$ to $R_{b5}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group.

(2) A silver halide color photographic photosensitive material comprising, on a support, at least one yellow color-forming photosensitive silver halide emulsion layer, at least one magenta color-forming photosensitive silver halide emulsion layer, and at least one cyan color-forming photosensitive silver halide emulsion layer, wherein a yellow color-forming photosensitive silver halide emulsion layer comprises at least one yellow dye-forming coupler represented by formula (I) set forth below, at least one compound represented by formula (TS-II) set forth below, and at least one compound represented by formula (Ph) set forth below:

Formula (I)

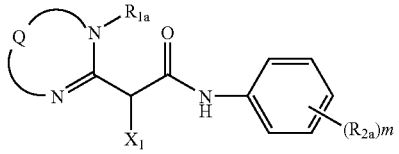

wherein, in formula (I), Q represents a group of non-metal atoms that forms a 5- to 7-membered ring in combination with the —N═C—N($R_{1a}$)—; $R_{1a}$ represents a substituent; $R_{2a}$ represents a substituent; m represents an integer of 0 or more and 5 or less; when m is 2 or more, $R_{2a}$s may be the same or different, and they may combine together to form a ring; and $X_1$ represents a hydrogen atom, or a group capable of being split-off upon a coupling reaction with an oxidized product of a developing agent;

Formula (TS-II)

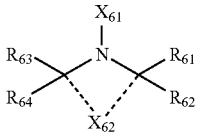

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may bond to each other to form a 5- to 7-membered ring; $X_{61}$ represents a hydrogen atom, an aliphatic group, an aliphatic oxy group, an aliphatic oxycarbonyl group, an aryloxycarbonyl group, an acyl group, an acyloxy group, an aliphatic oxycarbonyloxy group, an aryloxycarbonyloxy group, an aliphatic sulfonyl group, an aryl sulfonyl group, an aliphatic sulfinyl group, an arylsulfinyl group, a sulfamoyl group, a carbamoyl group, a hydroxyl group, or an oxy radical group; $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—;

Formula (Ph)

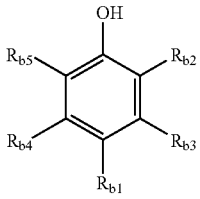

wherein, in formula (Ph), $R_{b1}$ represents an aliphatic group, an aryl group, a carbamoyl group, an acylamino group, a carbonyl group, or a sulfonyl group; and $R_{b2}$ to $R_{b5}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group.

(3) The silver halide color photographic photosensitive material according to the preceding item (2), further containing at least one compound selected from the group consisting of the compounds represented by any one of formulae (E-1) to (E-3) set forth below:

Formula (E-1)

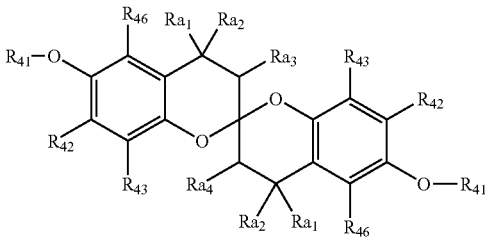

Formula (E-2)

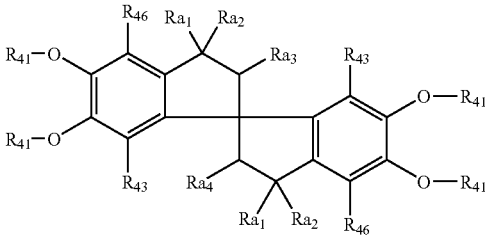

Formula (E-3)

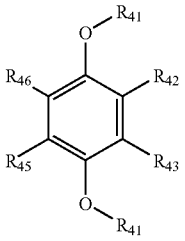

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si $(R_{47})(R_{48})(R_{49})$, in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and $Ra_1$ to $Ra_4$ each independently represent a hydrogen atom, or an aliphatic group.

(4) The silver halide color photographic photosensitive material according to the preceding item (2) or (3), further containing at least one compound selected from the group consisting of a compound represented by any one of formulae (TS-I), (TS-III), (TS-IV), (TS-V), (TS-VI), and (TS-VII) set forth below, a metal complex, a ultraviolet absorbing agent and a water-insoluble homopolymer or copolymer:

Formula (TS-I)

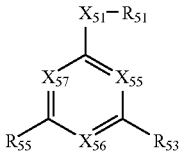

Formula (TS-III)

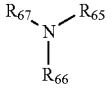

-continued

Formula (TS-IV)

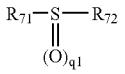

Formula (TS-V)

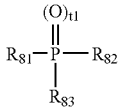

Formula (TS-VI)

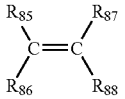

Formula (TS-VII)

$R_{91}—Y_{91}$ wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si$(R_{58})(R_{59})(R_{60})$, in which $R_{58}$, $R_{59}$, and $R_{60}$ each independently represent an aliphatic group, an aryl group, an aliphatic oxy group, or an aryloxy group; $X_{51}$ represents —O— or —N$(R_{57})$—, in which $R_{57}$ has the same meaning as $R_{51}$; $X_{55}$ represents —N═ or —C$(R_{52})$═; $X_{56}$ represents —N═ or —C$(R_{54})$═; $X_{57}$ represents —N═ or —C$(R_{56})$═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total number of carbon atoms of the compound represented by formula (TS-I) is 10 or more; and the compound represented by formula (TS-I) is neither identical to the compound represented by formula (Ph) nor the compound represented by any one of formulae (E-1) to (E-3);

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and both $R_{65}$ and $R_{66}$ are not hydrogen atoms at the same time;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q1 represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t1 represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and each of $R_{85}$ to $R_{88}$ cannot simultaneously represent a hydrogen atom; and wherein, in formula (TS-VII), $R_{91}$ represents an hydrophobic group having total carbon atoms of 10 or more; and $Y_{91}$ represents a monovalent organic group containing an alcoholic hydroxyl group;

(5) The silver halide color photographic photosensitive material according to any one of the above items (2) to (4), wherein the yellow dye-forming coupler represented by formula (I) is a yellow dye-forming coupler represented by formula (II):

Formula (II)

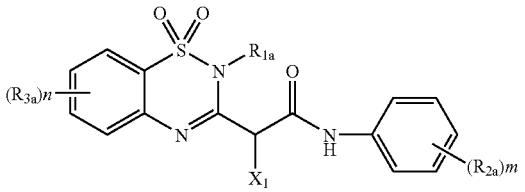

wherein, in formula (II), $R_{1a}$ represents a substituent; $R_{2a}$ represents a substituent; m represents an integer of 0 to 5; when m is 2 or more, a plurality of $R_{2a}$s may be the same or different, and the $R_{2a}$s may bond each other to form a ring; $R_{3a}$ represents a substituent; n represents an integer of 0 to 4; when n is 2 or more, a plurality of $R_{3a}$s may be the same or different, and the $R_{3a}$s may bond each other to form a ring; and $X_1$ represents a hydrogen atom, or a group capable of being split-off upon a coupling reaction with an oxidized product of a developing agent.

(6) The silver halide color photographic photosensitive material according to the above item (5), wherein, in the yellow dye-forming coupler represented by the above-mentioned formula (II), $R_{1a}$ is a substituted or unsubstituted alkyl group.

(7) The silver halide color photographic photosensitive material according to the preceding item (6), wherein, in the yellow dye-forming coupler represented by formula (II) set forth above, $R_{1a}$ represents a substituted or unsubstituted alkyl group having at least 2 carbon atoms; m is an integer of from 1 to 5; at least one $R_{2a}$ is located in an ortho-position to the —CONH— group, and is a group or atom selected from a halogen atom, an alkoxy group, an aryloxy group, an alkyl group, an alkylthio group and an arylthio group; and $X_1$ is a group capable of being split-off upon a coupling reaction with an oxidation product of a developing agent.

(8) The silver halide color photographic photosensitive material according to the preceding item (7), wherein, in the yellow dye-forming coupler represented by formula (II) set forth above, $R_{1a}$ is an alkoxypropyl group; and at least one $R_{2a}$ is an alkylthio group located in an ortho-position to the —CONH— group.

(9) The silver halide color photographic photosensitive material according to the preceding item (8), wherein, in the yellow dye-forming coupler represented by formula (II) set forth above, at least one of $R_{2a}$ is an alkylthio group located in an ortho-position to the —CONH— group, and another $R_{2a}$ is a t-butyl group located in the para-position to the alkylthio group.

(10) The silver halide color photographic photosensitive material according to any one of the preceding items (5) to (9), wherein, in the yellow dye-forming coupler represented by formula (II) set forth above, $X_1$ is a 5,5-dimethyloxazolidine-2,4-dione-3-yl group.

(Hereinafter, a first embodiment of the present invention means to include the silver halide color photographic photosensitive material described in the items (2) to (10) above.)

(11) A silver halide color photographic photosensitive material comprising, on a support, at least one yellow color-forming photosensitive silver halide emulsion layer, at least one magenta color-forming photosensitive silver halide emulsion layer and at least one cyan color-forming photosensitive silver halide emulsion layer, wherein at least one yellow-dye forming coupler represented by formula (Ia) set forth below is incorporated in the same layer as at least one compound represented by formula (Ph) set forth below:

Formula (Ia)

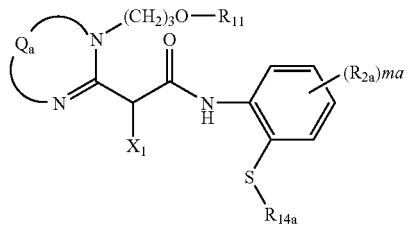

wherein, in formula (Ia), Qa represents a group of non-metal atoms that forms a 5- to 7-membered ring in combination with the —N═C—N($(CH_2)_3$O—$R_{11a}$)—; $R_{11a}$ represents an alkyl group having carbon atoms of 4 or more and 8 or less; $R_{2a}$ represents a substituent; $R_{14a}$ represents a primary alkyl group; $m_a$ represents an integer of 0 or more and 4 or less; when $m_a$ is 2 or more, $R_{2a}$s may be the same or different, and they may combine together to form a ring; and $X_1$ represents a hydrogen atom, or a group capable of being split-off upon a coupling reaction with an oxidized product of a developing agent;

Formula (Ph)

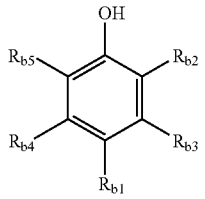

wherein, in formula (Ph), $R_{b1}$ represents an aliphatic group, an aryl group, a carbamoyl group, an acylamino group, a carbonyl group, or a sulfonyl group; and $R_{b2}$ to $R_{b5}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group.

(12) The silver halide color photographic photosensitive material according to the above item (11), wherein the compound represented by formula (Ph) is a compound represented by any one of formulae (Ph-1), (Ph-2) and (Ph-3):

Formula (Ph-1)

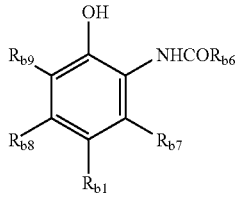

Formula (Ph-2)

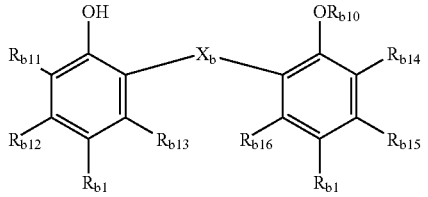

Formula (Ph-3)

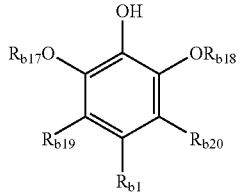

wherein, in formulae (Ph-1), (Ph-2) and (Ph-3), $R_{b1}$ represents an aliphatic group, an aryl group, a carbamoyl group, an acylamino group, a carbonyl group, or a sulfonyl group; $R_{b6}$ represents an aliphatic group, an aryl group, an amino group, or an acyl group; $R_{b7}$ to $R_{b9}$, $R_{b11}$ to $R_{b16}$, $R_{b19}$, and $R_{b20}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; $R_{b10}$ represents a hydrogen atom, an aliphatic group, an acyl group, an oxycarbonyl group, a silyl group, or a phosphoryl group; and $X_b$ represents an alkylene-linking group, a phenylene-linking group, an —O— linking group, or a —S— linking group; $R_{b17}$ and $R_{b18}$ each independently represent an aliphatic group, or an aryl group.

(13) The silver halide color photographic photosensitive material according to the preceding item (11) or (12), further containing at least one compound selected from the group consisting of compounds represented by any one of formulae (E-1) to (E-3) set forth below:

Formula (E-1)

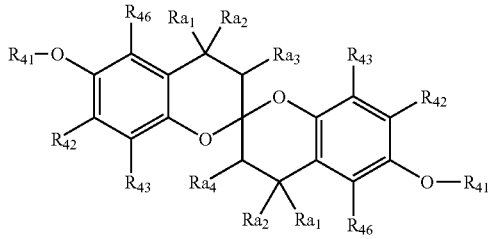

Formula (E-2)

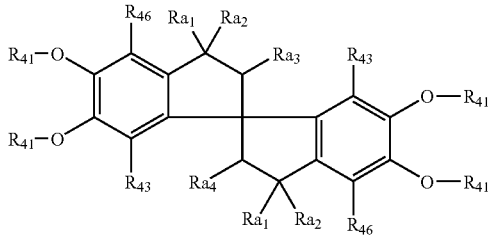

Formula (E-3)

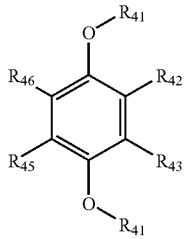

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and $Ra_1$ to $Ra_4$ each independently represent a hydrogen atom, or an aliphatic group.

(14) The silver halide color photographic photosensitive material according to any one of the preceding items (11) or (13), further containing at least one compound selected from the group consisting of a compound represented by any one of formulae (TS-I) to (TS-VII) set forth below, a metal complex, a ultraviolet absorbing agent and a water-insoluble homopolymer or copolymer:

Formula (TS-I)

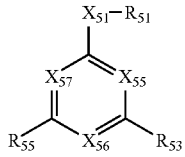

Formula (TS-II)

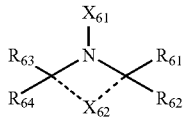

-continued

Formula (TS-III)

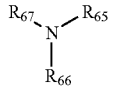

Formula (TS-IV)

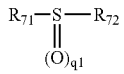

Formula (TS-V)

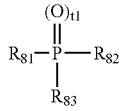

Formula (TS-VI)

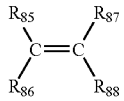

Formula (TS-VII)

wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$)($R_{60}$) in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or —C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total of carbon atoms of the compound represented by formula (TS-I) is 10 or more; and the compound represented by formulae (TS-I) is neither identical to the compound represented by formula (Ph) nor the compound represented by any one of formulae (E-1) to (E-3);

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, a carbamoyl group, a hydroxy group, or an oxy radical group; $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—; and the total of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total of carbon atoms of $R_{65}$ and $R_{66}$ is 7 or more; and each of $R_{65}$ and $R_{66}$ cannot simultaneously represent a hydrogen atom;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q1 represents 0, 1 or 2; and the total of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t1 represents 0 or 1; each combination of $R_{81}$ and $R_{82}$, and $R_{81}$ and $R_{83}$ may combine together to form a 5- to 8-membered ring; and the total of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and any two of $R_{85}$, $R_{86}$, $R_{87}$ and $R_{88}$ may combine together to form a 5- to 7-membered ring except an aromatic ring only consisting of carbon atoms as a skeleton atom; the total of carbon atoms of the compound represented by formula (TS-VI) is 10 or more; and each of $R_{85}$ to $R_{88}$ cannot simultaneously represent a hydrogen atom; and wherein, in formula (TS-VII), $R_{91}$ represents an hydrophobic group having total carbon atoms of 10 or more; and $Y_{91}$ represents a monovalent organic group containing an alcoholic hydroxyl group.

(Hereinafter, a second embodiment of the present invention means to include the silver halide color photographic photosensitive material described in the items (11) to (14) above.)

(15) A silver halide color photographic photosensitive material comprising, on a support, at least one yellow color-forming photosensitive silver halide emulsion layer, at least one magenta color-forming photosensitive silver halide emulsion layer and at least one cyan color-forming photosensitive silver halide emulsion layer, wherein at least one magenta dye-forming coupler, represented by any one of formulae (M-I) to (M-X) set forth below is incorporated in the same layer as at least one compound represented by formula (Ph-1) or (Ph-3) set forth below:

Formula (M-I)

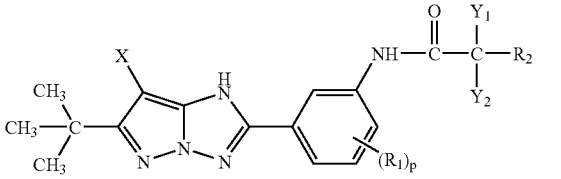

wherein, in formula (M-I), $Y_1$ and $Y_2$ each independently represent a hydrogen atom, an alkyl group, a cycloalkyl group, an aryl group, a heterocyclic group, an alkoxy group, a cycloalkoxy group, or a heterocyclic oxy group; $R_1$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, a ureido group, an acyl group, an acyloxy group, an amido group, a carbamoyl group, a sulfinyl group, a sulfonyl group, an amino group, a cyano group, a nitro group, or a hydroxyl group; $R_2$ represents a substituted or unsubstituted, alkyl group, alkenyl group, cycloalkyl group, aryl group, or heterocyclic group; when $R_2$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, an amido group, a sulfinyl group, a sulfonyl group, an amino group and a hydroxyl group, each of which may be further substituted; X represents a halogen atom; p represents 0, 1, or 2; and when p is 2, a plurality of $R_1$s may be the same or different;

Formula (M-II)

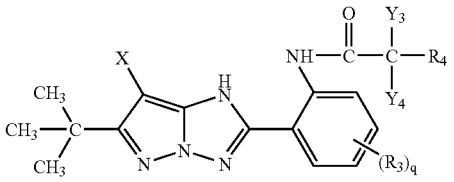

wherein, in formula (M-II), $Y_3$ and $Y_4$ each independently represent a hydrogen atom, an alkyl group, a cycloalkyl group, an aryl group, a heterocyclic group, an alkoxy group, a cycloalkoxy group, an aryloxy group, or a heterocyclic oxy group; $R_3$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_4$ represents a substituted or unsubstituted, alkyl group, alkenyl group, cycloalkyl group, aryl group, or heterocyclic group; when $R_4$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; q represents 0, 1, or 2; and when q is 2, a plurality of $R_3$s may be the same or different;

Formula (M-III)

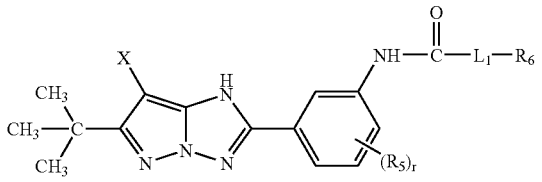

wherein, in formula (M-III), $L_1$ represents —$NR_7$— or —O—; $R_5$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_6$ represents a substituted or unsubstituted, alkyl group, alkenyl group, cycloalkyl group, aryl group, or heterocyclic group; $R_7$ represents a hydrogen atom, or a substituted or unsubstituted, alkyl group, alkenyl group, cycloalkyl group, aryl group, or heterocyclic group; when $R_6$ and $R_7$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; r represents 0, 1, or 2; and when r is 2, a plurality of $R_5$s may be the same or different;

Formula (M-IV)

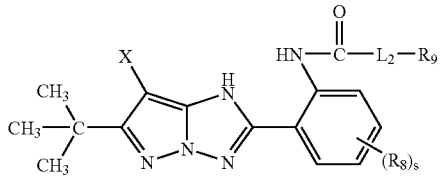

wherein, in formula (M-IV), $L_2$ represents —$NR_{10}$— or —O—; $R_8$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_9$ represents a substituted or unsubstituted, alkyl group, alkenyl group, cycloalkyl group, aryl group, or heterocyclic group; $R_{10}$ represents a hydrogen atom, or a substituted or unsubstituted, alkyl group, alkenyl group, cycloalkyl group, aryl group, or heterocyclic group; when $R_9$ and $R_{10}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; s represents 0, 1, or 2; and when s is 2, a plurality of $R_8$s may be the same or different;

Formula (M-V)

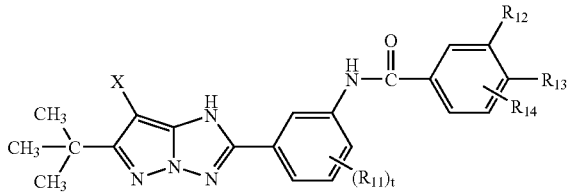

wherein, in formula (M-V), $R_{11}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{12}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; $R_{13}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfonyl group, an amino group, a sulfinyl group, or a hydroxyl group; $R_{14}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; t represents 0, 1, or 2; and when t is 2, a plurality of $R_{11}$s may be the same or different;

Formula (M-VI)

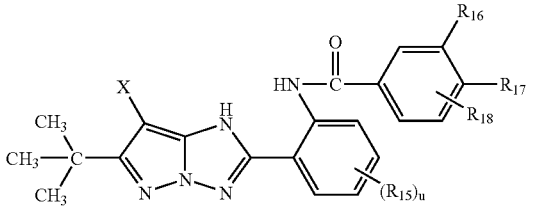

wherein, in formula (M-VI), $R_{15}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{16}$, $R_{17}$, and $R_{18}$ each independently represent a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; u represents 0, 1, or 2; and when u is 2, a plurality of $R_{15}$s may be the same or different;

Formula (M-VII)

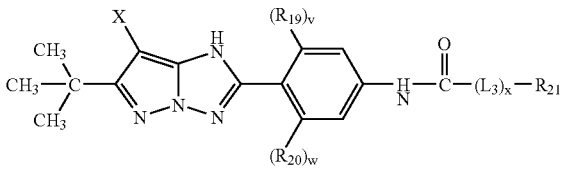

wherein, in formula (M-VII), $R_{19}$ and $R_{20}$ each independently represent an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; v and w each independently represent 0 or 1, and both v and w are not 0s at the same time; $L_3$ represents —$NR_{22}$— or —O—; X represents 0 or 1; $R_{21}$ represents a substituted or unsubstituted, alkyl group, alkenyl group, cycloalkyl group, aryl group, or heterocyclic group; $R_{22}$ represents a hydrogen atom, or a substituted or unsubstituted, alkyl group, alkenyl group, cycloalkyl group, aryl group, or heterocyclic group; when $R_{21}$ and $R_{22}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-VIII)

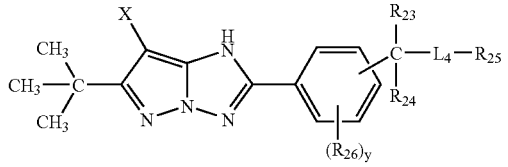

wherein, in formula (M-VIII), $R_{23}$ and $R_{24}$ each independently represent a hydrogen atom, an alkyl group, a cycloalkyl group, an aryl group, or a heterocyclic group; $R_{25}$ represents a substituted or unsubstituted, alkyl group, alkenyl group, cycloalkyl group, aryl group, or heterocyclic group; $R_{26}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; y represents 0, 1, or 2; when y is 2, a plurality of $R_{26}$s may be the same or different; $L_4$ represents a divalent linking group selected from —(C=O)—, —(C=O)—O—, —O—(C=O)—, —(C=O)—$NR_{27}$—, —$NR_{27}$—(C=O)—, —$NR_{27}$—(C=O)—$NR_{27}$—, —O—(C=O)—$NR_{27}$—, —$NR_{27}$—(C=O)—O—, —O—, —S—, —SO—, —$SO_2$—, and —$NR_{27}$—; $R_{27}$ represents a hydrogen atom, or a substituted or unsubstituted, alkyl group, alkenyl group, cycloalkyl group, aryl group, or heterocyclic group; when $R_{25}$ and $R_{27}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-IX)

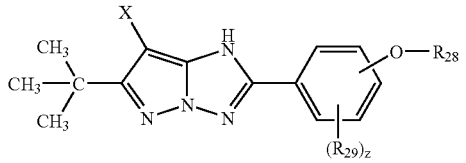

wherein, in formula (M-IX), $R_{28}$ represents a substituted or unsubstituted, alkyl group, alkenyl group, cycloalkyl group, aryl group, or heterocyclic group; when $R_{28}$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; $R_{29}$ represents an alkyl group, cycloalkyl group, an alkenyl group, an alkynyl group, an aryl group, a heterocyclic group, a halogen atom, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; X represents a halogen atom; z represents 0, 1, or 2; and when z is 2, a plurality of $R_{29}$s may be the same or different;

Formula (M-X)

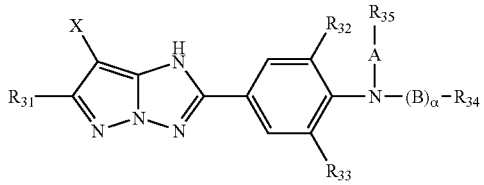

wherein, in formula (M-X), $R_{31}$ represents a tertiary alkyl group; $R_{32}$ and $R_{33}$ each independently represent a hydrogen atom or a substituent; X represents a hydrogen atom, a halogen atom, or an aryloxy group; A and B each independently represent —CO— or —$SO_2$—; α represents 0 or 1; $R_{34}$ represents a hydrogen atom, an alkyl group or an aryl group; $R_{35}$ represents an alkyl group, an aryl group, an alkoxy group, an alkylamino group or an arylamino group; and $R_{34}$ and $R_{35}$ may bond with each other to form a 5- to 7-membered ring;

Formula Ph-1

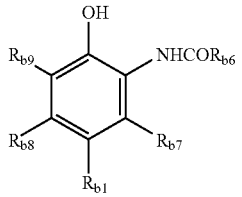

Formula Ph-3

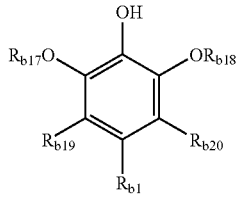

wherein, in formulae (Ph-1) and (Ph-3), $R_{b1}$ represents an aliphatic group, an aryl group, a carbamoyl group, an acylamino group, a carbonyl group, or a sulfonyl group; $R_{b6}$ represents an aliphatic group, an aryl group, an amino group, or an acyl group; $R_{b7}$ to $R_{b9}$, $R_{b19}$, and $R_{b20}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; and $R_{b17}$ and $R_{b18}$ each independently represent an aliphatic group or an aryl group.

(16) The silver halide color photographic photosensitive material according to the preceding item (15), wherein the compound represented by formula (Ph-1) or (Ph-3) is a compound represented by formula (Ph-4):

Formula Ph-4

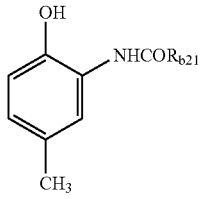

wherein, in formula (Ph-4), $R_{b21}$ represents a straight-chain, or branched, or cyclic, saturated or unsaturated, and unsubstituted aliphatic group, or a straight-chain, or branched, or cyclic, and saturated or unsaturated aliphatic group substituted with a halogen atom, a hydroxyl group, —$SR_{b30}$, —$CONR_{b30}R_{b31}$, —$CO_2R_{b30}$, or —OC(=O)$R_{b30}$, in which $R_{b30}$ and $R_{b31}$ each independently represent a hydrogen atom, or a straight-chain, branched, or cyclic unsubstituted aliphatic group.

(17) The silver halide color photographic photosensitive material according to the preceding item (16), wherein, in the compound represented by the above-mentioned formula (Ph-4), $R_{b21}$ is a straight-chain, branched, or cyclic, saturated or unsaturated, and unsubstituted aliphatic group.

(18) The silver halide color photographic photosensitive material according to the preceding item (16) or (17), wherein, in the compound represented by the above-mentioned formula (Ph-4), the sum total of carbon atoms in $R_{b21}$ is at least 12.

(19) The silver halide color photographic photosensitive material according to any one of the preceding items (15) to (18), further containing at least one compound selected from the group consisting of compounds represented by any one of formulae (E-1) to (E-3) set forth below:

Formula (E-1)

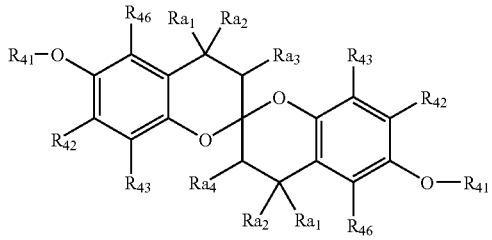

Formula (E-2)

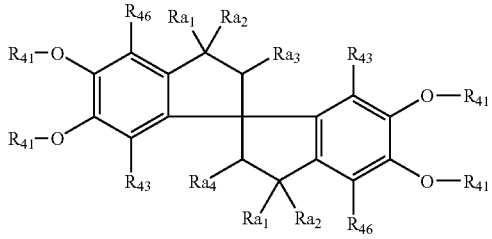

Formula (E-3)

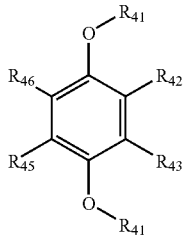

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —$Si(R_{47})(R_{48})(R_{49})$, in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and $Ra_1$ to $Ra_4$ each independently represent a hydrogen atom, or an aliphatic group.

(20) The silver halide color photographic photosensitive material according to any one of the preceding items (15) or (19), further containing at least one compound selected from the group consisting of a metal complex, a ultraviolet absorbing agent, a water-insoluble homopolymer or copolymer, and a compound represented by any one of formulae (TS-I) to (TS-VII) set forth below:

Formula (TS-I)

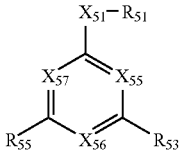

Formula (TS-II)

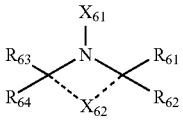

Formula (TS-III)

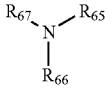

Formula (TS-IV)

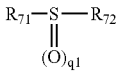

Formula (TS-V)

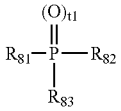

Formula (TS-VI)

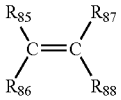

$R_{91}$—$Y_{91}$ Formula (TS-VII)

wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$) ($R_{60}$) in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or —C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; wherein the total number of carbon atoms of the compound represented by formula (TS-I) is 10 or more; the compound represented by formulae (TS-I) is neither identical to the compound represented by any one of formulae (Ph-1), (Ph-3) and (Ph-4) nor the compound represented by any one of formulae (E-1) to (E-3); and each of $R_{51}$ to $R_{57}$ cannot simultaneously represent a hydrogen atom;

wherein, in formula (TS-II), $R_{61}$, $R_{62}$, $R_{63}$, and $R_{64}$ each independently represent a hydrogen atom, or an aliphatic group; each combination of $R_{61}$, and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, a carbamoyl group, a hydroxy group, or an oxy radical group; and $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—; and the total number of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and each of $R_{65}$ and $R_{66}$ cannot simultaneously represent a hydrogen atom;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q1 represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t1 represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and each of $R_{85}$ to $R_{88}$ cannot simultaneously represent a hydrogen atom; and wherein, in formula (TS-VII), $R_{91}$ represents an hydrophobic group having total carbon atoms of 10 or more; and $Y_{91}$ represents a monovalent organic group containing an alcoholic hydroxyl group.

(Hereinafter, a third embodiment of the present invention means to include the silver halide color photographic photosensitive material described in the items (15) to (20) above.)

Herein, the present invention means to include each of the above first, second and third embodiments, unless otherwise specified.

The present invention is explained below in detail.

The term "aliphatic group" used in the present specification means such groups, in which the aliphatic portion may be a saturated or unsaturated, straight chain, branched chain, or a cycle, and the aliphatic portion embraces, for example, an alkyl group, an alkenyl group, a cycloalkyl group, and a cycloalkenyl group; and these can be unsubstituted or substituted. Further, the term "aryl group" used herein means a substituted or unsubstituted, monocyclic or condensed ring.

The term "heterocyclic group" used herein means such groups, in which the heterocycle portion contains a hetero atom(s) (such as nitrogen, sulfur and oxygen atoms) in the ring skeleton, and the heterocycle embraces a substituted or unsubstituted, saturated or unsaturated, and monocyclic or condensed ring.

The term "substituent" used in the present specification means any groups or atoms that are able to substitute for other groups or atoms; and embraces, for example, an aliphatic group, an aryl group, a heterocyclic group, an acyl group, an acyloxy group, an acylamino group, an aliphatic oxy group, an aryloxy group, a heterocyclic oxy group, an aliphatic oxycarbonyl group, an aryloxycarbonyl group, a heterocyclic oxycarbonyl group, a carbamoyl group, an aliphatic sulfonyl group, an arylsulfonyl group, a heterocyclic sulfonyl group, an aliphatic sulfonyloxy group, an arylsulfonyloxy group, a heterocyclic sulfonyloxy group, a sulfamoyl group, an aliphatic sulfonamido group, an aryl sulfonamido group, a heterocyclic sulfonamido group, an amino group, an aliphatic amino group, an arylamino group, a heterocyclic amino group, an aliphatic oxycarbonylamino group, an aryloxycarbonylamino group, a heterocyclic oxycarbonylamino group, an aliphatic sulfinyl group, an aryl sulfinyl group, an aliphatic thio group, an arylthio group, a hydroxy group, a cyano group, a sulfo group, a carboxyl group, an aliphatic oxyamino group, an aryloxyamino group, a carbamoylamino group, a sulfamoylamino group, a halogen atom, a sulfamoylcarbamoyl group, a carbamoylsulfamoyl group, a dialiphatic oxyphosphinyl group, and a diaryloxyphosphinyl group.

First, the compound represented by formula (I) for use in the present invention is explained in detail. In the present specification, the compound is also referred to as a yellow dye-forming coupler. In particular, this compound is preferably used in the first embodiment of the present invention.

Formula (I)

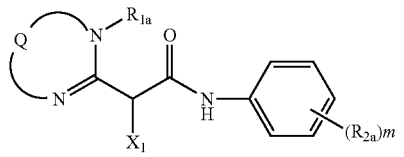

In formula, $R_{1a}$ represents a substituent except for a hydrogen atom. As examples of the substituent, there are illustrated a halogen atom, an alkyl group in which a cycloalkyl group and a bicycloalkyl group are embraced; an alkenyl group in which a cycloalkenyl group and a bicycloalkenyl group are embraced; an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group in which an alkylamino group and an anilino group are embraced; an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, and a silyl group.

These substituents may be further substituted with another substituent. Examples of this another substituent are the same as described as the examples of the above-mentioned substituent.

$R_{1a}$ is preferably a substituted or unsubstituted alkyl group. The total of carbon atoms of $R_{1a}$ is preferably in the range of from 1 to 60, more preferably in the range of from 2 to 50, furthermore preferably in the range of from 4 to 40, and most preferably in the range of from 7 to 30. When $R_{1a}$ is a substituted alkyl group, can be mentioned as the substituent are atoms and groups set forth as examples of the substituent of the above-mentioned $R_{1a}$.

$R_{1a}$ is preferably an unsubstituted alkyl group having the total of carbon atoms of at least 11, or a substituted alkyl group substituted with an alkoxy group or an aryloxy group in the 2-, 3-, or 4-position, and having the total of carbon atoms of at least 4 including the number of carbon atoms of substituents, more preferably an unsubstituted alkyl group having the total of carbon atoms of at least 16, or a substituted alkyl group substituted with an alkoxy group or an aryloxy group in the 3-position, and having the total of carbon atoms of at least 6 including the number of carbon atoms of substituents, furthermore preferably a $C_{16}H_{33}$ group, a $C_{18}H_{37}$ group, a 3-lauryloxypropyl group, a 3-hexyloxy propyl group, a 3-butoxypropyl group, or a 3-(2,4-di-t-amylphenoxy)propyl group, and most preferably a 3-butoxypropyl group.

In formula (I), Q represents a group of non-metal atoms that forms a 5- to 7-membered ring in combination with the —N═C—N($R_{1a}$)—. Preferably, the 5- to 7-membered ring thus formed is a substituted or unsubstituted, and monocyclic or condensed heterocycle. More preferably, the ring-forming atoms are selected from carbon, nitrogen and sulfur atoms. Still more preferably, Q represents a group represented by —C(—$R_{21a}$)═C(—$R_{22a}$)—$SO_2$— or —C(—$R_{21a}$)═C(—$R_{22a}$)—CO— (in the present invention, these expressions of the foregoing group do not limit the bonding orientation of the group in formula (I), to the ones shown by these expressions). $R_{21a}$ and $R_{22a}$ are groups that bond each other to form a 5- to 7-membered ring together with the —C═C— moiety, or $R_{21a}$ and $R_{22a}$ each independently represent a hydrogen atom or a substituent. The 5- to 7-membered ring thus formed may be saturated or unsaturated, and the ring may be an alicyclic, aromatic or heterocyclic ring. Examples of the ring include benzene, furan, thiophene, cyclopentane, and cyclohexane rings, each of which may be further substituted. Further, when $R_{21a}$ and $R_{22a}$ represent a substituent, examples thereof are those enumerated as the substituent of the above-described $R_{1a}$ (hereinafter also referred to as the substituent of $R_{1a}$).

These substituents and the rings formed through bonding of multiple substituents may be further substituted with another substituent. Examples of this another substituent are the same as described as the examples of the above-mentioned substituent of $R_{1a}$.

In formula (I), $R_{2a}$ represents a substituent except for a hydrogen atom. Examples of the substituent are the atoms and groups set forth as the substituent of $R_{1a}$. $R_{2a}$ is preferably a halogen atom (for example, fluorine, chlorine, bromine), an alkyl group (for example, methyl, isopropyl, t-butyl), an aryl group (for example, phenyl, naphthyl), an alkoxy group (for example, methoxy, isopropyloxy), an aryloxy group (for example, phenoxy), an alkylthio group (for example, methylthio, octylthio), an arylthio group (for example, phenylthio, 2-methoxyphenylthio), an acyloxy group (for example, acetyloxy), an amino group (for example, dimethylamino, morpholino), an acylamino group (for example, acetamido), a sulfonamido group (for example, methane sulfonamido, benzene sulfonamido), an alkoxycarbonyl group (for example, methoxycarbonyl), an aryloxycarbonyl group (for example, phenoxycarbonyl), a carbamoyl group (for example, N-methylcarbamoyl, N,N-diethylcarbamoyl), a sulfamoyl group (for example, N-methylsulfamoyl, N,N-diethylsulfamoyl), an alkylsulfonyl group (for example, methane sulfonyl), an arylsulfonyl group (for example, benzene sulfonyl), a cyano group, a carboxyl group, and a sulfo group. $R_{2a}$, when located in an ortho-position to the —CONH— group, is preferably a halogen atom, an alkoxy group, an aryloxy group, an alkyl group, an alkylthio group and an arylthio group, and more preferably an alkylthio group. Further, it is preferred that $R_{2a}$ is also located in the para-position to a substituent located in an ortho-position to the above-described —CONH— group. In this case, $R_{2a}$ located in the para-position is an alkyl group, preferably a t-alkyl group, more preferably a t-butyl group. It is most preferred that $R_{2a}$ located in the 2-position to the —CONH— group is a 2-ethylhexylthio group, and another $R_{2a}$ located in the 5-position to the —CONH— group is a t-butyl group.

In formula (I), m represents an integer of 0 or more and 5 or less. When m is 2 or more, $R_{2a}$s may be the same or different, and they may combine together to form a ring. From the point of the effects of the present invention, m is preferably in the range of 1 to 3.

In formula (I), $X_1$ represents a hydrogen atom, or a group capable of being split-off upon a coupling reaction with an oxidized product of a developing agent. Examples of the group capable of being split-off upon a coupling reaction with an oxidized product of a developing agent include a group that splits off with a nitrogen, oxygen, or sulfur atom (a splitting-off atom); and a halogen atom (e.g., chlorine, bromine).

Examples of the group that splits off with a nitrogen atom include a heterocyclic group (preferably a 5- to 7-membered substituted or unsubstituted saturated or unsaturated aromatic (herein the term "aromatic" is used to embrace a substance that has (4n+2) cyclic conjugated electrons) or non-aromatic, monocyclic or condensed heterocyclic group; more preferably a 5- or 6-membered heterocyclic group, in which the ring-forming atoms are selected from carbon, nitrogen, oxygen and sulfur atoms and in addition at least one of hetero atoms selected from nitrogen, oxygen and sulfur atoms is incorporated; specific examples of the heterocyclic group include succinimido, maleinimido, phthalimido, diglycolimido, pyrrole, pyrazole, imidazole, 1,2,4-triazole, tetrazole, indole, benzopyrazole, benzimidazole, benzotriazole, imidazolidine-2,4-dione, oxazolidine-2,4-dione, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine-4-one), a carbonamido group (e.g., acetamido, trifluoroacetamido), a sulfonamido group (e.g., methanesulfonamido, benzenesulfonamido), an arylazo group (e.g., phenylazo, naphthylazo), and a carbamoylamino group (e.g., N-methyl carbamoylamino).

Preferred of the group that splits off with a nitrogen atom are heterocyclic groups, more preferably aryl heterocyclic groups having 1, 2, 3 or 4 ring-forming nitrogen atoms, or heterocyclic groups represented by the following formula (L):

Formula (L)

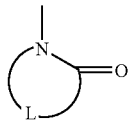

wherein L represents a moiety that forms a 5- to 6-membered nitrogen-containing heterocycle with the —NC(=O)—.

Examples of the moiety are enumerated in the explanation of the above-mentioned heterocyclic group, and such moieties as enumerated above are more preferred. Particularly preferably, L is a moiety that forms a 5-membered nitrogen-containing heterocyclic ring.

Examples of the group that splits off with an oxygen atom include an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbamoyloxy), an aryloxycarbonyloxy group (e.g., phenoxycarbonyloxy), an alkoxycarbonyloxy group (e.g., methoxycarbonyloxy, ethoxycarbonyloxy), an alkylsulfonyloxy group (e.g., methanesulfonyloxy), and an aryl sulfonyloxy group (e.g., benzenesulfonyloxy, toluenesulfonyloxy).

Preferred of the group that splits off with an oxygen atom are an aryloxy group, an acyloxy group and a heterocyclic oxy group.

Examples of the group that splits off with a sulfur atom include an arylthio group (e.g., phenylthio, naphthylthio), a heterocyclic thio group (e.g., tetrazolylthio, 1,3,4-thiadiazolylthio, 1,3,4-oxazolylthio, benzimidazolyl thio), an alkylthio group (e.g., methylthio, octylthio, hexadecylthio), an alkylsulfinyl group (e.g., methane sulfinyl), an arylsulfinyl group (e.g., benzenesulfinyl), an arylsulfonyl group (e.g., benzenesulfonyl), and an alkylsulfonyl group (e.g., methansulfonyl).

Preferred of the group that splits off with a sulfur atom are an arylthio group and a heterocyclic thio group. A heterocyclic thio group is more preferred.

$X_1$ may be substituted with a substituent. Examples of the substituent substituting on $X_1$ include those exemplified as the substituent of the above-mentioned $R_{1a}$.

$X_1$ is preferably a group that splits off with a nitrogen atom, a group that splits off with an oxygen atom, or a group that splits off with a sulfur atom. More preferably $X_1$ is a group that splits off with a nitrogen atom, and further preferably $X_1$ is one of the above-mentioned preferable examples of the group that splits off with a nitrogen atom, and they are preferable in the described order.

Particularly preferably, $X_1$ is a 5,5-dimethyl oxazolidine-2,4-dione-3-yl group.

$X_1$ may be a photographically useful group. Examples of the photographically useful group include a development inhibitor, a desilvering accelerator, a redox compound, a dye, a coupler, and precursors of these compounds.

In order to render the coupler immobile in the photosensitive material, at least one of Q, $R_{1a}$, $X_1$ and $R_{2a}$ has preferably 8 to 60 carbon atoms, more preferably 8 to 50 carbon atoms in total respectively, including carbon atoms of substituent(s) thereon.

In the present invention, especially in the first embodiment of the present invention, it is preferable, from the point of the effects of the present invention, that the compound represented by formula (I) is a compound represented by formula (II). Here, the compound represented by formula (II) is also referred to as a yellow dye-forming coupler. The compound represented by formula (II) is explained in detail below.

Formula (II)

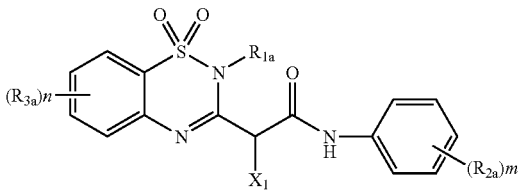

In formula (II), $R_{1a}$, $R_{2a}$, m, and $X_1$ each have the same meanings as described in formula (I). Preferable ranges thereof are also the same.

In formula (II), $R_{3a}$ represents a substituent. Examples of the substituent include those groups and atoms exemplified as the substituent of the above-mentioned $R_{1a}$. Preferably $R_{3a}$ is a halogen atom (i.e., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulfamoyl, N,N-diethylsulfamoyl), an alkylsulfonyl group (e.g., methane sulfonyl), an arylsulfonyl group (e.g., benzene sulfonyl), a cyano group, a carboxyl group, and a sulfo group.

n represents an integer of 0 to 4. When n is 2 or more, the multiple $R_{3a}$s may be the same or different, and the $R_{3a}$s may bond each other to form a ring.

In the present invention, preferably in the first embodiment of the present invention, among the dye-forming couplers represented by formula (II), the compound represented by formula (III) is more preferable.

Formula (III)

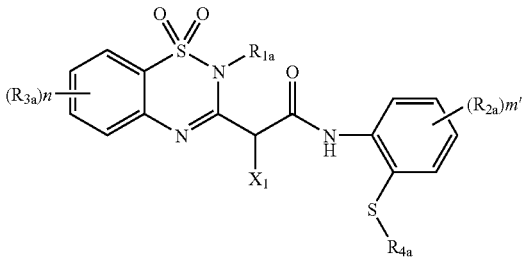

In formula (III), $R_{1a}$, $R_{2a}$, $R_{3a}$, n, and $X_1$ each have the same meanings as described in formula (II). Preferable ranges thereof are also the same.

$R_{4a}$ represents an alkyl group. m' represents an integer of from 0 to 4. When m' is 2 or more, a plurality of $R_{2a}$s may be the same or different, and they may bond to each other to form a ring. m' is preferably 0, 1, or 2, more preferably 0 or 1, and most preferably 1.

The alkyl group of $R_{4a}$ may have a substituent. As the substituent, atoms and groups set forth as a substituent of the above-mentioned $R_{1a}$ can be mentioned. The substituent is preferably an alkyl group and an aryl group, more preferably an alkyl group. The alkyl group of $R_{4a}$ is preferably a primary alkyl group or a tertiary alkyl group, more preferably a primary alkyl group, furthermore preferably a primary alkyl group that is branched at the β-position, and most preferably a 2-ethylhexyl group.

The total of carbon atoms of $R_{4a}$ including its substituent is preferably in the range of from 1 to 30, more preferably in the range of from 3 to 30, furthermore preferably in the range of from 3 to 20, and most preferably in the range of from 4 to 12.

Preferable specific examples of the coupler represented by any of formula (I), (II) and (III) according to the present invention are shown below. However, the present invention is not limited to these compounds. Herein, the present invention also embraces tautomers, in which the hydrogen atom at the coupling site (the hydrogen atom on the carbon atom to which $X_1$ is substituting) is transferred on the nitrogen atom in the C═N portion bonding to the coupling site (the ring-constituting nitrogen atom that is not bonded with $R_{1a}$).

(1)

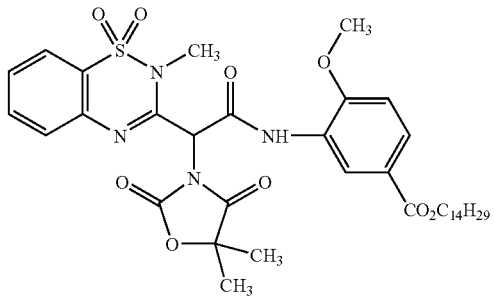

(2)

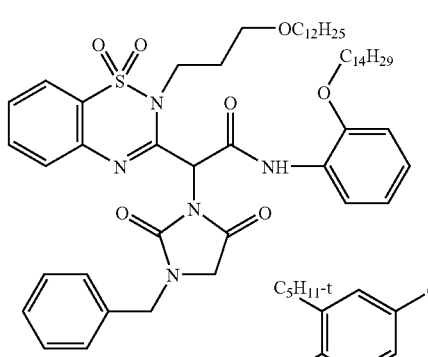

(3)

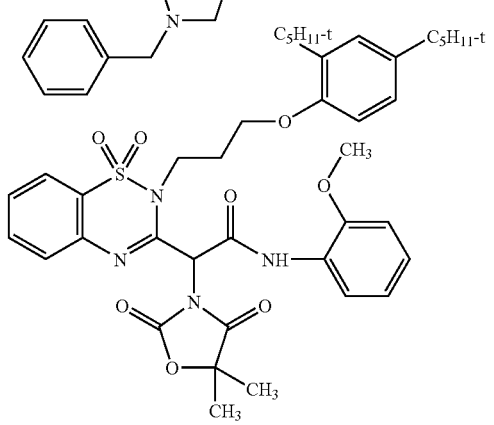

-continued
(4)
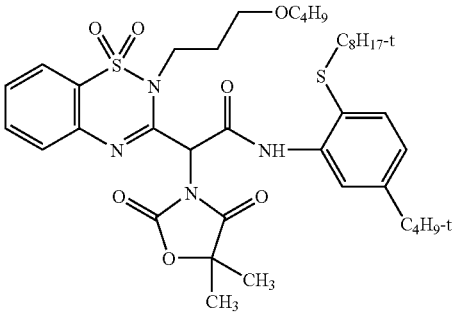
(5)
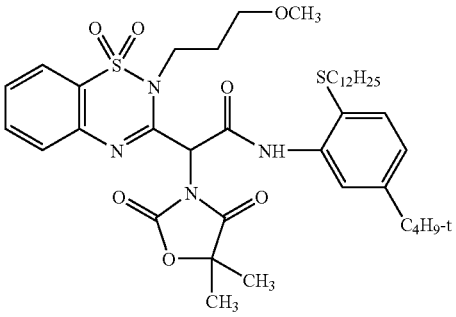
(6)
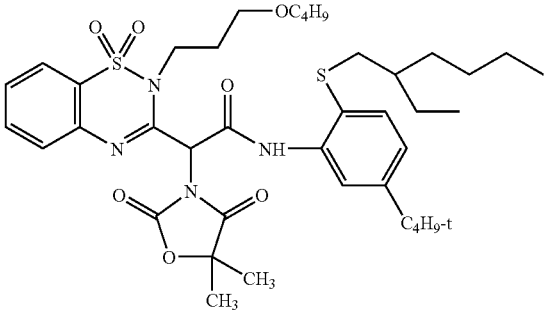
(7)
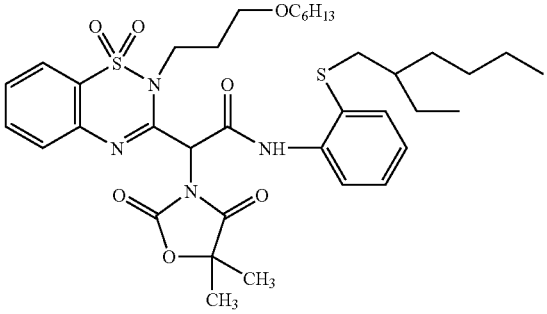
(8)
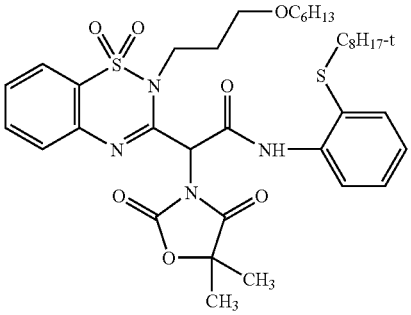
-continued
(9)
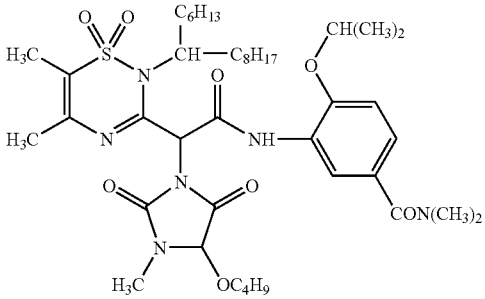
(10)
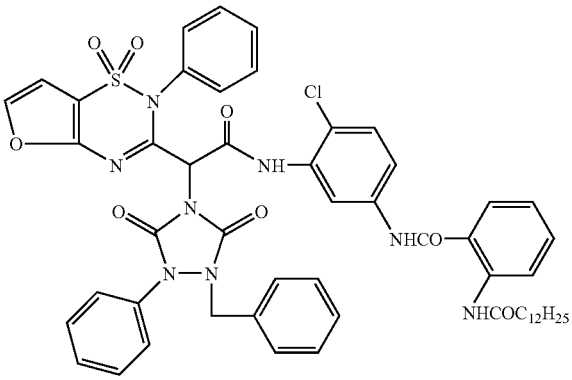
(11)
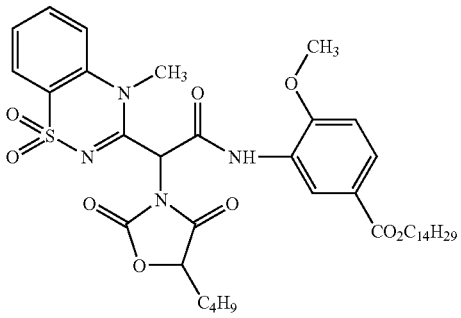
(12)
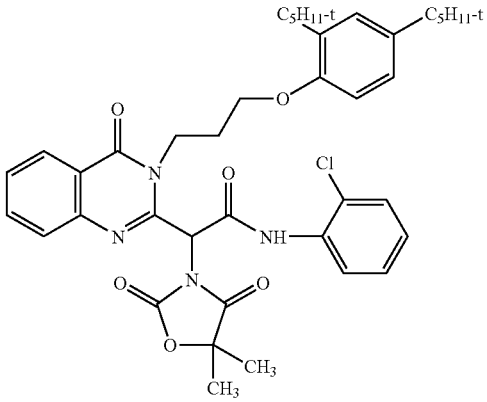

-continued
(13)
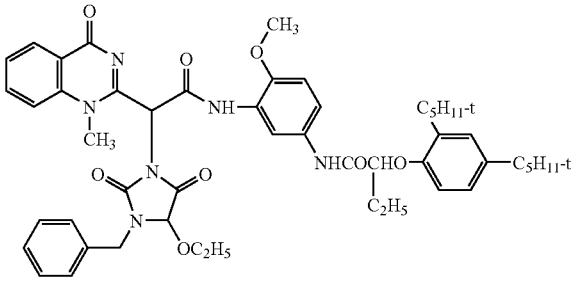
(14)
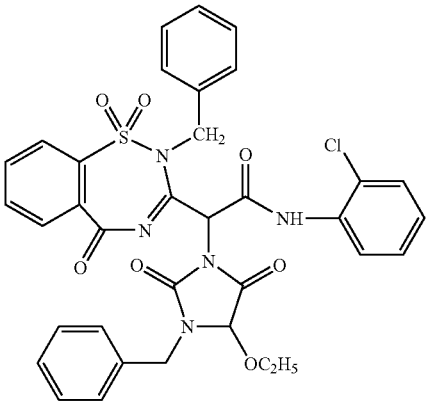
(15)
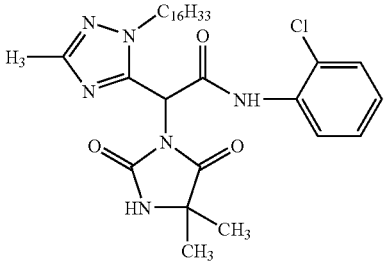
(16)
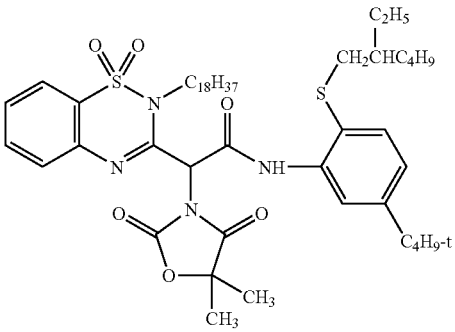
-continued
(17)
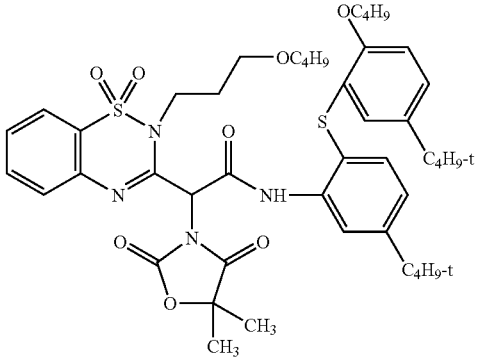
(18)
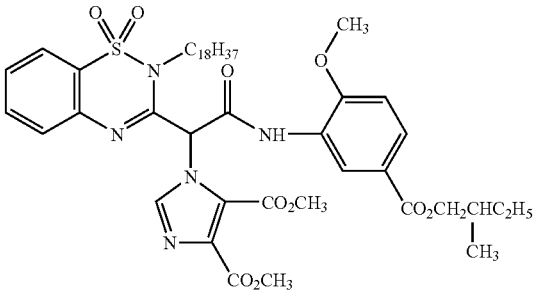
(19)
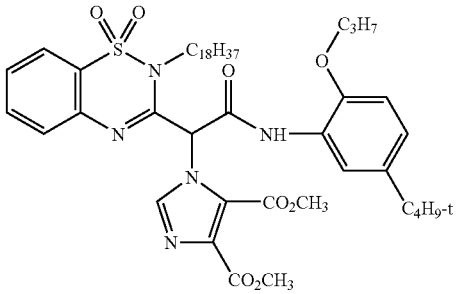
(20)
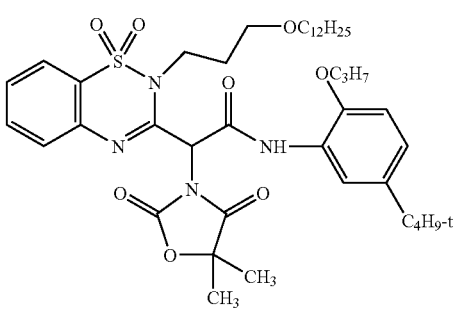

-continued (21)

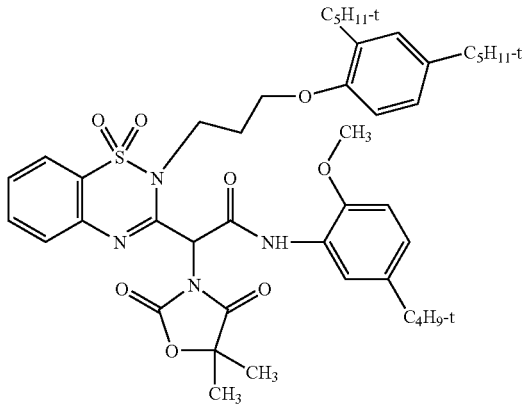

(22)

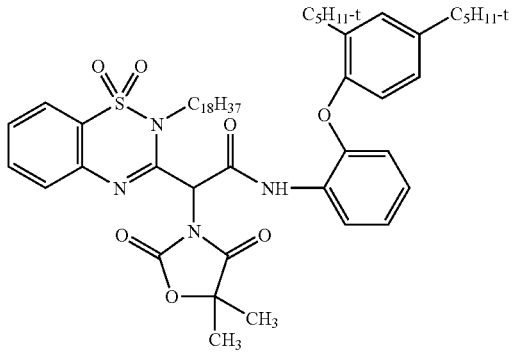

In the following explanation, when the exemplified compounds shown above are referred to, they are expressed as "coupler (x)", with using the number x labeled to each of the exemplified compounds in the parenthesis.

Next, the compound represented by formula (Ia) for use in the present invention, preferably in the second embodiment of the present invention, is explained in detail. In the present specification, the compound is also referred to as a yellow dye-forming coupler.

Formula (Ia)

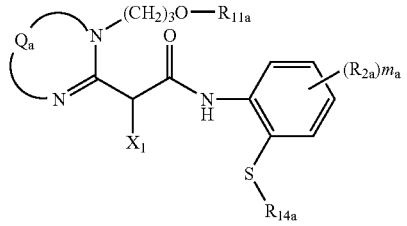

In formula, $R_{11a}$ represents a substituted or unsubstituted alkyl group having 4 to 8 carbon atoms. As the substituent that $R_{11a}$ may have, those atoms and groups set forth as the substituent of the above-mentioned $R_{1a}$, can be mentioned.

The above-mentioned substituent may be further substituted with another substituent. As the another substituent, there are those atoms and groups set forth as the substituent of the above-mentioned $R_{1a}$ (hereinafter sometimes also referred to simply as "the substituent of $R_{11a}$").

$R_{11a}$ is preferably an unsubstituted alkyl group having 4 to 6 carbon atoms, more preferably n-butyl group.

In formula (Ia), Qa represents a group of non-metal atoms that forms a 5- to 7-membered ring in combination with the —N═C—N((CH$_2$)$_3$O—$R_{11a}$)—. (Qa has substantially the same meaning as Q in formula (I), though literal expression of Qa is different from that of Q in formula (I).) Preferred examples of Qa include rings and groups exemplified as Q in formula (I).

In formula (Ia), $R_{2a}$ has the same meaning as described in formula (I). Preferable range thereof is also the same.

In formula (Ia), however, the total of carbon atoms of $R_{2a}$ is preferably in the range of from 0 to 60, more preferably in the range of from 0 to 50, and furthermore preferably in the range of from 0 to 40.

In formula (Ia), $R_{2a}$ is more preferably a t-alkyl group, furthermore preferably a t-butyl group, and most preferably a t-butyl group in the para-position to the —$SR_{14a}$.

In formula (Ia), $m_a$ represents an integer of from 0 to 4. When $m_a$ is 2 or more, a plurality of $R_{2a}$s may be the same or different from each other, and they may bond to each other to form a ring. In view of the effects of the present invention, ma is preferably 0 or 1.

In formula (Ia), $R_{14a}$ represents a primary alkyl group that may have a substituent. Examples of the substituent are the atoms and groups set forth above as the substituent of $R_{11a}$. A preferable carbon number of $R_{14a}$ including its substituent is in the range of from 3 to 30, more preferably in the range of from 3 to 20, and furthermore preferably in the range of from 6 to 12. As the substituent, preferred are an alkyl group and an aryl group, more preferably an alkyl group. $R_{14a}$ is most preferably a 2-ethylhexyl group.

The term "primary alkyl group" in this specification is used to mean that, taking, in the carbon skeleton of the alkyl group, the carbon atom bonding to S in formula (Ia) as a central carbon, the central carbon has at least two hydrogen atoms.

In formula (Ia), $X_1$ has the same meaning as described in formula (I). Preferable range thereof is also the same.

In order to render the coupler immobile in the photosensitive material, at least one of Qa, $R_{11a}$, $X_1$ and $R_{2a}$ has preferably 8 to 60 carbon atoms, more preferably 8 to 50 carbon atoms in total respectively, including carbon atoms of substituent(s) that they may have.

It is preferable, from the point of the effects of the present invention, that the compound represented by formula (Ia) is a compound represented by formula (IIa). Here, the compound represented by formula (IIa) is also referred to as a yellow dye-forming coupler. The compound represented by formula (IIa) is explained in detail below.

Formula (IIa)

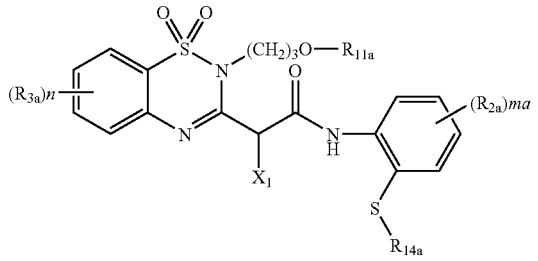

In formula (IIa), $R_{11a}$, $R_{2a}$, $R_{14a}$, $m_a$, and $X_1$ each have the same meanings as described in formula (Ia). Preferable ranges thereof are also the same.

In formula (IIa), $R_{3a}$ has the same meaning as described in formula (II). Preferable range thereof is also the same.

In formula (IIa), n has the same meaning as described in formula (II). Preferable range thereof is also the same.

Preferable specific examples of the couplers represented by formula (Ia) or (IIa) according to the present invention are shown below. However, the present invention is not limited to these compounds. Herein, the present invention also embraces tautomers, in which the hydrogen atom at the coupling site (the hydrogen atom on the carbon atom to which $X_1$ is substituting) is transferred on the nitrogen atom in the C═N portion bonding to the coupling site (the ring-constituting nitrogen atom that is not bonded with $(CH_2)_3O—R_{11a}$).

The following examples include, with putting new reference numbers, some of specific examples that were shown as compounds represented by any one of formulae (I), (II), and (III) in an earlier part of this specification.

(101)

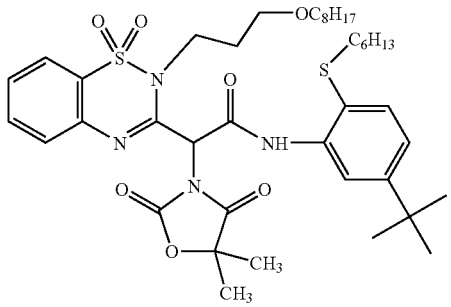

(102)

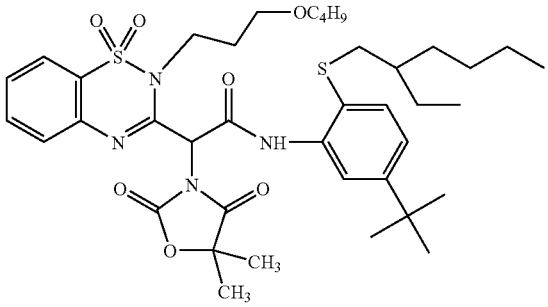

(103)

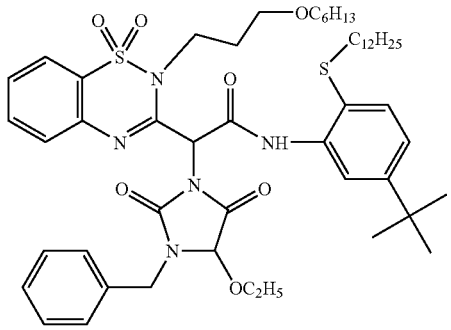

-continued (104)

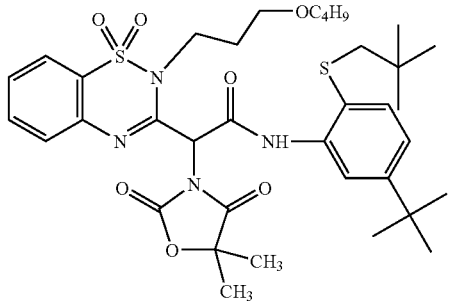

(105)

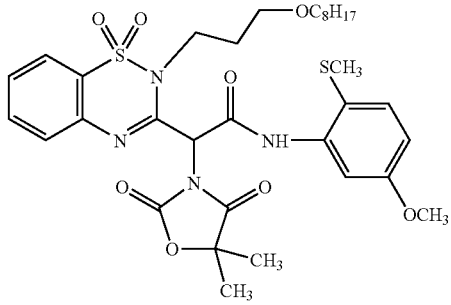

(106)

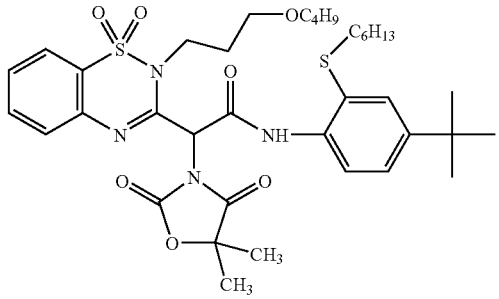

(107)

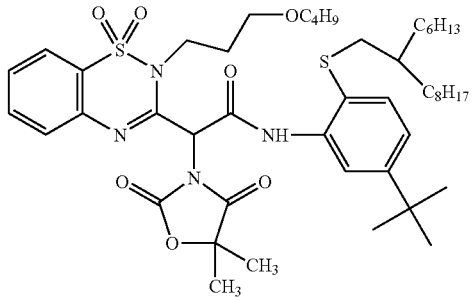

(108)

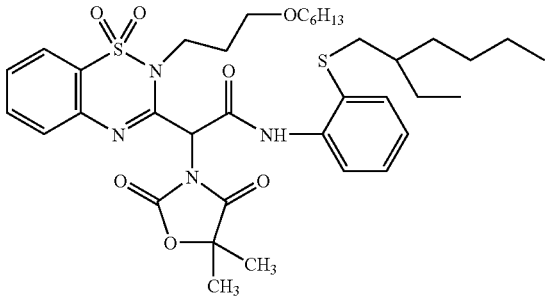

-continued
(109)
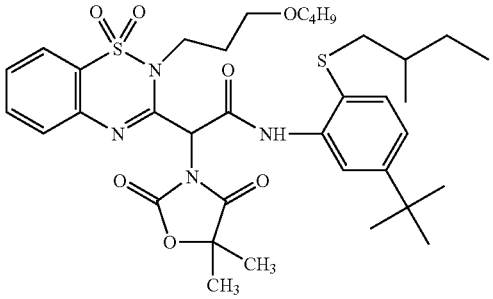
(110)
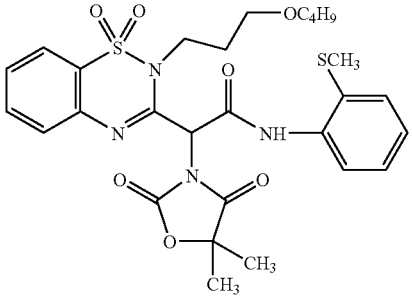
(111)
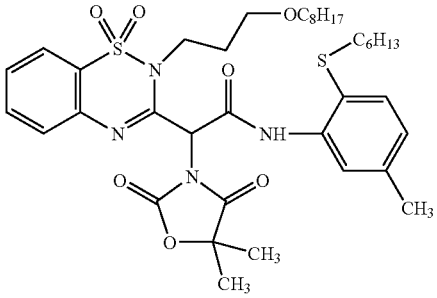
(112)
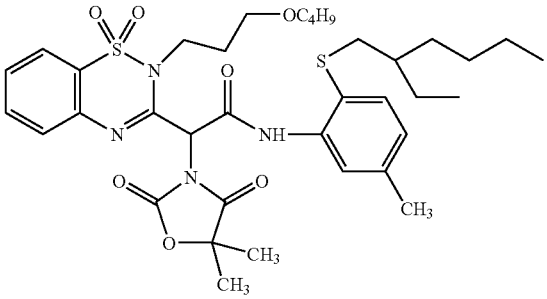
-continued
(113)
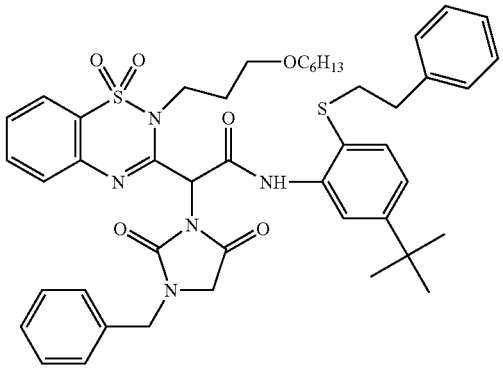
(114)
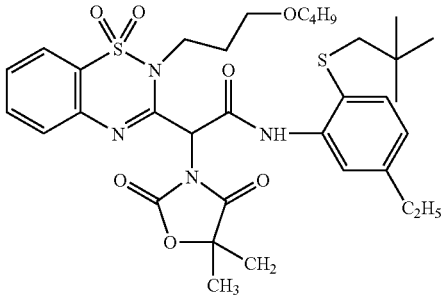
(115)
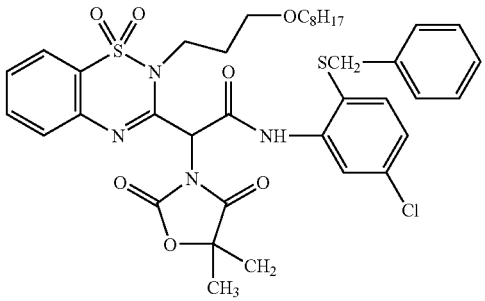
(116)
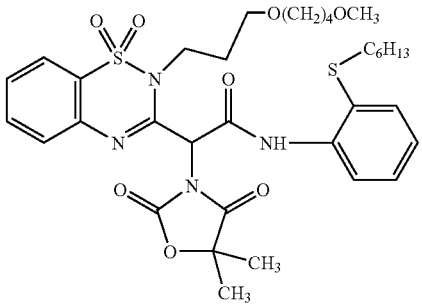

-continued
(117)
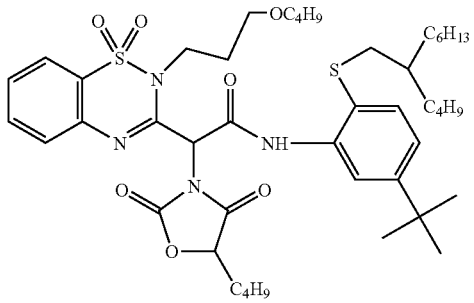
(118)
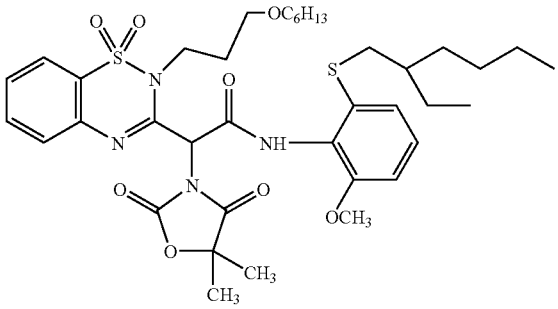
(119)
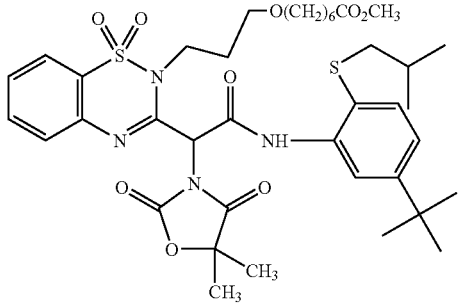
(120)
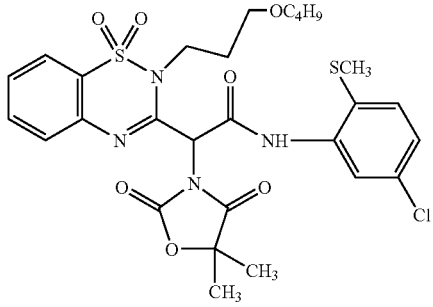
(12)
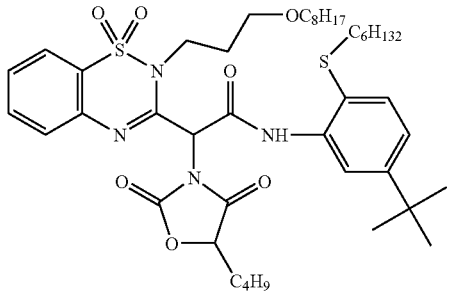
-continued
(122)
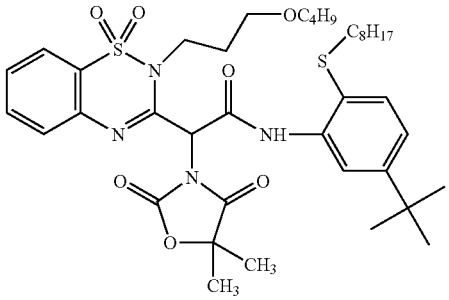
(123)
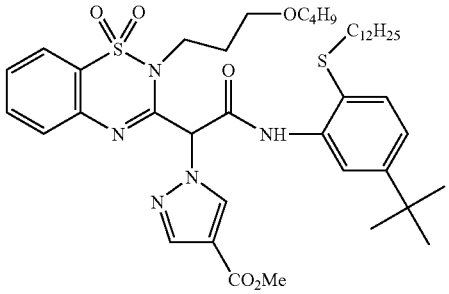
(124)
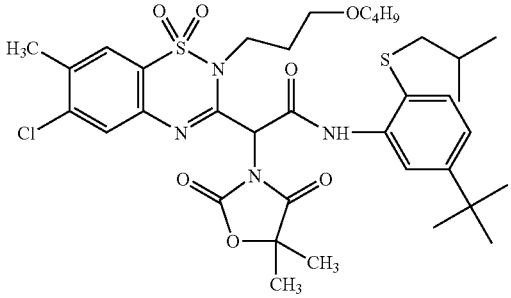
(125)
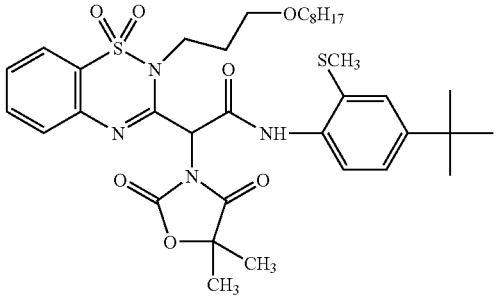
(126)
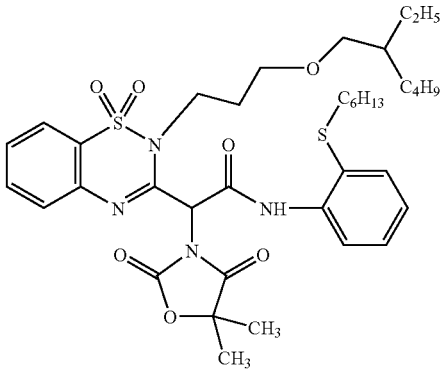

-continued
(127)
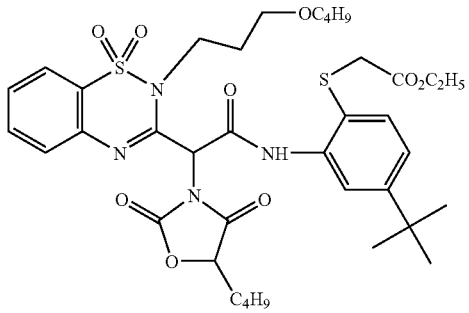
(128)
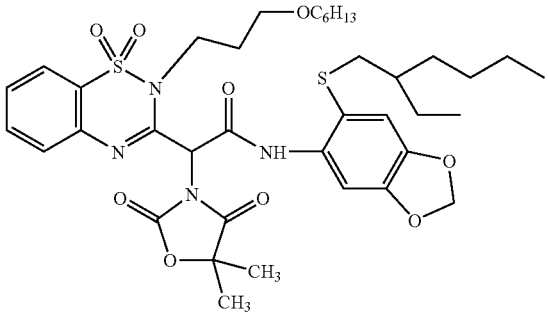
(129)
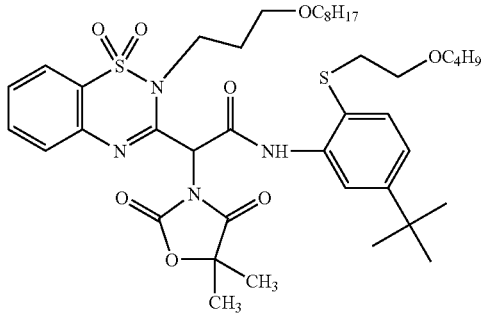
(130)
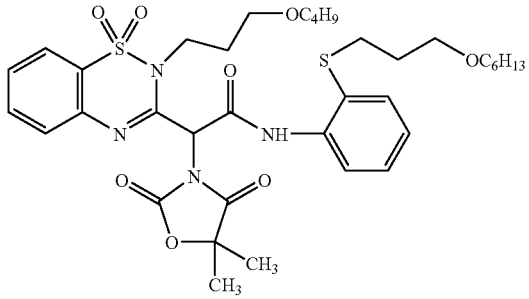
(131)
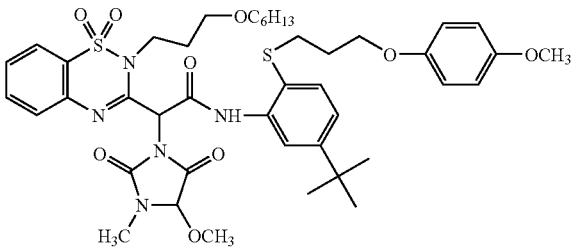
-continued
(132)
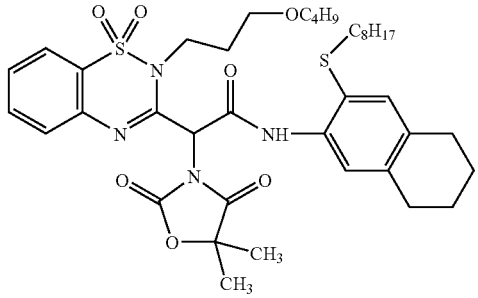
(133)
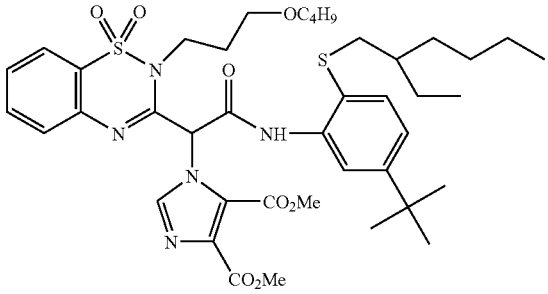
(134)
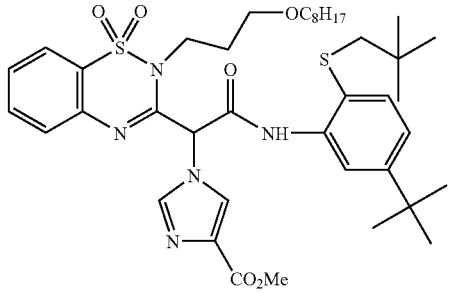
(135)
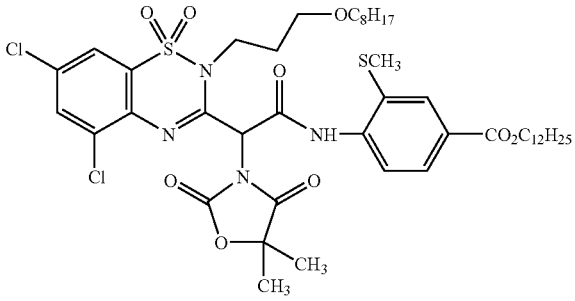
(136)
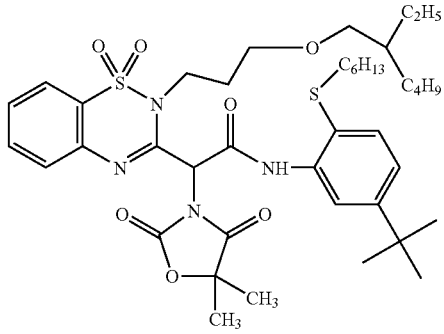

-continued (137)

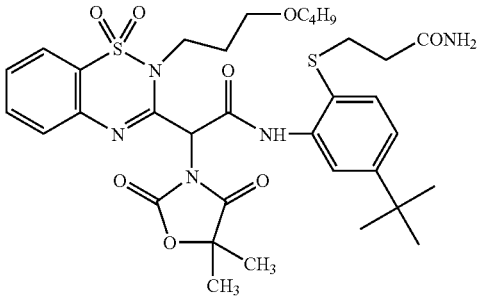

(138)

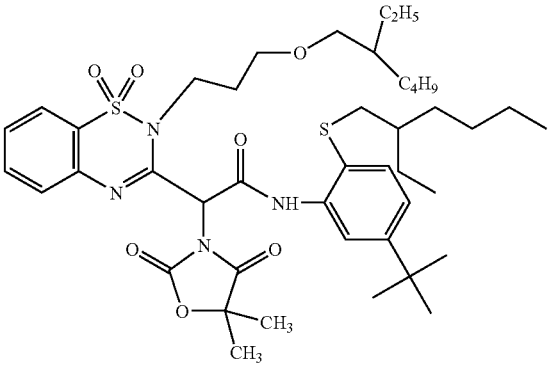

-continued (139)

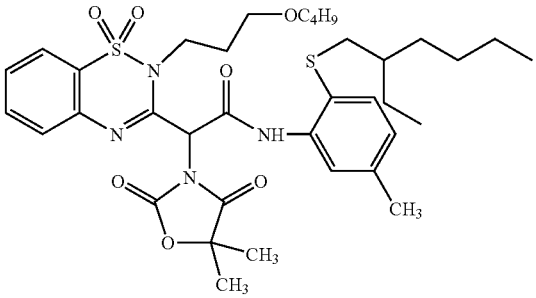

(140)

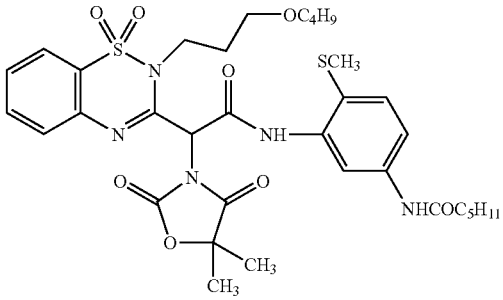

In the following explanation, when the exemplified compounds shown above are referred to, they are expressed as "coupler (x)", with using the number x labeled to each of the exemplified compounds in the parenthesis.

Specific synthetic examples of the compounds represented by the foregoing formula (I), (II), (III), (Ia) or (IIa) are described below.

SYNTHETIC EXAMPLE 1

Synthesis of Coupler (3)

Coupler (3) was synthesized according to the following synthesis route:

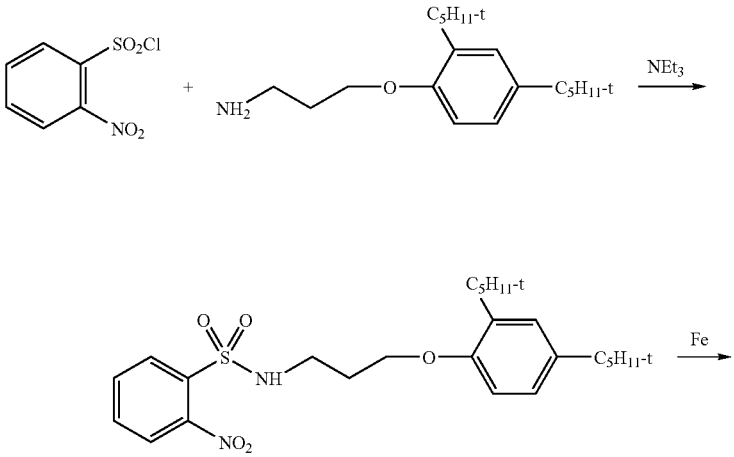

(A-1)

-continued
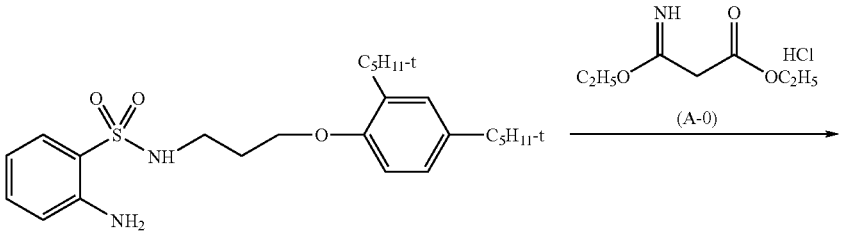
(A-2)
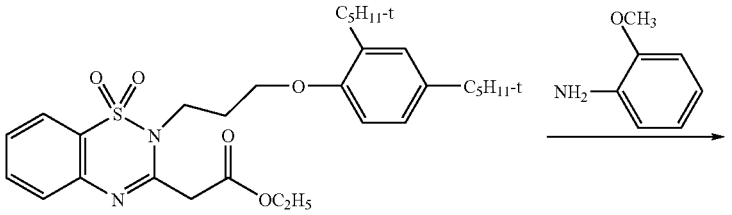
(A-3)
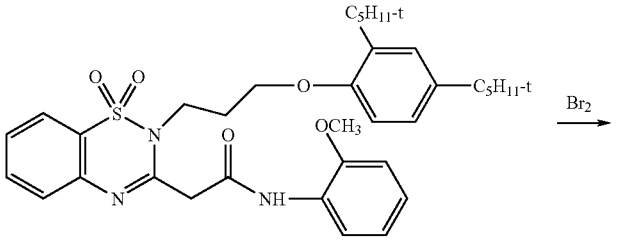
(A-4)
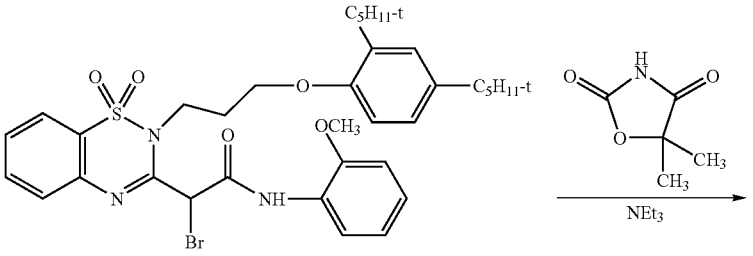
(A-5)
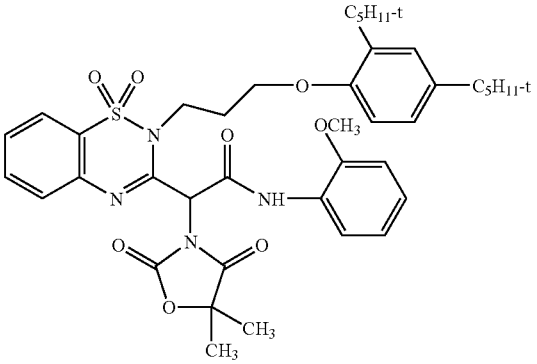
Coupler (3)

To a solution containing 438 g of 3-(2,4-di-t-amylphenoxy)propylamine, 210 ml of triethylamine and 1 liter of acetonitrile, under ice-cooling, 333 g of orthonitrobenzene sulfonyl chloride was added gradually with stirring. The temperature of the reaction system was elevated up to room temperature, and then, agitation was further continued for 1 hour. To the reaction mixture, ethyl acetate and water were added for separation. The organic layer was washed with dilute hydrochloric acid and saturated brine, and then dried with anhydrous magnesium sulfate. Thereafter, the solvent was distilled off under a reduced pressure. Crystallization from a mixed solvent of ethyl acetate and hexane gave 588 g of compound (A-1).

To a mixture of 540 ml of isopropanol and 90 ml of water, 84.0 g of a reduced iron and 8.4 g of ammonium chloride were dispersed and heated under reflux for 1 hour. To this dispersion, 119 g of compound (A-1) was gradually added, while stirring. Further, the reaction mixture was heated under reflux for 2 hours, and then suction-filtered through celite. To the filtrate, ethyl acetate and water were added for separation. The separated organic solvent layer was washed with saturated brine and dried with anhydrous magnesium sulfate. The solvent was distilled off under a reduced pressure to obtain 111 g of compound (A-2) as an oily product.

A solution of 111 g of compound (A-2), 68.4 g of a hydrochloride of imino ether (A-0) and 150 ml of ethyl alcohol was stirred for 1 hour while heating under reflux. Further, 4.9 g of a hydrochloride of imino ether was added and stirred with heating under reflux for 30 minutes. After cooling, the reaction mixture was filtered under reduced pressure. To the filtrate, 100 ml of p-xylene was added and heated under reflux for 4 hours, while eliminating ethanol by distillation. The reaction solution was purified by silica gel column chromatography using a mixed solvent of ethyl acetate and hexane as an eluent. Crystallization from methanol gave 93.1 g of compound (A-3).

A solution of 40.7 g of compound (A-3), 18.5 g of 2-methoxyaniline and 10 ml of p-xylene was stirred while heating under reflux for 6 hours. To the reaction mixture, ethyl acetate and water were added for separation. The organic solvent layer was washed with dilute hydrochloric acid and saturated brine, and then dried with anhydrous magnesium sulfate. Thereafter, the solvent was distilled off under a reduced pressure. The residue was purified by silica gel column chromatography using a mixed solvent of ethyl acetate and hexane as an eluent, to obtain 37.7 g of compound (A-4) as an oily product.

To a solution containing 24.8 g of compound (A-4) and 400 ml of methylene chloride, under ice-cooling, 35 ml of a methylene chloride solution containing 2.1 ml of bromine was added dropwise. After stirring for 30 minutes while cooling on ice, methylene chloride and water were added for separation. The separated organic solvent layer was washed with saturated brine and dried with anhydrous magnesium sulfate. The solvent was distilled off under a reduced pressure, to obtain a crude product of compound (A-5).

To a solution of 15.5 g of 5,5-dimethyloxazolidine-2,4-dione and 16.8 ml of triethylamine dissolved in 200 ml of N,N-dimethylacetamide, a solution of the whole quantity of the previously synthesized crude product of compound (A-5) dissolved in 40 ml of acetonitrile was added dropwise, over 10 minutes, at room temperature. After the temperature of the reaction system was elevated up to 40° C., and then, agitation was continued for 30 minutes. To the reaction solution, ethyl acetate and water were added to conduct separation. The separated organic layer was washed with a 0.1 normal aqueous solution of potassium hydroxide, dilute hydrochloric acid and saturated brine, and then dried with anhydrous magnesium sulfate. The solvent was eliminated by vacuum distillation. The residue was purified by silica gel column chromatography using a mixed solvent of acetone and hexane as an eluent. Crystallization from a mixed solvent of ethyl acetate and hexane gave 23.4 g of coupler (3).

SYNTHESIS EXAMPLE 2

Synthesis of Coupler (6) (Synthesis of Coupler (102))

Coupler (6) was synthesized according to the following synthesis rout.

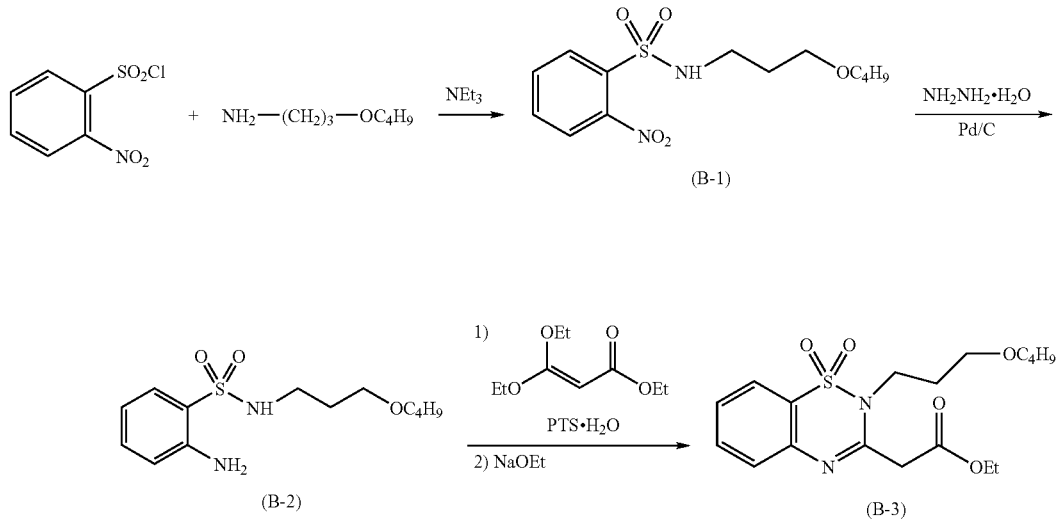

-continued
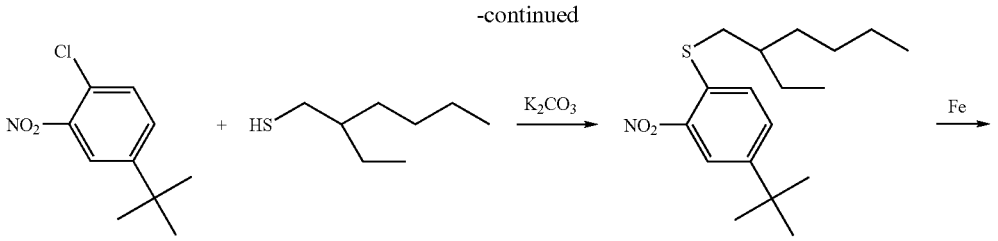
(B-4)
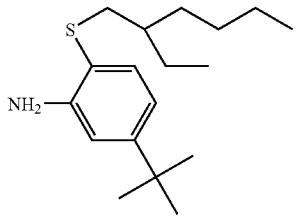
(B-5)
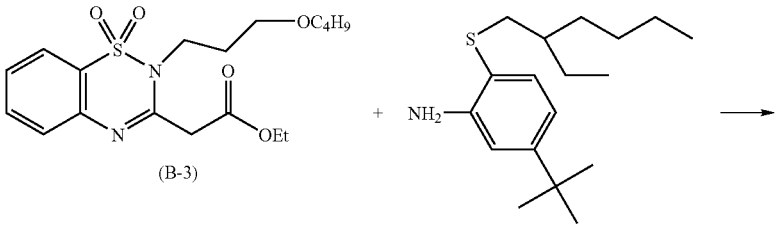
(B-3)
(B-5)
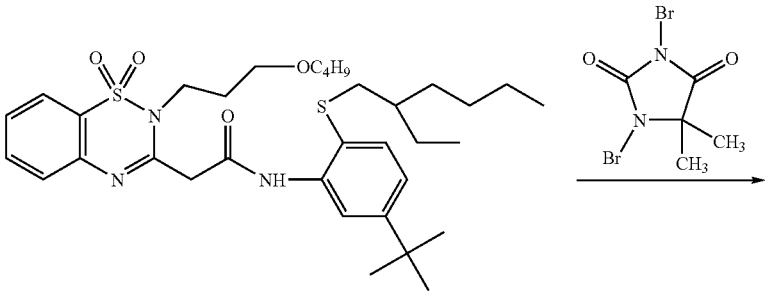
(B-6)
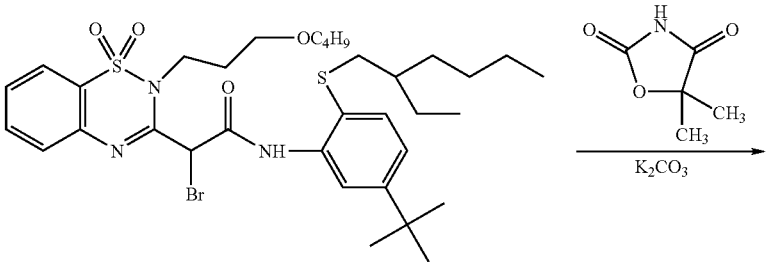
(B-7)

-continued

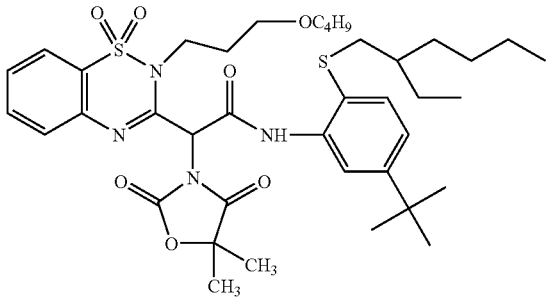

Coupler (6)

To a solution containing 181.2 g of 3-butoxypropylamine, 198.2 ml of triethylamine and 840 ml of toluene, 300.0 g of orthonitrobenzene sulfonyl chloride was added gradually with stirring while ice-cooling. After the temperature of the reaction system was elevated up to room temperature, agitation was further continued for 1 hour. To the reaction solution, 50 ml of hydrochloric acid and 750 ml of water were added for separation. The separated organic layer was washed with an aqueous solution of sodium bicarbonate, to obtain a reaction solution of compound (B-1).

To a mixture of 8.5 g of 10% Pd/C and 50 ml of water, the previously prepared reaction solution of compound (B-1) and 100 ml of toluene were added, and then 165 g of 80% hydrazine hydrate and 50 ml of water were added dropwise over 1 hour at 40° C. Thereafter, the reaction solution was further stirred for 1 hour at 45° C., and then filtered through celite. The reaction mixture was washed with 350 ml of toluene, 500 ml of isopropanol and 1.5 liter of water. After separation, the organic layer was washed twice with 500 ml of water, to obtain a reaction solution of compound (B-2). Thereafter, 800 ml of the solvent was eliminated by vacuum concentration. To the resulting residue, 400 ml of toluene, 305.7 g of ethyl 3,3-diethoxyacrylate and 2.6 g of p-toluene sulfonic acid monohydrate were added, and stirred at 85° C. for 30 minutes. Further, 13.8 g of 90% sodium ethoxide was added, and then the mixture was stirred with heating at 120° C. for 4 hours. After cooling, 25 ml of hydrochloric acid and 500 ml of water were added for separation. Further, 50 g of p-toluene sulfonic acid monohydrate and 500 ml of water were added for washing. Thereafter, the solvent was eliminated by concentration under reduced pressure. To the resulting residue, 600 ml of methanol and 30 ml of water were added for crystallization. Further, 100 ml of methanol and 110 ml of water were added dropwise, and the mixture was cooled to 0° C. The resulting precipitate was collected by filtration under reduced pressure, and then washed with a mixed solvent of methanol/water, to obtain 440.1 g of Compound (B-3).

To a mixture of 343 g of 2-ethylhexanethiol, 800 ml of N,N-dimethyl acetamide and 364 g of potassium carbonate, 470 g of 4-t-butyl-2-nitrochlorobenzene was added under a nitrogen atmosphere, and stirred with heating, at 90° C., for 2 hours. Thereafter, the reaction mixture was poured into 1000 ml of ice water, and then extracted with 1000 ml of ethyl acetate. The separated organic solvent layer was washed twice with saturated brine, and dried with anhydrous magnesium sulfate. After separating magnesium sulfate by filtration, the solvent was distilled off under a reduced pressure, to obtain 806 g of compound (B-4) as an oily product.

To a mixture of 2200 ml of isopropanol and 370 ml of water, 740 g of a reduced iron and 74.0 g of ammonium chloride were dispersed, and stirred with heating under reflux, for 1 hour. To this dispersion, 806 g of compound (B-4) was gradually added. Further, the reaction mixture was stirred with heating under reflux for 2 hours, and then suction-filtered through celite. To the filtrate, ethyl acetate and water were added for separation. The separated organic solvent layer was washed with saturated brine, and dried with anhydrous magnesium sulfate. The solvent was distilled off under a reduced pressure, to obtain 671 g of compound (B-5) as an oily product.

A mixture of 110 g of compound (B-3) and 84.5 g of compound (B-5) was stirred with heating, at the temperature of 145 to 150° C. for 6 hours, under a reduced pressure, to obtain a crude product of compound (B-6). To the reaction crude product, 750 ml of toluene was added, and then 41.2 g of 1,3-dibromo-5,5-dimethylhydantoin was added, with stirring, over 15 minutes, while ice-cooling. After stirring at room temperature for 1 hour, water was added for separation. The separated organic layer was washed with water, to obtain a reaction solution of compound (B-7).

To a mixture of 39.0 g of 5,5-dimethyloxazolidine-2,4-dione, 41.8 g of potassium carbonate and 150 ml of N,N-dimethylacetamide, the whole quantity of the previously synthesized reaction solution of compound (B-7) was added dropwise, over 30 minutes, at room temperature with stirring. Thereafter, the temperature of the reaction system was elevated up to 50° C., and agitation was continued for 2 hours. After separation, the separated organic layer was washed with a 0.1 normal aqueous solution of potassium hydroxide; dilute hydrochloric acid, and saturated brine. The solvent was eliminated by vacuum distillation. Crystallization from a methanol solvent gave 171.6 g of coupler (6).

Other dye-forming couplers can be also synthesized according to the above-mentioned method, or according to the method described in U.S. Pat. No. 5,455,149.

In the silver halide photographic photosensitive material of the present invention, the quantity of the coupler represented by formula (I), (II), (III), (Ia) or (IIa) in the photosensitive material is preferably in the range of from 0.01 g to 10 g, more preferably in the range of from 0.1 g to 2 g, per $m^2$ of the photosensitive material. The quantity of the coupler in a photosensitive emulsion layer is preferably in the range of from $1\times10^{-3}$ mole to 1 mole, and more preferably in the range of from $2\times10^{-3}$ mole to $3\times10^{-1}$ mole, per mole of silver halide in the same photosensitive emulsion layer.

In the present invention, the dye-forming couplers represented by formula (I), (II), (III), (Ia) or (IIa) are preferably used in a silver halide emulsion layer, or layers adjacent thereto. A silver halide emulsion layer is particularly preferred.

The compound represented by any one of formulae (M-I) to (M-X) for use in the present invention, preferably in the third embodiment of the present invention, is explained in detail below.

First, each group usable in the magenta dye-forming couplers represented by any one of formulae (M-I) to (M-X) is explained.

Specific examples for each of the groups are set forth below. Specific examples of the group corresponding to the each group that is in any one of formulae (M-I) to (M-X) are also the same as described below. These specific examples of the group are applied to groups of other formulae than the magenta couplers, unless otherwise mentioned in particular.

An alkyl group (for example, methyl, ethyl, propyl, isopropyl, (t)-butyl, pentyl, hexyl, octyl, dodecyl), a cycloalkyl group (for example, cyclopentyl, cyclohexyl), an alkenyl group (for example, vinyl, allyl), an alkynyl group (for example, propargyl), an aryl group (for example, phenyl, naphthyl), a heterocyclic group (this is also referred to as a hetero-ring group; for example, pyridyl, thiazolyl, oxazolyl, imidazolyl, furyl, pyrrolyl, pyrazinyl, pyrimidinyl, pyridazinyl, selenazolyl, sulforanyl, piperidinyl, pyrazolyl, tetrazolyl), a halogen atom (for example, chlorine, bromine, iodine, fluorine), an alkoxy group (this is also referred to as an alkyloxy group; for example, methoxy, ethoxy, propyloxy, pentyloxy, hexyloxy, octyloxy, dodecyloxy), a cycloalkoxy group (for example, cyclopentyloxy, cyclohexyloxy), an aryloxy group (for example, phenoxy, naphthyloxy), a heterocyclic oxy group (this is also referred to as a hetero-ring oxy group; for example, pyridyloxy, furyloxy, pyrazinyloxy, pyrimidinyloxy), an alkylthio group (for example, methylthio, ethylthio, propylthio, pentylthio, hexylthio, octylthio, dodecylthio), a cycloalkylthio group (for example, cyclopentylthio, cyclohexylthio), an arylthio group (for example, phenylthio, naphthylthio), an alkoxycarbonyl group (for example, methyloxycarbonyl, ethyloxycarbonyl, butyloxycarbonyl, octyloxycarbonyl, dodecyloxycarbonyl), a cycloalkoxycarbonyl group (for example, cyclopentyloxycarbonyl, cyclohexyloxycarbonyl), an aryloxycarbonyl group (for example, phenyloxycarbonyl, naphthyloxycarbonyl), a heterocyclic oxycarbonyl group (for example, pyridyloxycarbonyl, furyloxycarbonyl, pyrazinyloxycarbonyl, pyrimidinyloxycarbonyl), a sulfamoyl group (for example, aminosulfonyl, methylaminosulfonyl, dimethylaminosulfonyl, butylaminosulfonyl, hexylaminosulfonyl, cyclohexylaminosulfonyl, octylaminosulfonyl, dodecylaminosulfonyl, phenylaminosulfonyl, naphthylaminosulfonyl, 2-pyridylaminosulfonyl), a ureido group (for example, methylureido, ethylureido, pentylureido, cyclohexylureido, octylureido, dodecylureido, phenylureido, naphthylureido, 2-pyridylaminoureido), an acyl group (for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl), an acyloxy group (for example, acetyloxy, ethylcarbonyloxy, butylcarbonyloxy, octylcarbonyloxy, dodecylcarbonyloxy, phenylcarbonyloxy), an amido group (this is also referred to as an acylamino group; for example, methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), a carbamoyl group (for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl), a sulfinyl group (for example, methylsulfinyl, ethylsulfinyl, butylsulfinyl, cyclohexylsulfinyl, 2-ethylhexylsufinyl, dodecylsulfinyl, phenylsulfinyl, naphthylsulfinyl, 2-pyridylsulfinyl), a sulfonyl group (for example, methylsulfonyl, ethylsulfonyl, butylsulfonyl, cyclohexylsulfonyl, 2-ethylhexylsulfonyl, dodecylsulfonyl, phenylsulfonyl, naphthylsulfonyl, 2-pyridylsulfonyl), an amino group (this group embraces an alkylamino group and an arylamino group; for example, amino, ethylamino, dimethylamino, butylamino, cyclopentylamino, 2-ethylhexylamino, dodecylamino, anilino, naphthylamino, 2-pyridylamino), a sulfonamido group (for example, methylsulfonylamino, ethylsulfonylamino, butylsulfonylamino, hexylsulfonylamino, cyclohexylsulfonylamino, octylsulfonylamino, dodecylsulfonylamino, phenylsulfonylamino).

The magenta dye-forming coupler represented by the aforementioned formula (M-I) for use in the present invention, preferably in the third embodiment of the present invention, is explained.

In the aforementioned formula (M-I), $Y_1$ and $Y_2$ each independently represent a hydrogen atom, an alkyl group, a cycloalkyl group, an aryl group, a heterocyclic group, an alkoxy group, a cycloalkoxy group, or a heterocyclic oxy group. Of these, preferred are a hydrogen atom, and an alkyl or alkoxy group having 1 to 20 carbon atoms. A hydrogen atom, and an alkyl or alkoxy group having 1 to 12 carbon atoms are more preferable. $Y_1$ and $Y_2$ may be the same or different.

$R_1$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, a ureido group, an acyl group, an acyloxy group, an amido group, a carbamoyl group, a sulfinyl group, a sulfonyl group, an amino group, a cyano group, a nitro group, or a hydroxyl group. These groups may be further substituted with any of the aforementioned substituents.

Of these, preferred as $R_1$ are an alkyl group, an alkenyl group, an alkoxy group, an aryloxy group, an acyloxy group, an amido group, an amino group, and a hydroxyl group. An alkyl group, alkoxy group or amido group, having 1 to 12 carbon atoms (more preferably 1 to 8 carbon atoms) is more preferable. p represents 0, 1, or 2. When p is 2, a plurality of $R_1$s may be the same or different. p is preferably 0 or 1.

$R_2$ represents a substituted or unsubstituted, alkyl group, alkenyl group, cycloalkyl group, aryl group, or heterocyclic group.

The substituent(s) for $R_2$ may be selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, an amido group, a sulfinyl group, a sulfonyl group, an amino group and a hydroxyl group. These groups may be further substituted with any of the aforementioned substituents.

$R_2$ is preferably an alkyl group having 1 to 20 carbon atoms or an aryl group having 6 to 20 carbon atoms, more preferably an alkyl group having 1 to 12 carbon atoms or an aryl group having 6 to 12 carbon atoms. The substituent(s) for $R_2$ is preferably an alkyl group, an alkoxy group, an alkoxycarbonyl group, an aryloxycarbonyl group, an acyloxy group, or an amido group.

X represents a halogen atom. A chlorine atom and a bromine atom are preferable. A chlorine atom is more preferable.

The magenta dye-forming coupler represented by the aforementioned formula (M-II) for use in the present invention, preferably in the third embodiment of the present invention, is explained.

In the aforementioned formula (M-II), $Y_3$ and $Y_4$ each independently represent a hydrogen atom, an alkyl group, a cycloalkyl group, an aryl group, a heterocyclic group, an alkoxy group, a cycloalkoxy group, an aryloxy group, or a heterocyclic oxy group. Of these, preferred are a hydrogen atom, and an alkyl group, alkoxy group, or aryloxy group having 1 to 20 carbon atoms. A hydrogen atom, and an alkyl group or alkoxy group having 1 to 12 carbon atoms are more preferable. $Y_3$ and $Y_4$ may be the same or different.

$R_3$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. Of these, preferred as $R_3$ are an alkyl group, an alkenyl group, an alkoxy group, an aryloxy group, an acyloxy group, an amido group, an amino group, and a hydroxyl group. An alkyl group, alkoxy group or amido group having 1 to 12 carbon atoms (more preferably 1 to 8 carbon atoms) is more preferable. q represents 0, 1, or 2. When q is 2, a plurality of $R_3$s may be the same or different. q is preferably 0 or 1.

$R_4$ represents a substituted or unsubstituted, alkyl group, alkenyl group, cycloalkyl group, aryl group, or heterocyclic group. The substituent(s) for $R_4$ may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_4$ is preferably an alkyl group or aryl group having 1 to 20 carbon atoms, and more preferably an alkyl group or aryl group having 1 to 12 carbon atoms. The substituent(s) for $R_4$ is preferably an alkyl group, an alkoxy group, an alkoxycarbonyl group, an aryloxycarbonyl group, an acyloxy group, a carbamoyl group, or an amido group.

X represents a halogen atom. A chlorine atom and a bromine atom are preferable. A chlorine atom is more preferable.

The magenta dye-forming coupler represented by the aforementioned formula (M-III) for use in the present invention, preferably in the third embodiment of the present invention, is explained.

In formula (M-III), $L_1$ represents —$NR_7$— or —O—. $R_5$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. Of these, preferred are an alkyl group, an alkenyl group, an alkoxy group, an aryloxy group, an acyloxy group, an amido group, an amino group, and a hydroxyl group. An alkyl group, alkoxy group or amido group having 1 to 12 carbon atoms (more preferably 1 to 8 carbon atoms) is more preferable. r represents 0, 1, or 2. When r is 2, a plurality of $R_5$s may be the same or different. r is preferably 0 or 1.

$R_6$ represents a substituted or unsubstituted, alkyl group, alkenyl group, cycloalkyl group, aryl group, or heterocyclic group. $R_7$ represents a hydrogen atom, or a substituted or unsubstituted, alkyl group, cycloalkyl group, alkenyl group, aryl group, or heterocyclic group. The substituent(s) for $R_6$ and $R_7$ each may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_6$ is preferably an alkyl group having 1 to 20 carbon atoms or an aryl group having 6 to 20 carbon atoms, more preferably an alkyl group having 1 to 12 carbon atoms or an aryl group having 6 to 12 carbon atoms. The substituent(s) for $R_6$ is preferably an alkyl group, an alkoxy group, an alkoxycarbonyl group, an aryloxycarbonyl group, an acyloxy group, a carbamoyl group, or an amido group. $R_7$ is preferably a hydrogen atom, an alkyl group having 1 to 20 carbon atoms or an aryl group having 6 to 20 carbon atoms, more preferably a hydrogen atom, an alkyl group having 1 to 12 carbon atoms or an aryl group having 6 to 12 carbon atoms. The substituent(s) for $R_7$ is preferably an alkyl group, an alkoxy group, an alkoxycarbonyl group, an aryloxycarbonyl group, an acyloxy group, a carbamoyl group, or an amido group. X represents a halogen atom. A chlorine atom and a bromine atom are preferable. A chlorine atom is more preferable.

The magenta dye-forming coupler represented by the aforementioned formula (M-IV) for use in the present invention, preferably in the third embodiment of the present invention, is explained.

In formula (M-IV), $L_2$ represents —$NR_{10}$— or —O—. $R_8$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. Of these, preferred as $R_8$ are an alkyl group, an alkenyl group, an alkoxy group, an aryloxy group, an acyloxy group, an amido group, an amino group, and a hydroxyl group. An alkyl group, alkoxy group or amido group having 1 to 12 carbon atoms (more preferably 1 to 8 carbon atoms) is more preferable. s represents 0, 1, or 2. When s is 2, a plurality of $R_8$s may be the same or different. s is preferably 0 or 1.

$R_9$ represents a substituted or unsubstituted, alkyl group, alkenyl group, cycloalkyl group, aryl group, or heterocyclic group. $R_{10}$ represents a hydrogen atom, or a substituted or unsubstituted, alkyl group, alkenyl group, cycloalkyl group, aryl group, or heterocyclic group. The substituent(s) for $R_9$ and $R_{10}$ each may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_9$ is preferably an alkyl group having 1 to 20 carbon atoms or an aryl group having 6 to 20 carbon atoms, more preferably an alkyl group having 1 to 12 carbon atoms or an aryl group having 6 to 12 carbon atoms. The substituent(s) for $R_9$ is preferably an alkyl group, an alkoxy group, an alkoxycarbonyl group, an aryloxycarbonyl group, an acyloxy group, a carbamoyl group, or an amido group. $R_{10}$ is preferably a hydrogen atom, or an alkyl group or aryl group having 1 to 20 carbon atoms, and more preferably a hydrogen atom, or an alkyl group or aryl group having 1 to 12 carbon atoms. The substituent for $R_{10}$ is preferably an alkyl group, an alkoxy group, an alkoxycarbonyl group, an aryloxycarbonyl group, an acyloxy group, a carbamoyl group, or an amido group. X represents a halogen atom. A chlorine atom and a bromine atom are preferable. A chlorine atom is more preferable.

The magenta dye-forming coupler represented by the aforementioned formula (M-V) for use in the present invention, preferably in the third embodiment of the present invention, is explained.

In formula (M-V), $R_{11}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. Of these, preferred as $R_{11}$ are an alkyl group, an alkenyl group, an alkoxy group, an aryloxy group, an acyloxy group, an amido group, an amino group, and a hydroxyl group. An alkyl group, alkoxy group or amido group, having 1 to 12 carbon atoms (more preferably 1 to 8 carbon atoms) is more preferable. t represents 0, 1, or 2. When t is 2, a plurality of $R_{11}$s may be the same or different. t is preferably 0 or 1.

$R_{12}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfonyl group, a sulfinyl group, an amino group, or a hydroxyl group. These groups may be further substituted with any of the aforementioned substituents. $R_{12}$ is preferably a hydrogen atom, an alkyl group, an alkoxy group, an aryloxycarbonyl group, an acyloxy group, a carbamoyl group, an amido group, or a hydroxyl group, and more preferably a hydrogen atom, an alkyl group, an alkoxy group, an aryloxycarbonyl group, an acyloxy group, or an amido group. Of these, particularly preferred are groups having 1 to 36 carbon atoms, more preferably 1 to 26 carbon atoms.

$R_{13}$ represents a hydrogen atom, an alkyl group, an alkenyl group, a cycloalkyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group. These groups may be further substituted with any of the aforementioned substituents. $R_{13}$ is preferably a hydrogen atom, an alkyl group, an alkoxy group, an alkoxycarbonyl group, an aryloxycarbonyl group, an acyloxy group, a carbamoyl group, an amido group, or a hydroxyl group, and more preferably a hydrogen atom, an alkyl group, an alkoxy group, an alkoxycarbonyl group, an aryloxycarbonyl group, an acyloxy group, or an amido group. Of these, particularly preferred are groups having 1 to 36 carbon atoms, more preferably 1 to 26 carbon atoms.

$R_{14}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group. These groups may be further substituted with any of the aforementioned substituents. $R_{14}$ is preferably a hydrogen atom, an alkyl group, an alkoxycarbonyl group, an aryloxycarbonyl group, an acyloxy group, a carbamoyl group, an amido group, or a hydroxyl group, and more preferably a hydrogen atom, an alkyl group, an alkoxy group, an alkoxycarbonyl group, an aryloxycarbonyl group, an acyloxy group, or an amido group. Of these, particularly preferred are groups having 1 to 36 carbon atoms, more preferably 1 to 26 carbon atoms. X represents a halogen atom. A chlorine atom and a bromine atom are preferable. A chlorine atom is more preferable.

The magenta dye-forming coupler represented by the aforementioned formula (M-VI) for use in the present invention, preferably in the third embodiment of the present invention, is explained.

In formula (M-VI), $R_{15}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. Of these, preferred as $R_{15}$ are an alkyl group, an alkenyl group, an alkoxy group, an aryloxy group, an acyloxy group, an amido group, an amino group, and a hydroxyl group. An alkyl group, alkoxy group or amido group, having 1 to 12 carbon atoms (more preferably 1 to 8 carbon atoms) is more preferable. u represents 0, 1, or 2. When u is 2, a plurality of $R_{15}$s may be the same or different. u is preferably 0 or 1.

$R_{16}$, $R_{17}$, and $R_{18}$ each independently represent a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group. These groups may be further substituted with any of the aforementioned substituents. $R_{16}$, $R_{17}$ and $R_{18}$ are preferably a hydrogen atom, an alkyl group, an alkoxy group, an alkoxycarbonyl group, an aryloxycarbonyl group, an acyloxy group, a carbamoyl group, an amido group, or a hydroxyl group, and more preferably a hydrogen atom, an alkyl group, an alkoxy group, an alkoxycarbonyl group, an aryloxycarbonyl group, an acyloxy group, or an amido group. Of these, particularly preferred are groups having 1 to 36 carbon atoms, more preferably 1 to 26 carbon atoms. X represents a halogen atom. A chlorine atom and a bromine atom are preferable. A chlorine atom is more preferable.

The magenta dye-forming coupler represented by the aforementioned formula (M-VII) for use in the present invention, preferably in the third embodiment of the present invention, is explained.

In formula (M-VII), $R_{19}$ and $R_{20}$ each independently represent an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. $R_{19}$ and $R_{20}$ are preferably a hydrogen atom, an alkyl group, an alkoxy group, an alkoxycarbonyl group, an aryloxycarbonyl group, an acyloxy group, a carbamoyl group, an amido group, or a hydroxyl group, and more preferably a hydrogen atom, an alkyl group, an alkoxy group, an alkoxycarbonyl group, an acyloxy group, or an amido group. v and w each independently represent 0 or I, with the proviso that v and w are not 0 at the same time.

$L_3$ represents —$NR_{22}$— or —O—. X represents 0 or 1. $R_{21}$ represents a substituted or unsubstituted, alkyl group, alkenyl group, cycloalkyl group, aryl group, or heterocyclic group. $R_{22}$ represents a hydrogen atom, or a substituted or unsubstituted, alkyl group, alkenyl group, cycloalkyl group, aryl group, or heterocyclic group. The substituent(s) for $R_2$, and $R_{22}$ may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_{21}$ is preferably an alkyl group having 1 to 20 carbon atoms or an aryl group having 6 to 20 carbon atoms, more preferably an alkyl group having 1 to 12 carbon atoms or an aryl group having 6 to 12 carbon atoms. The substituent(s) for $R_{21}$ is preferably an alkyl group, an alkoxy group, an alkoxycarbonyl group, an aryloxycarbonyl group, an acyloxy group, a carbamoyl group, an amido group, or a hydroxyl group, more preferably an alkyl group, an alkoxy group, an alkoxycarbonyl group, an acyloxy group, or an amido group. $R_{22}$ is preferably a hydrogen atom, an alkyl group having 1 to 20 carbon atoms or an aryl group having 6 to 20 carbon atoms, more preferably a hydrogen atom, an alkyl group having 1 to 12 carbon atoms or an aryl group having 6 to 12 carbon atoms. The substituent(s) for $R_{22}$ is preferably an alkyl group, an alkoxy group, an alkoxycarbonyl group, an aryloxycarbonyl group, an acyloxy group, a carbamoyl group, an amido group, or a hydroxyl group, more preferably an alkyl group, an alkoxy group, an alkoxycarbonyl group, an acyloxy group, or an amido group. X represents a halogen atom. A chlorine atom and a bromine atom are preferable. A chlorine atom is more preferable.

The magenta dye-forming coupler represented by the aforementioned formula (M-VIII) for use in the present invention, preferably in the third embodiment of the present invention, is explained.

In the aforementioned formula (M-VIII), $R_{23}$ and $R_{24}$ each independently represent a hydrogen atom, an alkyl group, a cycloalkyl group, an aryl group, or a heterocyclic group. $R_{23}$ and $R_{24}$ are preferably a hydrogen atom, an alkyl group having 1 to 20 carbon atoms, or an aryl group having 6 to 20 carbon atoms, and more preferably a hydrogen atom, an alkyl group having 1 to 12 carbon atoms, or an aryl group having 6 to 12 carbon atoms. $L_4$ represents a divalent linking group selected from —(C═O)—, —(C═O)—O—, —O—(C═O)—, —(C═O)—$NR_{27}$—, —$NR_{27}$—(C═O)—, —$NR_{27}$—(C═O)—$NR_{27}$—, —O—(C═O)—$NR_{27}$—, —$NR_{27}$—(C═O)—, —SO—, —$SO_2$—, and —$NR_{27}$—. $L_4$ is preferably —(C═O)—, —(C═O)—O—, —O—(C═O)—, —(C═O)—$NR_{27}$—, —$NR_{27}$—(C═O)—, or —$NR_{27}$—(C═O)—$NR_{27}$—, and more preferably —(C═O)—, —(C═O)—O—, —O—(C═O)—, —(C═O)—$NR_{27}$—, or —$NR_{27}$—(C═O)—. $R_{25}$ represents a substituted or unsubstituted, alkyl group, alkenyl group, cycloalkyl group, aryl group, or heterocyclic group. The substituent(s) for $R_{25}$ may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_{25}$ is preferably an alkyl group or aryl group having 1 to 20 carbon atoms, and more preferably an alkyl group or aryl group having 1 to 12 carbon atoms. The substituents for $R_{25}$ is preferably an alkyl group, an alkoxy group, an alkoxycarbonyl group, an aryloxycarbonyl group, an acyloxy group, a carbamoyl group, an amido group, or a hydroxyl group, more preferably an alkyl group, an alkoxy group, an alkoxycarbonyl group, an acyloxy group, or an amido group.

$R_{26}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. $R_{26}$ is preferably an alkyl group, an alkoxy group, an alkoxycarbonyl group, an aryloxycarbonyl group, an acyloxy group, a carbamoyl group, an amido group, or a hydroxyl group, and more preferably an alkyl group, an alkoxy group, an alkoxycarbonyl group, an acyloxy group, or an amido group. Of these, particularly preferred are groups having 1 to 36 carbon atoms, more preferably 1 to 26 carbon atoms. y represents 0, 1, or 2. When y is 2, a plurality of $R_{26}$s may be the same or different. y is preferably 0 or 1.

$R_{27}$ represents a hydrogen atom, or a substituted or unsubstituted, alkyl group, cycloalkyl group, alkenyl group, aryl group, or heterocyclic group. $R_{27}$ is preferably a hydrogen atom or an alkyl group having 1 to 20 carbon atoms, more preferably a hydrogen atom or an alkyl group having 1 to 12 carbon atoms. The substituent(s) for $R_{27}$ may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_{27}$ is preferably an alkyl group having 1 to 20 carbon atoms or an aryl group having 6 to 20 carbon atoms, more preferably an alkyl group having 1 to 12 carbon atoms or an aryl group having 6 to 12 carbon atoms. The substituent(s) for $R_{27}$ is preferably an alkyl group, an alkoxy group, an alkoxycarbonyl group, an aryloxycarbonyl group, an acyloxy group, a carbamoyl group, an amido group, or a hydroxyl group, more preferably an alkyl group, an alkoxy group, an alkoxycarbonyl group, an acyloxy group, or an amido group. X represents a halogen atom. A chlorine atom and a bromine atom are preferable. A chlorine atom is more preferable.

The magenta dye-forming coupler represented by the aforementioned formula (M-IX) for use in the present invention, preferably in the third embodiment of the present invention, is explained.

In formula (M-IX), $R_{28}$ represents a substituted or unsubstituted, alkyl group, alkenyl group, cycloalkyl group, aryl group, or heterocyclic group. The substituent(s) for $R_{28}$ may be selected from an alkyl group, an alkenyl group, a cycloalkyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group. These groups may be further substituted with any of the aforementioned substituents. $R_{28}$ is preferably an alkyl group having 1 to 20 carbon atoms or an aryl group having 6 to 20 carbon atoms, more preferably an alkyl group having 1 to 12 carbon atoms or an aryl group having 6 to 12 carbon atoms. The substituent(s) for $R_{28}$ is preferably an alkyl group, an alkoxy group, an alkoxycarbonyl group, an aryloxycarbonyl group, an acyloxy group, a carbamoyl group, an amido group, or a hydroxyl group, more preferably an alkyl group, an alkoxy group, an alkoxycarbonyl group, an acyloxy group, or an amido group.

$R_{29}$ represents an alkyl group, a cycloalkyl group, an alkenyl group, an alkynyl group, an aryl group, a heterocyclic group, a halogen atom, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group. These groups may be further substituted with any of the aforementioned substituents. $R_{29}$ is preferably an alkyl group, an alkoxycarbonyl group, an aryloxycarbonyl group, an acyloxy group, a carbamoyl group, an amido group, or a hydroxyl group, and more preferably an alkyl group, an alkoxycarbonyl group, an acyloxy group, or an amido group. Of these, particularly preferred are groups having 1 to 36 carbon atoms, more preferably 1 to 26 carbon atoms. z represents 0, 1, or 2. When z is 2, a plurality of $R_{29}$s may be the same or different. z is preferably 0 or 1. X represents a halogen atom. A chlorine atom and a bromine atom are preferable. A chlorine atom is more preferable.

The magenta dye-forming coupler represented by the aforementioned formula (M-X) for use in the present invention, preferably in the third embodiment of the present invention, is explained.

$R_{31}$ represents a tertiary alkyl group. The tertiary alkyl group may have a substituent, and branched alkyl groups thereof may bond with each other to form a ring. As the substituent(s), preferred are, for example, a halogen atom, an aryl group, an alkoxy group, an aryloxy group, an alkylthio group, an arylthio group, an alkylcarbonyloxy group, an arylcarbonyloxy group, an alkoxycarbonyl group, a carbonamido group, a sulfonamido group, a carboxyl group, and a cyano group. Examples of $R_{31}$ in which branched alkyl groups bond with each other to form a ring, include 1-methyl cyclopropyl group, 1-ethyl cyclopropyl group, and adamantyl group. $R_{31}$ is most preferably a t-butyl group. $R_{32}$ and $R_{33}$ each independently represent a hydrogen atom, or a substituent. As the substituent, preferred are, for example, a cyano group, a hydroxyl group, a carboxyl group, a halogen atom, an alkyl group, an aryl group, an alkoxy group, an aryloxy group, an alkoxycarbonyl group, a carbamoyl group, and a sulfamoyl group. In the present invention, it is preferred that $R_{32}$ is a hydrogen atom, and $R_{33}$ is a hydrogen atom, an alkyl group, or an alkoxy group. Most preferably both $R_{32}$ and $R_{33}$ are hydrogen atoms at the same time.

$R_{34}$ represents a hydrogen atom, an alkyl group or an aryl group. The term "alkyl group" herein is used to mean a substituted or unsubstituted and straight or branched chain alkyl group. Examples of the substituent(s) of the substituted alkyl group include a halogen atom, a hydroxyl group, a cyano group, a carboxyl group, an aryl group, an alkoxy group, an aryloxy group, an alkylthio group, an arylthio group, an oxycarbonyl group, an carbonyloxy group, a carbonamido group, a sulfonamido group, a carbamoyl group, a sulfamoyl group, an imido group (for example, succinimido, phthalimido, hexadecylsuccinimido, octadecylsuccinimido), a urethane group (for example, methylurethane, ethylurethane, dodecylurethane, phenylurethane), a ureido group, and a sulfonyl group. The term "aryl group" herein is used to mean a substituted or unsubstituted aryl group. The substituent(s) of the substituted aryl group has the same meanings as "the substituent(s) of the substituted alkyl group" explained with respect to the aforementioned substituent $R_{34}$. $R_{35}$ represents an alkyl group, an aryl group, an alkoxy group, an alkylamino group or an arylamino group. The term "alkyl group" herein is used to mean a substituted or unsubstituted and straight or branched chain alkyl group. Examples of the substituent(s) of this substituted alkyl group has the same meanings as "the substituent(s) of the substituted alkyl group" explained with respect to the aforementioned substituent $R_{34}$. As the alkyl group, a substituted alkyl group, or a straight or branched chain unsubstituted alkyl group having at least 14 carbon atoms are preferable from the viewpoint of solubility to organic solvents. Of these alkyl groups, substituted alkyl groups are more preferable, and substituted alkyl groups having the total of carbon atoms of 14 or more are further more preferable. As the examples of the substituent(s) of this substituted alkyl group, preferred are an alkoxy group, an aryloxy group, an alkylthio group, an arylthio group, an alkoxycarbonyl group, an aryloxycarbonyl group, a carbonamido group, a urethane group, a ureido group, an imido group, a sulfonamido group and a sulfonyl group. Particularly an alkoxycarbonyl group is preferable.

The term "aryl group" of $R_{35}$ herein is used to mean a substituted or unsubstituted aryl group. The substituent(s) of this substituted aryl group has the same meanings as "the substituent(s) of the substituted alkyl group" explained with respect to the aforementioned substituent $R_{34}$. The term "alkoxy group" of $R_{35}$ herein is used to mean a substituted or unsubstituted and straight or branched chain alkyloxy group. Examples of the substituent(s) of the substituted alkyloxy group has the same meanings as "the substituent(s) of the substituted alkyl group" explained with respect to the aforementioned substituent $R_{34}$. The term "alkylamino group" of $R_{35}$ herein is used to mean a substituted or unsubstituted and straight or branched chain alkylamino group. Examples of the substituent(s) of the substituted alkylamino group has the same meanings as "the substituent(s) of the substituted alkyl group" explained with respect to the aforementioned substituent $R_{34}$. The term "arylamino group" of $R_{35}$ herein is used to mean a substituted or unsubstituted arylamino group. The substituent(s) of the substituted arylamino group has the same meanings as "the substituent(s) of the substituted alkyl group" explained with respect to the aforementioned substituent $R_{34}$. As $R_{35}$, an alkyl group, an aryl group, an alkoxy group and an alkylamino group are preferred from the viewpoint of solubility. An alkyl group, an aryl group and an alkoxy group are more preferred from the easiness of synthesis. Particularly an alkyl group is preferable. A and B each represent —CO— or —$SO_2$—. $\alpha$ represents 0 or 1. A is preferably —CO— because the maximum absorption wavelength of a dye formed upon a coupling reaction with an oxidation product of a developing agent is short. $R_{34}$ and $R_{35}$ may bond with each other to form a 5- to 7-membered ring. Typical examples of the 5- to 7-membered ring are shown below. However, the present invention is not limited to these rings.

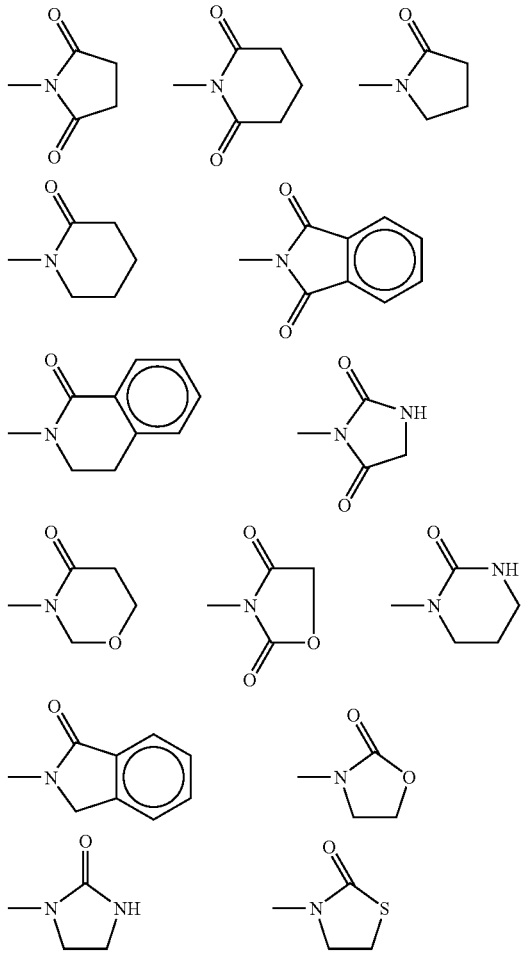

The 5- to 7-membered ring may have a substituent substitutive on the ring, such as those described in the aforementioned $R_{32}$ and $R_{33}$. When $R_{34}$ and $R_{35}$ bond with each other to form a ring, an imido ring and a lactam ring are preferable as the ring. However, it is more preferable that $R_{34}$ and $R_{35}$ do not bond with each other. $\alpha$ is preferably 0. It is most preferred that $\alpha$ is 0 and $R_{34}$ is a hydrogen atom. X represents a hydrogen atom, a halogen atom, or an aryloxy group. In the coupler for use in the present invention, the X that is a halogen atom, or an aryloxy group, leaves upon a coupling reaction with an oxidation product of a developing agent. As the halogen atom, there are fluorine, chlorine and bromine atoms. The term "aryloxy group" herein is used to mean a substituted or unsubstituted aryloxy group. The substituent(s) of the substituted aryloxy group has the same meanings as "the substituent(s) of the substituted alkyl group" explained with respect to the aforementioned substituent $R_{34}$. Examples of the aryloxy group include a phenoxy group, a 4-methylphenoxy group, a 4-tert-butylphenoxy group, a 4-methoxycarbonyl phenoxy group, a 4-ethoxycarbonyl phenoxy group, a 4-carboxyphenoxy group, a 4-cyanophenoxy group, and a 2,4-dimethylphenoxy group. X is preferably a halogen atom, or an aryloxy group, more preferably a halogen atom, and most preferably a chlorine atom.

Specific examples of the typical magenta couplers according to the present invention are shown below. However, the present invention should not be construed as being limited to these compounds.

M-1-1

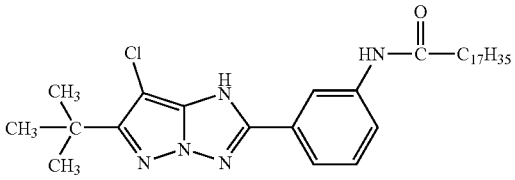

M-1-2

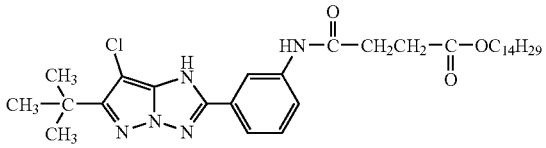

M-1-5

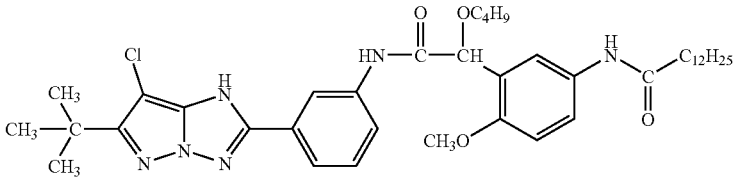

M-1-6

M-1-7

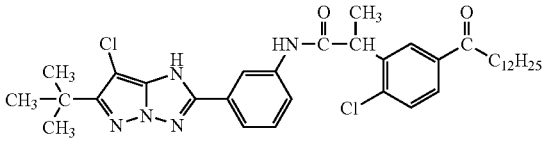

M-1-8

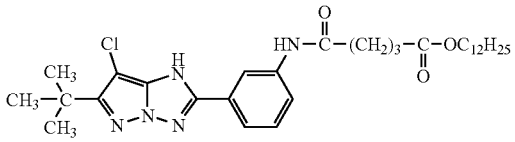

M-1-9

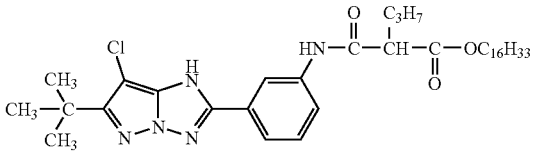

M-1-10

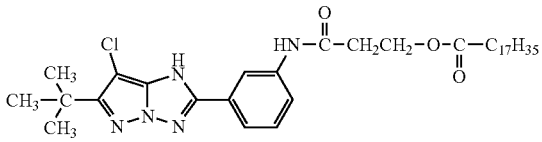

M-1-11

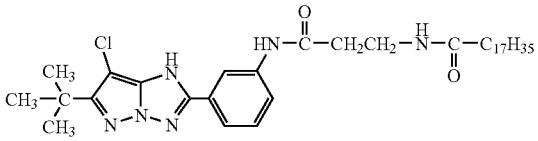

M-1-12

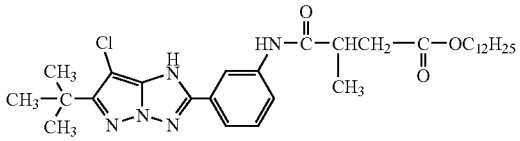

M-1-13

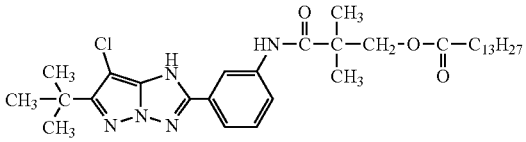

M-1-14

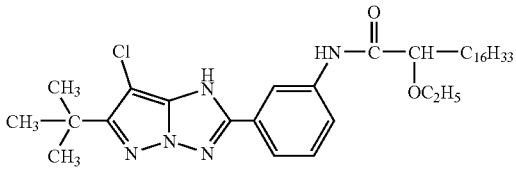

M-1-15

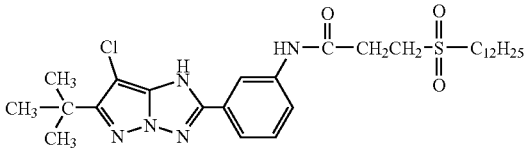

M-1-16

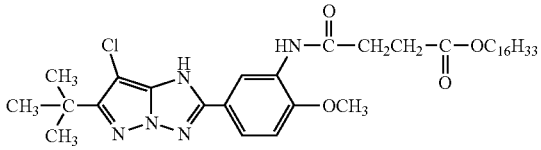

M-1-17

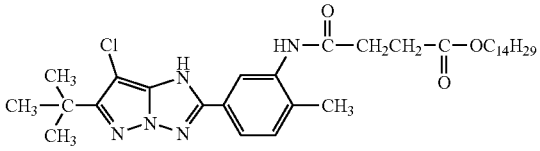

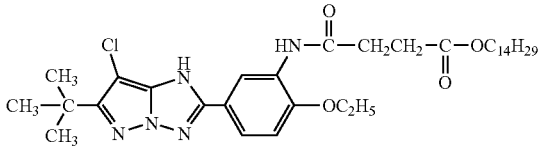

-continued
M-1-18
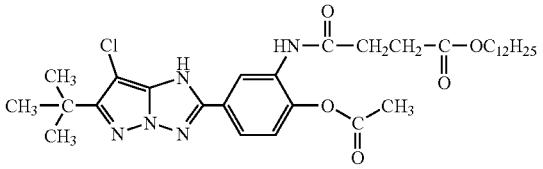
M-1-19
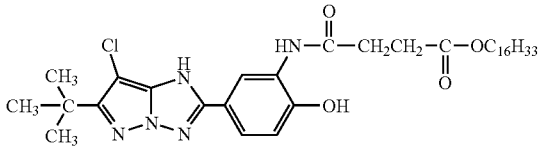
M-1-20
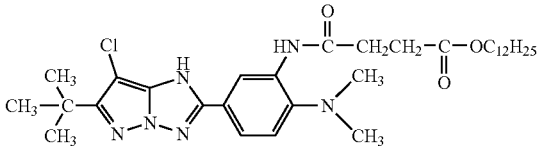
M-1-21
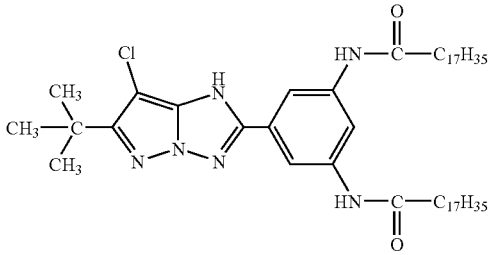
M-1-22
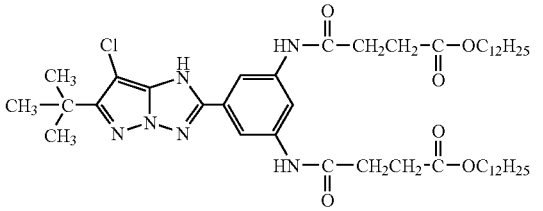
M-1-23
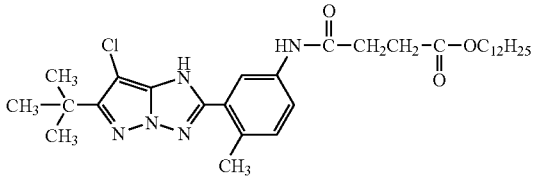
M-1-24
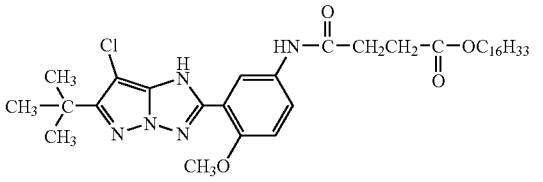
M-1-25
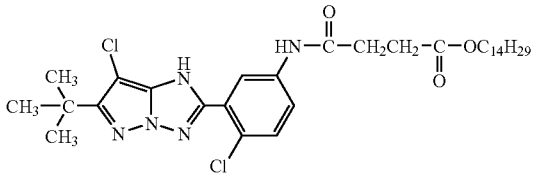
M-1-26
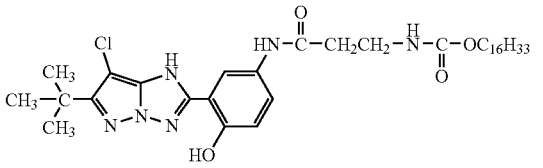
M-1-27
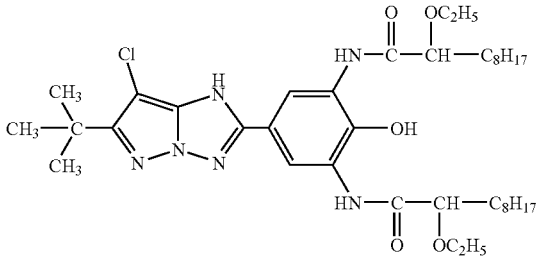
M-1-28
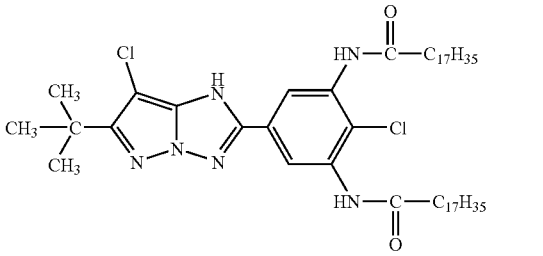
M-1-29
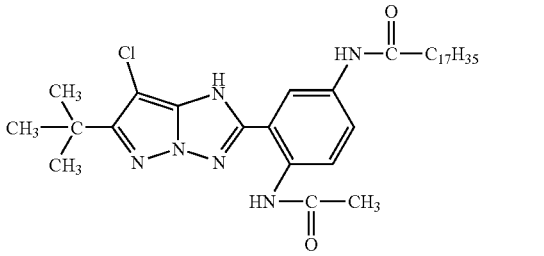

-continued
M-1-30
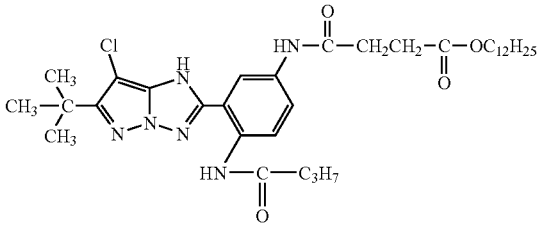
M-2-1
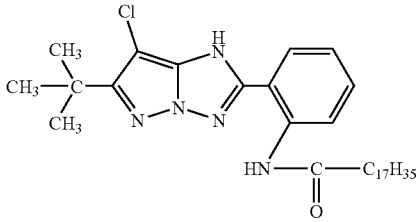
M-2-2
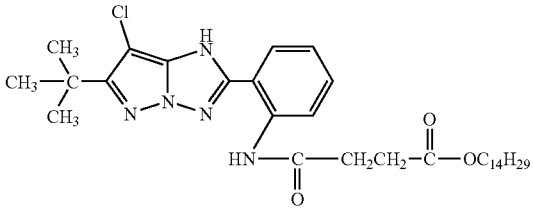
M-2-3
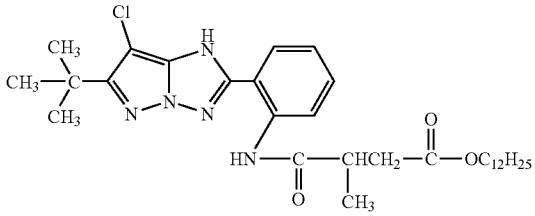
M-2-4
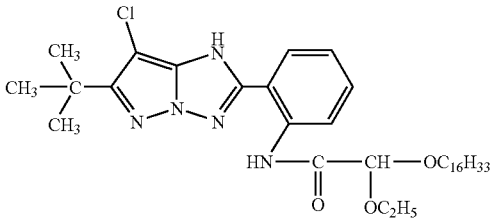
M-2-5
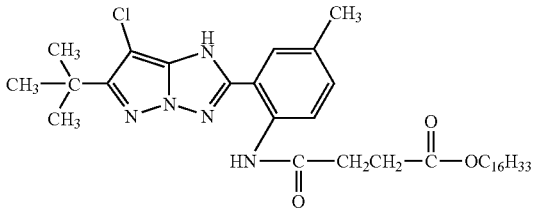
M-2-6
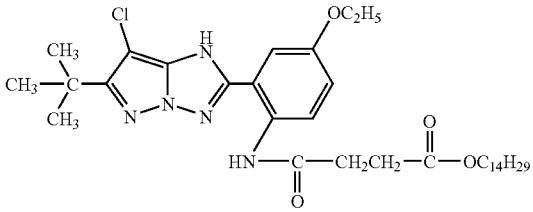
M-2-7
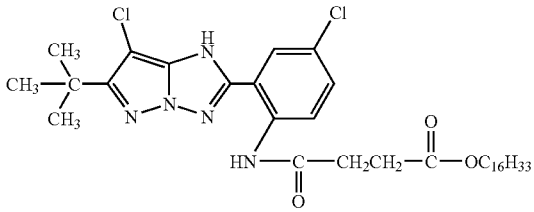
M-2-8
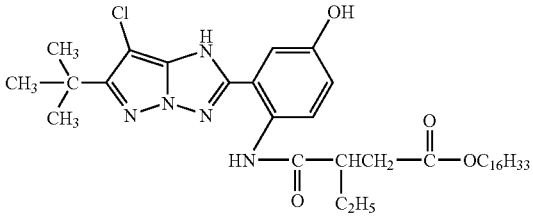
M-2-9
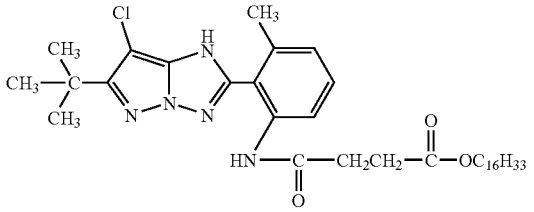
M-2-10
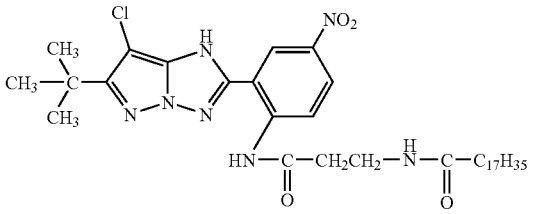
M-3-1
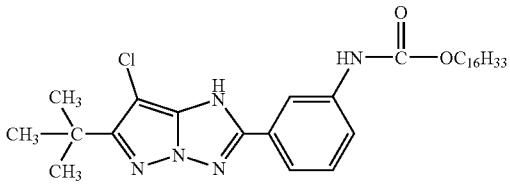

-continued
M-3-2
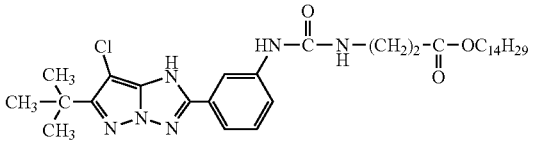
M-3-3
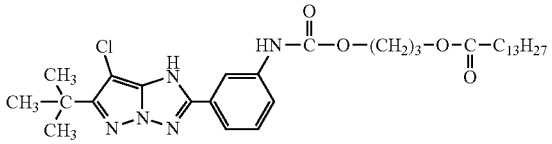
M-3-4
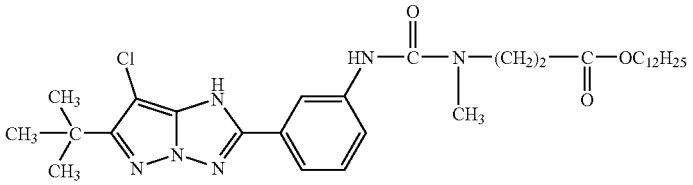
M-3-5
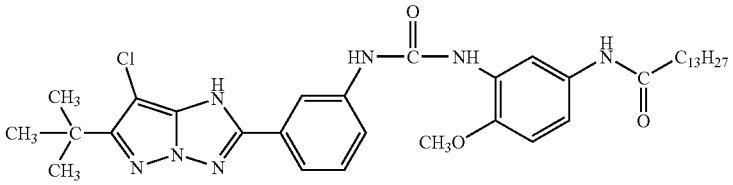
M-3-6
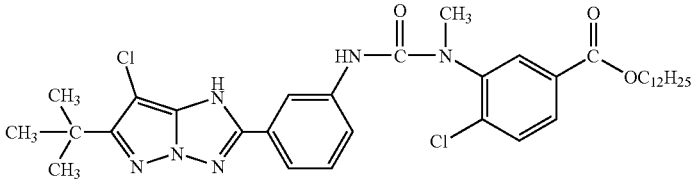
M-3-7
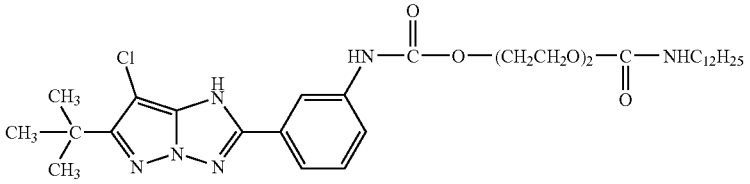
M-3-8
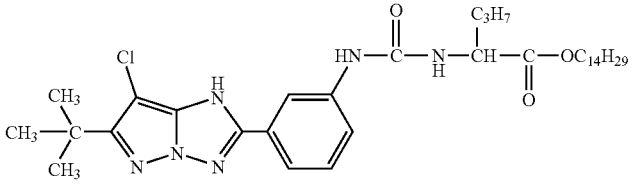
M-3-9
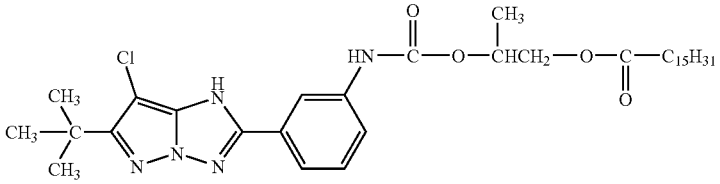
M-3-10
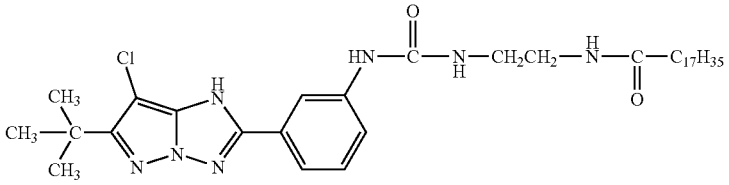

-continued
M-3-11
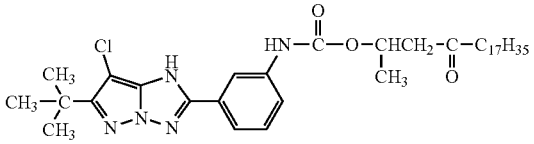
M-3-12
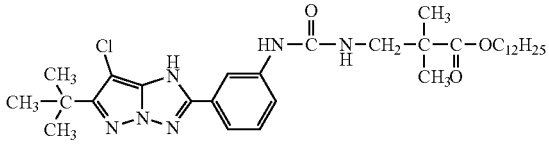
M-3-13
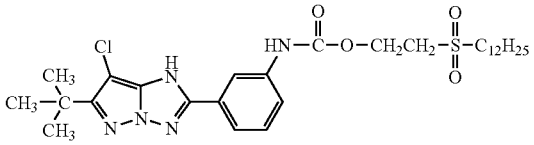
M-3-14
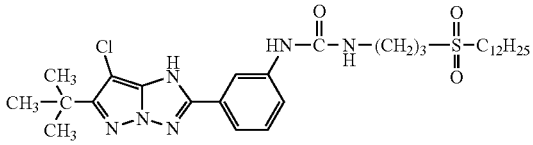
M-3-15
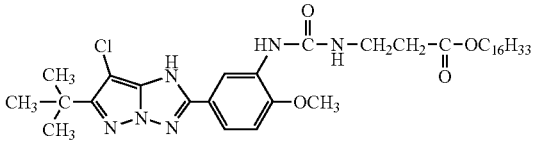
M-3-16
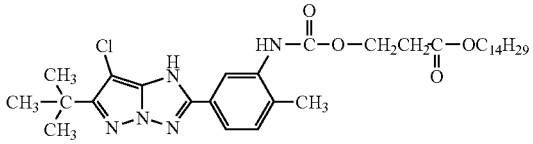
M-3-17
M-3-18
M-3-19
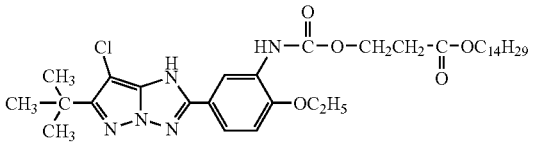
M-3-20
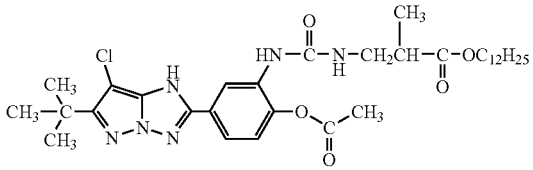
M-3-21
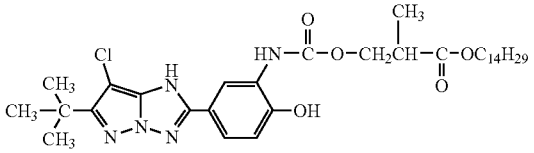
M-3-22
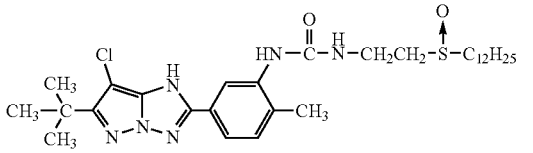
M-3-23
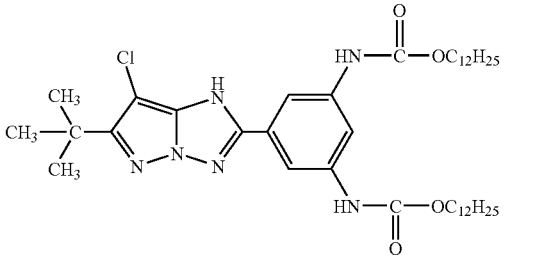
M-3-24
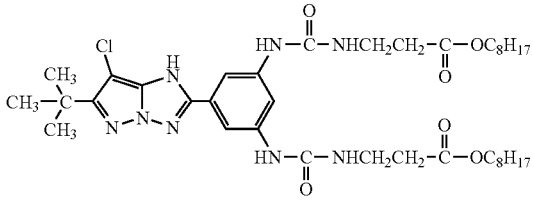
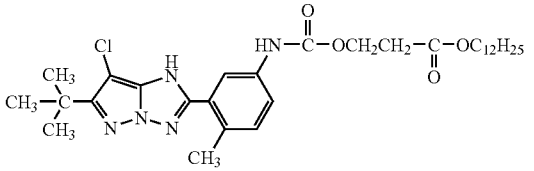
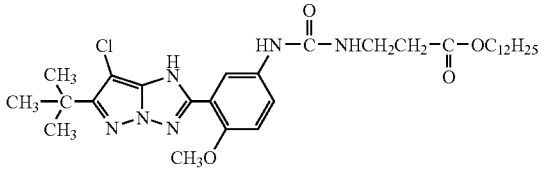
M-3-25
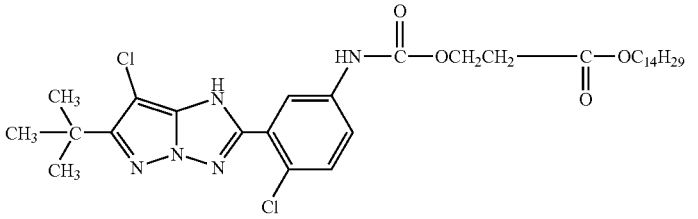

-continued
M-3-26
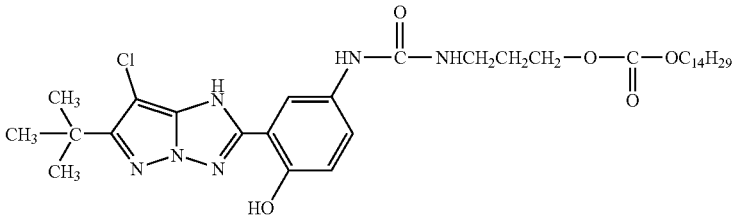
M-3-27
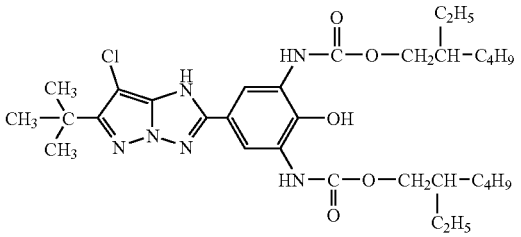
M-3-28
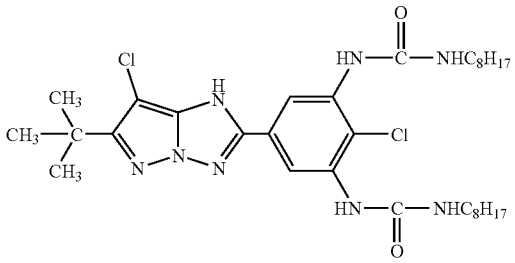
M-3-29
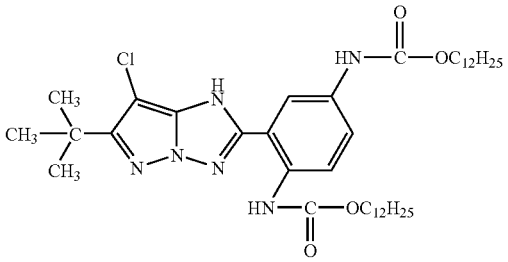
M-3-30
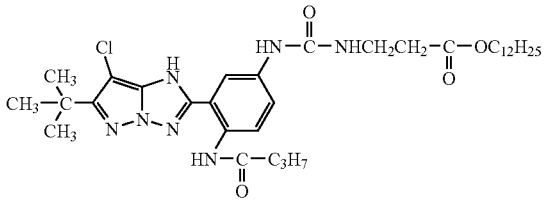
M-3-31
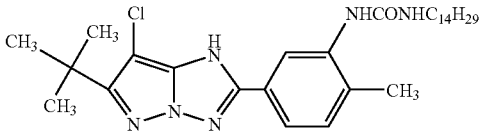
M-3-32
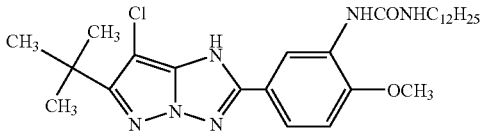
M-3-33
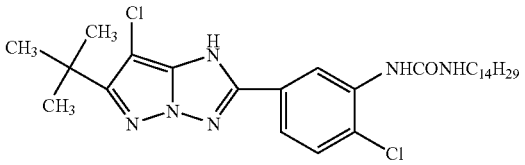
M-3-34
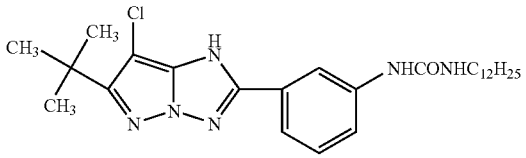
M-3-35
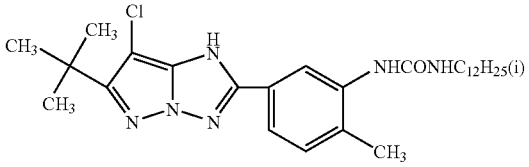
M-3-36
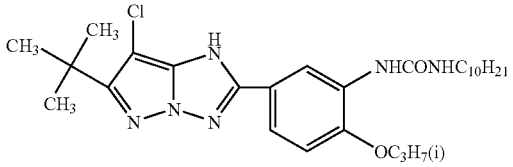
M-3-37
M-4-1
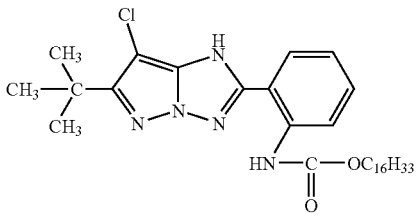
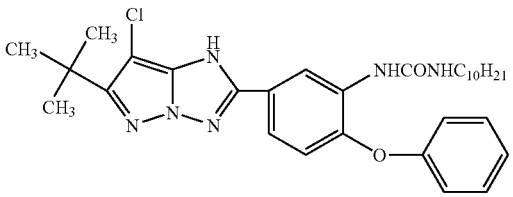

-continued
M-4-2
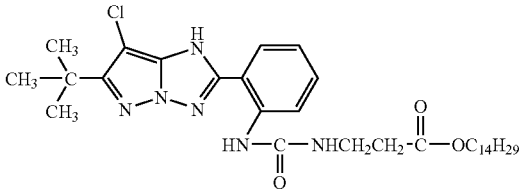
M-4-3
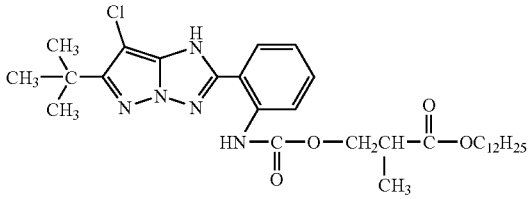
M-4-4
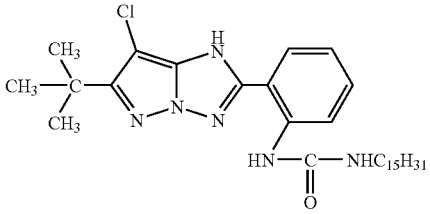
M-4-5
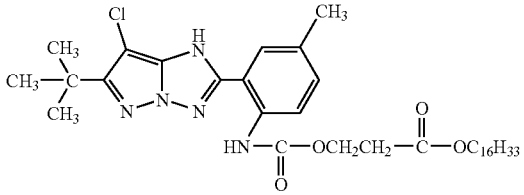
M-4-6
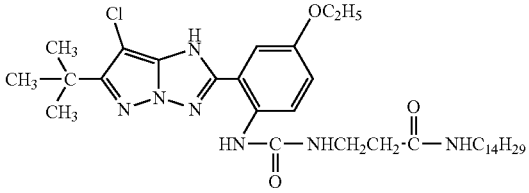
M-4-7
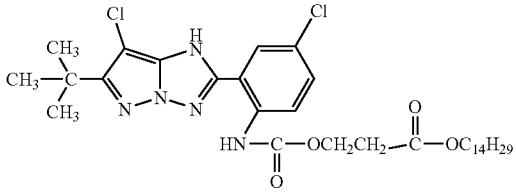
M-4-8
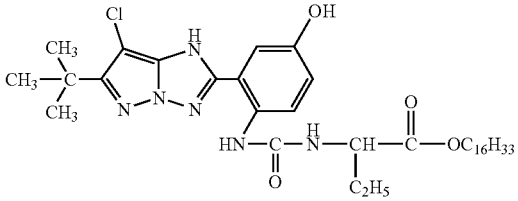
M-4-9
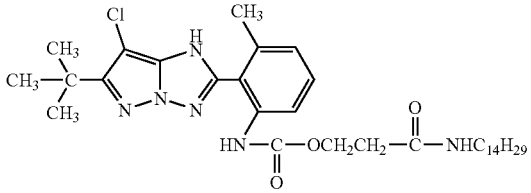
M-4-10
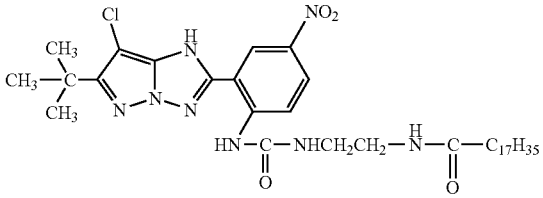
M-5-1
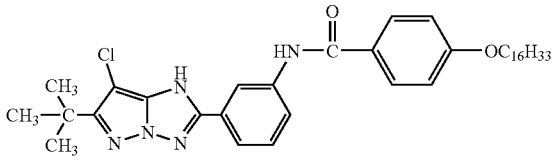
M-5-2
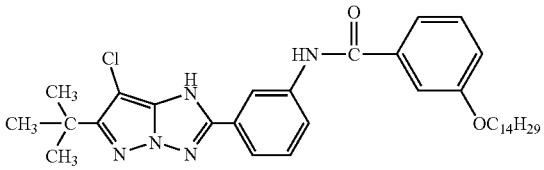
M-5-3
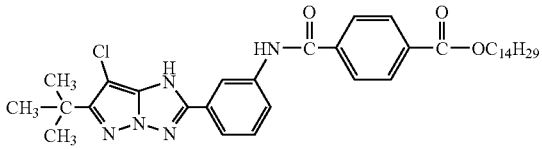
M-5-4
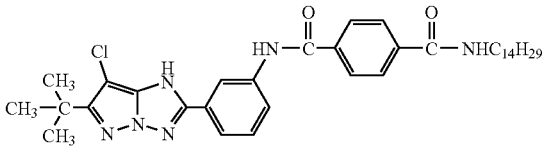
M-5-5
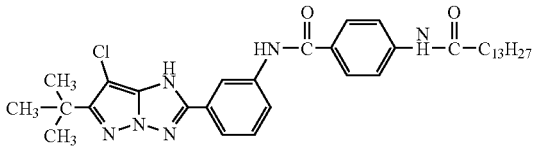

-continued
M-5-6
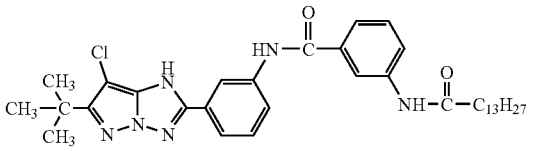
M-5-7
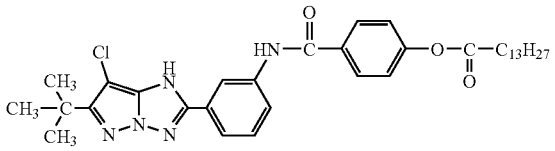
M-5-8
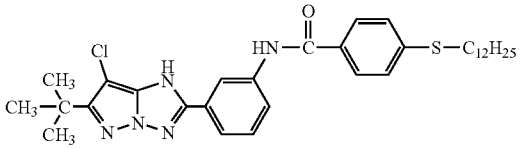
M-5-9
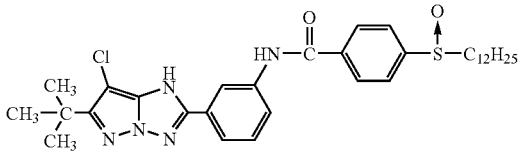
M-5-10
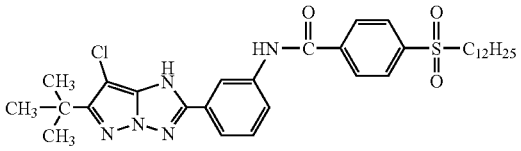
M-5-11
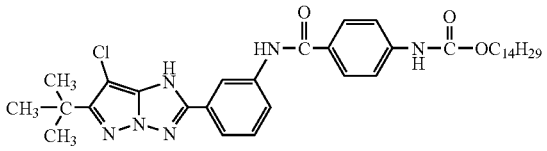
M-5-12
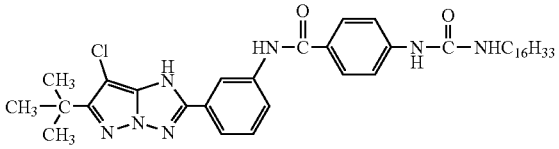
M-5-13
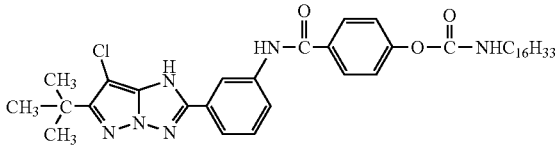
M-5-14
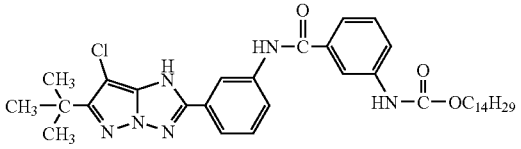
M-5-15
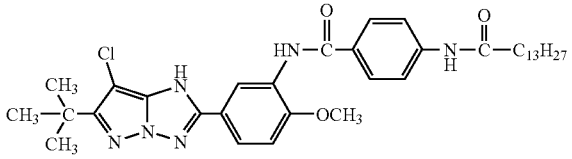
M-5-16
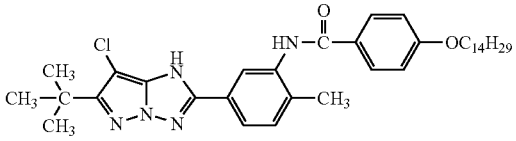
M-5-17
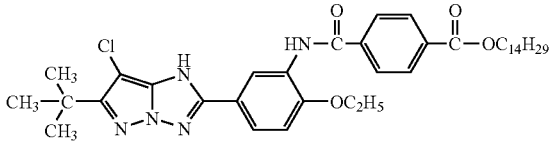
M-5-18
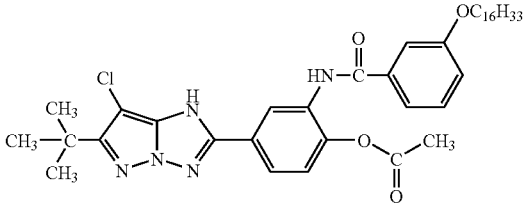
M-5-19
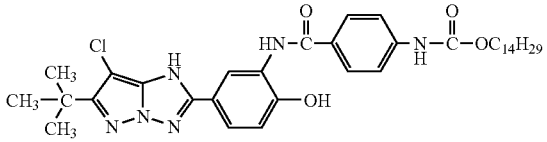

-continued
M-5-20
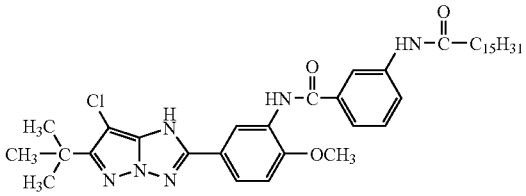
M-5-21
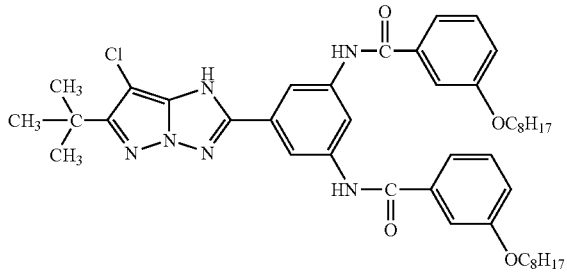
M-5-22
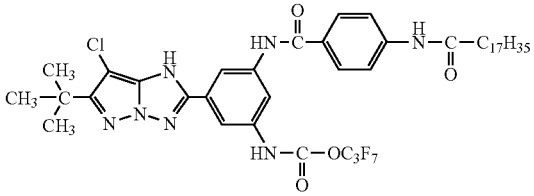
M-5-23
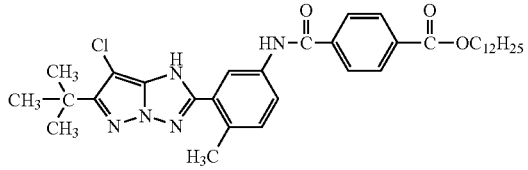
M-5-24
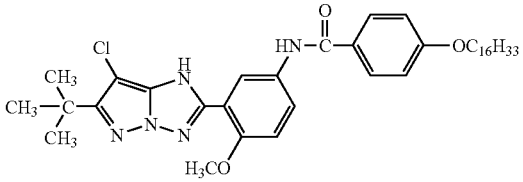
M-5-25
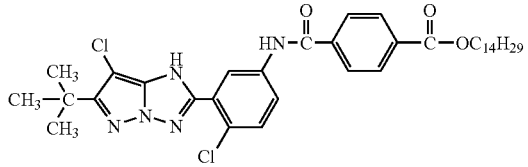
M-5-26
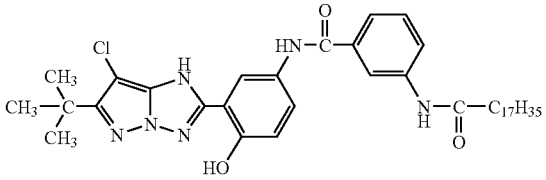
M-5-27
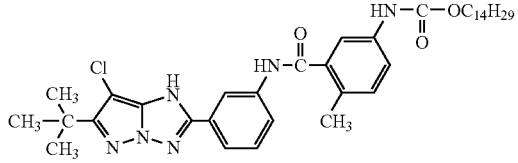
M-5-28
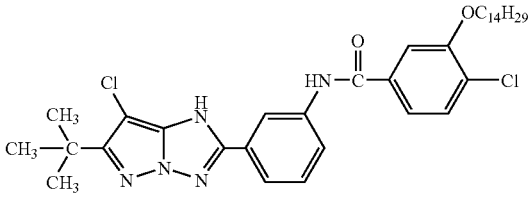
M-5-29
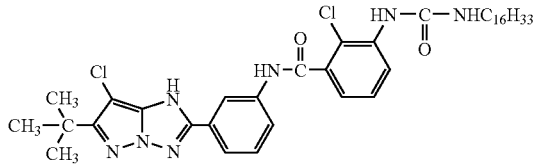
M-5-30
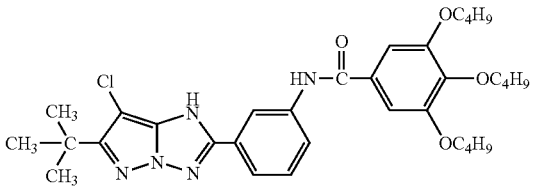
M-6-1
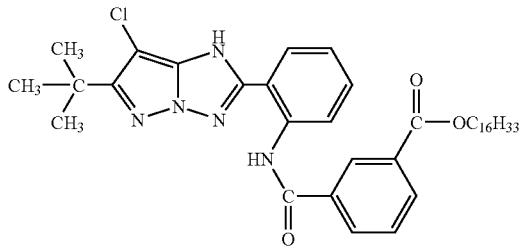

-continued
M-6-2
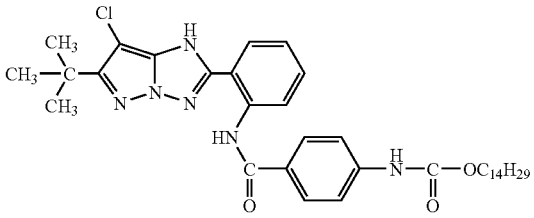
M-6-3
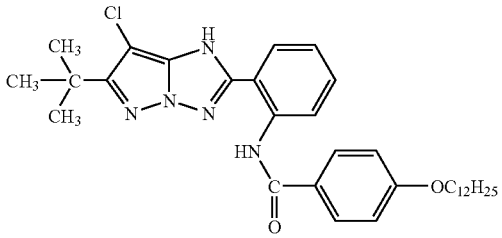
M-6-4
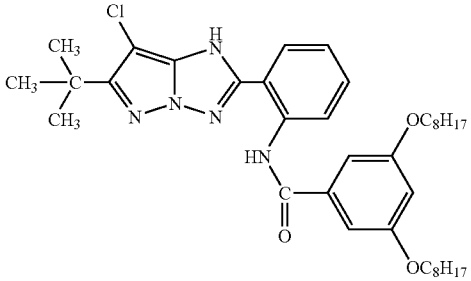
M-6-5
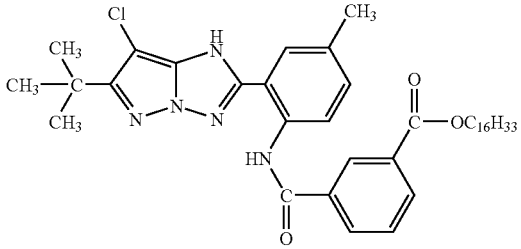
M-6-6
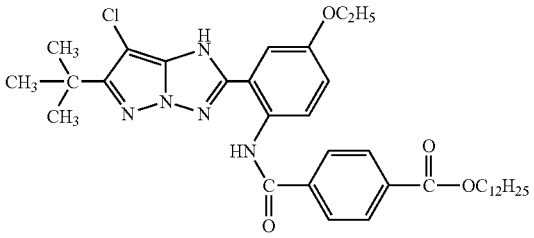
M-6-7
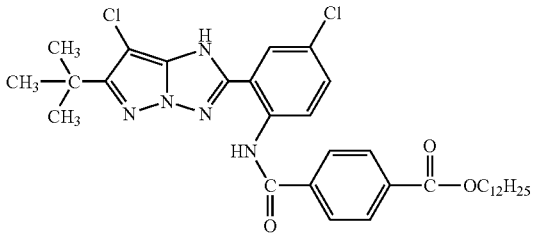
M-6-8
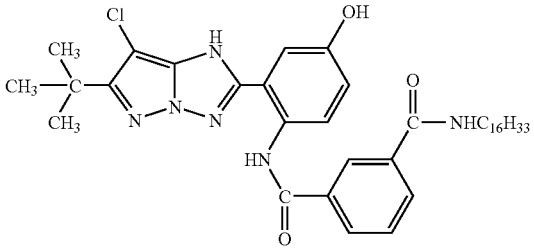
M-6-9
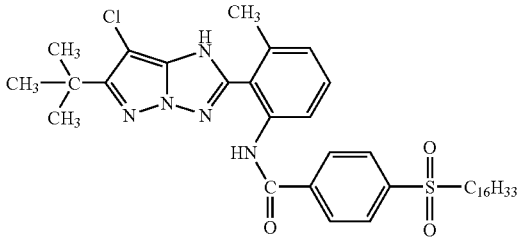
M-6-10
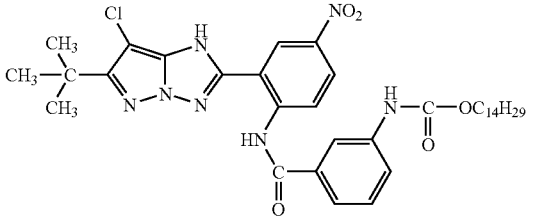
M-7-1
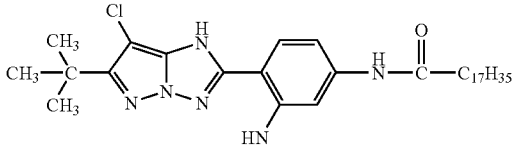
M-7-2
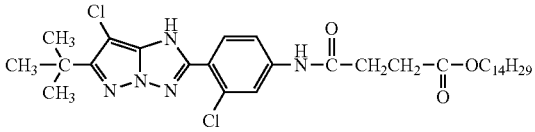
M-7-3
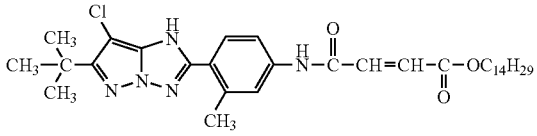

-continued
M-7-4
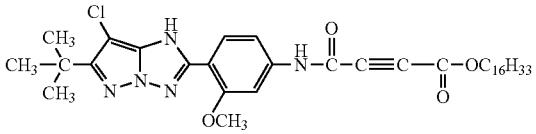
M-7-5
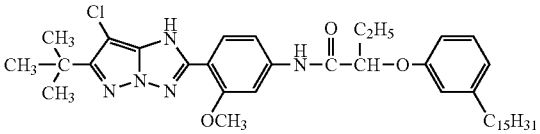
M-7-6
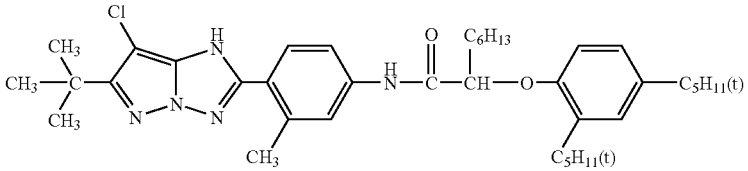
M-7-7
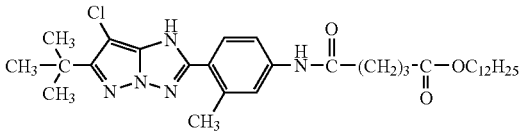
M-7-8
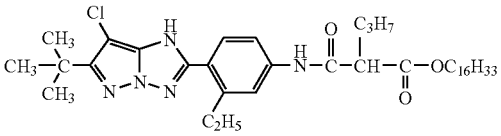
M-7-9
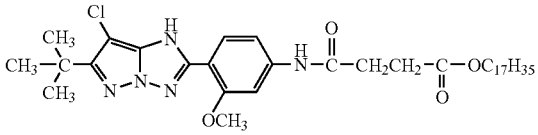
M-7-10
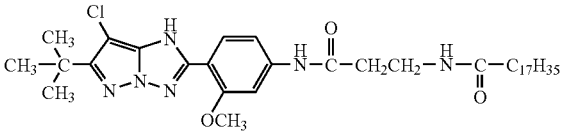
M-7-11
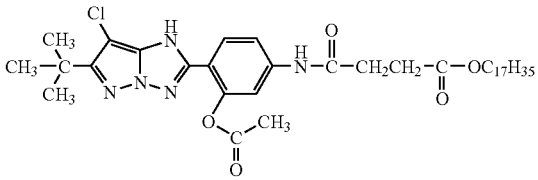
M-7-12
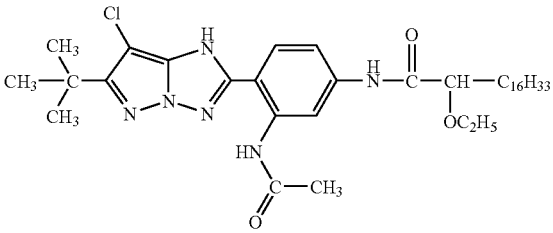
M-7-13
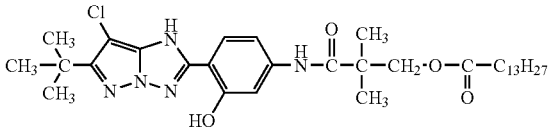
M-7-14
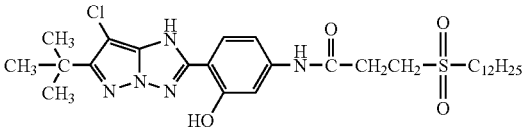
M-7-15
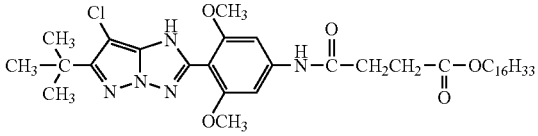
M-7-16
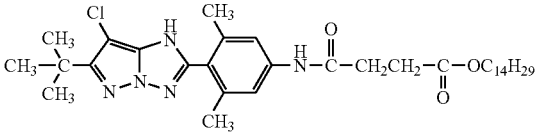
M-7-17
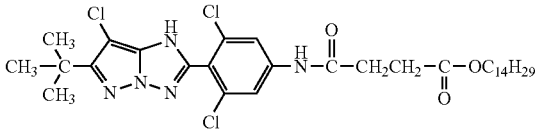
M-7-18
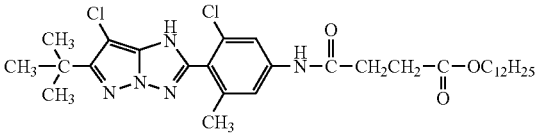

-continued
M-7-19
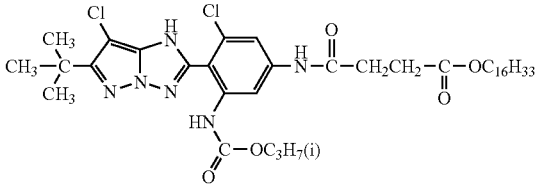
M-7-20
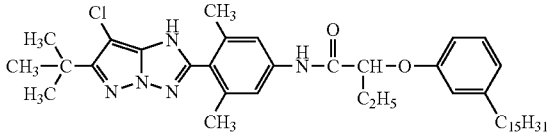
M-7-21
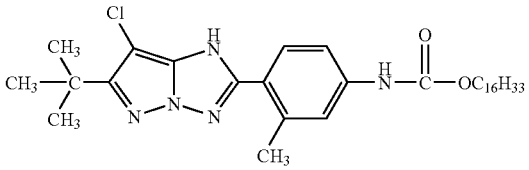
M-7-22
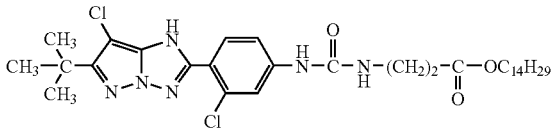
M-7-23
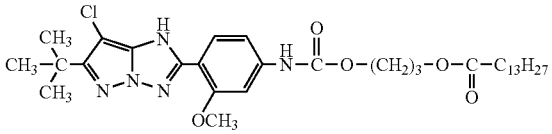
M-7-24
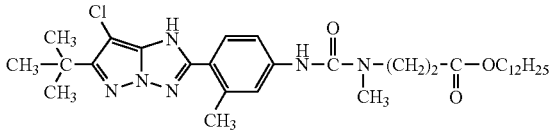
M-7-25
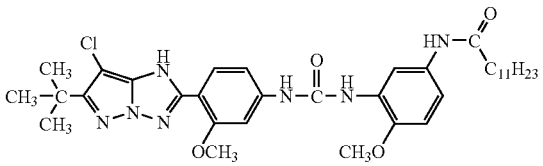
M-7-26
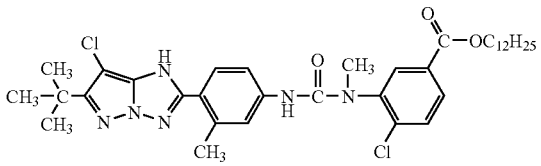
M-7-27
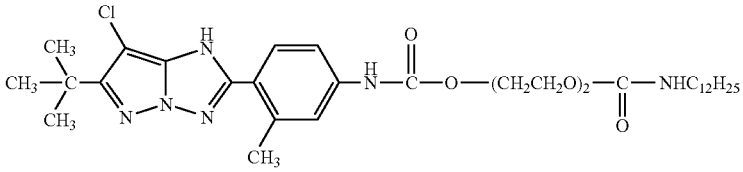
M-7-28
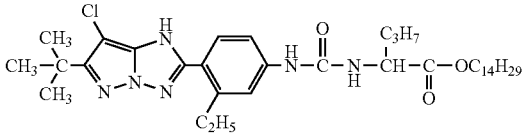
M-7-29
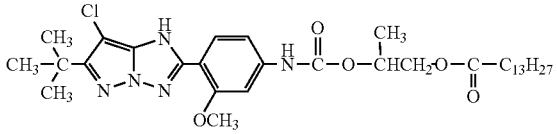
M-7-30
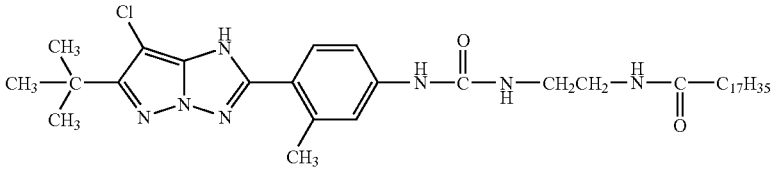
M-7-31
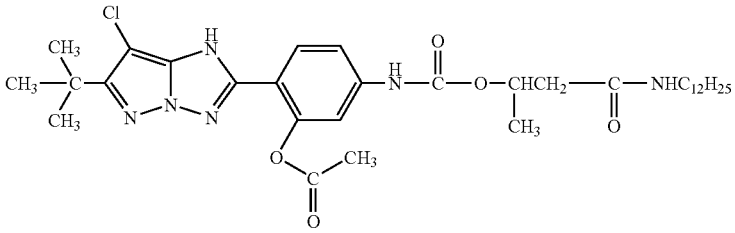

-continued
M-7-32
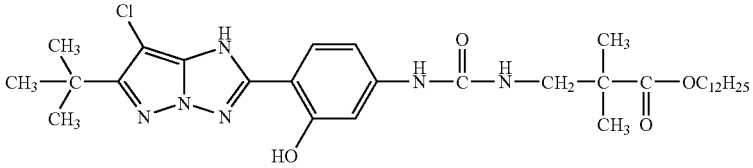
M-7-33
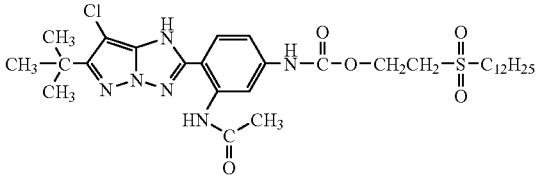
M-7-34
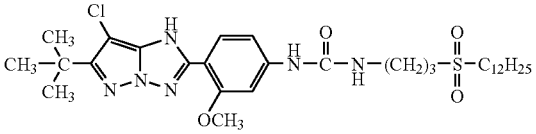
M-7-35
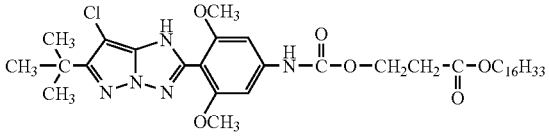
M-7-36
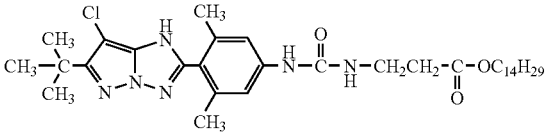
M-7-37
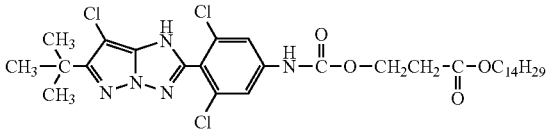
M-7-38
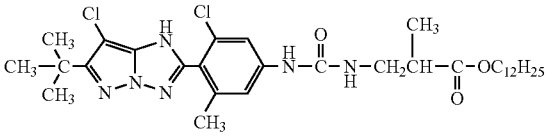
M-7-39
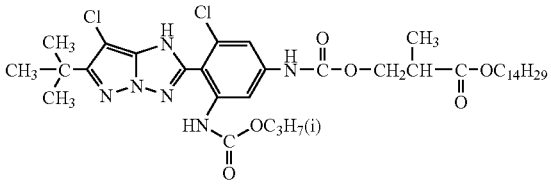
M-7-40
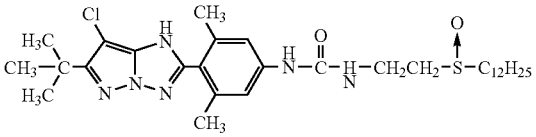
M-8-1
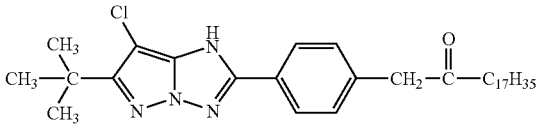
M-8-2
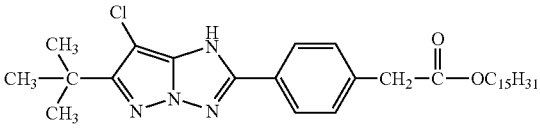
M-8-3
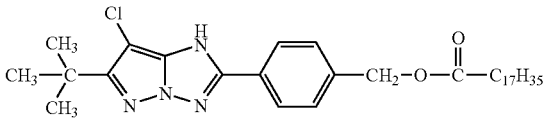
M-8-4
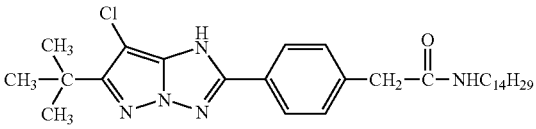
M-8-5
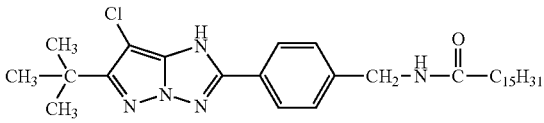
M-8-6
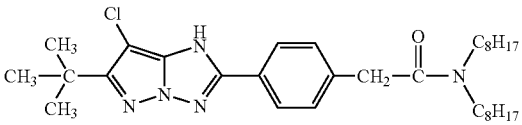
M-8-7
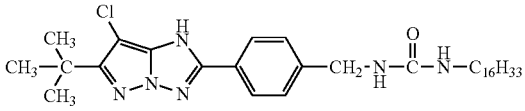
M-8-8
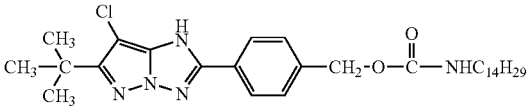

-continued
M-8-9
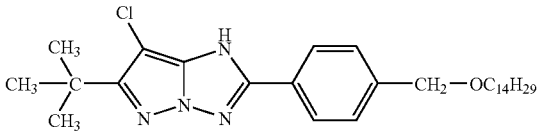
M-8-10
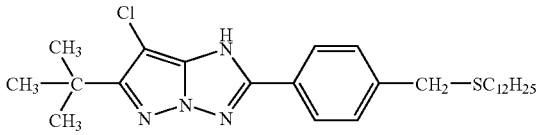
M-8-11
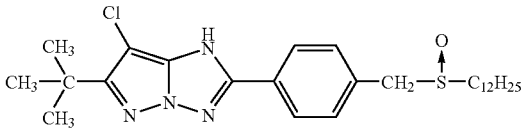
M-8-12
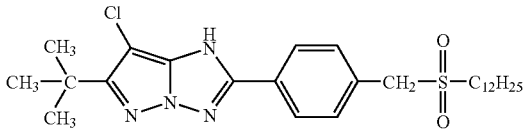
M-8-13
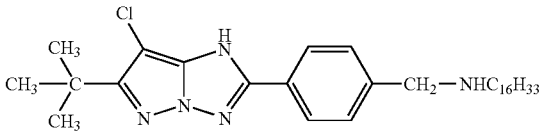
M-8-14
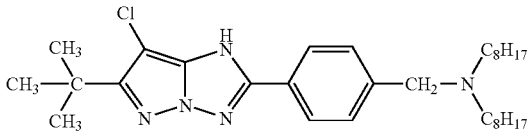
M-8-15
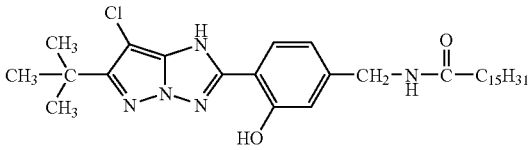
M-8-16
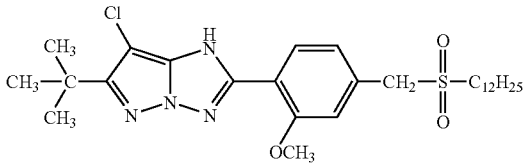
M-8-17
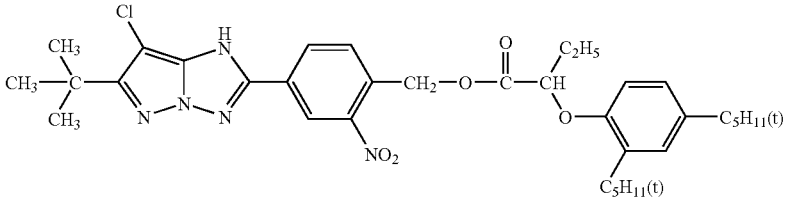
M-8-18
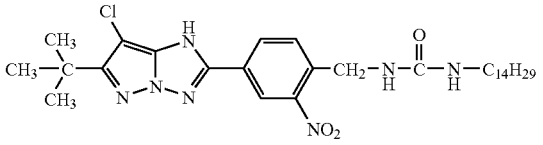
M-8-19
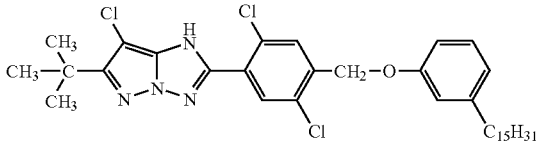
M-8-20
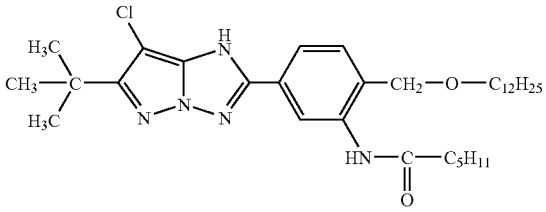
M-8-21
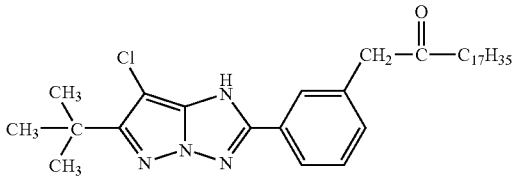
M-8-22
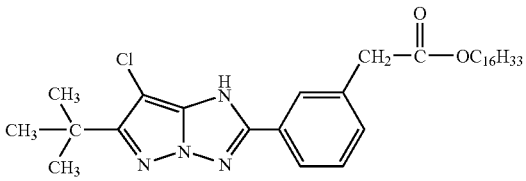

-continued
M-8-23
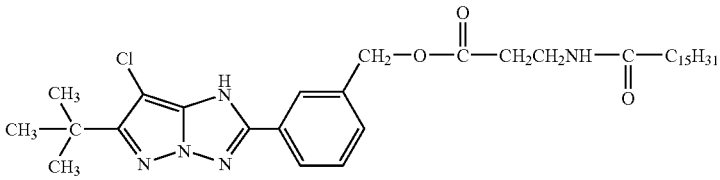
M-8-24
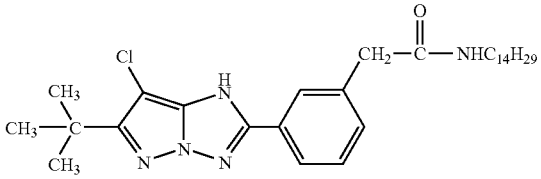
M-8-25
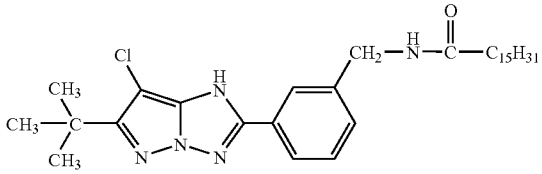
M-8-26
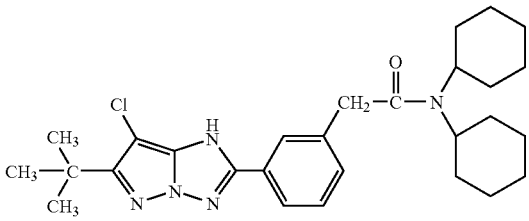
M-8-27
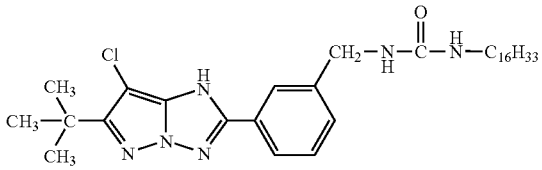
M-8-28
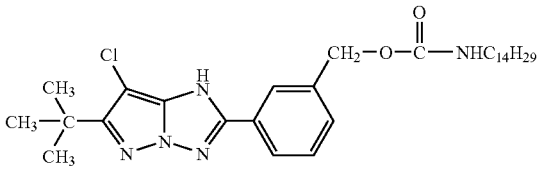
M-8-29
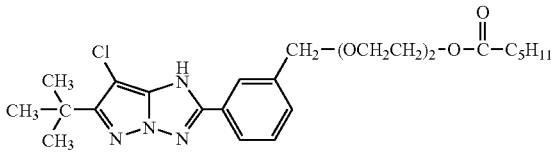
M-8-30
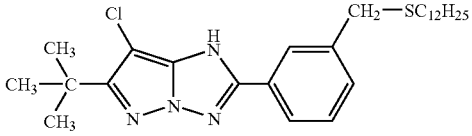
M-8-31
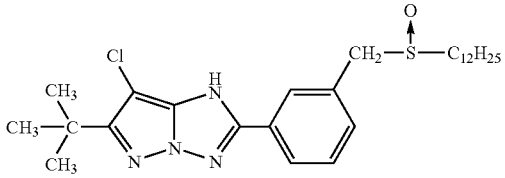
M-8-32
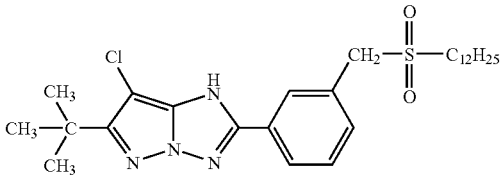
M-8-33
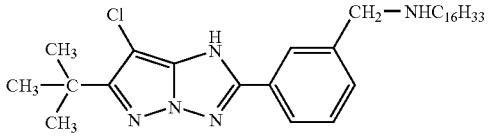
M-8-34
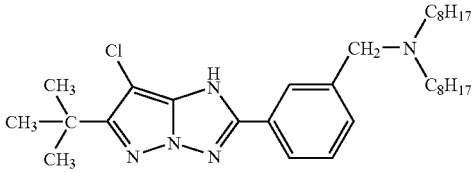
M-8-35
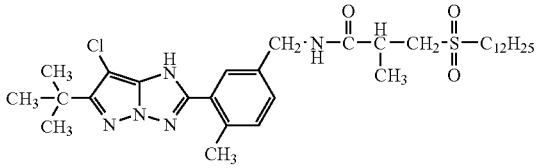

-continued
M-8-36
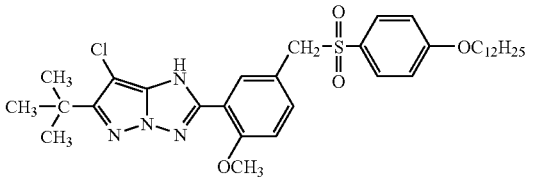
M-8-37
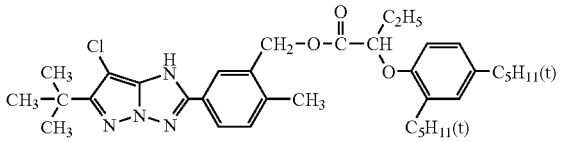
M-8-38
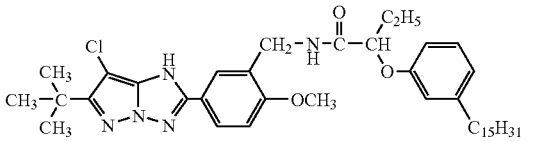
M-8-39
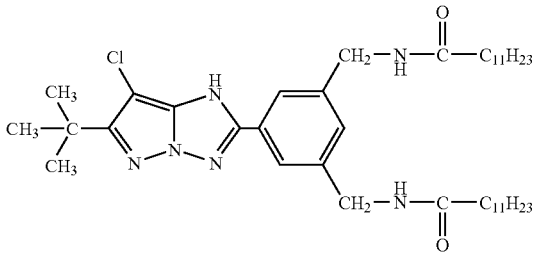
M-8-40
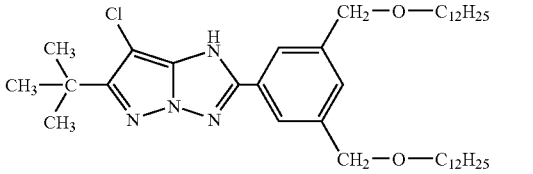
M-8-41
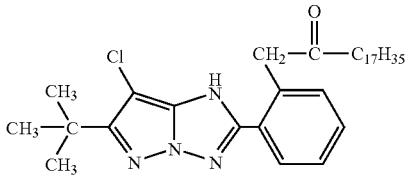
M-8-42
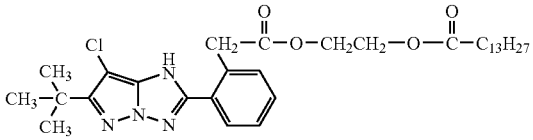
M-8-43
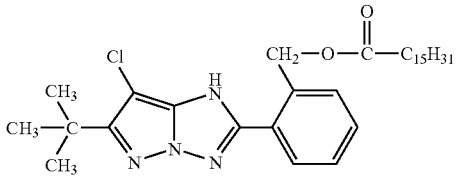
M-8-44
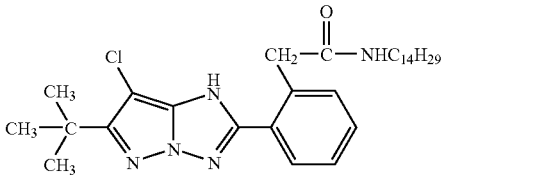
M-8-45
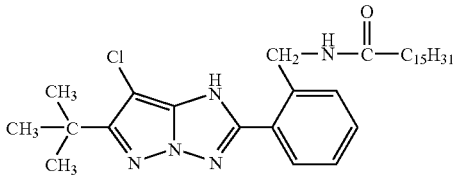
M-8-46
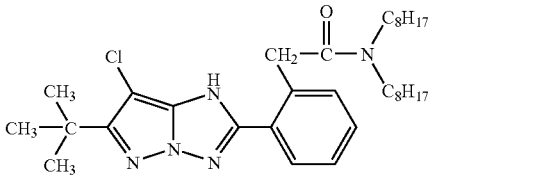
M-8-47
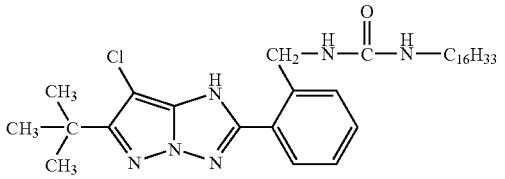
M-8-48
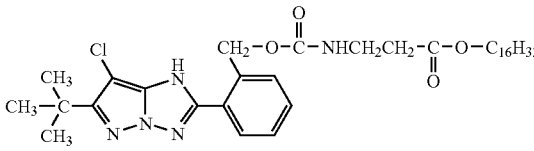
M-8-49
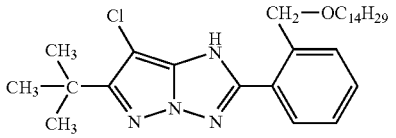

-continued
M-8-50
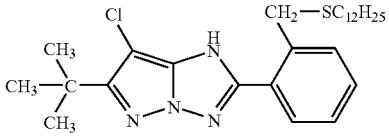
M-8-51
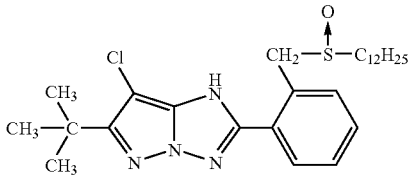
M-8-52
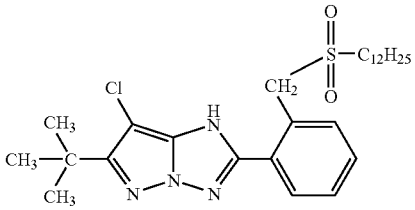
M-8-53
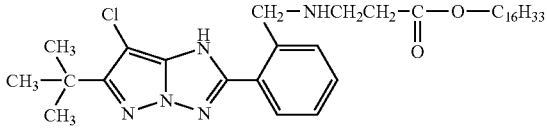
M-8-54
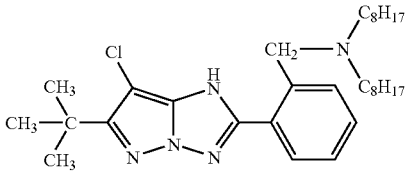
M-8-55
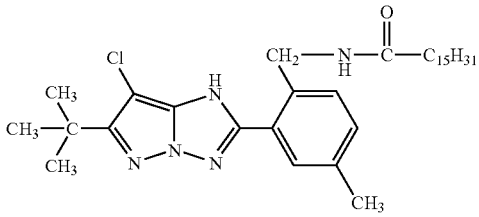
M-8-56
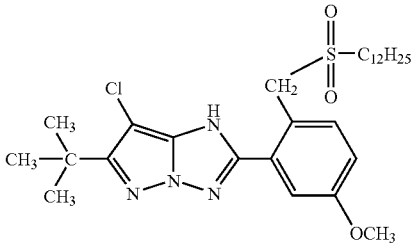
M-8-57
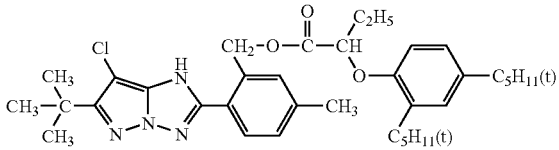
M-8-58
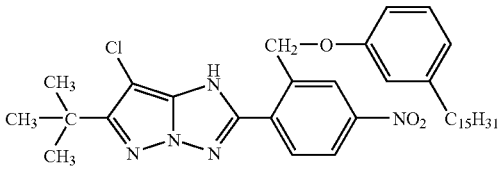
M-8-59
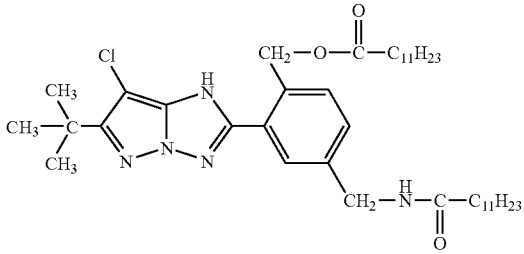
M-8-60
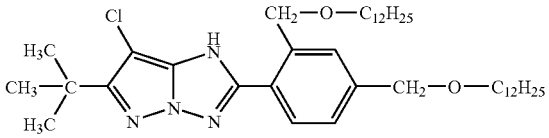
M-8-61
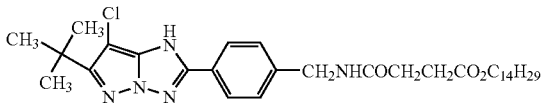
M-9-1
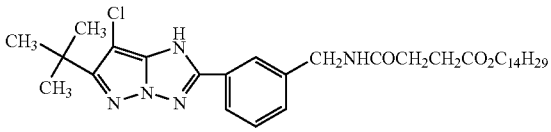
M-9-2
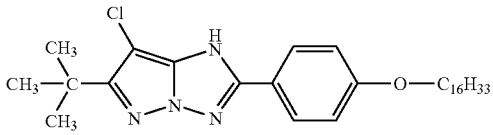

-continued
M-9-3
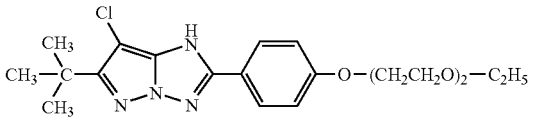
M-9-4
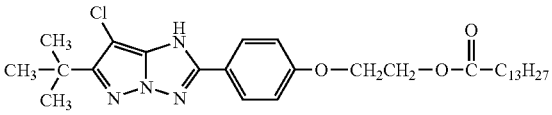
M-9-4
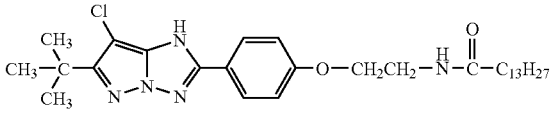
M-9-5
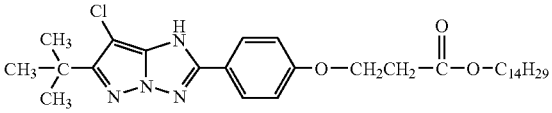
M-9-6
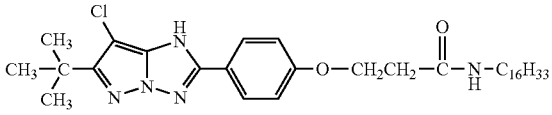
M-9-7
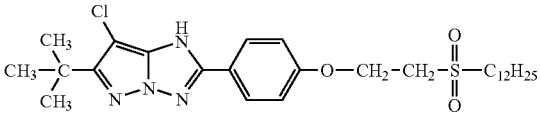
M-9-8
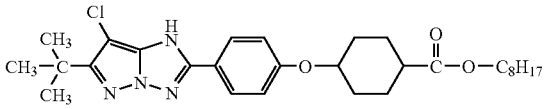
M-9-9
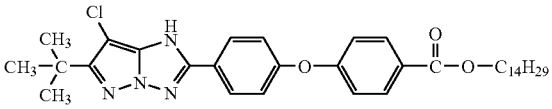
M-9-10
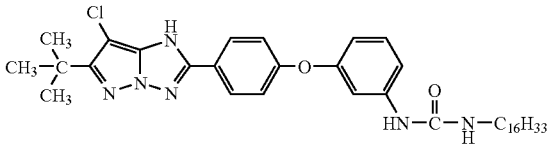
M-9-11
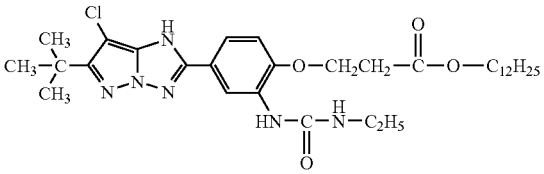
M-9-12
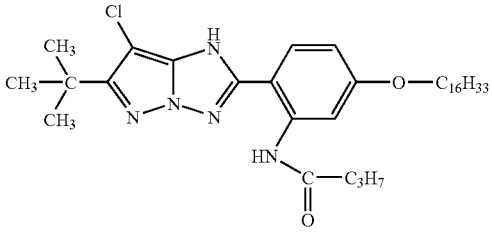
M-9-13
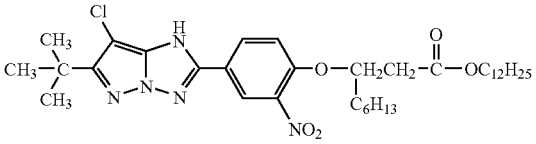
M-9-14
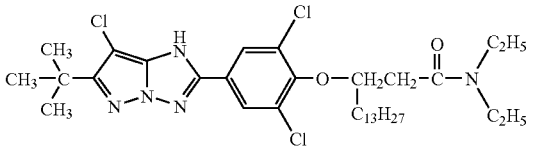
M-9-15
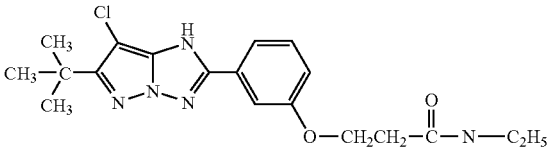
M-9-16
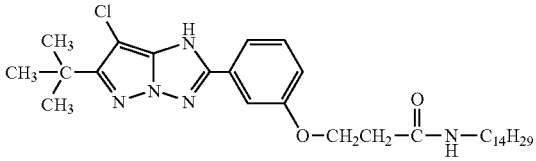
M-9-17
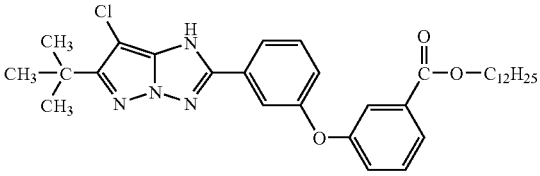

-continued
M-9-18
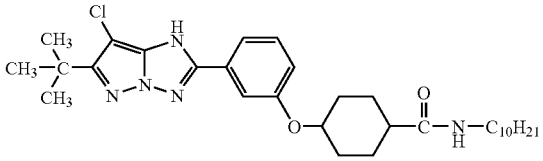
M-9-19
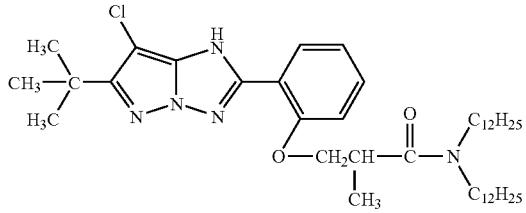
M-9-20
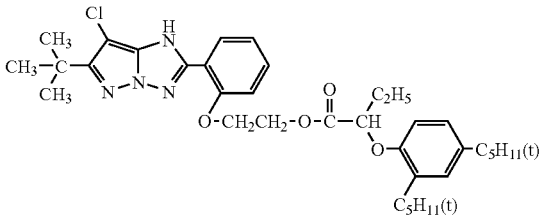
M-10-1
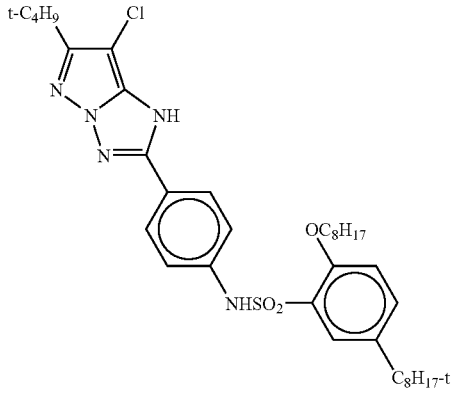
M-10-2
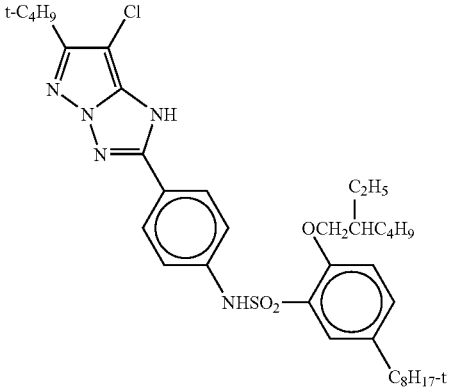
M-10-3
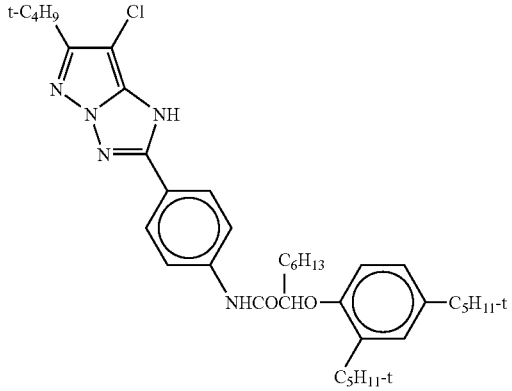
M-10-4
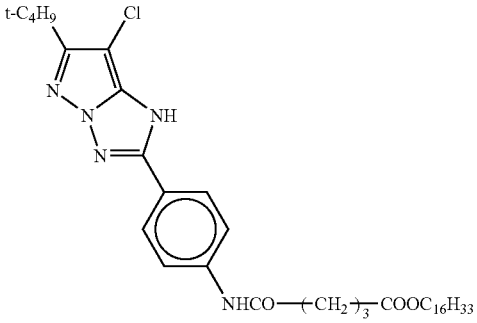
M-10-5
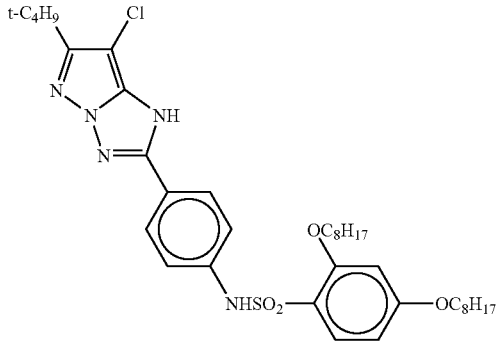

-continued
M-10-6
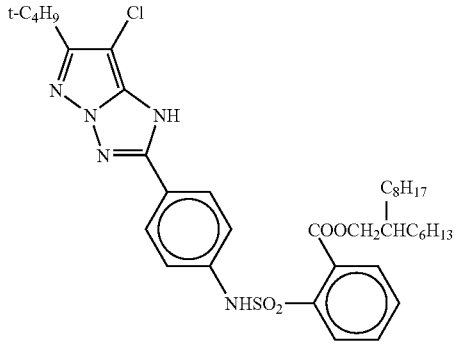
M-10-7
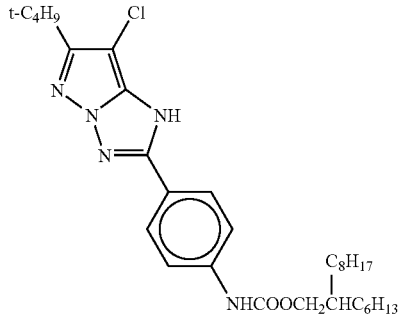
M-10-8
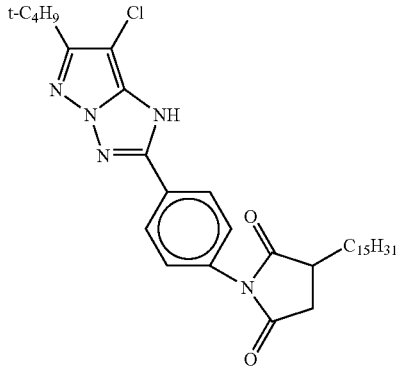
M-10-9
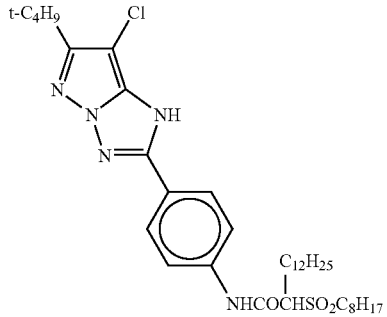
M-10-10
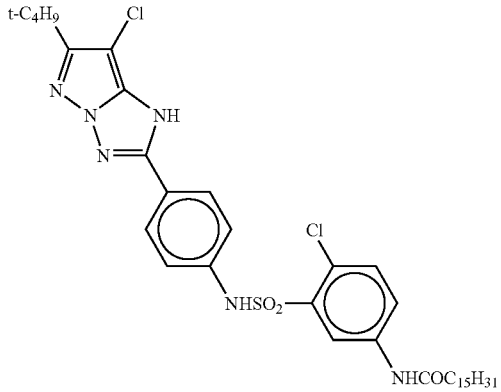
M-10-11
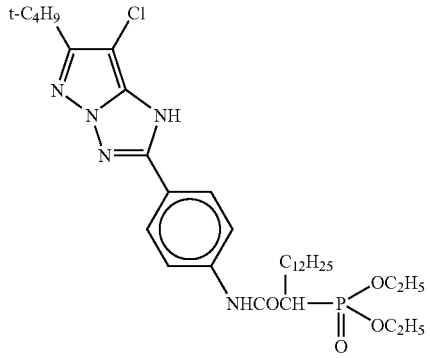
M-10-12
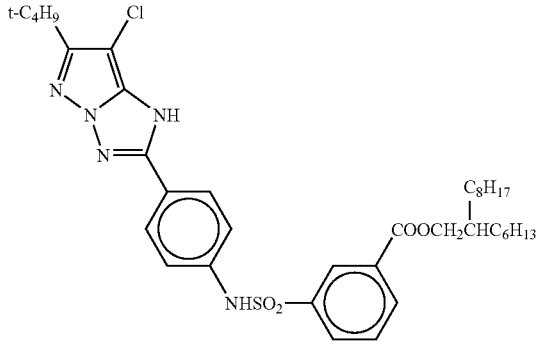
M-10-13
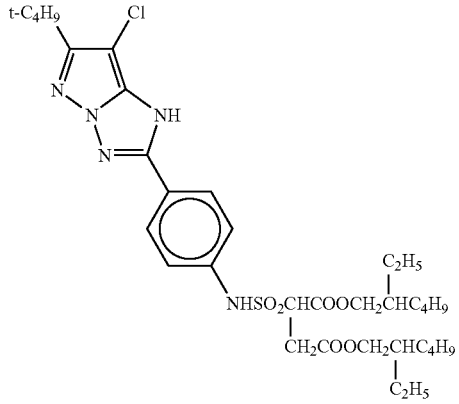

-continued
M-10-14
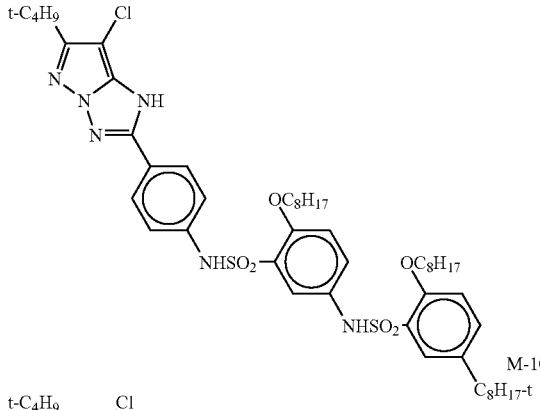
M-10-15
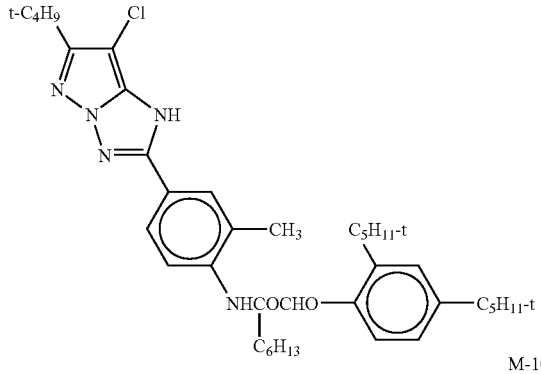
M-10-16
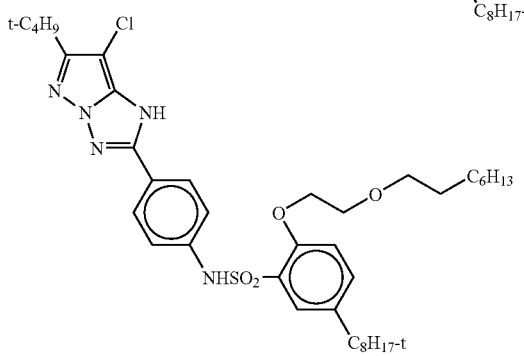
M-10-17
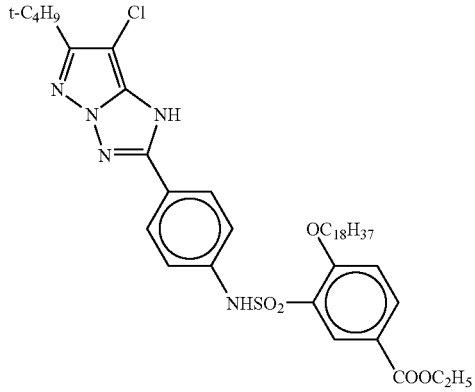
M-10-18
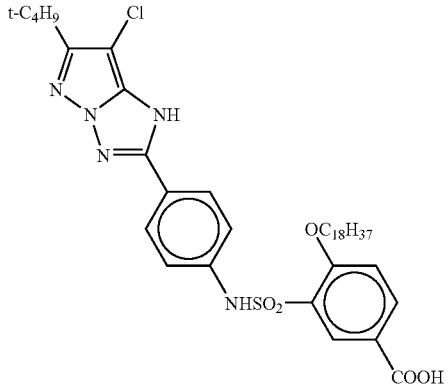
M-10-19
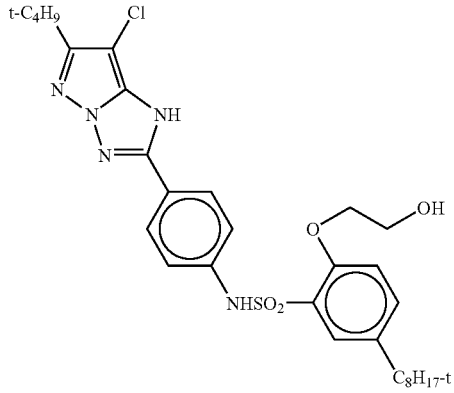
M-10-20
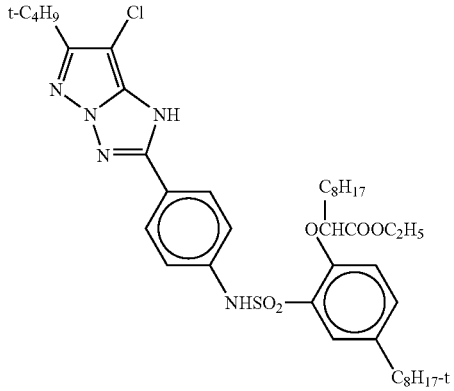
M-10-21
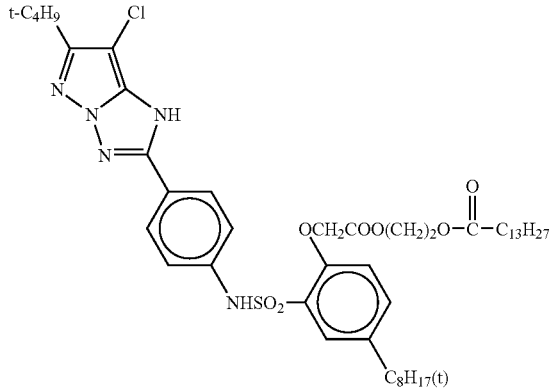

-continued
M-10-22
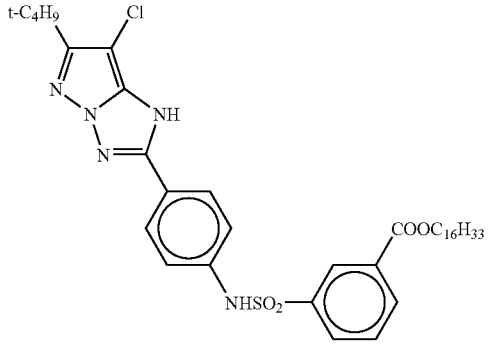
M-10-23
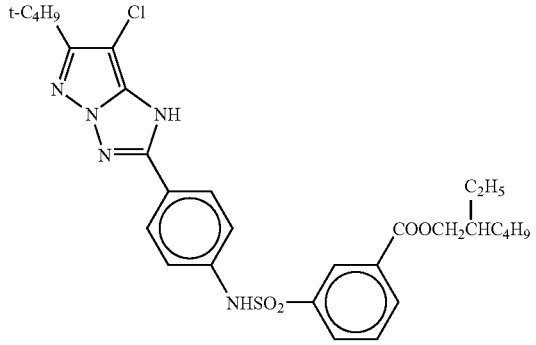
M-10-24
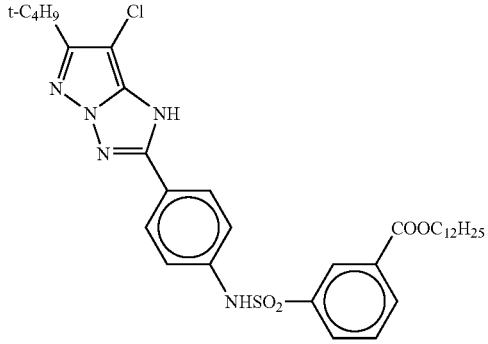
M-10-25
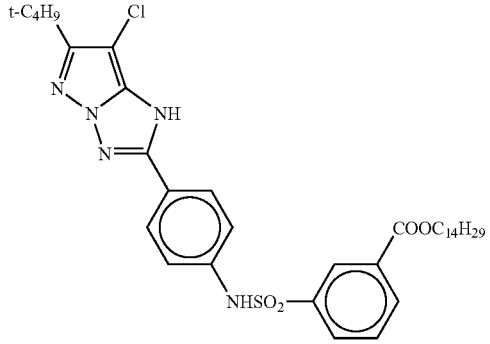
M-10-26
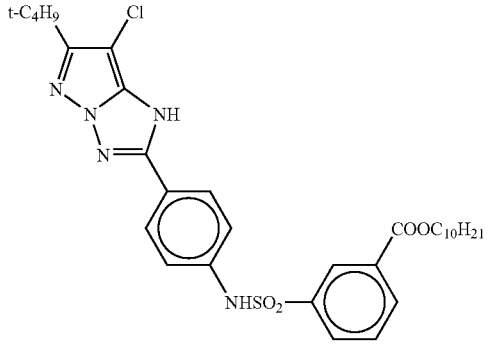
M-10-27
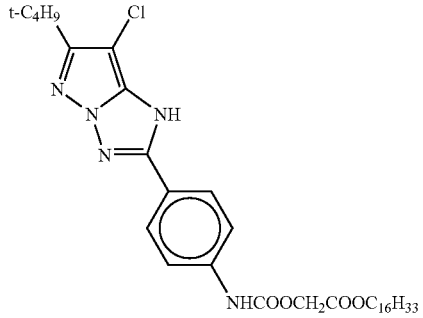
M-10-28
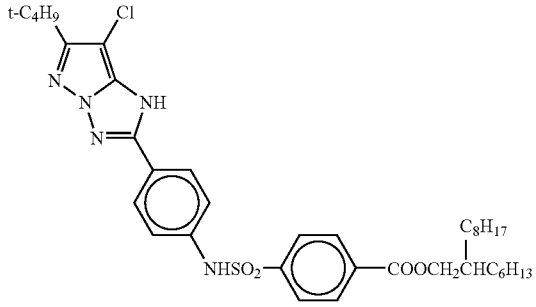
M-10-29
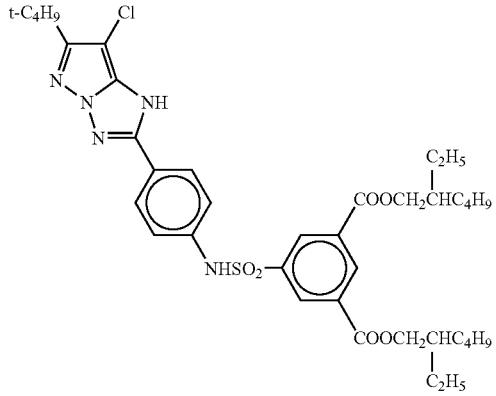

-continued
M-10-30
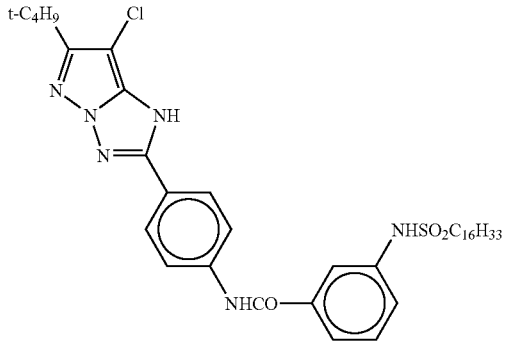
M-10-31
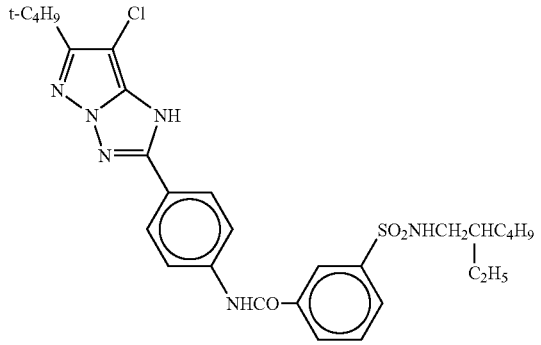
M-10-32
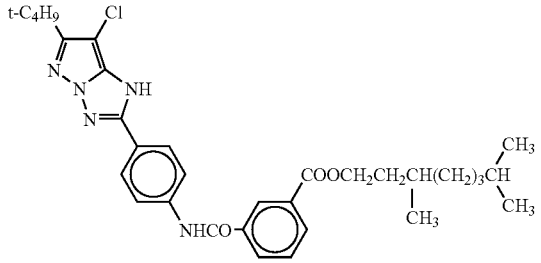
M-10-33
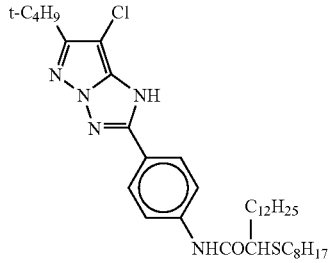
M-10-34
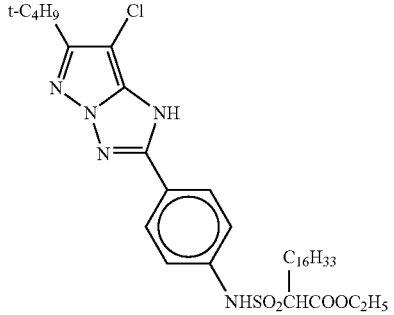
M-10-35
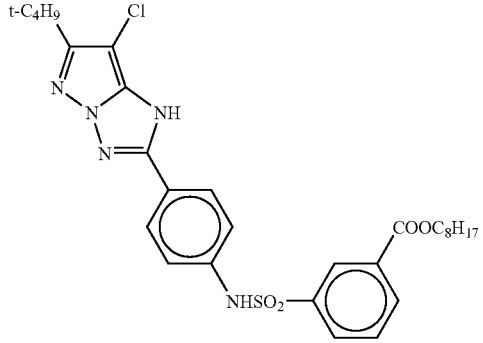
M-10-36
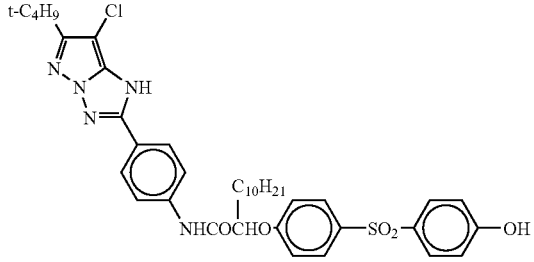
M-10-37
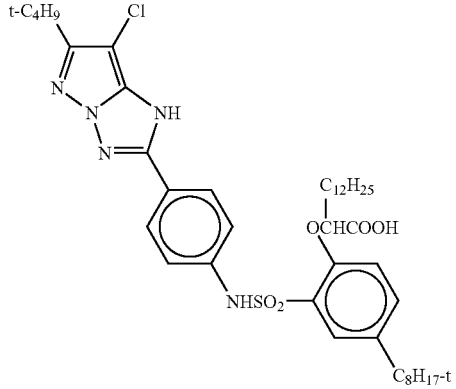

-continued
M-10-38
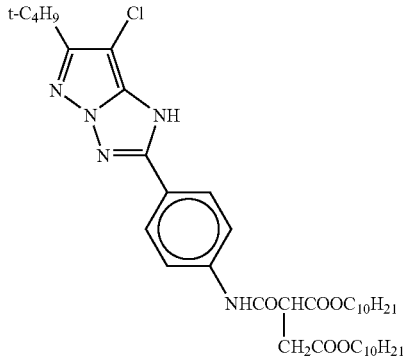
M-10-39
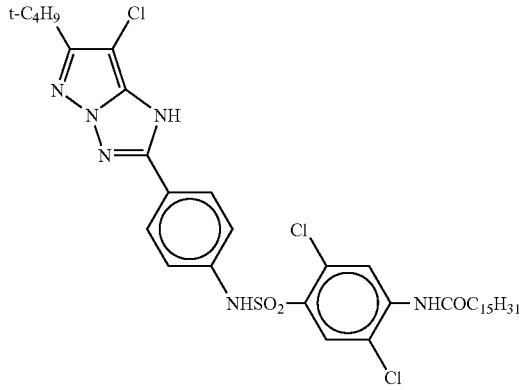
M-10-40
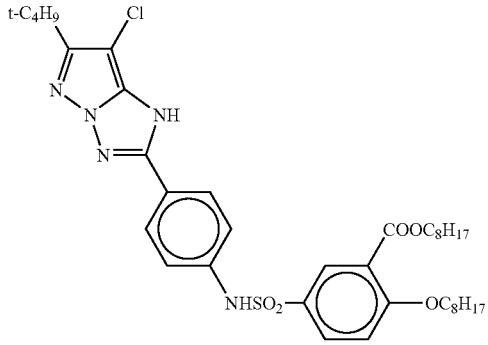
M-10-41
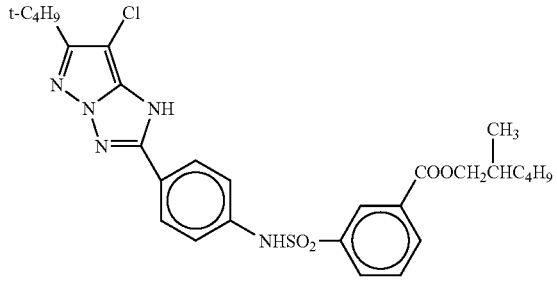
M-10-42
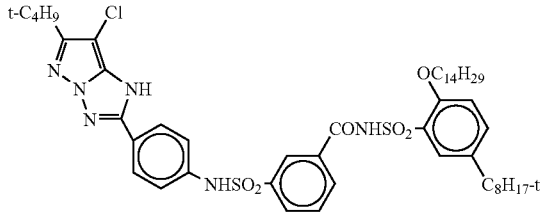
M-10-43
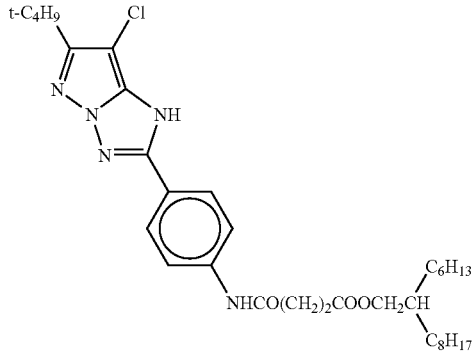
M-10-44
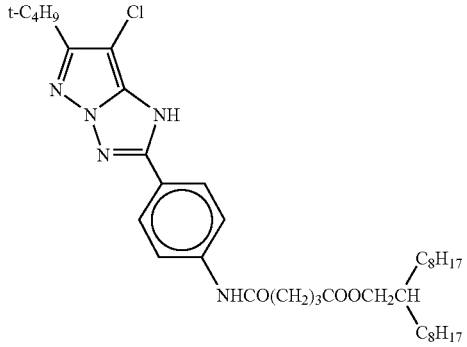
M-10-45
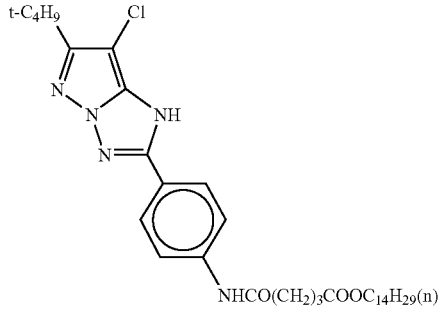

-continued
M-10-46
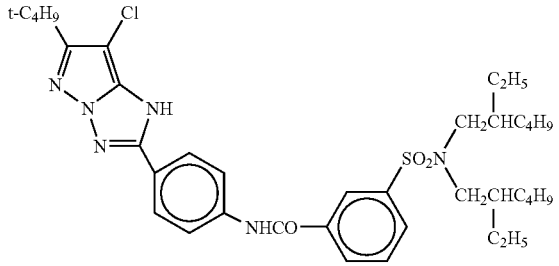
M-10-47
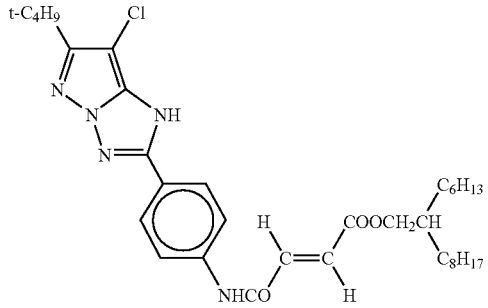
M-10-48
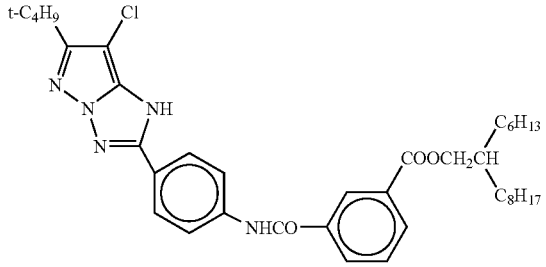
M-10-49
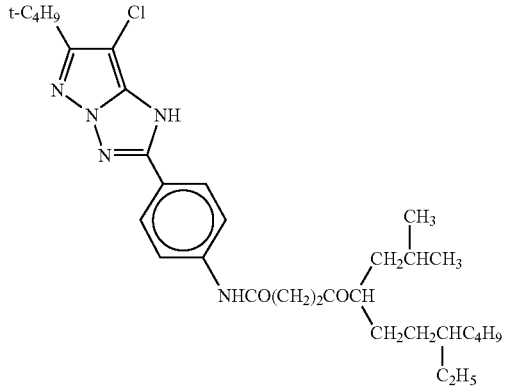
M-10-50
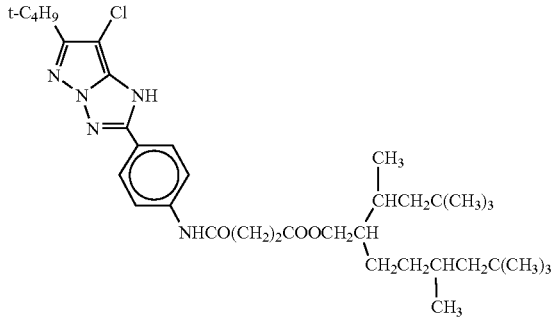
M-10-51
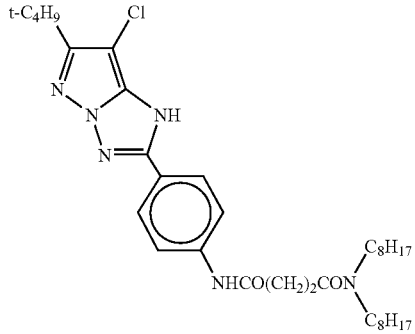
M-10-52
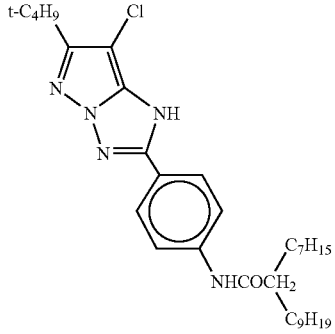
M-10-53
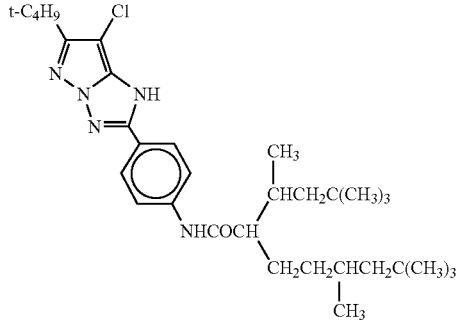

-continued
M-10-54
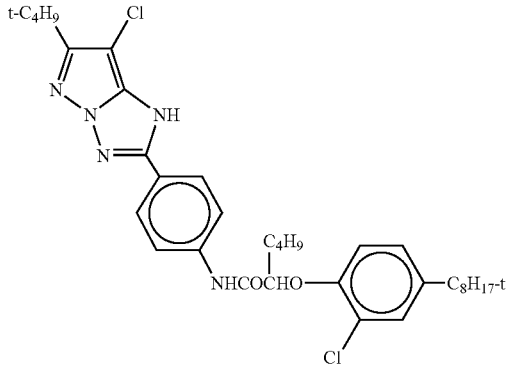
M-10-55
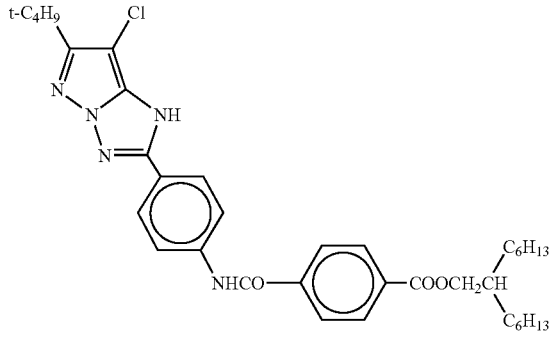
M-10-56
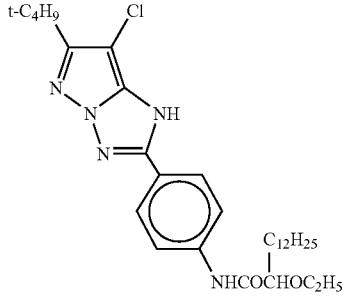
M-10-57
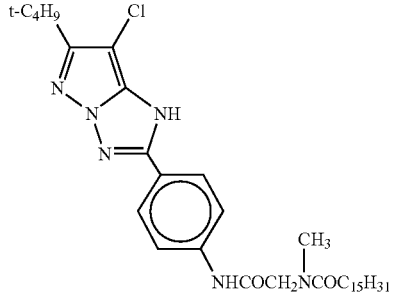
M-10-58
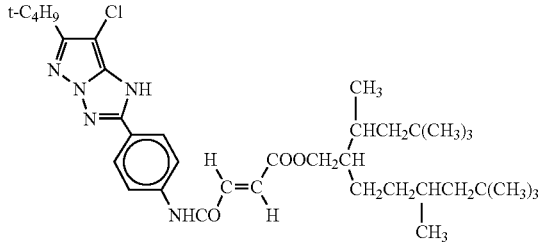
M-10-59
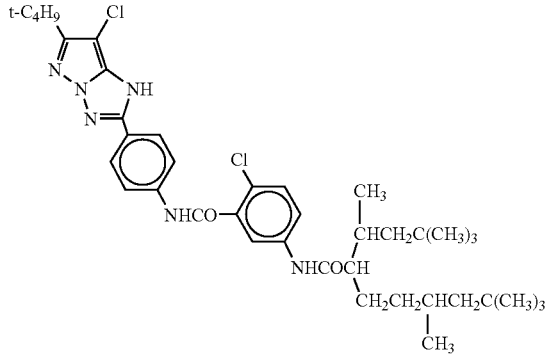
M-10-60
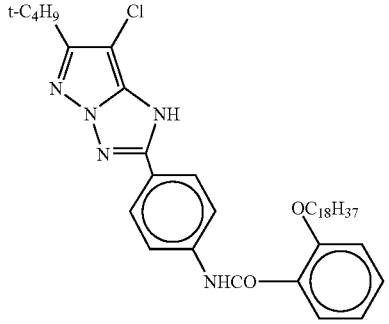
M-10-61
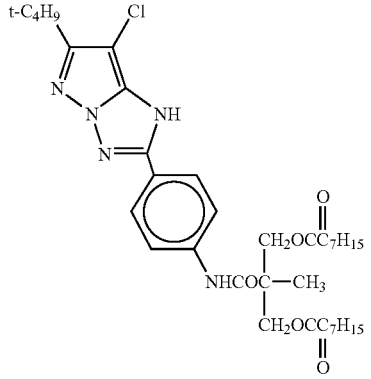

-continued
M-10-62
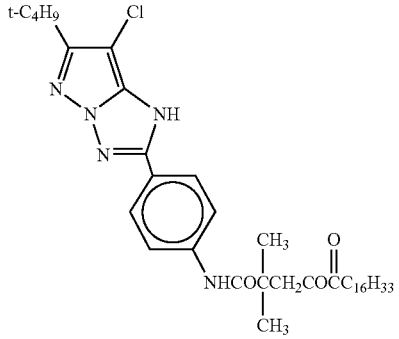
M-10-63
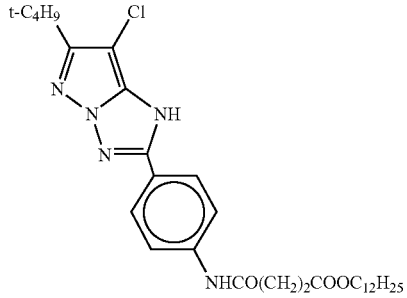
M-10-64
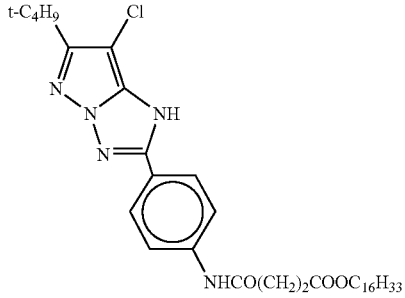
M-10-65
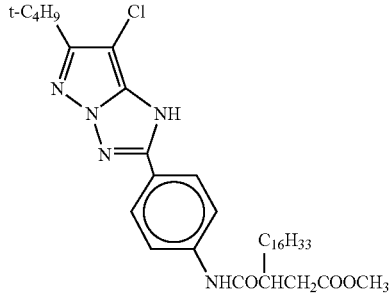
M-10-66
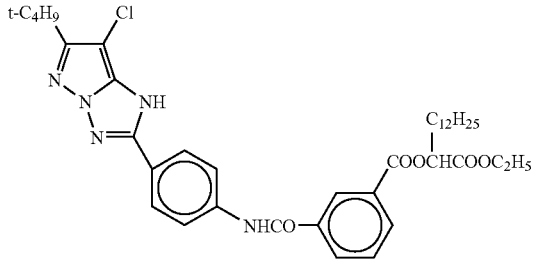
M-10-67
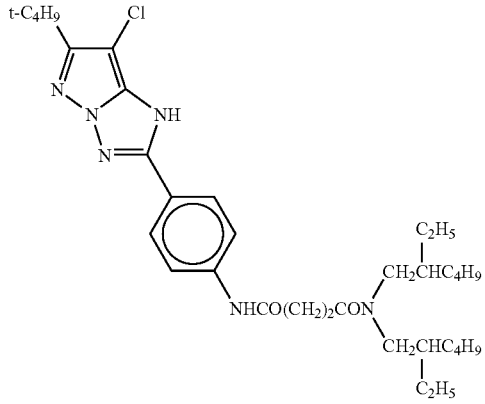
M-10-68
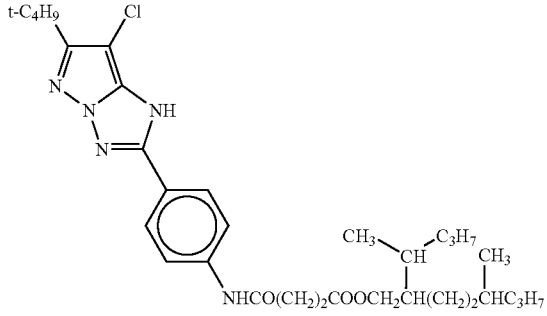
M-10-69
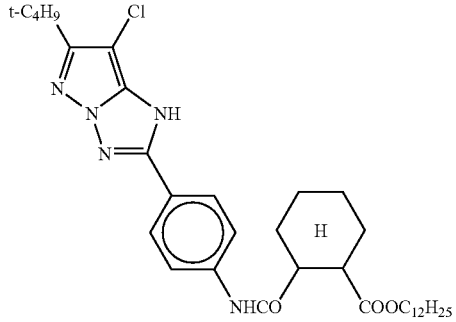

-continued
M-10-70
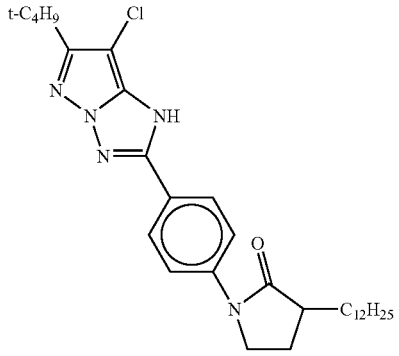
M-10-71
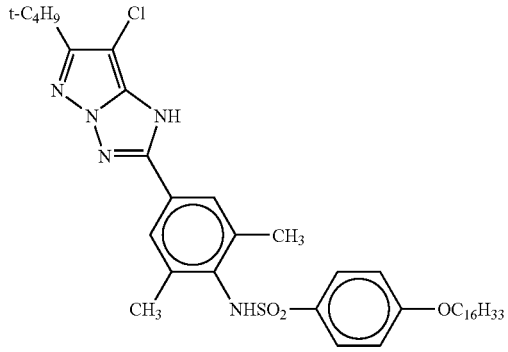
M-10-71
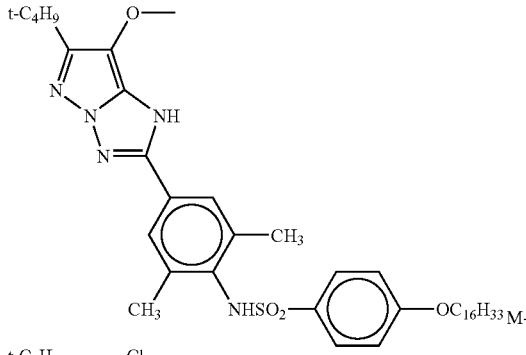
M-10-73
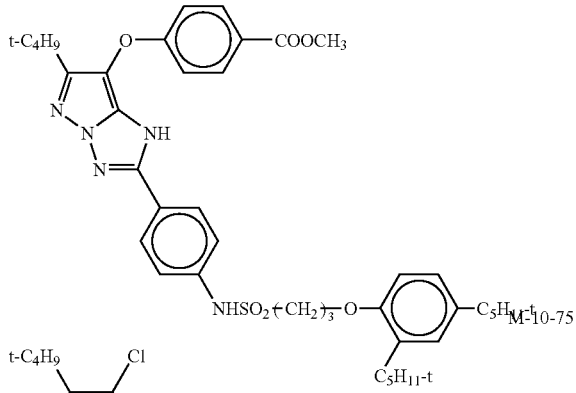
M-10-74
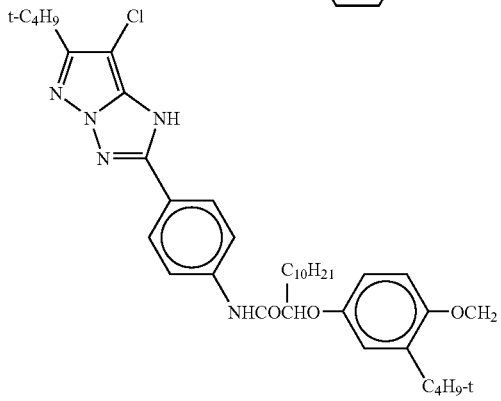
M-10-75
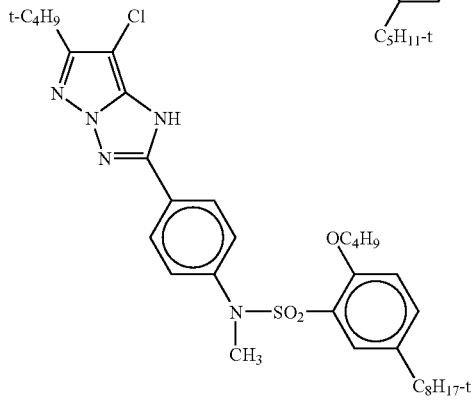
M-10-76
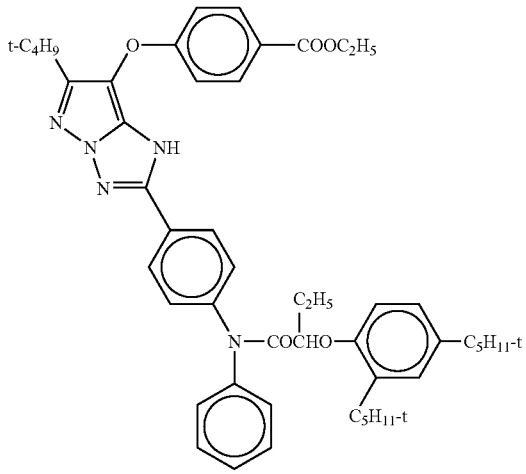
M-10-77
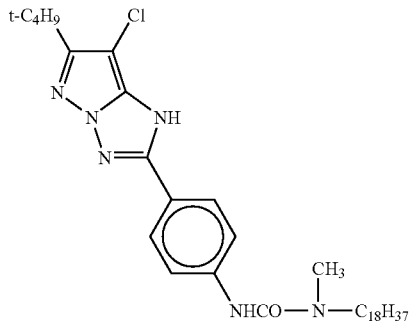

-continued
M-10-78
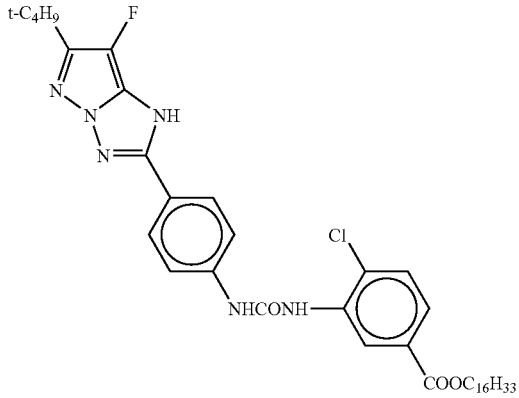
M-10-79
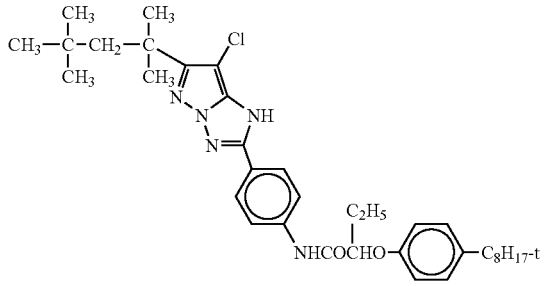
M-10-80
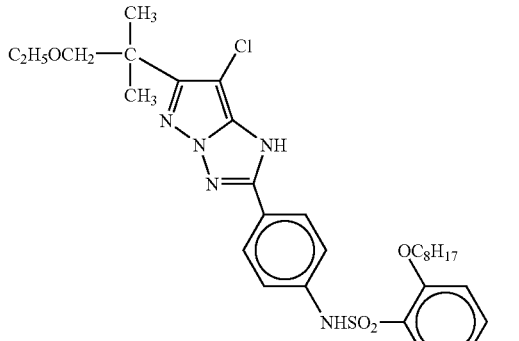
M-10-81
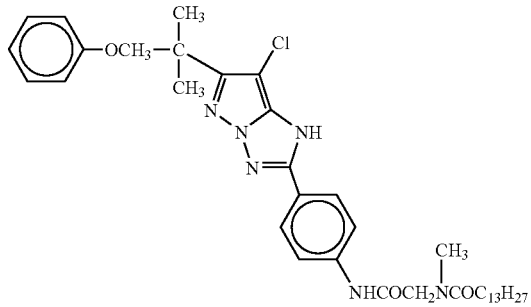
M-10-82
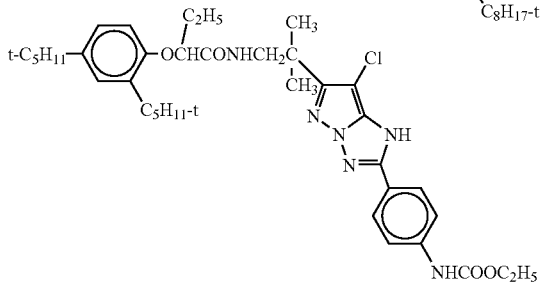
M-10-83
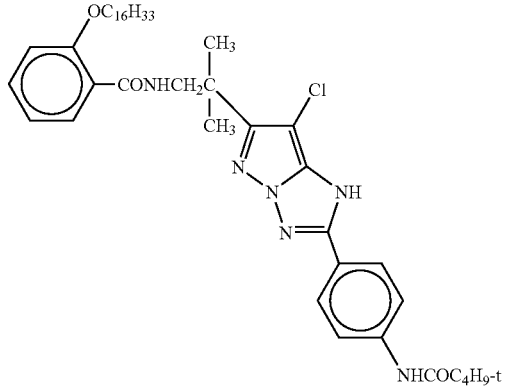
M-10-84
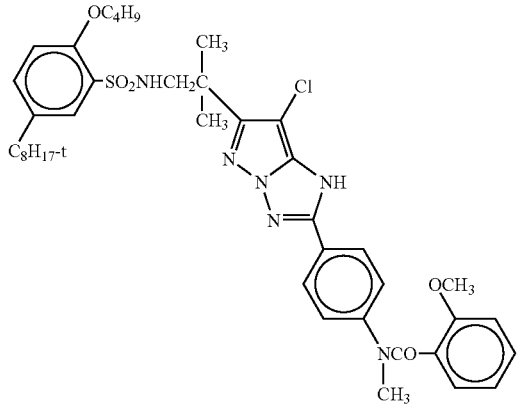
M-10-85
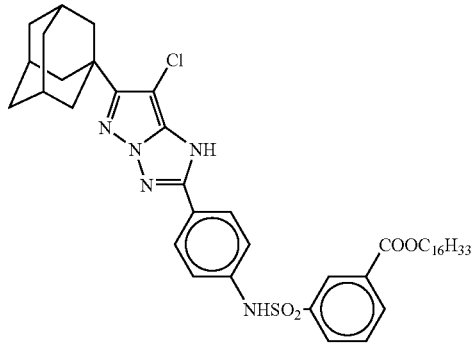

-continued
M-10-86
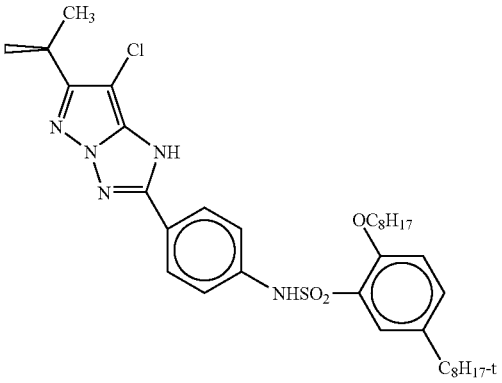
M-10-87
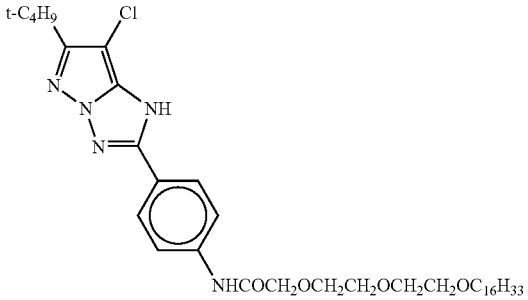
M-10-88
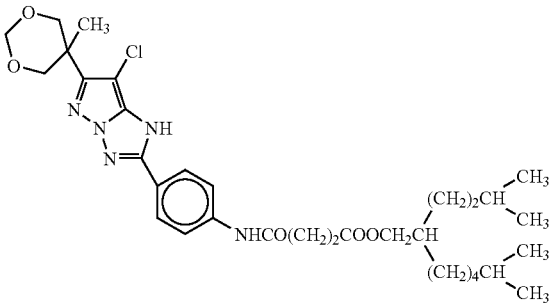
M-10-89
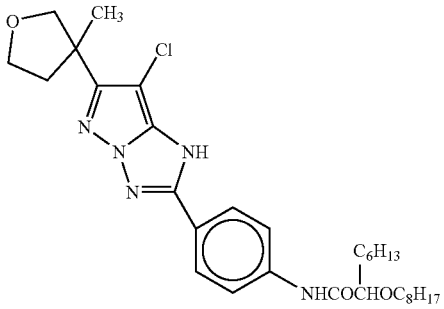
M-10-90
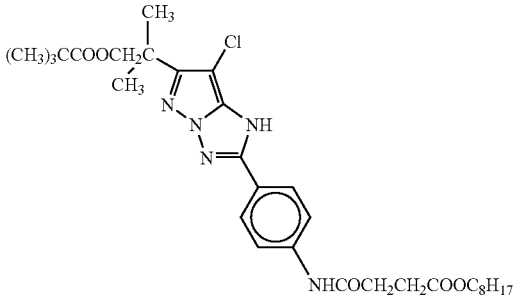
M-10-91
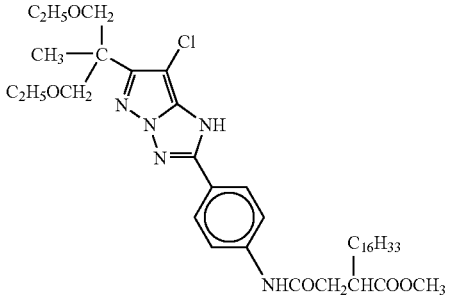
M-10-92
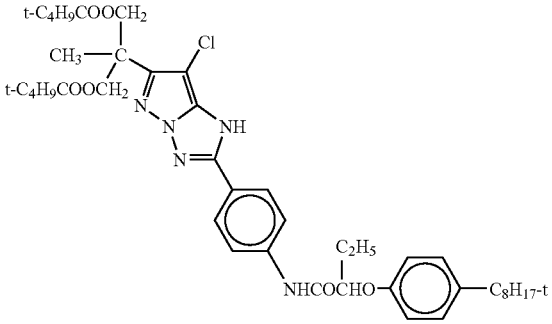
M-10-93
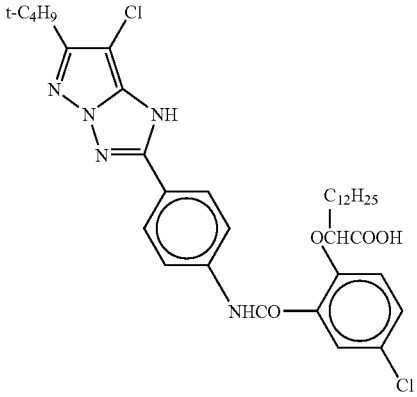

-continued
M-10-94
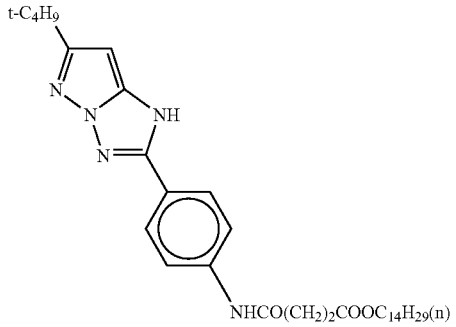
M-10-95
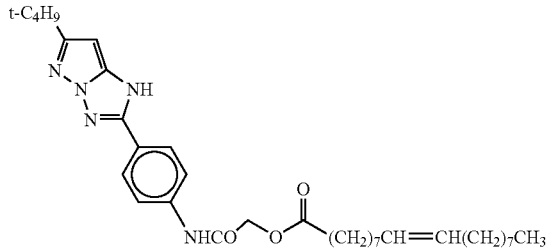
M-10-96
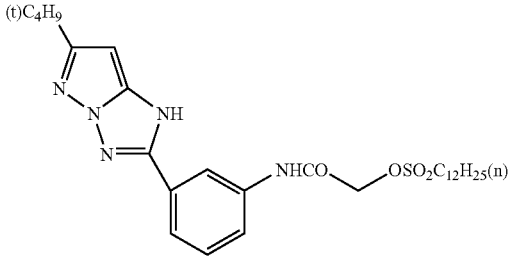
M-10-97
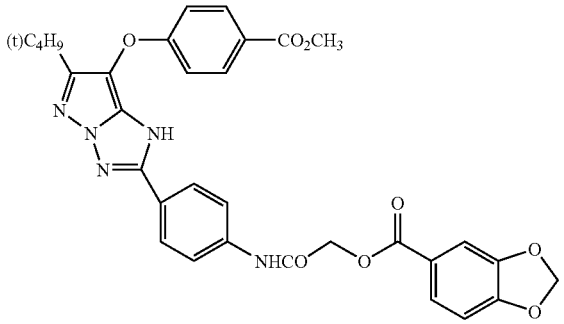
M-10-98
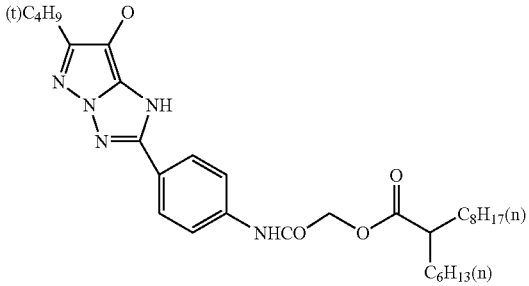
M-10-99
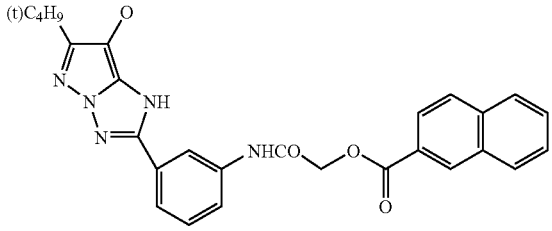
M-10-100
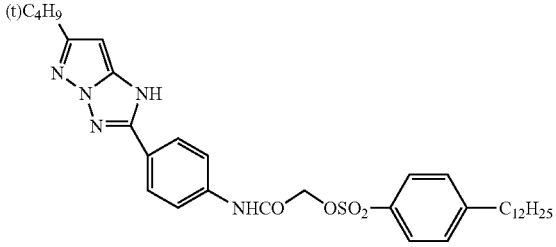
M-10-101
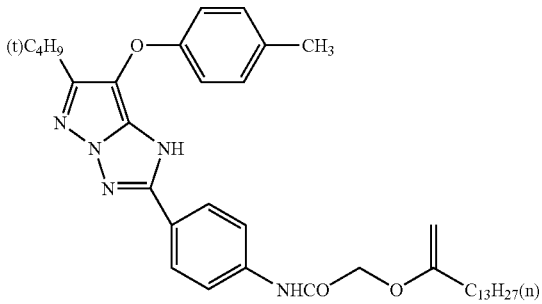

-continued
M-10-102
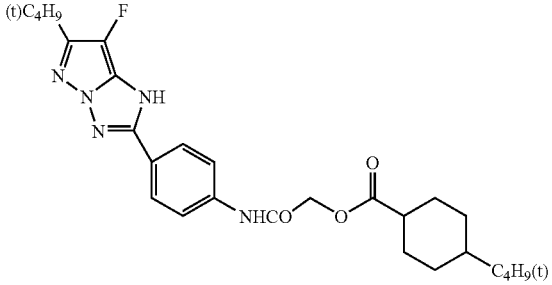
M-10-103
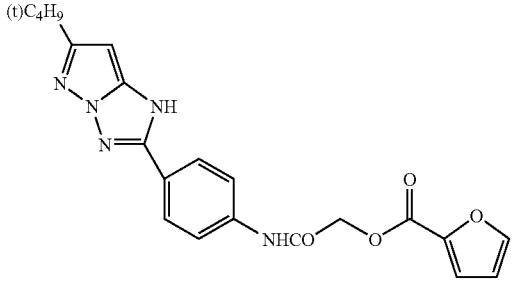
M-10-104
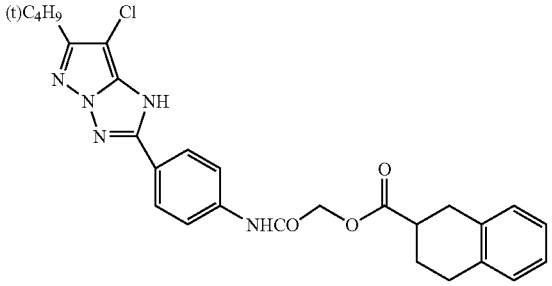
M-10-105
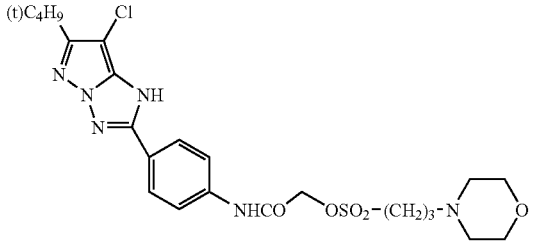
M-10-106
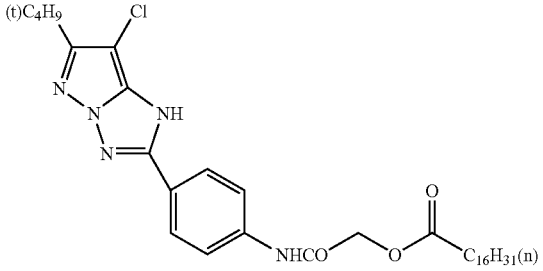
M-10-107
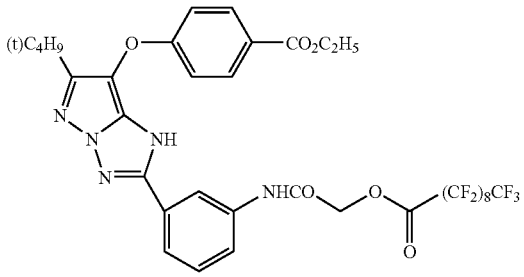
M-10-108
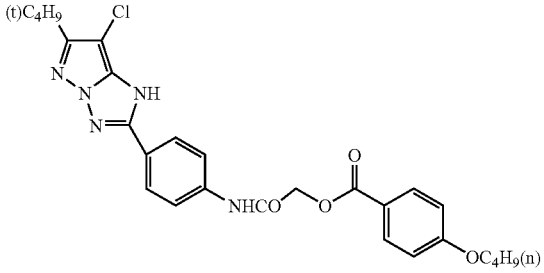
M-10-109
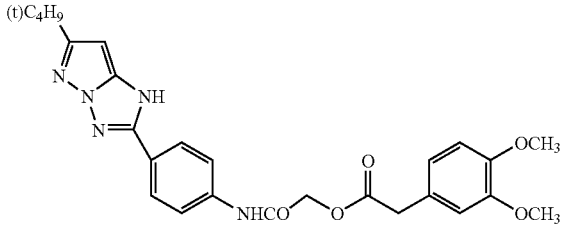
M-10-110
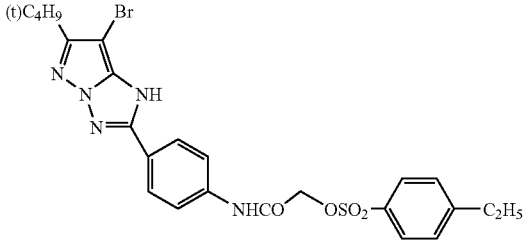
M-10-111
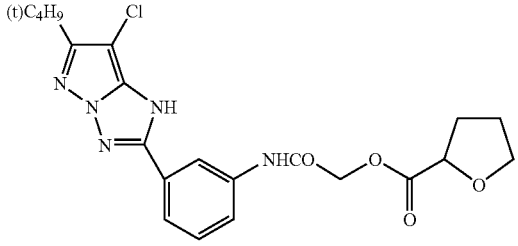

-continued
M-10-112
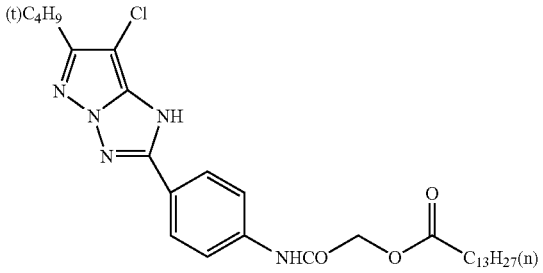
M-10-113
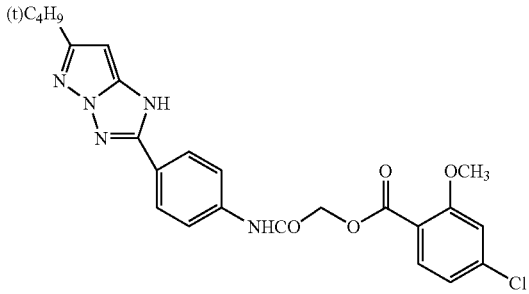
M-10-114
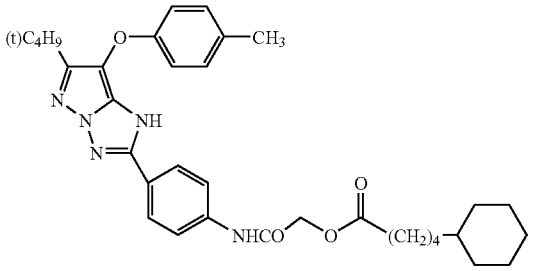
M-10-115
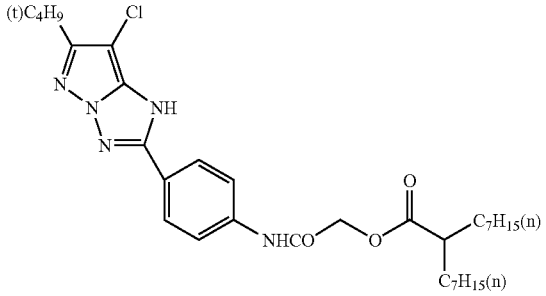
M-10-116
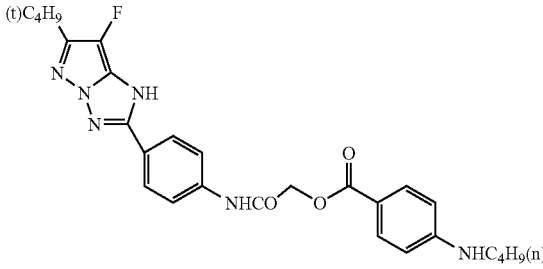
M-10-117
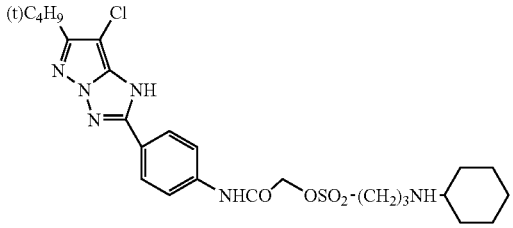
M-10-118
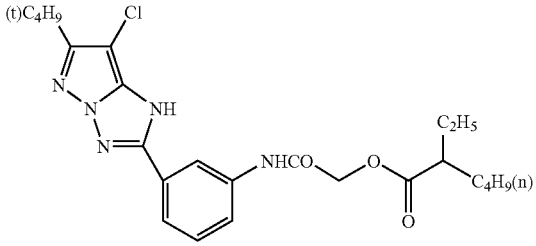
M-10-119
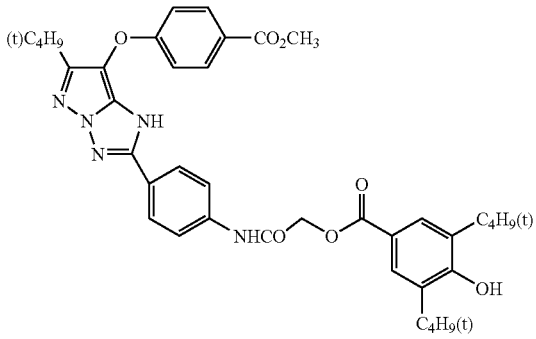
M-10-120
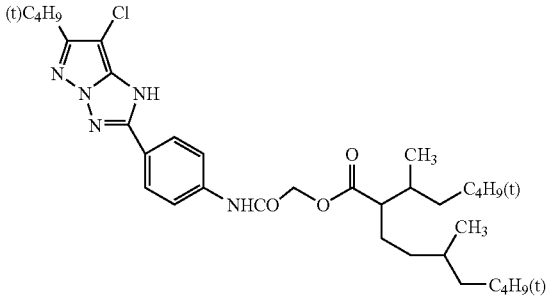
M-10-121
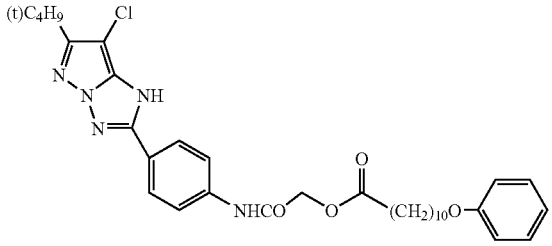

-continued
M-10-122
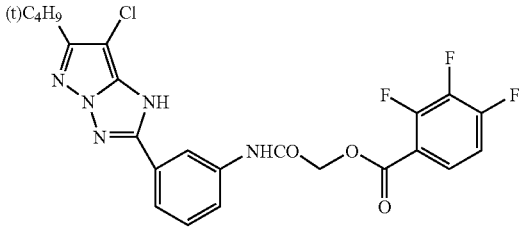
M-10-123
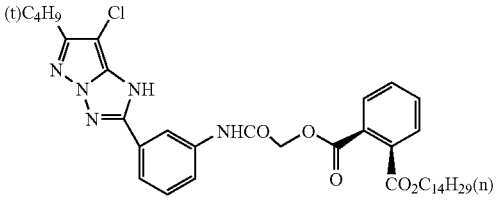
M-10-124
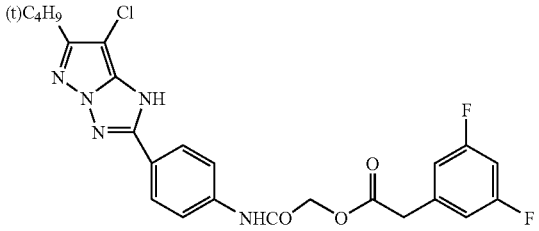
M-10-125
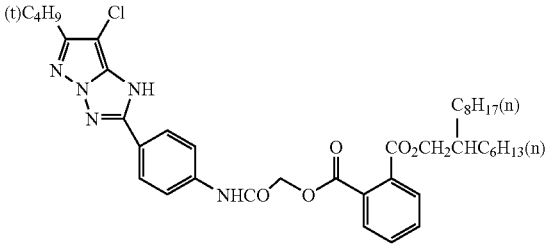
M-10-126
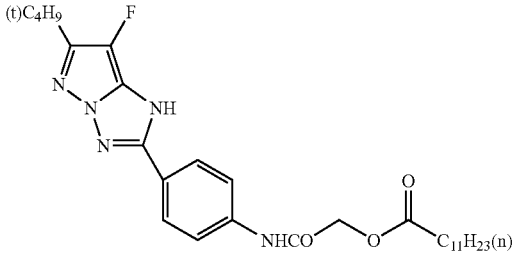
M-10-127
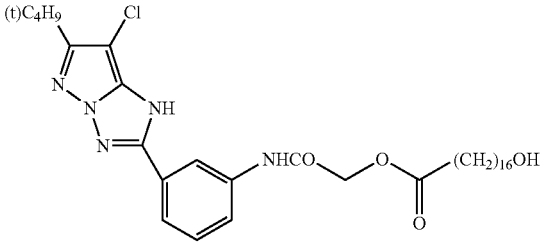
M-10-128
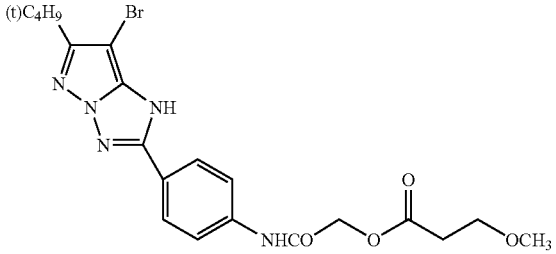
M-10-129
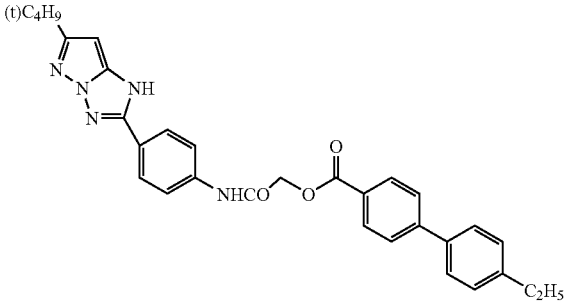
M-10-130
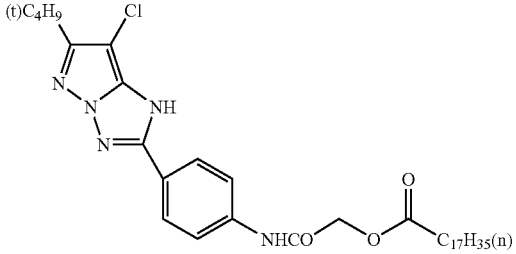
M-10-131
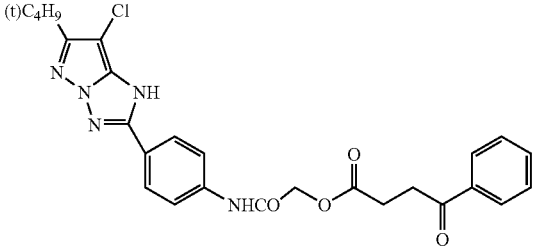

-continued
M-10-132
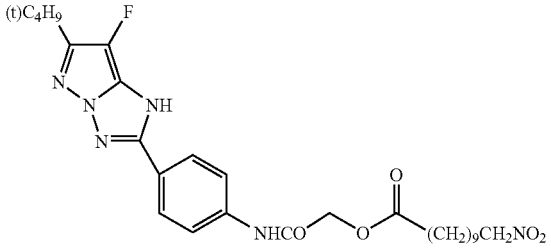
M-10-133
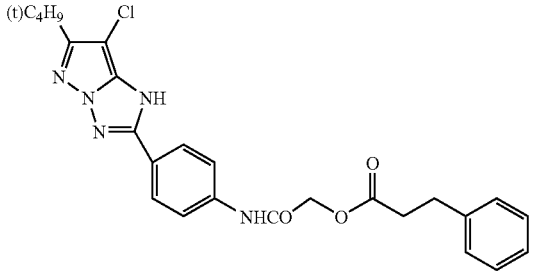
M-10-134
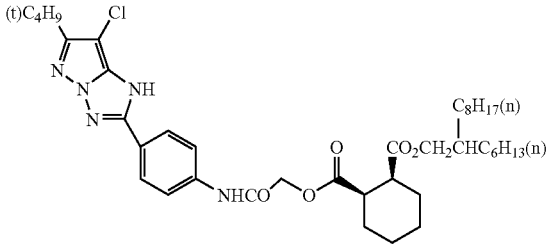
M-10-135
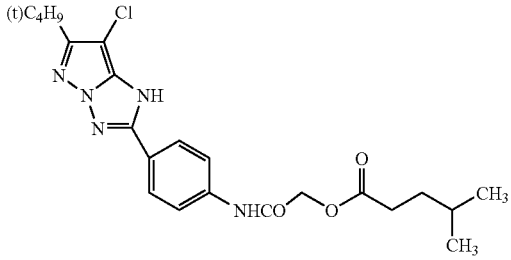
M-10-136
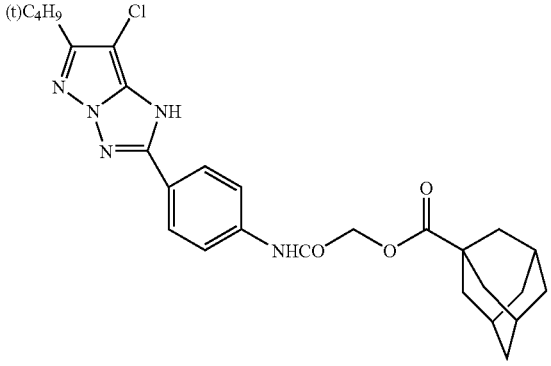
M-10-137
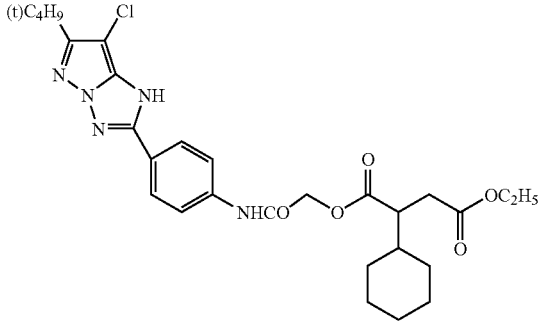
M-10-138
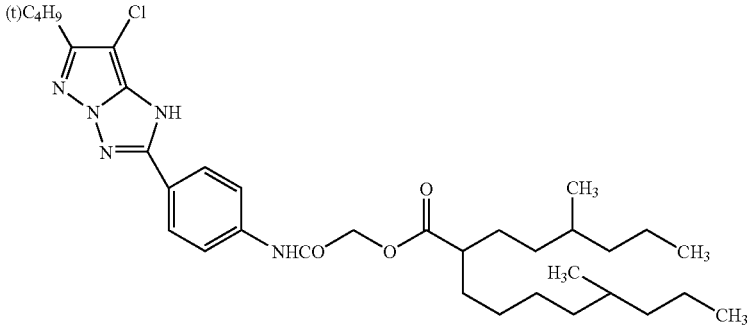
M-10-139
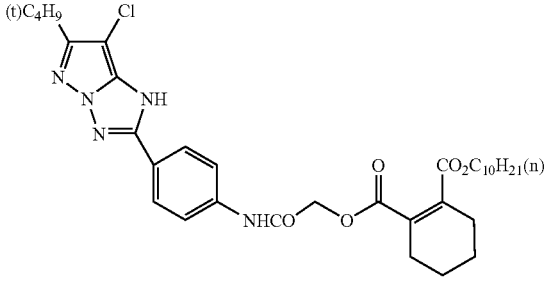
M-10-140
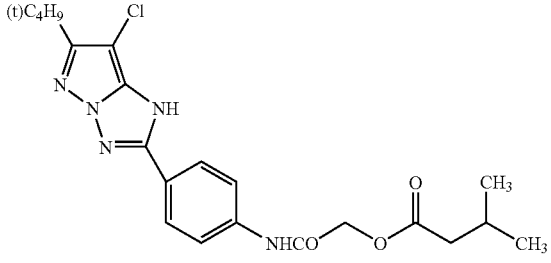

-continued

M-10-141

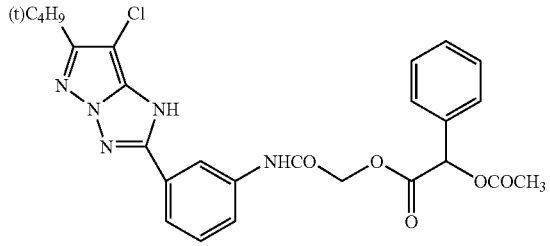

M-10-142

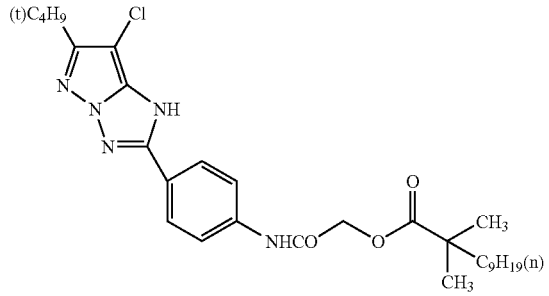

The magenta coupler represented by any one of formulae (M-I) to (M-X) for use in the present invention can be synthesized by methods described in JP-A-60-197688, JP-A-3-184980, JP-A-6-43611, or JP-A-2001-356455, or methods according to these methods.

The amount of the magenta coupler represented by any one of formulae (M-I) to (M-X) for use in the present invention is preferably in the range of from 0.001 g to 3.0 g, more preferably in the range of from 0.01 g to 1.0 g, per $m^2$ of the photosensitive material. Particularly in case of the reflection type photosensitive material, the amount is preferably in the range of from 0.01 g to 0.8 g, more preferably in the range of from 0.02 g to 0.6 g, per $m^2$ of the photosensitive material. In the present invention, the magenta coupler represented by any one of formulae (M-I) to (M-X) is preferably used in a silver halide emulsion layer or layers adjacent to the emulsion layer, particularly preferably in a silver halide emulsion layer. The magenta coupler, when used in the silver halide emulsion layer, is preferably used in the range of from 0.001 to 10 mole, more preferably in the range of from 0.05 to 2 mole, per mole of silver halide.

Next, the compound represented by formula (Ph) for use in the present invention is explained in detail below. This compound can be particularly preferably used in the first and second embodiments of the present invention.

Formula (Ph)

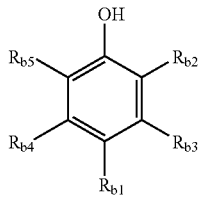

In formula (Ph), $R_{b1}$ represents an aliphatic group, an aryl group, a carbamoyl group, an acylamino group (this group is also referred to as an amido group), a carbonyl group (this group is also referred to as an acyl group), or a sulfonyl group. $R_{b2}$, $R_{b3}$, $R_{b4}$ and $R_{b5}$ each represent a hydrogen atom, a halogen atom, a hydroxyl group, an aliphatic group, an aryl group, a heterocyclic group, an aliphatic oxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group.

The compound represented by formula (Ph) is explained in more detail below.

$R_{b1}$ represents an aliphatic group, an aryl group, a carbamoyl group, an acylamino group, a carbonyl group, or a sulfonyl group. Further, each of these groups may be further substituted with other substituent(s). The above aliphatic group is a general term embracing an alkyl group, an alkenyl group, an alkynyl group, a cycloalkyl group, a cycloalkenyl group and a cycloalkynyl group, and examples of the aliphatic group include a methyl group, an ethyl group, an i-propyl group, a t-butyl group, a t-octyl group, and a cyclohexyl group. Examples of the aryl group include a phenyl group and a naphthyl group, each of which may have a substituent. Examples of the carbamoyl group include a N,N-diethylcarbamoyl group, a N,N-dibutylcarbamoyl group, a hexylcarbamoyl group, and a N,N-diphenylcarbamoyl group. Examples of the acylamino group include a butylamido group, a hexylamido group, an octylamido group, and a benzamido group. As a carbonyl group, an oxycarbonyl group is preferable, and examples of the carbonyl group include a hexyloxycarbonyl group, an octyloxycarbonyl group, and a dodecyloxycarbonyl group. Examples of the sulfonyl group include a butylsulfonyl group, an octylsulfonyl group, and a dodecylsulfonyl group.

$R_{b2}$, $R_{b3}$, $R_{b4}$ and $R_{b5}$ each independently represent a hydrogen atom, a halogen atom (for example, fluorine, chlorine, bromine, iodine), a hydroxyl group, an aliphatic group (for example, methyl, ethyl, butyl, allyl), an aryl group (for example, phenyl, naphthyl), a heterocyclic group (for example, piperidyl, pyrrolyl, indolyl), an aliphatic oxy group (for example, methoxy, octyloxy, cyclohexyloxy), an aryloxy group (for example, phenoxy, naphthoxy), a heterocyclic oxy group (for example, piperidyloxy, pyrrolyloxy, indolyloxy), an oxycarbonyl group (preferably an alkoxycarbonyl group or an aryloxycarbonyl group, for example, methoxycarbonyl, hexadecyloxycarbonyl, phenoxycarbonyl, p-chlorophenoxycarbonyl), an acyl group (for example, acetyl, pivaloyl, methacryloyl), an acyloxy group (for example, acetoxy, benzoyloxy), an oxycarbonyloxy group (preferably an alkoxycarbonyloxy group or an aryloxycarbonyloxy group, for example, methoxycarbonyloxy, octyloxycarbonyloxy, phenoxycarbonyloxy), a carbamoyl group (for example, N,N-dimethylcarbamoyl, N,N-diethylcarbamoyl, diphenylcarbamoyl, hexylcarbamoyl), an acylamino group (for example, heptylamido, undecylamido, pentadecylamido, 1-hexylnonylamido), a sulfonyl group (including an aliphatic sulfonyl group and an arylsulfonyl group, for example, methane sulfonyl, butane sulfonyl, octane sulfonyl, benzene sulfonyl, p-toluene sulfonyl), a sulfinyl group (for example, methane sulfinyl, octane sulfinyl, benzene sulfinyl, p-toluene sulfinyl), a sulfamoyl group (for example, dimethylsulfamoyl), an alkylthio group (for example, methylthio, octylthio, dodecylthio), or an arylthio group (for example, phenylthio). Further, $R_{b1}$ to $R_{b5}$ each may be a linking group that links at least two phenol skeletons (mother nuclei).

Each of the aforementioned groups may be further substituted with a substituent.

As $R_{b1}$, an alkyl group, a carbonyl group and an acylamino group are preferable. An alkyl group is more preferable of all. A methyl group is particularly preferred. As $R_{b2}$, an acylamino group, an aliphatic oxy group and an alkylene-linking group are preferable. In the case of the alkylene-linking group, it is preferred that two phenol skeletons are linked via the linking group.

Preferable structures of the compounds represented by formula (Ph) are shown below.

Formula (Ph-1)

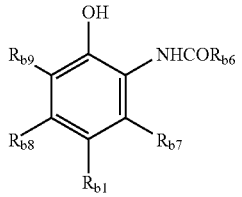

Formula (Ph-2)

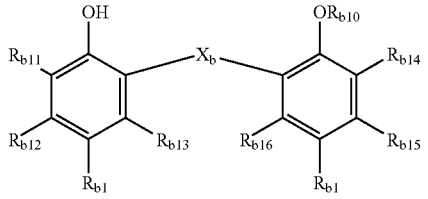

Formula (Ph-3)

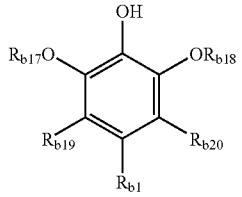

The compounds represented by formula (Ph-1) are explained in detail below.

$R_{b6}$ represents an aliphatic group, an aryl group, an amino group, or an acyl group. $R_{b1}$ has the same meaning as defined in formula (Ph) and the same preferable range as described above with respective to the $R_{b1}$. $R_{b7}$, $R_{b8}$ and $R_{b9}$ each independently have the same meanings as $R_{b2}$ to $R_{b5}$ defined in formula (Ph) and the same preferable ranges as described above with respective to the $R_{b2}$ to $R_{b5}$.

Each of the aforementioned groups may be further substituted with a substituent.

Specific examples set forth with respect to the groups in formulae (M-I) to (M-X) may be applied to specific examples of each of groups of an aliphatic group, an aryl group, a carbamoyl group, an acylamino group, a carbonyl group and a sulfonyl group, each of which is represented by $R_{b1}$.

Preferably, $R_{b6}$ represents an aliphatic group (for example, 1-ethylpentyl, 1-hexylnonyl, undecyl, dodecyl, pentadecyl, heptadecyl), an aryl group, an amino group, or an acyl group.

$R_{b6}$ is preferably an aliphatic group, more preferably an unsubstituted aliphatic group, and especially preferably a branched aliphatic group. The total of carbon atoms in $R_{b6}$ is preferably in the range of from 8 to 25, especially preferably in the range of from 12 to 20. $R_{b1}$ is preferably an aliphatic group, an aryl group, a carbamoyl group, or an oxycarbonyl group, more preferably an aliphatic group, and especially preferably a methyl group. $R_{b7}$, $R_{b8}$ and $R_{b9}$ each are preferably a hydrogen atom or an aliphatic group, especially preferably a hydrogen atom.

The compounds represented by formula (Ph-2) are explained in detail below. These compounds are preferable for use especially in the first and second embodiments of the present invention.

$R_{b1}$ has the same meaning as defined in formula (Ph) and the same preferable range as described above with respective to the $R_{b1}$ in formula (Ph). $R_{b10}$ represents a hydrogen atom, an aliphatic group (for example, butyl, benzyl), an acyl group (for example, acryloyl, 1-methylacryloyl, 2-methylacryloyl), an oxycarbonyl group (for example, methoxycarbonyl, butoxycarbonyl, phenoxycarbonyl), a silyl group, or a phosphoryl group. $X_b$ represents an alkylene-linking group (for example, methylene, ethylene, propylene, isopropylmethylene, pentylmethylene), a phenylene-linking group (for example, phenylene), an —O— linking group, or a —S— linking group. $R_{b11}$ to $R_{b16}$ each independently have the same meaning as $R_{b2}$ to $R_{b5}$ defined in formula (Ph) and the same preferable ranges as described above with respective to each of them.

From the viewpoint of improvement in fastness to light, $R_{b10}$ is preferably a hydrogen atom, an acyl group or an alkyl group, more preferably a hydrogen atom or an acyl group. It is especially preferred from the viewpoint of improvement in fastness to light that $R_{b10}$ is a hydrogen atom. However, if $R_{b10}$ is a hydrogen atom, the compound represented by formula (Ph-2) itself reacts with an oxidation product of a paraphenylene diamine to develop a cyan color, thereby causing a color mixing, which is not preferable. Therefore, from this aspect, it is not most preferred that $R_{b10}$ is a hydrogen atom. $X_b$ is preferably an alkylene-linking group, more preferably —$CHR_{b21}$ ($R_{b21}$ represents a hydrogen atom, an aliphatic group, or an aryl group). $R_{b21}$ is especially preferably an aliphatic group. $R_{b11}$ and $R_{b14}$ each are preferably an aliphatic group, more preferably an aliphatic group having 6 or less carbon atoms, and especially preferably a methyl group.

$R_{b1}$ is preferably an aliphatic group, an aryl group, a carbamoyl group, or an oxycarbonyl group, more preferably an aliphatic group, and especially preferably a methyl group. $R_{b12}$, $R_{b13}$, $R_{b15}$ and $R_{b16}$ each are preferably a hydrogen atom or an aliphatic group, and especially preferably a hydrogen atom.

The compounds represented by formula (Ph-3) are explained in detail below.

$R_{b17}$ and $R_{b18}$ each independently represent an aliphatic group, or an aryl group. $R_{b1}$ has the same meaning as defined in formula (Ph) and the same preferable range as described above with respective to the $R_{b1}$. $R_{b19}$ and $R_{b20}$ each have the same meanings as $R_{b2}$ to $R_{b5}$ defined in formula (Ph) and the same preferable ranges as described above with respective to each of them.

Preferably, $R_{b17}$ and $R_{b18}$ each independently represent an aliphatic group (for example, 1-ethylhexyl, 1-hexyldecyl, dodecyl, tetradecyl, hexadecyl, octadecyl), or an aryl group.

Specific examples set forth with respect to the groups in formulae (M-I) to (M-X) may be applied to specific examples of each of these groups.

$R_{b17}$ and $R_{b18}$ each are preferably an aliphatic group. $R_{b19}$ and $R_{b20}$ each are preferably a hydrogen atom or an aliphatic group, and especially preferably a hydrogen atom. $R_{b1}$ is preferably a carbamoyl group, an oxycarbonyl group or an aliphatic group, especially preferably a carbamoyl group or an oxycarbonyl group.

In the present invention, preferably in the third embodiment of the present invention, of these compounds represented by formula (Ph-1) or formula (Ph-3), those represented by formula (Ph-4) are particularly preferred.

The compounds represented by formula (Ph-4) are explained in detail below.

In formula (Ph-4), $R_{b21}$ represents a straight-chain, branched or cyclic, saturated or unsaturated, unsubstituted aliphatic group, or a straight-chain, branched or cyclic, saturated or unsaturated aliphatic group substituted with a halogen atom, a hydroxyl group, —$SR_{b30}$, —$CONR_{b30}R_{b31}$, —$CO_2R_{b30}$, or —$OCOR_{b30}$. $R_{b30}$ and $R_{b31}$ each independently represent a hydrogen atom, or a straight-chain, branched or cyclic, saturated or unsaturated, unsubstituted aliphatic group. Examples of the straight-chain unsubstituted aliphatic group include a heptyl group, a nonyl group, a undecyl group, a dodecyl group, a pentadecyl group, a heptadecyl group, an octadecyl group, an icosyl group, a henicosyl group, a tricosyl group, a 8-heptadecel group, 8,11-heptadecadienyl group, and 8,11,14-heptadecatrienyl group. Examples of the branched aliphatic group include a t-butyl group, a t-pentyl group, a t-propylbutyl group, a 1-ethylpentyl group, and 1-hexylnonyl group. Examples of the cyclic aliphatic group include a cyclohexyl group, a cyclooctyl group, a dicyclohexylmethyl group, a (4-methyl) cyclohexylmethyl group, an adamantly group, a norbornenyl group, and a 1-(3-methyl)hexyl-5-methylnonyl group.

Examples of the halogen atom with which the aliphatic group of $R_{b21}$ may be substituted, include fluorine, chlorine, bromine and iodine atoms. Examples of the aliphatic group substituted with a halogen atom, include a perfluorononyl group, a 8,9-dichloroheptadecyl group, 1-chloro-1-hexylnonyl group, 1-bromoheptyl group, 1-bromopropadecyl group, and 1-bromo-1-hexylnonyl group. Examples of the aliphatic group substituted with a hydroxyl group, include a 9-hydroxynonyl group, 15-hydroxypentadecyl group, and 11-hydroxyheptapentyl group. Examples of the aliphatic group substituted with —$SR_{b30}$, include a 2-dodecylthioethyl group, a 1-hexyl-1-methylthiononyl group, 1-t-octylthiopentyl group, a 1-methylthiopropadecyl group, and 1-t-butylthio-1-hexylnonyl group. Examples of the aliphatic group substituted with —$CONR_{b30}R_{b31}$, include a 1-(N,N-dibutyl)carbamoyl butyl group, a 3-(N,N-dibutyl)carbamoyl-1-methylpropyl group, a 1-carbamoylmethyl heptadecyl group, and a 2-(N,N-dibutyl)carbamoylcyclohexyl group. Examples of the aliphatic group substituted with —$CO_2R_{b30}$ include a 2-dodecyloxycarbonyl-1-methylethyl group, and a 1-dodecyl-2-methoxy carbonylethyl group. Examples of the aliphatic group substituted with —OC(=O)$R_{b30}$ include a dodecylcarbonyloxyethyl group and a 2-acetyloxy-1-dodecylethyl group. Double 2-acylamino-p-cresol mother skeletons may hold a single aliphatic group in common.

The total of carbon atoms in $R_{b21}$ is preferably in the range of 8 to 25, particularly preferably in the range of 12 to 20. If the total of carbon atoms is too few, an inhibitor tends to easily come out of an oil layer dispersed together with a coupler, so that the inhibitor becomes difficult to exert its effect. In contrast, if the total of carbon atoms is too many, when the inhibitor is added in an equivalent molar amount, the resulting increase in volume makes it difficult to form a thin layer, and the inhibitor tends to hardly dissolve into the above oil layer in which a coupler is co-dispersed.

Further, as the kind of preferable aliphatic groups, an unsubstituted aliphatic group is preferred from the viewpoint of an excellent fade-preventing capability. Of these aliphatic groups, a straight-chain, or branched aliphatic group is more preferable, and a branched aliphatic group is particularly preferred. Among the branched aliphatic groups, an aliphatic group branching at its α-position is particularly preferable.

Preferable specific examples of the compounds represented by formula (Ph) for use in the present invention are shown below, but the present invention is not limited to these compounds.

(A-1)

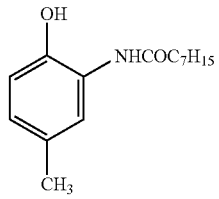

(A-2)

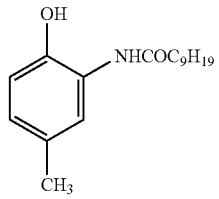

(A-3)

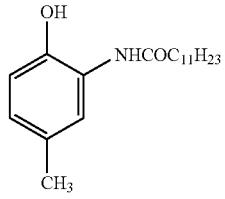

(A-4)

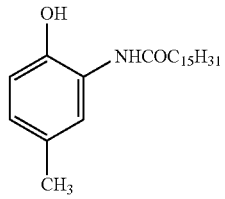

(A-5)

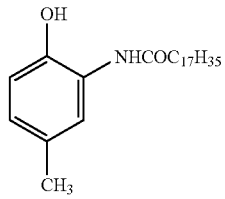

(A-6)

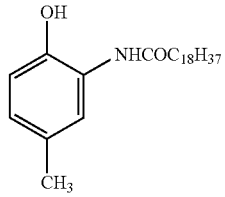

-continued
(A-7)
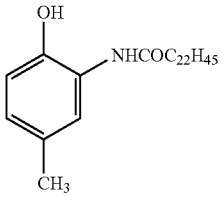
(A-8)
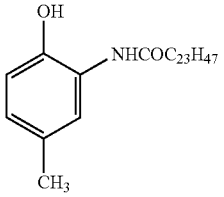
(A-9)
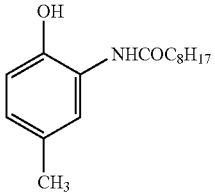
(A-10)
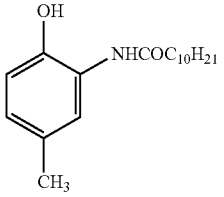
(A-11)
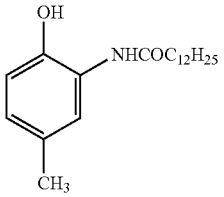
(A-12)
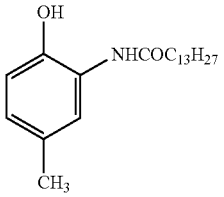
(A-13)
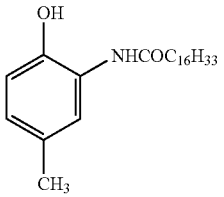
-continued
(A-14)
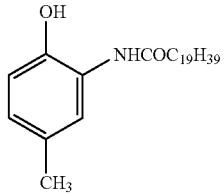
(A-15)
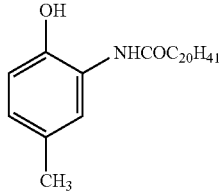
(A-16)
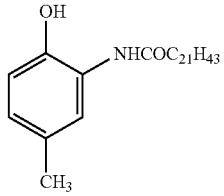
(A-17)
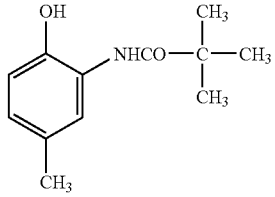
(A-18)
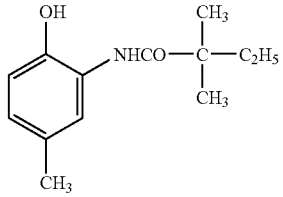
(A-19)
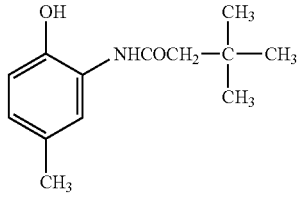
(A-20)
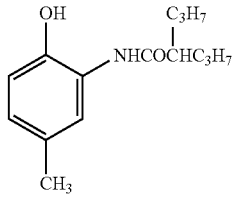

-continued
(A-21)
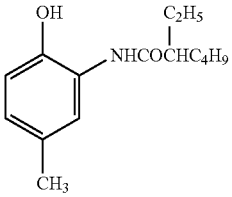
(A-22)
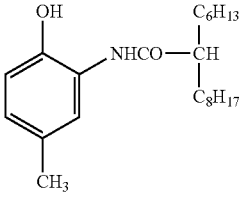
(A-23)
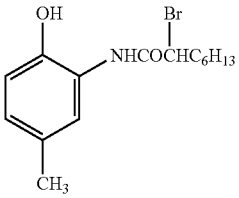
(A-24)
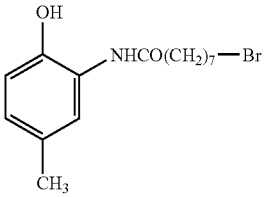
(A-25)
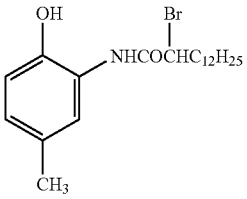
(A-26)
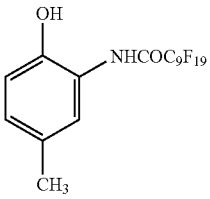
(A-27)
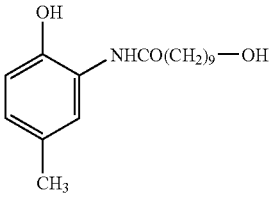
-continued
(A-28)
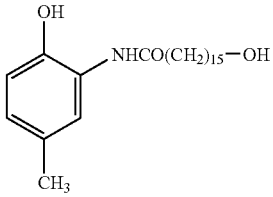
(A-29)
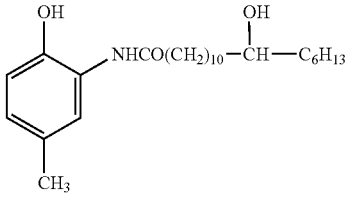
(A-30)
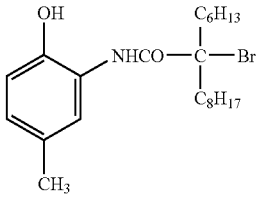
(A-31)
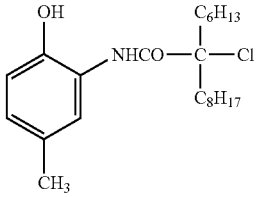
(A-32)
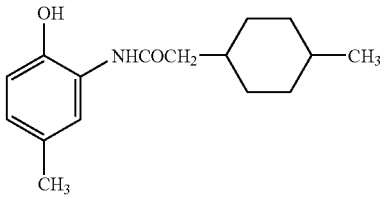
(A-33)
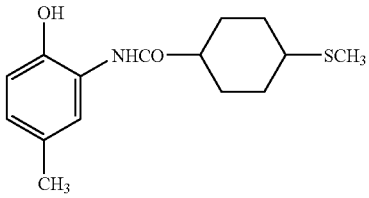
(A-34)
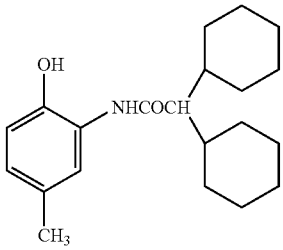

-continued
(A-35)
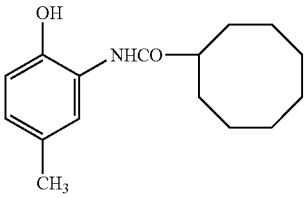
(A-36)
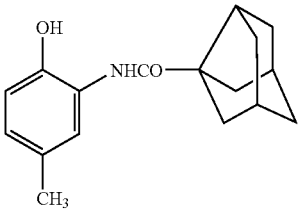
(A-37)
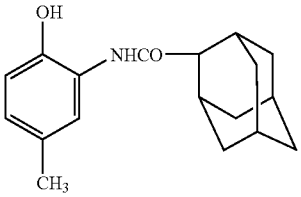
(A-38)
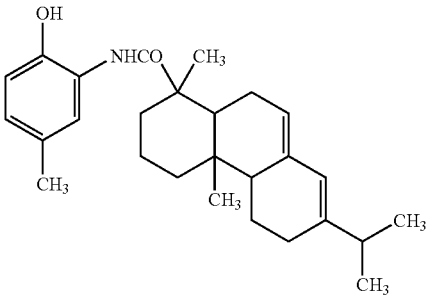
(A-39)
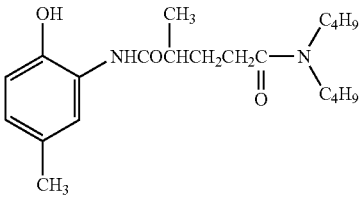
(A-40)
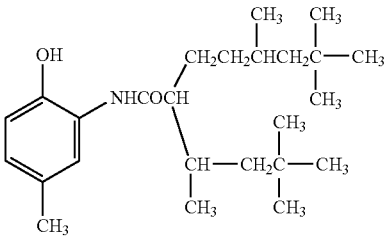
(A-41)
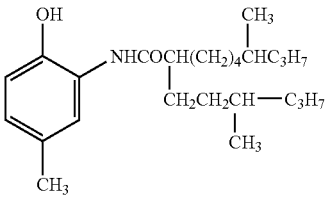
-continued
(A-42)
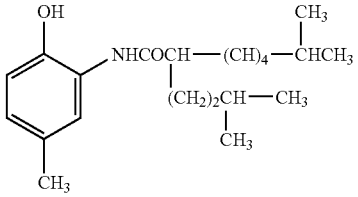
(A-43)
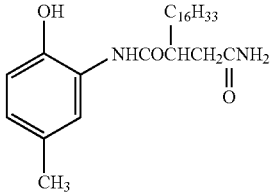
(A-44)
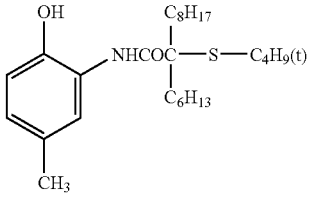
(A-45)
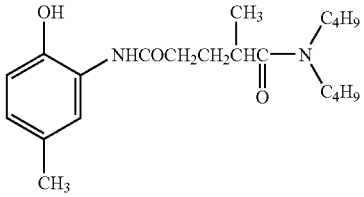
(A-46)
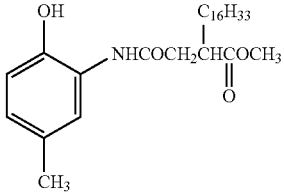
(A-47)
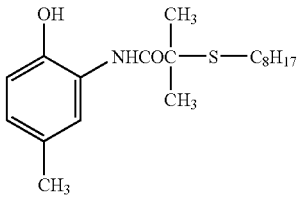
(A-48)
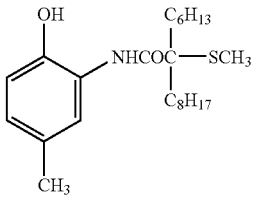

-continued
(A-49)
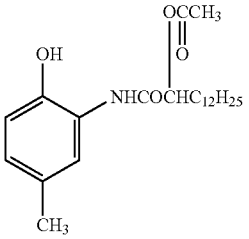
(A-50)
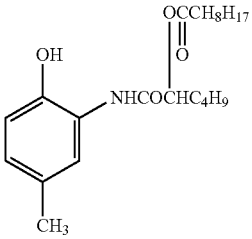
(A-51)
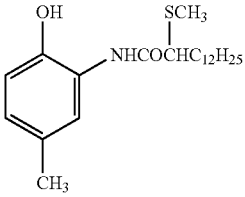
(A-52)
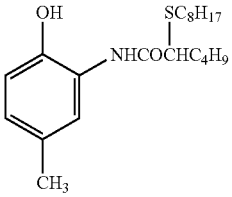
(A-53)
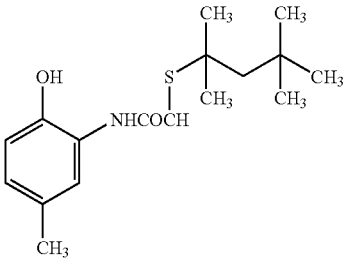
(A-54)
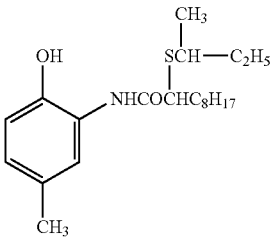
(A-55)
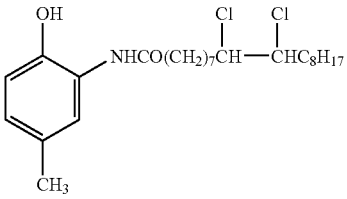
-continued
(A-56)
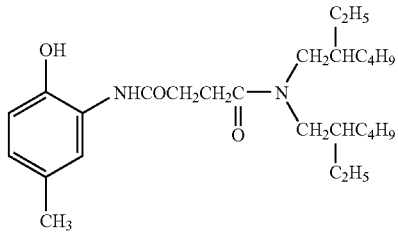
(A-57)
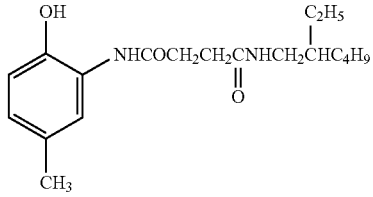
(A-58)
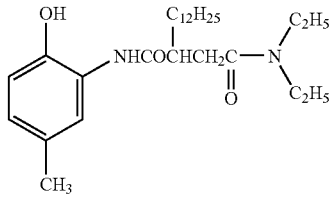
(A-59)
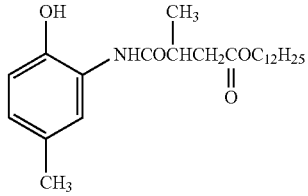
(A-60)
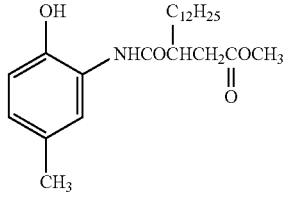
(A-61)
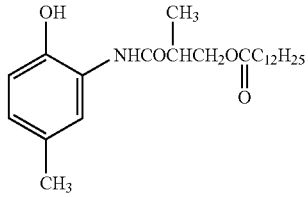
(A-62)
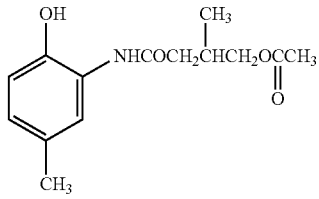

-continued
(A-63)
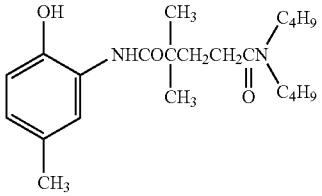
(A-64)
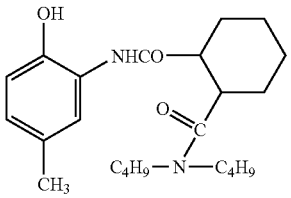
(A-65)
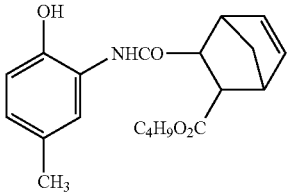
(A-66)
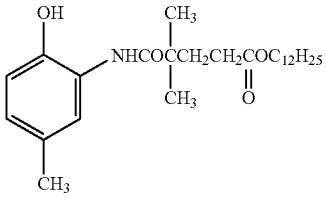
(A-67)
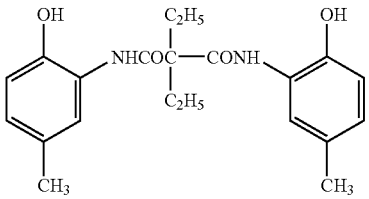
(A-68)
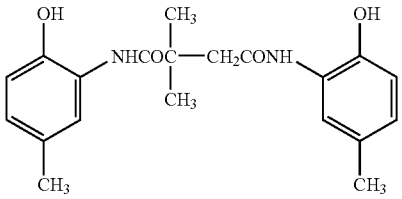
(A-69)
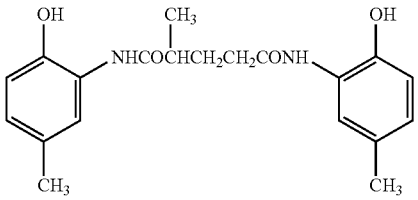
-continued
(A-70)
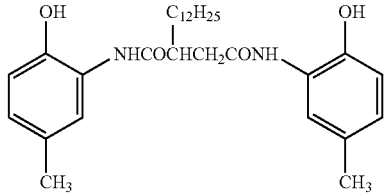
(A-71)
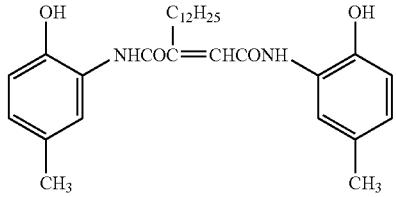
(A-72)
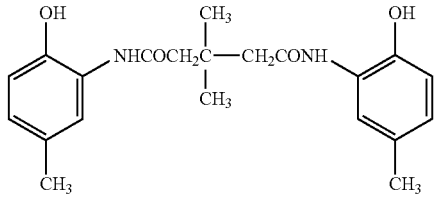
(A-73)
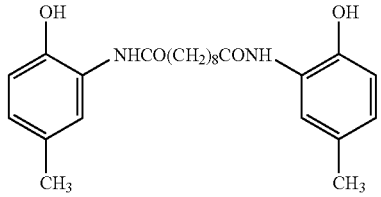
(A-74)
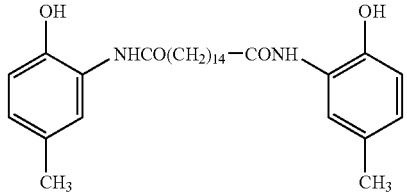
(A-75)
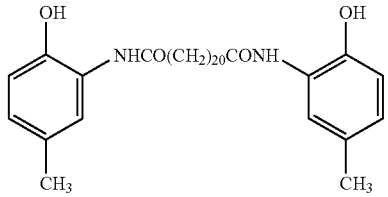
(A-76)
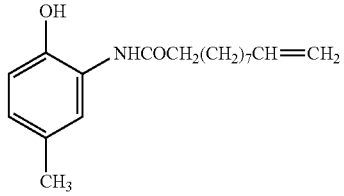

-continued
(A-77)
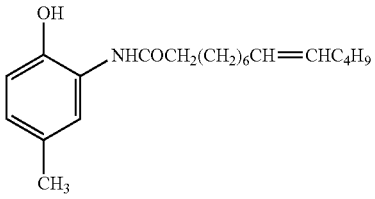
(A-78)
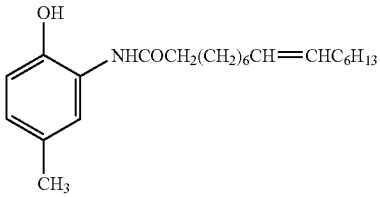
(A-79)
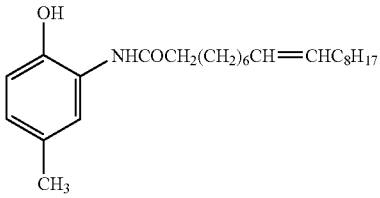
(A-80)
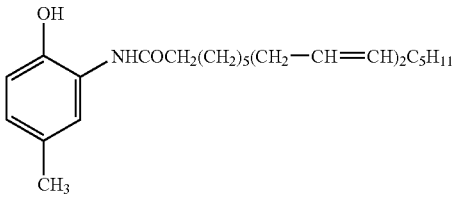
(A-81)
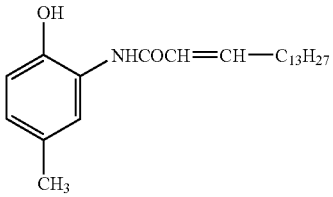
(A-82)
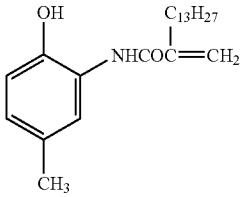
(A-83)
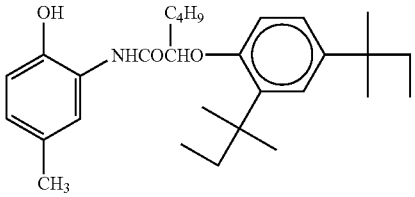
-continued
(A-84)
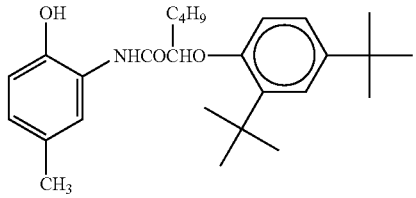
(A-85)
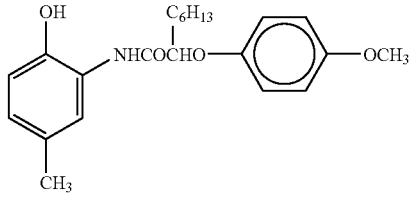
(A-86)
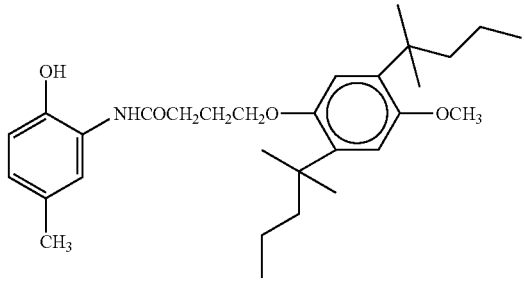
(A-87)
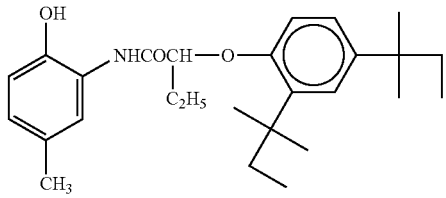
(A-88)
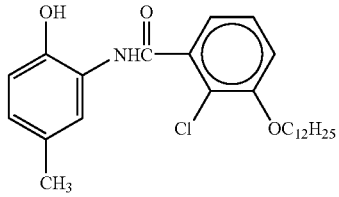
(A-89)
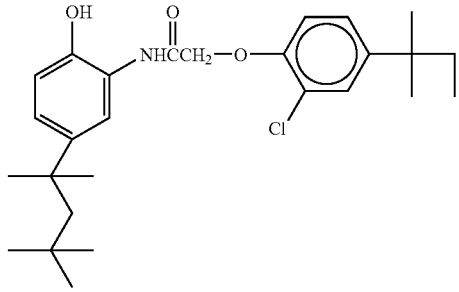

-continued
(A-90)
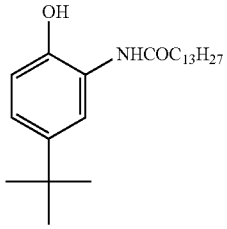
(A-91)
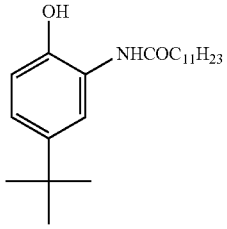
(A-92)
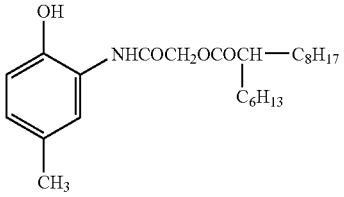
(A-93)
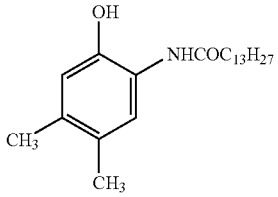
(A-94)
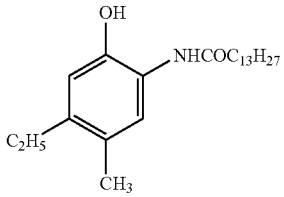
(A-95)
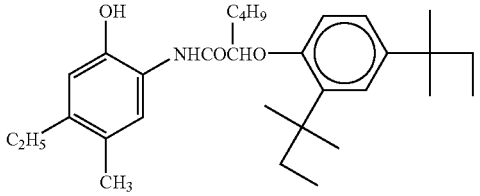
(A-96)
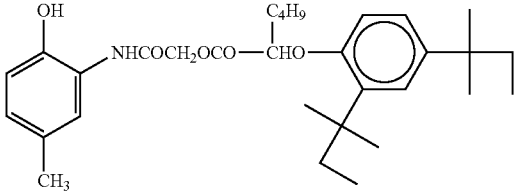
-continued
(A-97)
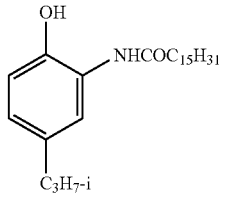
(A-98)
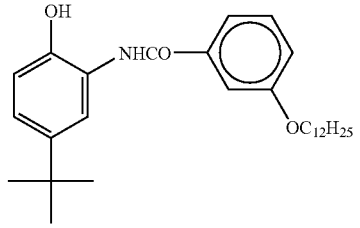
(A-99)
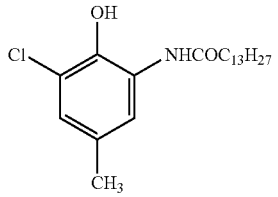
(A-100)
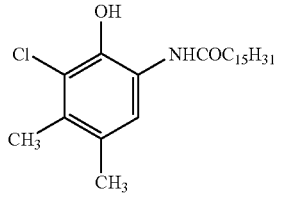
(A-101)
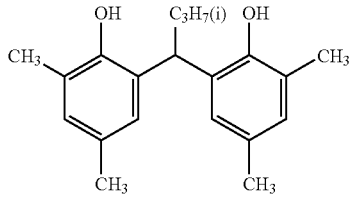
(A-102)
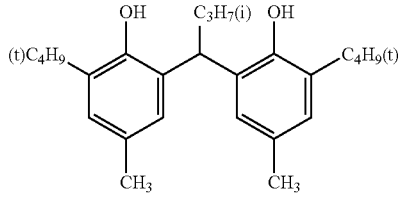
(A-103)
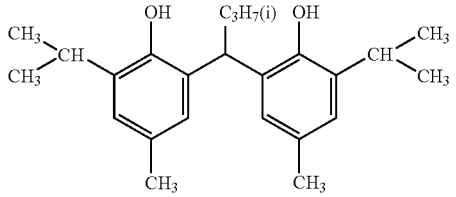

-continued
(A-104)
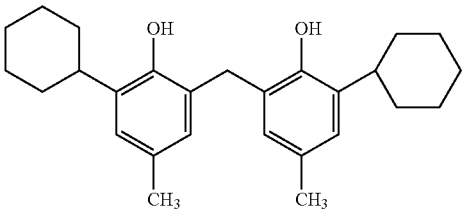
(A-105)
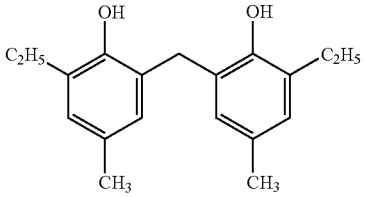
(A-106)
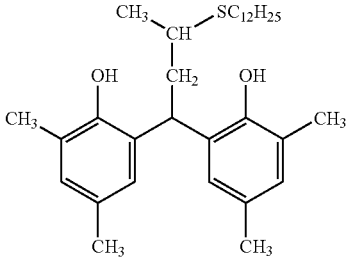
(A-107)
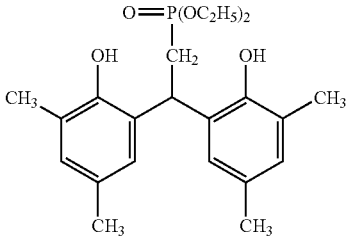
(A-108)
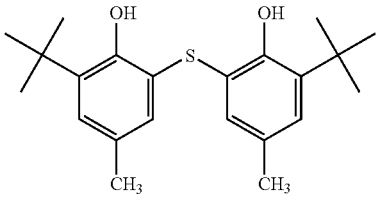
(A-109)
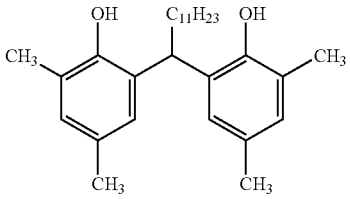
(A-110)
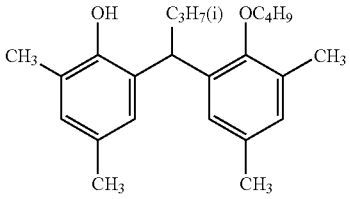
-continued
(A-111)
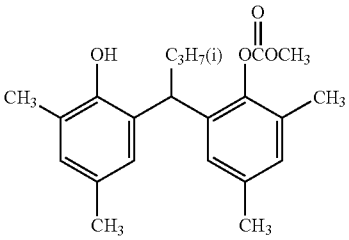
(A-112)
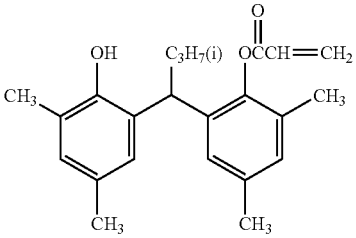
(A-113)
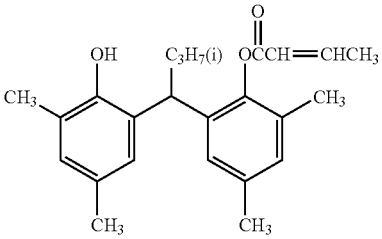
(A-114)
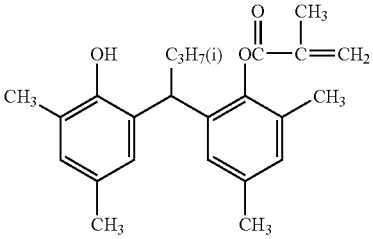
(A-115)
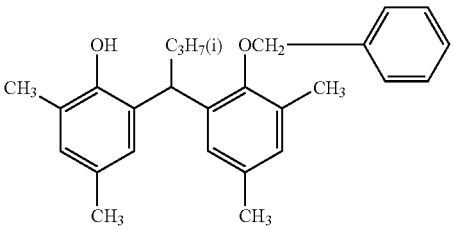
(A-116)
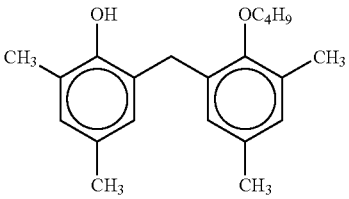

-continued
(A-117)
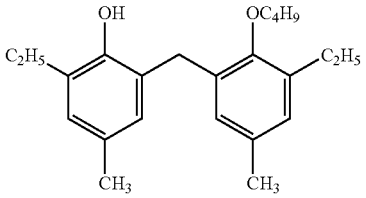
(A-118)
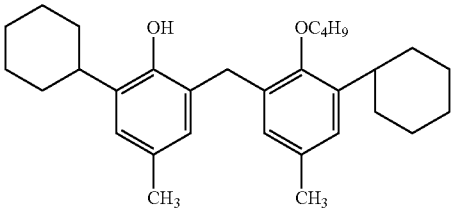
(A-119)
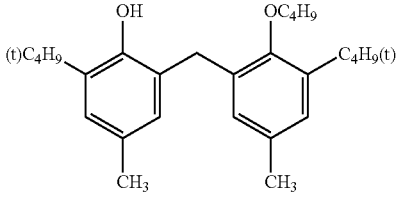
(A-120)
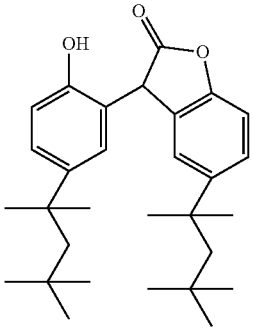
(A-121)
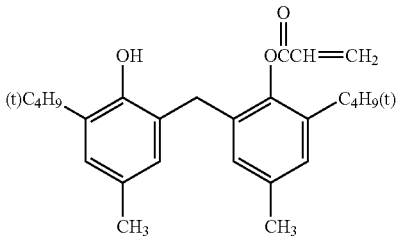
(A-122)
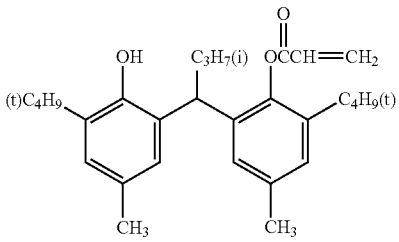
-continued
(A-123)
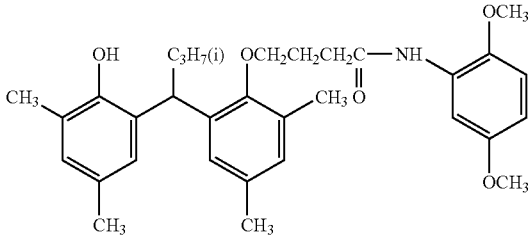
(A-124)
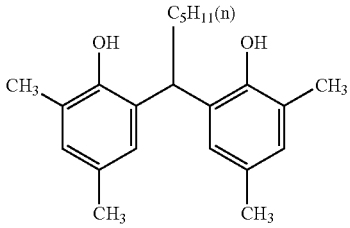
(A-125)
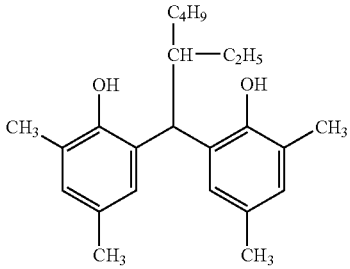
(A-126)
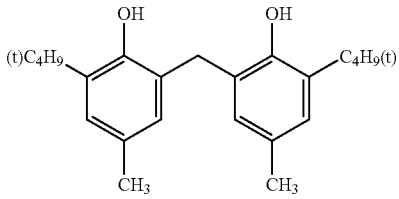
(A-127)
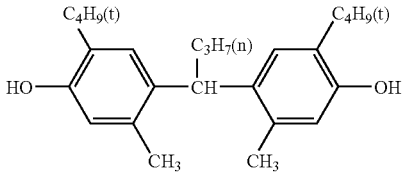
(A-128)
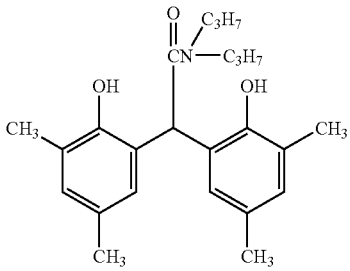

-continued
(A-129)
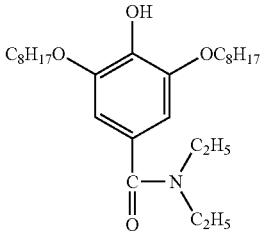
(A-130)
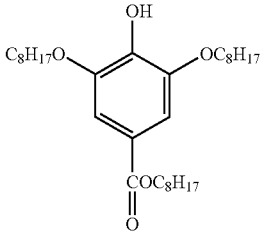
(A-131)
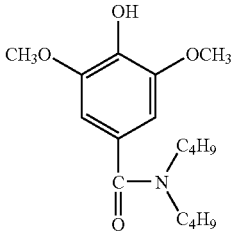
(A-132)
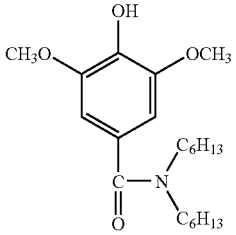
(A-133)
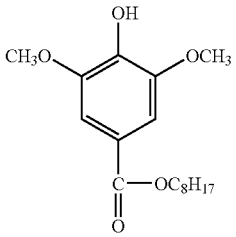
(A-134)
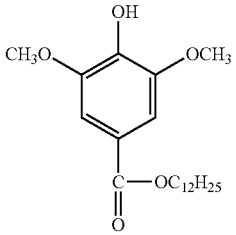
-continued
(A-135)
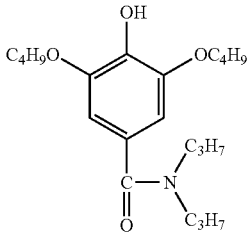
(A-136)
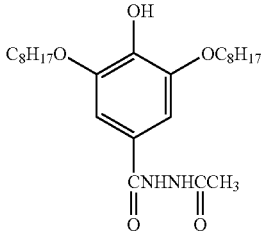
(A-137)
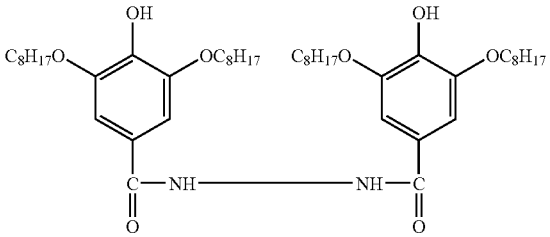
(A-138)
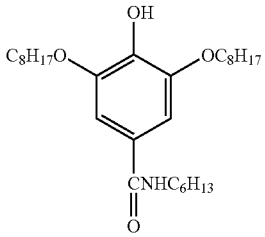
(A-139)
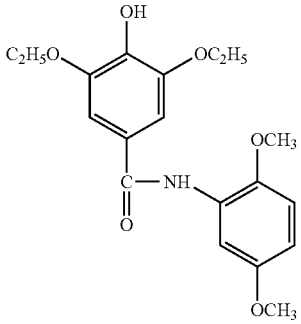
(A-140)
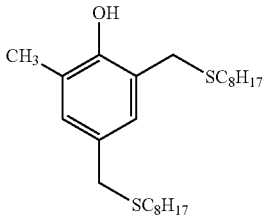

-continued (A-141)

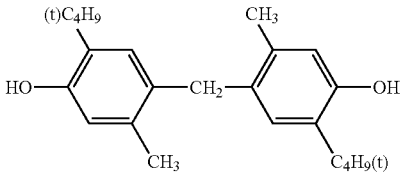

(A-142)

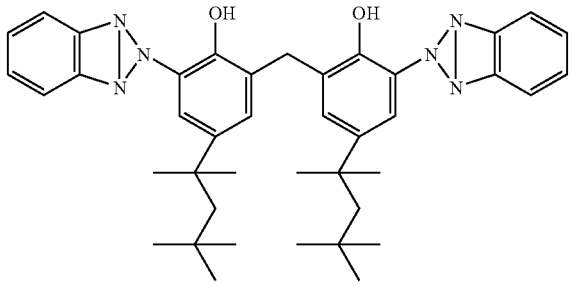

The compound represented by formula (Ph) for use in the present invention may be used solely or in combination with two or more kinds of these compounds. Further, the layer to which the compound represented by formula (Ph) for use in the present invention is added may be different from, or identical to a layer incorporating therein a dye-forming coupler for use in the present invention. It is preferred that the compound represented by formula (Ph) and the dye-forming coupler for use in the present invention are added to the identical layer. In this connection, however, at least one compound represented by formula (Ph) for use in the present invention is added to the layer incorporating therein the dye-forming coupler represented by any one of formulae (M-I) to (M-X) or the dye-forming coupler represented by formula (I) for use in the present invention.

The compound represented by formula (Ph) for use in the present invention, if used in combination with the yellow dye-forming coupler represented by formula (I) or the magenta dye-forming coupler represented by any one of formulae (M-I) to (M-X), enables to inhibit discoloration, thereby to improve image fastness after processing.

The addition amount of the compound represented by formula (Ph) for use in the present invention is preferably in the range of from 10 mole % to 200 mole %, more preferably in the range of from 20 mole % to 150 mole %, especially preferably in the range of from 40 mole % to 120 mole %, to the dye-forming coupler, respectively.

Next, a concrete synthesis example of the compounds represented by formula (Ph) is shown below.

SYNTHETIC EXAMPLE

Synthesis of (A-22)

To 28.7 g (0.233 mole) of 2-amino-p-cresol and 38.6 g (0.460 mole) of sodium bicarbonate, 126 ml of acetonitrile was added and 63.2 g (0.23 mole) of isopalmitinic acid chloride was added dropwise over 30 minutes with heating and stirring. After additional heating and stirring for 1 hour, 100 ml of methanol was added thereto. The resulting insoluble residue was separated by filter and washed with 100 ml of methanol. To the thus-obtained solution, 50 ml of water was added dropwise over 25 minutes with stirring at room temperature for crystallization. Further stirring was continued for 2 hours with water-cooling. The precipitated crystals were separated by filter and washed with 250 ml of methanol/water=5/1, and further washed with 250 ml of water. The thus-obtained crystals were dried at 45° C. for 1 day by means of a blast drier. 80.5 g of white crystals were obtained. Yield: 96.8%, Melting point: 82 to 84° C.

Other compounds can also be synthesized in the similar manner as in the method set forth above.

The compounds represented by any one of formulae (E-1), (E-2), and (E-3) are explained in detail below.

Formula (E-1)

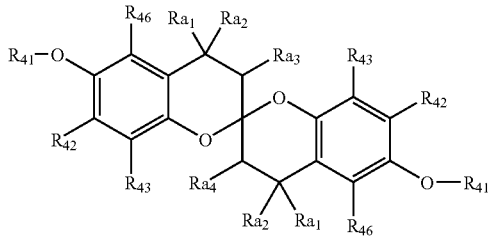

Formula (E-2)

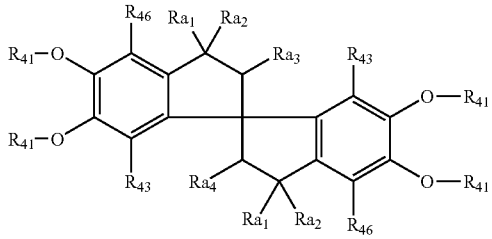

Formula (E-3)

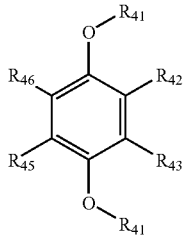

In formulae (E-1), (E-2), and (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a group —$Si(R_{47})(R_{48})(R_{49})$ in which $R_{47}$, $R_{48}$ and $R_{49}$ each independently represent an aliphatic group, an aryl group, an aliphatic oxy group, or an aryloxy group. $R_{42}$ to $R_{46}$ each independently represent a hydrogen atom, or a substituent. $Ra_1$, $Ra_2$, $Ra_3$, and $Ra_4$ each independently represent a hydrogen atom, or an aliphatic group (for example, methyl, ethyl). Preferable specific examples of each group are the same as those set forth in the explanation of formulae (M-I) to (M-X).

With respect to the compounds represented by any one of formulae (E-1) to (E-3), the groups that are preferred from the viewpoint of the effect obtained by the present invention, are explained below.

In formulae (E-1) to (E-3), it is preferred that $R_{41}$ represents an aliphatic group, an acyl group, an aliphatic oxycar bonyl group, an aryloxycarbonyl group, or a phosphoryl group, and $R_{42}$, $R_{43}$, $R_{45}$ and $R_{46}$ each independently represent a hydrogen atom, an aliphatic group, an aliphatic oxy group, or an acylamino group. It is more preferred that $R_{41}$ represents an aliphatic group, and $R_{42}$, $R_{43}$, $R_{45}$ and $R_{46}$ each independently represent a hydrogen atom, or an aliphatic group.

Preferable specific examples of the compounds represented by any one of formulae (E-1) to (E-3) for use in the present invention are shown below, but the present invention is not limited to these compounds.

B-1

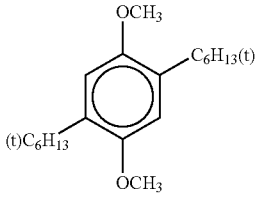

B-2

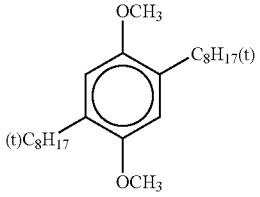

B-3

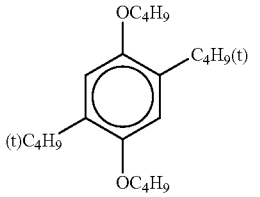

B-4

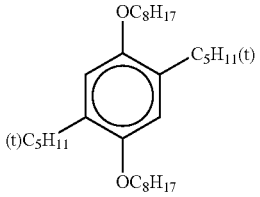

B-5

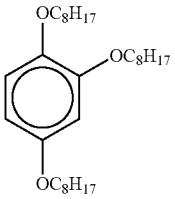

B-6

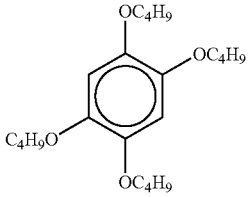

-continued

B-7

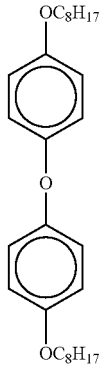

B-8

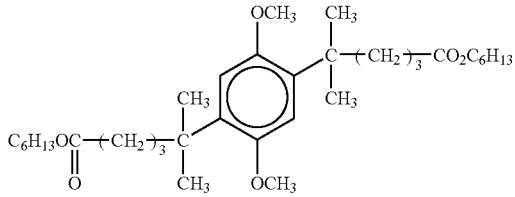

B-9

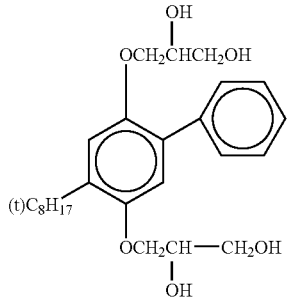

B-10

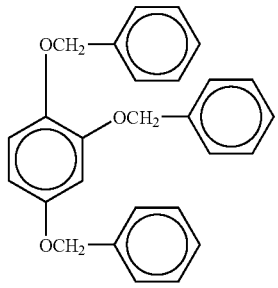

B-11

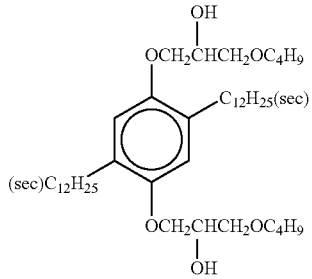

-continued

B-12

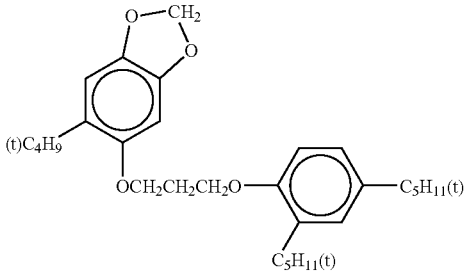

B-13

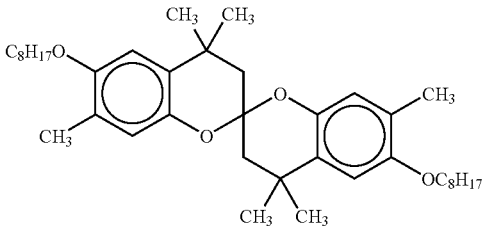

B-14

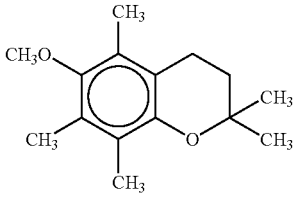

B-15

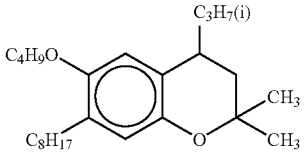

B-16

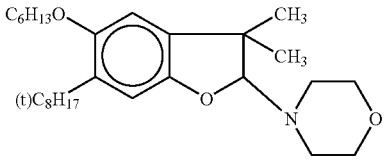

B-17

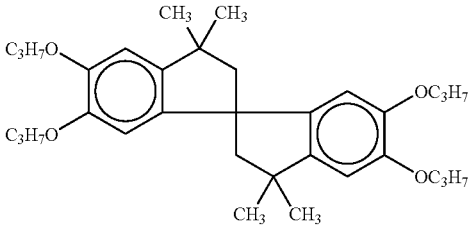

B-18

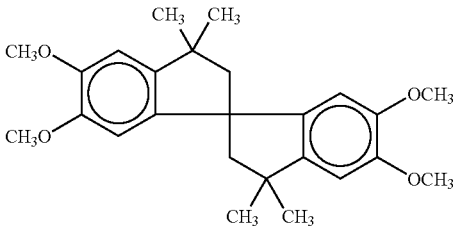

-continued

B-19

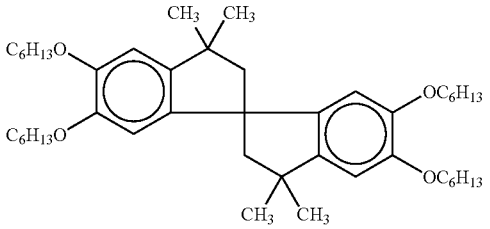

B-20

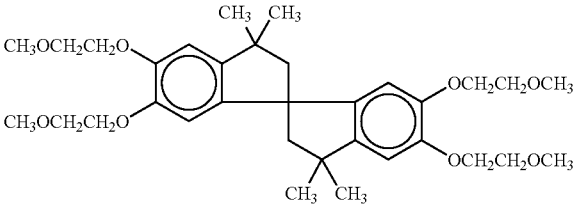

B-21

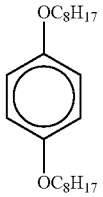

The addition amount of the compound represented by any one of formulae (E-1) to (E-3) that can be preferably used in the present invention, is preferably in the range of from 10 mole % to 100 mole %, more preferably in the range of from 20 mole % to 80 mole %, especially preferably in the range of from 30 mole % to 60 mole %, to the dye-forming coupler, respectively.

The compounds represented by any one of formulae (E-1) to (E-3) can be synthesized by the methods described in JP-A-53-17729, JP-A-53-20327, JP-A-54-145530, JP-A-55-21004, and JP-A-56-159644, or according to these methods.

The compound represented by any one of formulae (E-1), (E-2) and (E-3) for use in the present invention may be used solely or in combination with two or more kinds of the compounds. Further, in the photosensitive material containing the dye-forming coupler represented by formula (I), the layer to which the compound represented by any one of formulae (E-1) to (E-3) for use in the present invention is added may be different from, or identical to a layer incorporating therein the dye-forming coupler represented by formula (I). It is preferred that the compound represented by any one of formulae (E-1) to (E-3) and the dye-forming coupler represented by formula (I) for use in the present invention are added to the identical layer.

The above compound represented by any one of formulae (E-1) to (E-3) for use in the present invention, if used in combination with the compound represented by formula (I) and the compound represented by formula (Ph) mentioned above, enables to further improve image fastness after processing.

Further, in the photosensitive material containing the dye-forming coupler represented by any one of formulae (M-I) to (M-X), the layer to which the compound represented by any one of formulae (E-1) to (E-3) is added may be different from, or identical to a layer incorporating therein the dye-forming coupler represented by any one of formulae (M-I) to (M-X). It is preferred that the compound represented by any one of formulae (E-1) to (E-3) and the dye-forming coupler represented by any one of formulae (M-I) to (M-X) for use in the present invention are added to the identical layer.

Next, a compound represented by any one of formulae (TS-I) to (TS-VII), a metal complex, a ultraviolet ray absorbing agent, and a water-insoluble homopolymer or copolymer, each of which can be preferably used in the present invention, are explained in detail below.

In the present invention, preferably in the first embodiment of the present invention, in addition to the combination use of the compound represented by formula (TS-II) and the compound represented by formula (Ph), it is also preferable to further use:

(i) the compound represented by any one of formulae (E-1) to (E-3); and/or (ii) at least one selected from the group consisting of the compound represented by formula (TS-I), (TS-III), (TS-IV), (TS-V), (TS-VI) or (TS-VII), a metal complex, a ultraviolet absorbing agent, and a water-insoluble homopolymer or copolymer.

Further, in the present invention, preferably in the second embodiment of the present invention, in addition to the use of the compound represented by formula (Ph), it is also preferable to further use:

(i) the compound represented by any one of formulae (E-1) to (E-3); and/or (ii) at least one selected from the group consisting of the compound represented by any one of formulae (TS-I) to (TS-VII), a metal complex, a ultraviolet absorbing agent, and a water-insoluble homopolymer or copolymer.

First, the compounds represented by any one of formulae (TS-I) to (TS-VII) are explained in detail below.

Formula (TS-I)

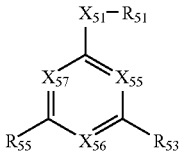

Formula (TS-II)

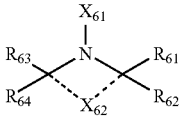

Formula (TS-III)

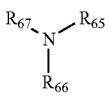

Formula (TS-IV)

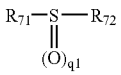

Formula (TS-V)

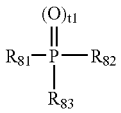

-continued

Formula (TS-VI)

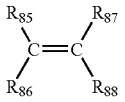

Formula (TS-VII)

The compound represented by formula (TS-I) is described in more detail.

In formula (TS-I), $R_{51}$ represents a hydrogen atom, an aliphatic group (e.g., methyl, i-propyl, s-butyl, dodecyl, methoxyethyl, allyl, benzyl), an aryl group (e.g., phenyl, p-methoxyphenyl), a heterocyclic group (e.g., 2-tetrahydrofuryl, pyranyl), an acyl group (e.g., acetyl, pivaroyl, benzoyl, acryloyl), an aliphatic oxycarbonyl group (e.g., methoxycarbonyl, hexadecyloxycarbonyl), an aryloxycarbonyl group (e.g., phenoxycarbonyl, p-methoxy phenoxycarbonyl), an aliphatic sulfonyl group (e.g., methane sulfonyl, butane sulfonyl), an aryl sulfonyl group (e.g., benzene sulfonyl, p-toluene sulfonyl), a phosphoryl group (e.g., diethyl phosphoryl, diphenyl phosphoryl, diphenoxy phosphoryl), or —$Si(R_{58})(R_{59})(R_{60})$. $R_{58}$, $R_{59}$, and $R_{60}$, which may be the same or different from each other, each independently represent an aliphatic group (e.g., methyl, ethyl, t-butyl, benzyl, allyl), an aryl group (e.g., phenyl), an aliphatic oxy group (e.g., methoxy, butoxy), or an aryloxy group (e.g., phenoxy).

$X_{51}$, represents —O— or —$N(R_{57})$—, in which $R_{57}$ has the same meaning as $R_{51}$. $X_{55}$ represents —N═ or —$C(R_{52})$═, $X_{56}$ represents —N═ or —$C(R_{54})$═, $X_{57}$ represents —N═ or —$C(R_{56})$═. $R_{52}$, $R_{53}$, $R_{54}$, $R_{55}$, and $R_{56}$ each independently represent a hydrogen atom, or a substituent. As the preferable substituent exemplified are an aliphatic group (e.g., methyl, t-butyl, t-hexyl, benzyl), an aryl group (e.g., phenyl), an aliphatic oxycarbonyl group (e.g., methoxycarbonyl, dodecyloxycarbonyl), an aryloxycarbonyl group (e.g., phenoxycarbonyl), an aliphatic sulfonyl group (e.g., methane sulfonyl, butane sulfonyl), an aryl sulfonyl group (e.g., benzene sulfonyl, p-hydroxybenzene sulfonyl), or —$X_{51}$—$R_{51}$.

However, all of $R_{51}$ to $R_{57}$ cannot simultaneously represent hydrogen atoms, respectively, and the total number of carbon atoms in each of these groups is generally 10 or more (preferably 10 to 50), and more preferably 16 or more (preferably 16 to 40).

Further, in the first and second embodiments of the present invention, the compound represented by formula (TS-I) is neither identical to the compound represented by formula (Ph) nor the compound represented by any one of formulae (E-1) to (E-3). In other words, both the compound represented by formula (Ph) and the compound represented by any one of formulae (E-1) to (E-3) are excluded from the compound represented by formula (TS-I).

In the third embodiment of the present invention, the compound represented by formulae (TS-I) is neither identical to the compound represented by formula (Ph-1), (Ph-3) or (Ph-4), nor the compound represented by any one of formulae (E-1) to (E-3).

The compound represented by formula (TS-I) for use in the present invention includes those compounds represented by any of, for example, formula (I) of JP-B-63-50691 ("JP-B" means examined Japanese patent publication), for mula (IIIa), (IIIb), or (IIIc) of JP-B-2-37575, formula of JP-B-2-50457, formula of JP-B-5-67220, formula (IX) of JP-B-5-70809, formula of JP-B-6-19534, formula (I) of JP-A-62-227889, formula (I) or (II) of JP-A-62-244046, formula (I) or (II) of JP-A-2-66541, formula (II) or (III) of JP-A-2-139544, formula (I) of JP-A-2-194062, formula (B), (C), or (D) of JP-A-2-212836, formula (III) of JP-A-3-200758, formula (II) or (III) of JP-A-3-48845, formula (B), (C), or (D) of JP-A-3-266836, formula (I) of JP-A-3-969440, formula (I) of JP-A-4-330440, formula (I) of JP-A-5-297541, formula of JP-A-6-130602, formula (1), (2), or (3) of International Patent Application Publication WO 91/11749, formula (I) of German Patent Publication DE4, 008,785A1, formula (II) of U.S. Pat. No. 4,931,382, formula (a) of European Patent No. 203,746B1, formula (I) of European Patent No. 264,730B1, and formula (III) of JP-A-62-89962. These compounds can be synthesized according to the methods described in these publications, or general methods described in *Shin Jikken Kagaku Koza*, Vol. 14 (Maruzen Co., Ltd.) (1977, 1978).

From the viewpoint of the effects of the present invention, the compound represented by formula (TS-I) is preferably any of those compounds represented by any one of formulae (TS-ID), (TS-IE), (TS-IF), (TS-IG), and (TS-1H) shown below.

Formula (TS-ID)

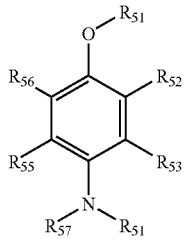

Formula (TS-IE)

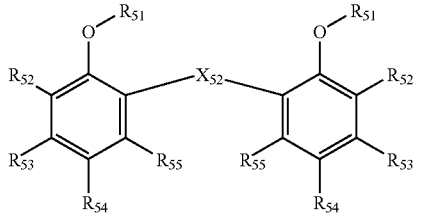

Formula (TS-IF)

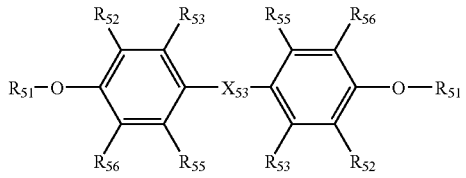

Formula (TS-IG)

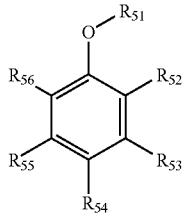

-continued

Formula (TS-IH)

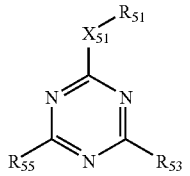

In formulae (TS-ID) to (TS-1H), $R_{51}$, $R_{52}$, $R_{53}$, $R_{54}$, $R_{55}$, $R_{56}$, $R_{57}$, and $X_{51}$ have the same meanings as those defined in formula (TS-I). $X_{52}$ and $X_{53}$ each independently represent a divalent linking group. Examples of the divalent linking group include an alkylene group, an oxy group, and a sulfonyl group. In the formulae, the same symbols in the same molecule may be the same or different in meanings.

The compound represented by any one of formulae (TS-ID) to (TS-IG) is neither identical to the compound represented by formula (Ph) nor the compound represented by any one of formulae (E-1) to (E-3).

As to the compounds represented by any one of formulae (TS-ID) to (TS-IH), the groups thereon preferable in view of the effects of the present invention are described below.

In formula (TS-ID), preferable is the case where $R_{51}$ is a hydrogen atom, an aliphatic group, an acyl group, an aliphatic oxycarbonyl group, an aryl oxycarbonyl group, or a phosphoryl group, and $R_{52}$, $R_{53}$, $R_{55}$, and $R_{56}$ each independently are a hydrogen atom, an aliphatic group, an aliphatic oxy group, or an acyl amino group. More preferable is the case where $R_{51}$ is an aliphatic group, and $R_{52}$, $R_{53}$, $R_{55}$, and $R_{56}$ may be the same or different, and each independently are a hydrogen atom, or an aliphatic group. In formulae (TS-IE), (TS-IF), and (TS-IG), preferable is the case where $R_{51}$ is a hydrogen atom, an aliphatic group, an acyl group, an aliphatic oxycarbonyl group, an aryl oxycarbonyl group, or a phosphoryl group, and $R_{52}$, $R_{53}$, $R_{55}$, and $R_{56}$ each independently are a hydrogen atom, an aliphatic group, an aliphatic oxy group, or an acyl amino group, and $R_{54}$ is an aliphatic group, a carbamoyl group, or an acyl amino group, and $X_{52}$ and $X_{53}$ each independently are an alkylene group or an oxy group. More preferable is the case where $R_{51}$ is a hydrogen atom, an aliphatic group, an acyl group, or a phosphoryl group, and $R_{52}$, $R_{53}$, $R_{55}$, and $R_{56}$ may be the same or different, and each independently are a hydrogen atom, an aliphatic group, an aliphatic oxy group, or an acyl amino group, and $R_{54}$ is an aliphatic group, or a carbamoyl group, and $X_{52}$ and $X_{53}$ each independently are —$CHR_{158}$—($R_{158}$ is an alkyl group). In formula (TS-IH), preferable is the case where $R_{51}$ is an aliphatic group, an aryl group, or a heterocyclic group, and $R_{53}$ and $R_{55}$ each independently are an aliphatic oxy group, an aryloxy group, or a heterocyclic oxy group. More preferable is the case where $R_{51}$ is an aryl group, or a heterocyclic group, and $R_{53}$ and $R_{55}$ each independently are an aryloxy group, or a heterocyclic oxy group.

From the point of the effects of the present invention, the compounds represented by formula (TS-I) are preferably the compounds represented by formula (TS-IE) or (TS-IG).

The compound represented by formula (TS-II) is described in detail below.

In formula (TS-II), $R_{61}$, $R_{62}$, $R_{63}$, and $R_{64}$ each independently are a hydrogen atom, or an aliphatic group (e.g., methyl, ethyl, preferably an alkyl group), $X_{61}$ represents a hydrogen atom, an aliphatic group (e.g., methyl, ethyl, allyl), an aliphatic oxy group (e.g., methoxy, octyloxy, cyclohexyloxy), an aliphatic oxycarbonyl group (e.g., methoxycarbonyl, hexadecyl oxycarbonyl), an aryloxycarbonyl group (e.g., phenoxycarbonyl, p-chlorophenoxycarbonyl), an acyl group (e.g., acetyl, pivaloyl, methacryloyl), an acyloxy group (e.g., acetoxy, benzoyloxy), an aliphatic oxycarbonyloxy group (e.g., methoxycarbonyloxy, octyloxycarbonyloxy), an aryloxycarbonyloxy group (e.g., phenoxycarbonyloxy), an aliphatic sulfonyl group (e.g., methane sulfonyl, butane sulfonyl), an aryl sulfonyl group (e.g., benzene sulfonyl, p-toluene sulfonyl), an aliphatic sulfinyl group (e.g., methane sulfinyl, octane sulfinyl), an arylsulfinyl group (e.g., benzene sulfinyl, p-toluene sulfinyl), a sulfamoyl group (e.g., dimethylsulfamoyl), a carbamoyl group (e.g., dimethylcarbamoyl, diethylcarbamoyl), a hydroxyl group, or an oxy radical group. $X_{62}$ represents a group of non-metal atoms necessary to form a 5- to 7-membered ring (e.g., piperidine ring, piperazine ring). The total number of carbon atoms of the compound represented by formula (TS-II) is 8 or more (preferably 8 to 60).

The compound represented by formula (TS-II) for use in the present invention include those compounds represented by, for example, formula (I) of JP-B-2-32298, formula (I) of JP-B-3-39296, formula of JP-B-3-40373, formula (I) of JP-A-2-49762, formula (II) of JP-A-2-208653, formula (III) of JP-A-2-217845, formula (B) of U.S. Pat. No. 4,906,555, formula of European Patent Publication EP309,400A2, formula of European Patent Publication EP309,401A1, and formula of European Patent Publication EP309,402A1. These compounds can be synthesized according to the methods described in these publications or general methods described in *Shin Jikken Kagaku Koza*, Vol. 14 (Maruzen Co., Ltd.) (1977, 1978).

As to the compound represented by formula (TS-II), the groups thereon preferable from the point of the effects of the present invention are described below. From the point of the effects of the present invention, $R_{61}$, $R_{62}$, $R_{63}$ and $R_{64}$ each are preferably an aliphatic group, and more preferably a methyl group. From the point of the effects of the present invention, $X_{61}$ is preferably a hydrogen atom, an aliphatic group, an aliphatic oxy group, an acyl group, an acyloxy group, or an oxyradical group; more preferably a hydrogen atom, an aliphatic group, an aliphatic oxy group, an acyl group, or an oxyradical group; and most preferably an aliphatic group, or an aliphatic oxy group. From the point of the effects of the present invention, $X_{62}$ forms preferably a 6-membered ring, more preferably a piperidine ring. From the point of the effects of the present invention, the compound represented by formula (TS-II) is preferably in an embodiment where $R_{61}$, $R_{62}$, $R_{63}$, and $R_{64}$ each are a methyl group, $X_{61}$ is a hydrogen atom, an aliphatic group, an aliphatic oxy group, an acyl group, or an oxy radical group, and $X_{62}$ forms a 6-membered ring; and more preferably in an embodiment where $R_{61}$, $R_{62}$, $R_{63}$, and $R_{64}$ each are a methyl group, $X_{61}$ is an aliphatic group, or an aliphatic oxy group, and $X_{62}$ forms a piperidine ring.

The amount to be added of the compound represented by formula (TS-II) for use in the present invention, preferably in the first embodiment of the present invention, is preferably 0.5 to 200 mol %, more preferably 1 to 100 mol %, especially preferably 1 to 50 mol %, to the dye-forming coupler.

The compound represented by formula (TS-III) is described in more detail below.

In formula (TS-III), $R_{65}$ and $R_{66}$ each independently represent a hydrogen atom, an aliphatic group (e.g., methyl, ethyl, t-butyl, octyl, methoxyethyl), an aryl group (e.g., phenyl, 4-methoxyphenyl), an acyl group (e.g., acetyl, pivaloyl, methacryloyl), an aliphatic oxycarbonyl group (e.g., methoxycarbonyl, hexadecyl oxycarbonyl), an aryloxycarbonyl group (e.g., phenoxycarbonyl), a carbamoyl group (e.g., dimethylcarbamoyl, phenylcarbamoyl), an aliphatic sulfonyl group (e.g., methane sulfonyl, butane sulfonyl), or an aryl sulfonyl group (e.g., benzene sulfonyl). $R_{67}$ represents a hydrogen atom, an aliphatic group (e.g., methyl, ethyl, t-butyl, octyl, methoxyethyl), an aliphatic oxy group (e.g., methoxy, octyloxy), an aryloxy group (e.g., phenoxy, p-methoxyphenoxy), an aliphatic thio group (e.g., methylthio, octylthio), an arylthio group (e.g., phenylthio, p-methoxyphenylthio), an acyloxy group (e.g., acetoxy, pivaloyloxy), an aliphatic oxycarbonyloxy group (e.g., methoxycarbonyloxy, octyloxycarbonyloxy), an aryloxycarbonyloxy group (e.g., phenoxycarbonyl oxy), a substituted amino group (the substituent may be any one that is able to substitute for the hydrogen atom(s) on the amino group, e.g., amino groups substituted with a substituent such as an aliphatic group, an aryl group, an acyl group, an aliphatic sulfonyl group or an arylsulfonyl group), a heterocyclic group (e.g., a piperidine ring, a thiomorpholine ring), or a hydroxyl group. If possible, each combination of $R_{65}$ and $R_{66}$, $R_{66}$ and $R_{67}$, and $R_{65}$ and $R_{67}$ combine together to form a 5- to 7-membered ring (e.g. a morpholine ring and a pyrazolidine ring), but they never form a 2,2,6,6-tetraalkylpiperidine ring. In addition, both $R_{65}$ and $R_{66}$ are not hydrogen atoms at the same time. Further, the total number of carbon atoms of the compound represented by formula (TS-III) is generally 7 or more (preferably 7 to 50).

The compound represented by formula (TS-III) for use in the present invention include compounds represented by, for example, formula (I) of JP-B-6-97332, formula (I) of JP-B-6-97334, formula (I) of JP-A-2-148037, formula (I) of JP-A-2-150841, formula (I) of JP-A-2-181145, formula (I) of JP-A-3-266836, formula (IV) of JP-A-4-350854, and formula (I) of JP-A-5-61166. These compounds can be synthesized according to the methods described in these publications or general methods described in *Shin Jikken Kagaku Koza*, Vol. 14 (Maruzen Co., Ltd.) (1977, 1978).

From the point of the effects of the present invention, the compounds represented by formula (TS-III) are preferably the compounds represented by any one of formulae (TS-IIIA), (TS-IIIB), (TS-IIIC), and (TS-IIID) shown below.

Formula (TS-IIIA)

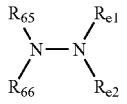

Formula (TS-IIIB)

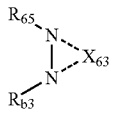

Formula (TS-IIIC)

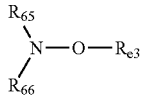

Formula (TS-IIID)

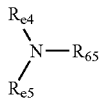

In formulae (TS-IIIA) to (TS-IIID), $R_{65}$ and $R_{66}$ each have the same meanings as those defined in formula (TS-III). $R_{e1}$, $R_{e2}$, $R_{e3}$ and $R_{e5}$ each independently have the same meaning as $R_{65}$. $R_{e4}$ represents a hydrogen atom, an aliphatic group (e.g., octyl, dodecyl, 3-phenoxypropyl), or an aryl group (e.g., phenyl, 4-dodecyloxyphenyl). $X_{63}$ represents a group of non-metal atoms necessary, together with the —N—N—, to form a 5- to 7-membered ring, such as a pyrazolidine ring and a pyrazoline ring.

As to the compounds represented by any one of formulae (TS-IIIA) to (TS-IIID), the groups thereon preferable from the point of the effects of the present invention are described below. In formula (TS-IIIA), preferable is the case where $R_{65}$ and $R_{e1}$ each independently represent a hydrogen atom, an aliphatic group, or an aryl group, and $R_{66}$ and $R_{e2}$ each independently represent an aliphatic group, an aryl group, or an acyl group; and more preferable is the case where $R_{65}$ and $R_{e1}$ each independently represent an aliphatic group, and $R_{66}$ and $R_{e2}$ each independently represent an aliphatic group, an aryl group, or an acyl group. In formula (TS-IIIB), preferable is the case where $R_{65}$ represents a hydrogen atom, an aliphatic group, an aryl group, an acyl group, or an aliphatic oxycarbonyl group, $R_{e3}$ represents an aliphatic group, an aryl group, or an acyl group, and $X_{63}$ represents a group of non-metal atoms necessary to form a 5-membered ring; and more preferable is the case where $R_{65}$ represents a hydrogen atom, or an aliphatic group, and $R_{e3}$ represents an aliphatic group, or an aryl group, and $X_{63}$ represents a group of non-metal atoms that forms a pyrazolidine ring. In formula (TS-IIIC), preferable is the case where $R_{65}$ and $R_{66}$ each independently represent a hydrogen atom, an aliphatic group, an aryl group, an acyl group, an aliphatic oxycarbonyl group, or an aryl oxycarbonyl group, and $R_{e3}$ represents a hydrogen atom, an aliphatic group, or an acyl group; and more preferable is the case where $R_{65}$ and $R_{66}$ each independently represent an aliphatic group, an acyl group, or an aliphatic oxycarbonyl group, and $R_{e3}$ represents a hydrogen atom, an aliphatic group, or an acyl group. In formula (TS-IIID), preferable is the case where $R_{65}$ represents a hydrogen atom, an aliphatic group, an aryl group, an acyl group, or a carbamoyl group, $R_{e5}$ represents an aliphatic group, or an aryl group, and $R_{e4}$ represents an aliphatic group, or an aryl group; and more preferable is the case where $R_{65}$ represents an aliphatic group, an aryl group, an acyl group, or a carbamoyl group, $R_{e5}$ represents an aliphatic group, or an aryl group, and $R_{e4}$ represents an aliphatic group, or an aryl group.

From the point of the effects of the present invention, the compounds represented by formula (TS-III) are more preferably those compounds represented by any one of formulae (TS-IIIB), (TS-IIIC), and (TS-IIID), and most preferably those compounds represented by formula (TS-IIIB), or (TS-IIIC).

The compound represented by formula (TS-IV) is described in more detail below.

In formula (TS-IV), $R_{71}$ and $R_{72}$ each independently represent an aliphatic group (e.g., methyl, methoxycarbonylethyl, dodecyloxycarbonyl ethyl, benzyl), an aryl group (e.g., phenyl, 4-octyloxyphenyl, 2-butoxy-5-(t)octylphenyl), or a heterocyclic group (e.g., 2-pyridyl, 2-pyrimidyl). Further, $R_{71}$ represents a hydrogen atom, Li, Na, or K. $R_{71}$ and $R_{72}$ may combine together to form a 5- to 7-membered ring, such as a tetrahydrothiophene ring and a thiomorpholine ring. q1 represents 0, 1, or 2. In the above, the total number of carbon atoms of $R_{71}$, and $R_{72}$ is 10 or more, preferably 10 to 60.

The compound represented by formula (TS-IV) for use in the present invention include compounds represented by, for example, formula (I) of JP-B-2-44052, formula (T) of JP-A-3-48242, formula (A) of JP-A-3-266836, formula (I), (II) or (III) of JP-A-5-323545, formula (I) of JP-A-6-148837, formula (I) of U.S. Pat. No. 4,933,271, and formula (I) of U.S. Pat. No. 4,770,987. These compounds can be synthesized according to the methods described in these publications or general methods described in *Shin Jikken Kagaku Koza*, Vol. 14 (Maruzen Co., Ltd.) (1977, 1978).

From the point of the effects of the present invention, in formula (TS-IV), q1 is preferably 0 or 2. When q1 is 0, it is preferable that $R_{71}$ and $R_{72}$ each independently represent an aliphatic group, or an aryl group, or that $R_{71}$ and $R_{72}$ combine together to form a 6-membered ring. When q1 is 2, it is preferable that $R_{71}$ represents a hydrogen atom, Na, K, an aliphatic group, or an aryl group, and $R_{72}$ represents an aliphatic group, or an aryl group; it is more preferable that $R_{71}$ represents a hydrogen atom, Na, or K, and $R_{72}$ represents an aryl group.

The compound represented by formula (TS-V) is described in more detail below.

In formula (TS-V), $R_{81}$ $R_{82}$, and $R_{83}$ each independently represent an aliphatic group (e.g., methyl, ethyl, t-octyl, allyl), an aryl group (e.g., phenyl, 4-t-butylphenyl, 4-vinylphenyl), an aliphatic oxy group (e.g., methoxy, t-octyloxy), an aryloxy group (e.g., phenoxy, 2,4-di-t-butylphenoxy), an aliphatic amino group (e.g., butyl amino, dibutyl amino), or an arylamino group (e.g., anilino, 4-methoxyanilino, N-methylanilino), and t1 represents 0 or 1. Each combination of $R_{81}$ and $R_{82}$, and $R_{81}$ and $R_{83}$ may combine together to form a 5- to 8-membered ring. The number of total carbon atoms of $R_{81}$, $R_{82}$, and $R_{83}$ is 10 or more (preferably 10 to 50).

The compound represented by formula (TS-V) for use in the present invention include compounds represented by, for example, formula (I) of JP-A-3-25437, formula (I) of JP-A-3-142444, formula of U.S. Pat. No. 4,749,645, and formula of U.S. Pat. No. 4,980,275. These compounds can be synthesized according to the methods described in these publications or general methods described in *Shin Jikken Kagaku Koza*, Vol. 14 (Maruzen Co., Ltd.) (1977, 1978).

In formula (TS-V), from the point of the effects of the present invention, preferable is the case where t1 is 1 and $R_{81}$, $R_{82}$ and $R_{83}$ each independently represent an aliphatic group, an aryl group, an aliphatic oxy group, an aryloxy, or an arylamino group (more preferably at least one of $R_{81}$, $R_{82}$, and $R_{83}$ is an aliphatic group, an aryl group, an aliphatic oxy group, or an aryloxy group). Also preferable is the case where $R_{81}$ and $R_{82}$ combine together to form an 8-membered ring. More preferable is the case where t1 is 1, and $R_{81}$, $R_{82}$, and $R_{83}$ each independently represent an aryl group, an aliphatic oxy group, or an aryloxy group (more preferably at least one of $R_{81}$, $R_{82}$, and $R_{83}$ is an aryl group, or an aryloxy group).

The compound represented by formula (TS-VI) is described in more detail below.

In formula (TS-VI), $R_{85}$, $R_{86}$, $R_{87}$, and $R_{88}$ each independently represent a hydrogen atom or a substituent (e.g., an aliphatic group, an aryl group, an aliphatic oxycarbonyl group, an aryl oxycarbonyl group, a phosphoryl group, an acyl amino group, or a carbamoyl group). However, all of $R_{85}$, $R_{86}$, $R_{87}$, and $R_{88}$ cannot simultaneously represent hydrogen atoms, respectively. Any two of $R_{85}$, $R_{86}$, $R_{87}$, and $R_{88}$ may combine together to form a 5- to 7-membered ring (e.g., a cyclohexene ring, a cyclohexane ring), however the ring is not an aromatic ring consisting only of carbon atoms. The total number of carbon atoms of the compound represented by formula (TS-VI) is 10 or more (preferably 10 to 50).

The compound represented by formula (TS-VI) for use in the present invention include compounds represented by, for example, formula (I) of U.S. Pat. No. 4,713,317, formula (I) of JP-A-8-44017, formula (I) of JP-A-8-44018, formula (I) of JP-A-8-44019, formula (I) or (II) of JP-A-8-44020, formula (I) of JP-A-8-44021 and formula (I) or (II) of JP-A-8-44022. These compounds can be synthesized according to the methods described in these publications or general methods described in *Shin Jikken Kagaku Koza*, Vol. 14 (Maruzen Co., Ltd.) (1977, 1978).

From the point of the effects of the present invention, the compounds represented by formula (TS-VI) are preferably the compounds represented by any one of formulae (TS-VIA), (TS-VIB), and (TS-VIC).

Formula (TS-VIA)

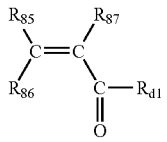

Formula (TS-VIB)

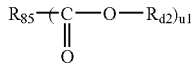

Formula (TS-VIC)

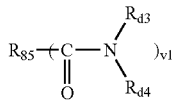

In formulae (TS-VIA), (TS-VIB) and (TS-VIC), $R_{85}$, $R_{86}$, and $R_{87}$ each have the same meanings as defined in formula (TS-VI). $R_{d1}$ represents an aliphatic group (e.g., methyl, butyl, (t-)butyl, dodecyl), an aliphatic oxy group (e.g., methoxy, butoxy, (t-)butoxy, dodecyloxy, allyloxy), an aryloxy group (e.g., phenoxy, 2,4,6-trimethylphenoxy), an aliphatic amino group (e.g., methyl amino, allyl amino, diallylamino), or an arylamino group (e.g., anilino, N-methylanilino). $R_{d2}$ and $R_{d3}$ each independently represent an alkenyl group (e.g., vinyl, allyl, oleyl). $R_{d4}$ represents a hydrogen atom, an aliphatic group (e.g., methyl, allyl, vinyl, octyl), or an aryl group (e.g., phenyl, naphthyl, 4-vinylphenyl). u1 and v1 each independently represent 1, 2 or 3.

As to the compounds represented by any one of formulae (TS-VIA) to (TS-VIC), the groups thereon preferable from the point of the effects of the present invention are described below. In formula (TS-VIA), preferable is the case where $R_{85}$, $R_{86}$, and $R_{87}$ each independently represent a hydrogen atom, or an aliphatic group, and $R_{d1}$ is an aliphatic oxy group, an aliphatic amino group, or an arylamino group; and more preferable is the case where $R_{85}$, $R_{86}$ and $R_{87}$ each independently represent a hydrogen atom, or an aliphatic group, and $R_{d1}$ is an aliphatic oxy group, or an aliphatic amino group. In formula (TS-VIB), preferable is the case where $R_{85}$ is an aliphatic group or an aryl group, $R_{d2}$ is an alkenyl group, and u1 is 1, 2 or 3; and more preferable is the case where $R_{85}$ is an aliphatic group or an aryl group, $R_{d2}$ is an alkenyl group, and u1 is 2 or 3. In formula (TS-VIC), preferable is the case where $R_{85}$ is an aliphatic group or an aryl group, $R_{d3}$ is an alkenyl group, $R_{d4}$ is a hydrogen atom, or an aliphatic group, and v1 is 1, 2 or 3; and more preferable is the case where $R_{85}$ is an aliphatic group or an aryl group, $R_{d3}$ is an alkenyl group, $R_{d4}$ is a hydrogen atom, or an alkenyl group, and v1 is 2 or 3.

From the point of the effects of the present invention, the compounds represented by formula (TS-VI) are preferably the compounds represented by formula (TS-VIA) or (TS-VIB), and most preferably the compounds represented by formula (TS-VIA).

The compounds represented by formula (TS-VII) are explained below.

$R_{91}$ represents an aliphatic or aromatic hydrophobic group having the total number of carbon atoms of 10 or more (preferably from 10 to 50, more preferably from 10 to 32). Examples of preferable aliphatic hydrophobic groups include an alkyl group having 1 to 32 carbon atoms, an alkenyl group having 2 to 32 carbon atoms, an alkynyl group having 2 to 32 carbon atoms, a cycloalkyl group having 3 to 32 carbon atoms and a cycloalkenyl group having 3 to 32 carbon atoms. The above alkyl group, alkenyl group and alkynyl group each may be straight-chain or branched. Further, each of these aliphatic groups may have a substituent(s).

Examples of aromatic hydrophobic groups include an aryl group (for example, phenyl) and an aromatic heterocyclic group (for example, pyridyl, furyl). Further, each of these aromatic groups may have a substituent.

$R_{91}$ is preferably an alkyl group or an aryl group.

As the substituent with which the aliphatic or aromatic group represented by $R_{91}$ may be substituted, there is no particular limitation, but as a preferable substituent, for example, there are illustrated an alkoxy group, an aryloxy group, an acyl group, an acyloxy group, an alkoxycarbonyl group, an aryloxycarbonyl group, a carbamoyl group, a sulfamoyl group, an acylamino group and an amino group. An aliphatic group is more preferred.

$Y_{91}$ represents a monovalent organic group containing an alcoholic hydroxyl group. $Y_{91}$ is preferably a monovalent organic group represented by formula [AL] set forth below.

$$Y_{92}\text{-}(L_{92})m_{92}\text{-} \qquad \text{Formula [AL]}$$

In the formula, $Y_{92}$ represents a group from a compound in which a hydrogen atom is removed from at least one of hydroxyl groups in a polyhydric alcohol. $L_{92}$ represents a divalent linking group. $m_{92}$ is 0 or 1.

The polyhydric alcohol from which a hydrogen atom is removed to form a group represented by $Y_{92}$, is preferably glycerol, polyglycerol, pentaerythritol, trimethylolpropane, neopentylglycol, sorbitan, sorbide, sorbitol, sugars, and the like. The divalent linking group represented by $L_{92}$ is preferably —C(=O)— or —$SO_2$—.

Preferable compounds in another embodiment of the compounds represented by formula (TS-VII) are compounds in which $R_{91}$ represents an aliphatic group having carbon atoms of 12 or more (preferably alkyl or alkenyl groups having 12 to 32 carbon atoms) and $Y_{91}$ represents an OH group.

The metal complex for use in the present invention is explained below.

The metal complex for use in the present invention, is preferably those having Cu, Co, Ni, Pd, or Pt as a central metal, and more preferably those having Ni as a central metal. It is preferable that they are low in solubility to water. Specifically, the solubility at room temperature is preferably 50% or less, more preferably 25% or less, and furthermore preferably 10% or less. The category of a preferable compound can also be defined in terms of total number of carbon atoms of the whole compound. Specifically, the compound has carbon atoms preferably in the range of 15 to 65, more preferably in the range of 20 to 60, furthermore preferably in the range of 25 to 55, and most preferably in the range of 30 to 50, in total.

The metal complex for use in the present invention may have any kind of ligand. Dithiolate-series metal complexes and salicylaldoxime-series metal complexes are preferable, and salicylaldoxime-series metal complexes are more preferable.

As the metal complex for use in the present invention, there are many known metal complexes, including dithiolate-series nickel complexes and salicylaldoxime-series nickel complexes, which are effective. Preferable examples include compounds represented, for example, by, formula (I) of JP-B-61-13736, formula (I) of JP-B-61-13737, formula (I) of JP-B-61-13738, formula (I) of JP-B-61-13739, formula (I) of JP-B-61-13740, formula (I) of JP-B-61-13742, formula (I) of JP-B-61-13743, formula (I) of JP-B-61-13744, formula of JP-B-5-69212, formula (I) or (II) of JP-B-5-88809, formula of JP-A-63-199248, formula (I) or (II) of JP-A-64-75568, formula (I) or (II) of JP-A-3-182749, formula (II), (III), (IV) or (V) of U.S. Pat. No. 4,590,153, or formula (II), (III), or (IV) of U.S. Pat. No. 4,912,027.

As the metal complex, the compound represented by formula (TS-VIIIA) is preferable from the point of the effects of the present invention.

Formula (TS-VIIIA)

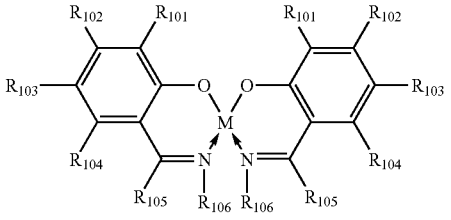

In formula (TS-VIIIA), $R_{101}$, $R_{102}$, $R_{103}$, and $R_{104}$ each independently represent a hydrogen atom or a substituent (e.g., an aliphatic group, an aliphatic oxy group, an aliphatic sulfonyl group, an aryl sulfonyl group, an acyl amino group). $R_{105}$ represents a hydrogen atom, an aliphatic group (e.g., methyl, ethyl, vinyl, undecyl), or an aryl group (e.g., phenyl, naphthyl). $R_{106}$ represents a hydrogen atom, an aliphatic group (e.g., methyl, ethyl), an aryl group (e.g., phenyl, 4-methylphenyl), or a hydroxyl group. M represents Cu, Co, Ni, Pd, or Pt. Two $R_{106}$s may combine together to form a 5- to 7-membered ring. $R_{101}$ and $R_{102}$, $R_{102}$ and $R_{103}$, $R_{103}$ and $R_{104}$, and $R_{104}$ and $R_{105}$, each two of which are adjacent to each other, may combine together to form a 5- to 6-membered ring.

In formula (TS-VIIIA), it is preferable from the point of the effects of the present invention that $R_{101}$, $R_{102}$, $R_{103}$, and $R_{104}$ each independently represent a hydrogen atom, an aliphatic group, or an aliphatic oxy group, $R_{105}$ is a hydrogen atom, $R_{106}$ is a hydrogen atom, an aliphatic group, or a hydroxyl group, and M is Ni; and it is more preferable that $R_{101}$, $R_{102}$, $R_{103}$, and $R_{104}$ each independently represent a hydrogen atom, or an aliphatic oxy group, $R_{105}$ is a hydrogen atom, $R_{106}$ is a hydroxyl group, and M is Ni.

An ultraviolet absorbing agent for use in the present invention is explained below.

The ultraviolet absorbing agent for use in the present invention is not particularly limited, so long as the compound has the maximum absorption wavelength (λmax) at 400 nm or less. The compounds represented by any of formulae (A), (B), (C), (D) and (E) are preferred.

Formula (A)

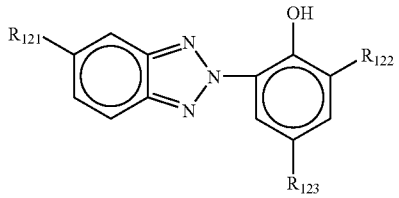

In the formula, $R_{121}$ represents a hydrogen atom, a halogen atom, an alkyl group, or an alkoxy group. $R_{122}$ and $R_{123}$ each independently represent a hydrogen atom, a substituted or unsubstituted alkyl group, or a substituted or unsubstituted aryl group.

Preferably, $R_{121}$ represents a hydrogen atom, a halogen atom (for example, Cl, Br), an alkyl group having 1 to 5 carbon atoms (for example, methyl, ethyl, butyl), or an alkoxy group having 1 to 4 carbon atoms (for example, methoxy, butoxy). $R_{122}$ and $R_{123}$, which may be the same or different from each other, each represent a hydrogen atom, a substituted or unsubstituted alkyl group having 1 to 20 carbon atoms (for example, methyl, ethyl, sec-butyl, tert-butyl, tert-octyl, dodecyl, carboxyethyl, n-octyloxycarbonylethyl), or a substituted or unsubstituted aryl group having 6 to 12 carbon atoms (for example, phenyl, p-chlorophenyl, p-methoxyphenyl).

Formula (B)

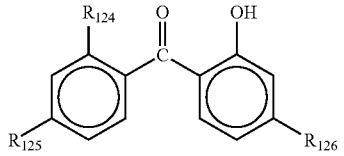

In the formula, $R_{124}$, $R_{125}$ and $R_{126}$, which may be the same or different from each other, each represent a hydrogen atom, an alkoxy group having 1 to 12 carbon atoms (for example, methoxy, ethoxy, dodecyloxy), or a hydroxyl group.

Formula (C)

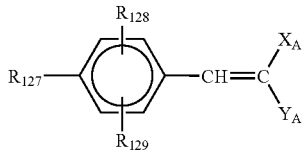

In the formula, $R_{127}$ represent a hydroxyl group, an alkoxy group, or an alkyl group. $R_{128}$ and $R_{129}$ each independently represent a hydrogen atom, a hydroxyl group, an alkoxy group, or an alkyl group. $R_{128}$ and $R_{127}$, or $R_{129}$ and $R_{127}$ may adjoin each other to form a 5- or 6-membered ring. $X_A$ and $Y_A$, which may be the same or different from each other, each represent CN, —$COR_{140}$, —$COOR_{140}$, —$SO_2R_{140}$, —$CON(R_{140})(R_{141})$, or —COOH. $R_{140}$ and $R_{141}$ each independently represent an alkyl group or an aryl group. $R_{141}$ may be a hydrogen atom.

Preferably, $R_{127}$ represents a hydroxyl group, an alkoxy group having 1 to 6 carbon atoms (for example, methoxy, ethoxy, n-butoxy), or an alkyl group having 1 to 6 carbon atoms (for example, methyl, ethyl, t-butyl, iso-propyl). $R_{128}$ and $R_{129}$ each represent a hydrogen atom, a hydroxyl group, an alkoxy group or an alkyl group, in which the alkoxy group and the alkyl group each have the same meanings as in $R_{127}$. $R_{128}$ and $R_{127}$, or $R_{129}$ and $R_{127}$ may adjoin each other to form a 5- or 6-membered ring (for example, methylenedioxy ring). $X_A$ and $Y_A$, which may be the same or different from each other, each represent —CN, —$COR_{140}$, —$COOR_{140}$, —$SO_2R_{140}$, —$CON(R_{140})$ $(R_{141})$, or —COOH. $R_{140}$ and $R_{141}$ each represent a substituted or unsubstituted alkyl group having 1 to 16 carbon atoms (for example, methyl, ethyl, methoxyethyl, n-hexyl, phenoxyethyl) or a substituted or unsubstituted aryl group having 6 to 12 carbon atoms (for example, phenyl, p-chlorophenyl, p-methylphenyl, p-tert-butylphenyl). $R_{141}$ may be a hydrogen atom.

Formula (D)

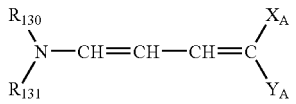

In the formula, $R_{130}$ and $R_{131}$ each independently represent a hydrogen atom, an alkyl group, an alkenyl group, or an aryl group. $R_{130}$ and $R_{131}$ may be the same or different from each other, but they cannot be a hydrogen atom at the same time. Further, a 5- or 6-membered ring may be formed by $R_{130}$ and $R_{131}$ together with the N. $X_A$ and $Y_A$ have the same meanings as defined in formula (C).

Preferably, $R_{130}$ and $R_{131}$, each represent a hydrogen atom, a substituted or unsubstituted alkyl group having 1 to 12 carbon atoms (for example, methyl, ethyl, t-butyl, n-dodecyl, methoxyethyl, ethoxyethyl), an alkenyl group having 3 to 6 carbon atoms, or an aryl group (for example, phenyl, tolyl, p-chlorophenyl, p-methoxyphenyl). $R_{130}$ and $R_{131}$ may be the same or different from each other, but they can not be a hydrogen atom at the same time. Further, a 5- or 6-membered ring, e.g. a piperidine ring or a morpholine ring, may be formed by $R_{130}$ and $R_{131}$ together with the N. $X_A$ and $Y_A$ have the same meanings as mentioned in formula (C).

Formula (E)

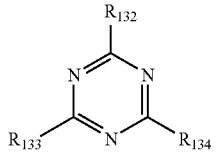

In the formula, $R_{132}$, $R_{133}$ and $R_{134}$ each independently represent a substituted or unsubstituted alkyl group, aryl group, alkoxyl group, aryloxy group, or heterocyclic group, in which at least one of the above $R_{132}$, $R_{133}$ and $R_{134}$ is represented by formula (F) set forth below.

Formula (F)

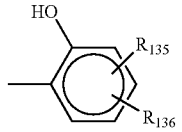

In the formula, $R_{135}$ and $R_{136}$ each independently represent a hydrogen atom, a halogen atom, or a substituted or unsubstituted alkyl group, cycloalkyl group, aryl group, alkoxyl group or aryloxy group.

Examples of specific compounds of the compound represented by any one of formulae (TS-I) to (TS-VII), the metal complex, and the ultraviolet absorbing agent are set forth below, but the present invention is not limited to these compounds.

(TI-1)

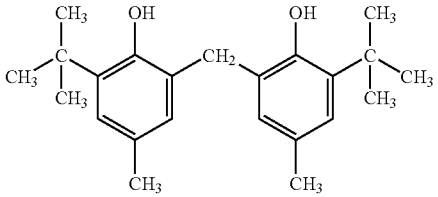

(TI-2)

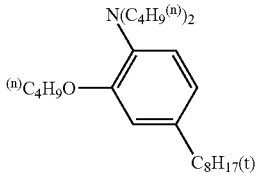

(TI-3)

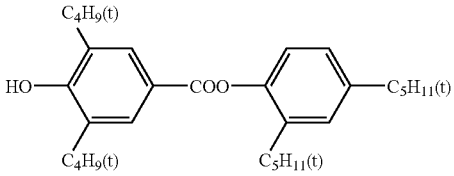

(TI-4)

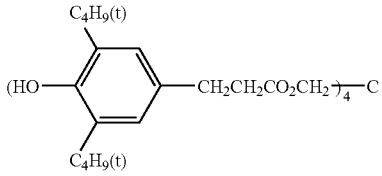

(TI-5)

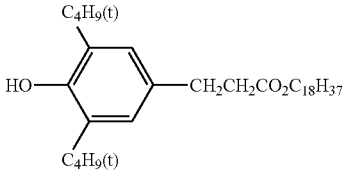

(TI-6)

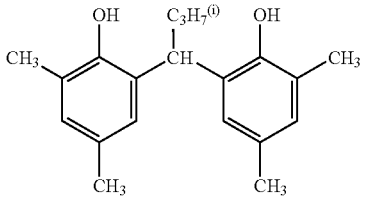

-continued
(TI-7)
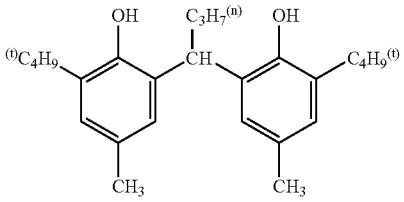
(TI-8)
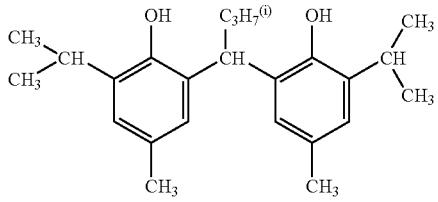
(TI-9)
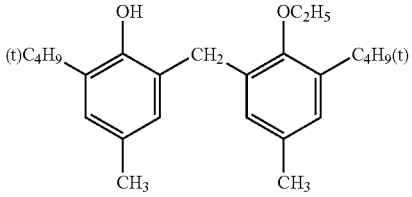
(TI-10)
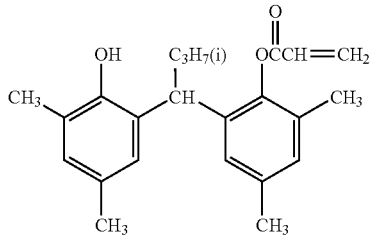
(TI-11)
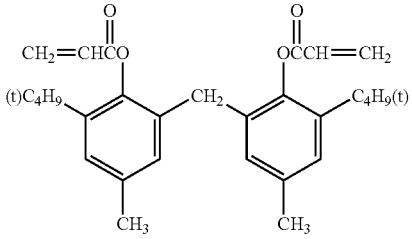
(TI-12)
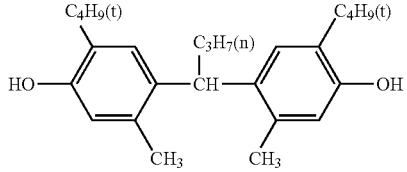
(TI-13)
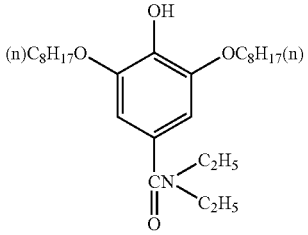
(TI-14)
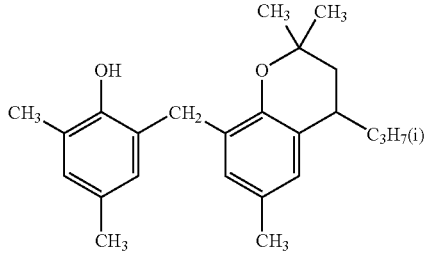
(TI-15)
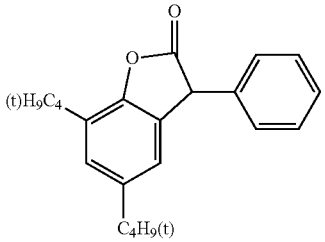
(TI-16)
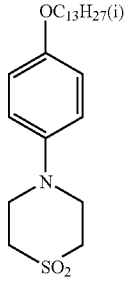
(TI-17)
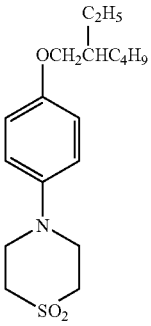
(TI-18)
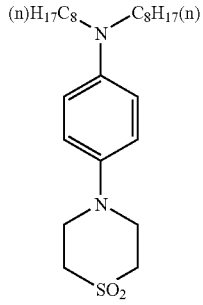

-continued
(TI-19)
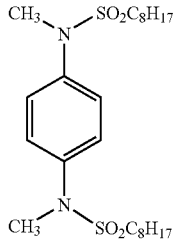
(TI-20)
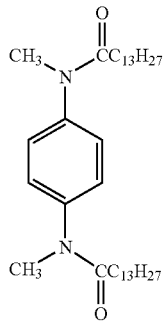
(TI-21)
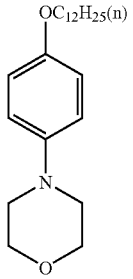
(TI-22)
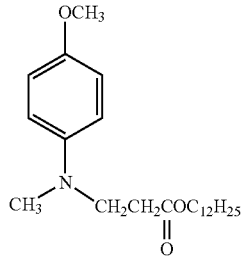
(TI-23)
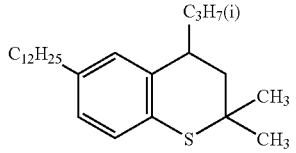
(TI-24)
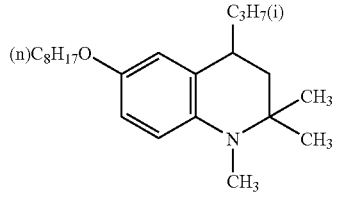
(TI-25)
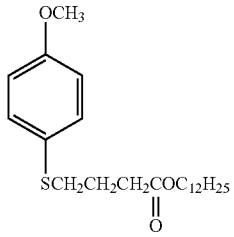
(TI-26)
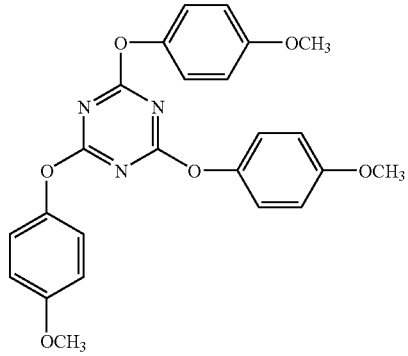
(TI-27)
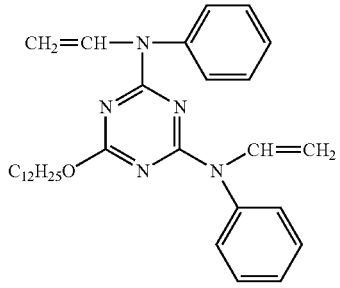
(TI-28)
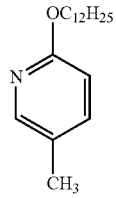

-continued
(TI-29)
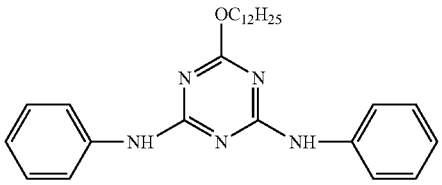
(TI-30)
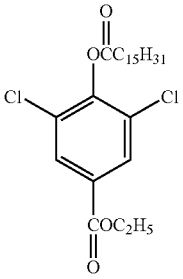
(TI-31)
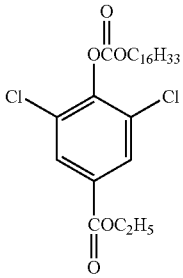
(TI-32)
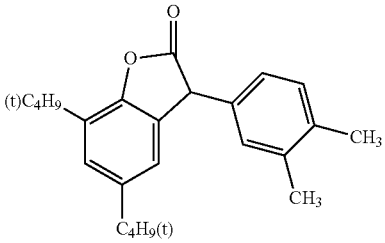
(TI-33)
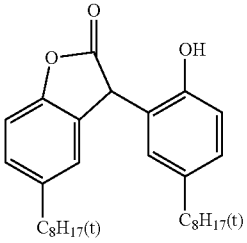
(TI-34)
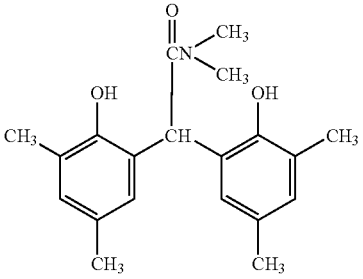
(TII-1)
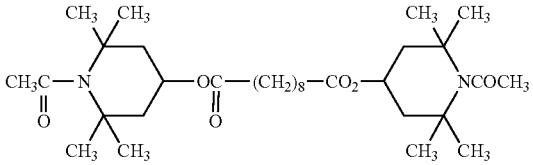
(TII-2)
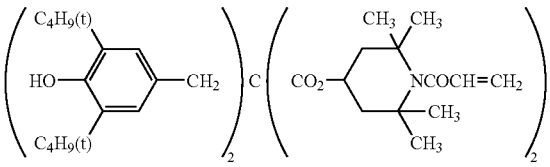
(TII-3)
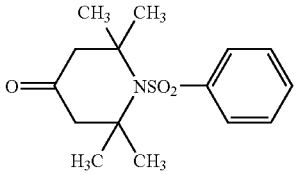
(TII-4)
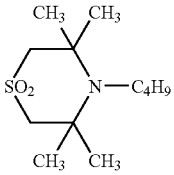
(TII-5)
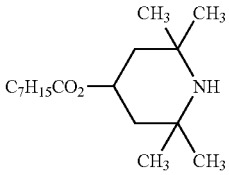
(TII-6)
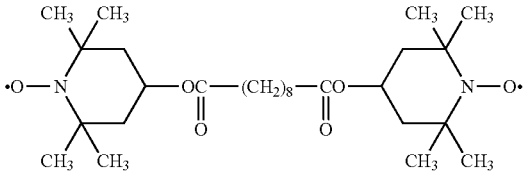

-continued
(TII-7)
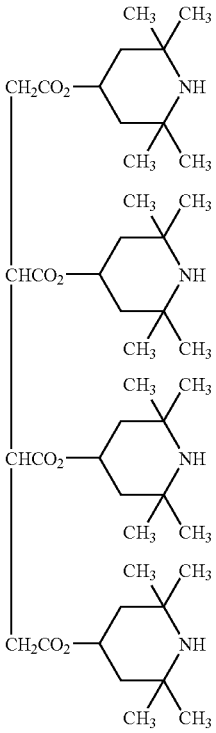
(TII-8)
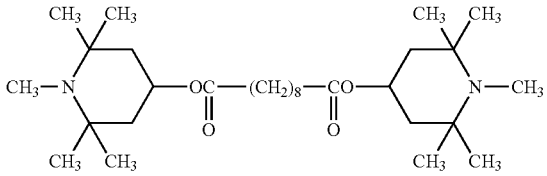
(TII-9)
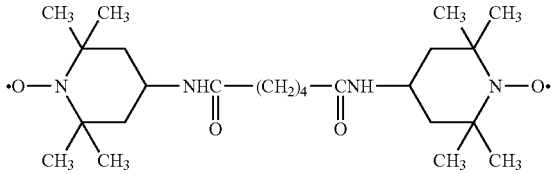
(TII-10)
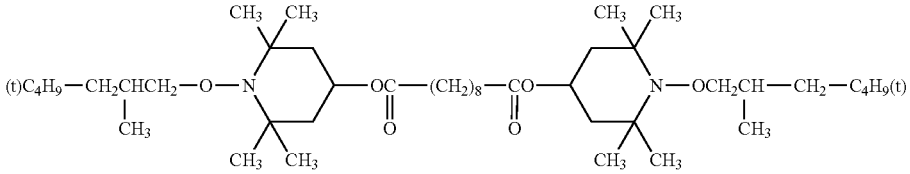
(TII-11)
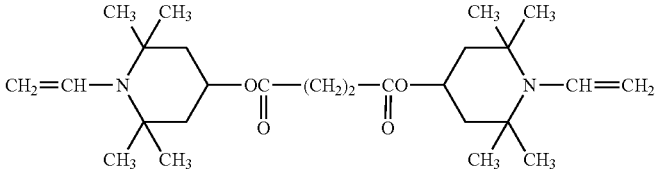
(TII-12)
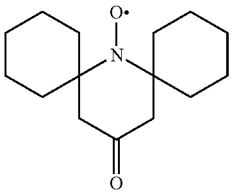
(TII-13)
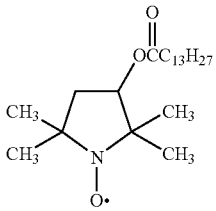

-continued
(TII-14)
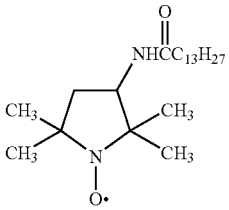
(TII-15)
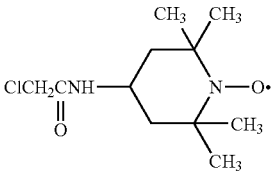
(TII-16)
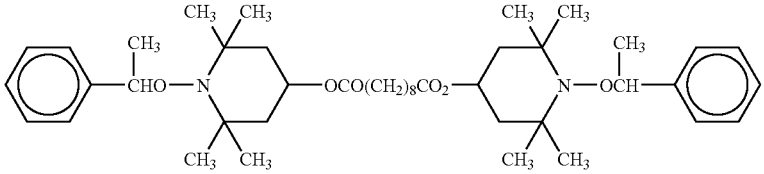
(TII-17)
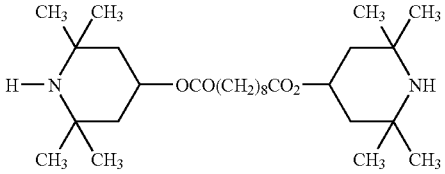
(TII-18)
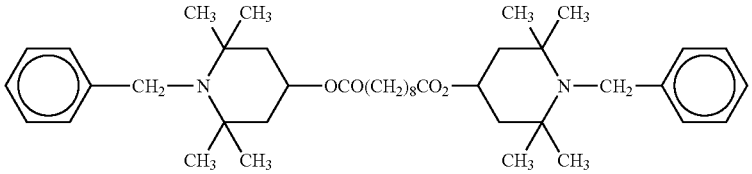
(TII-19)
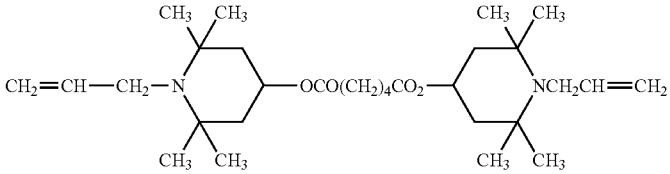
(TII-20)
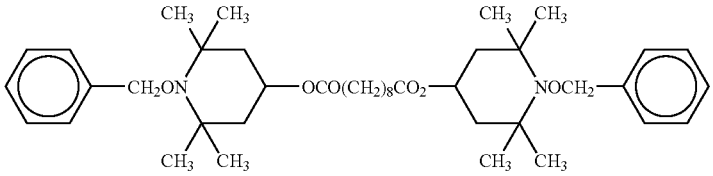
(TII-21)
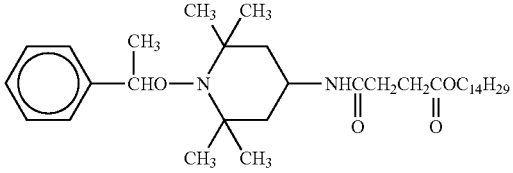
(TII-22)
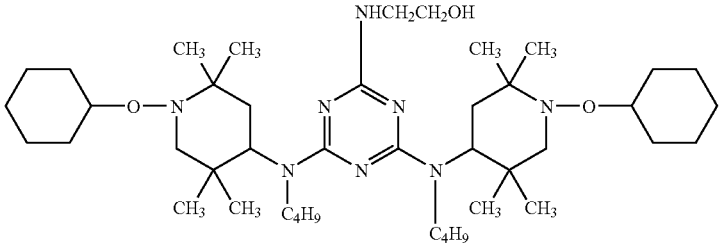

-continued
(TII-23)
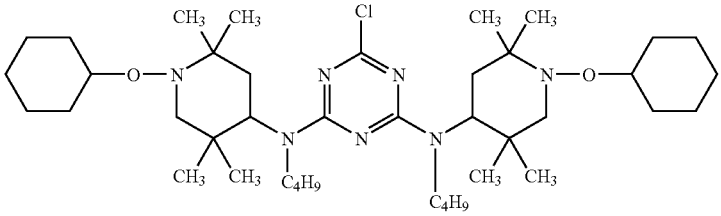
(TII-24)
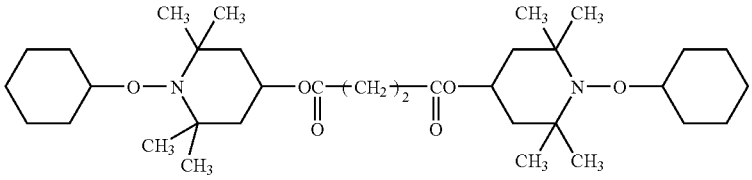
(TII-25)
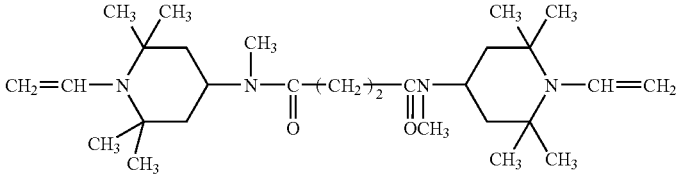
(TII-26)
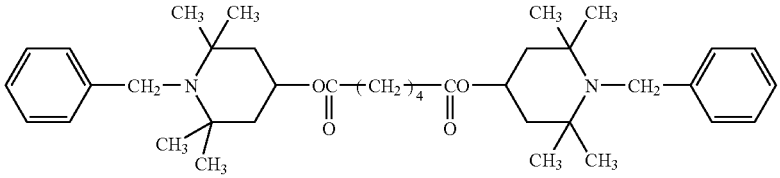
(TII-27)
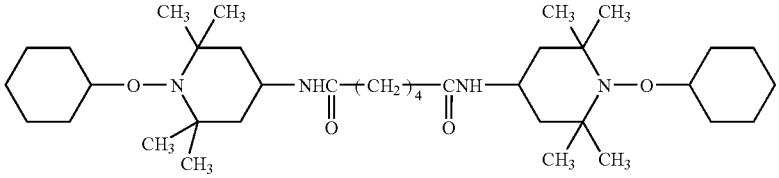
(TII-28)
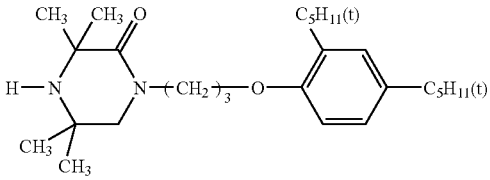
(TII-29)
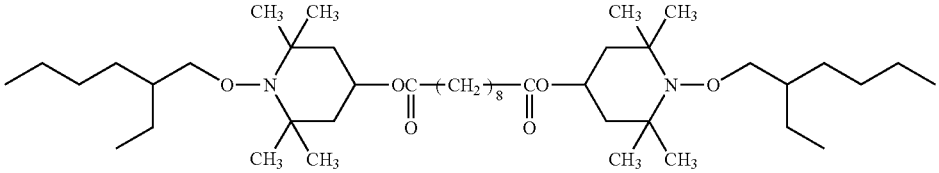
(TII-30)
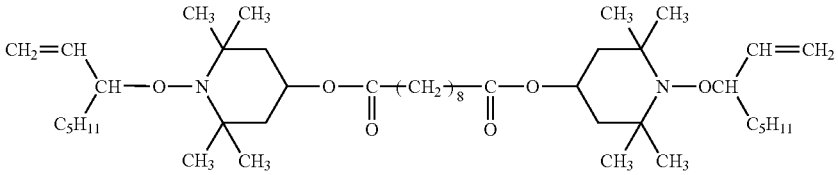

-continued
(TII-31)
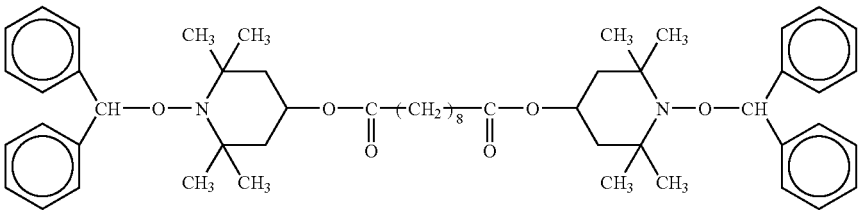
(TII-32)
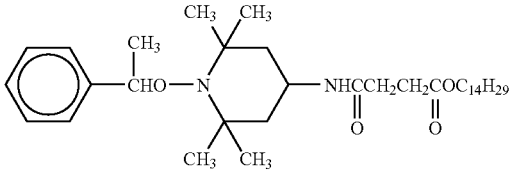
(TII-33)
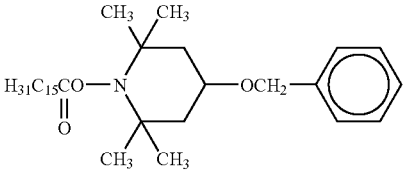
(TII-34)
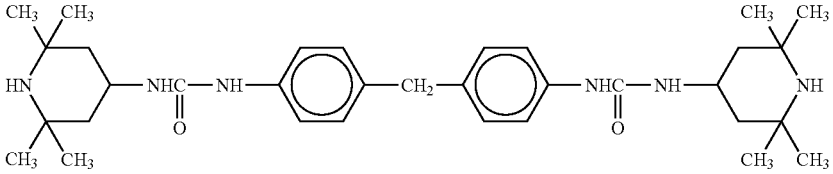
(TII-35)
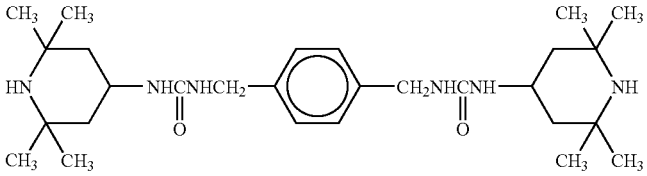
(TII-36)
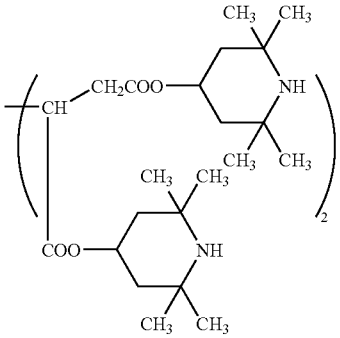
(TII-37)
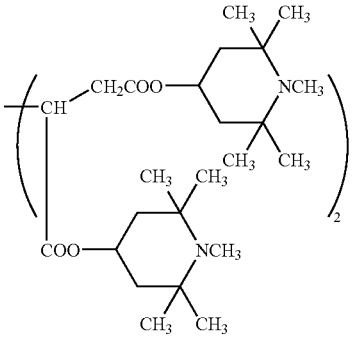
(TII-38)
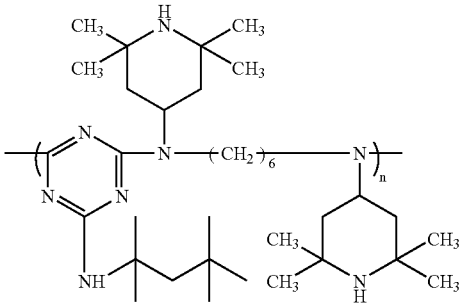
(TII-39)
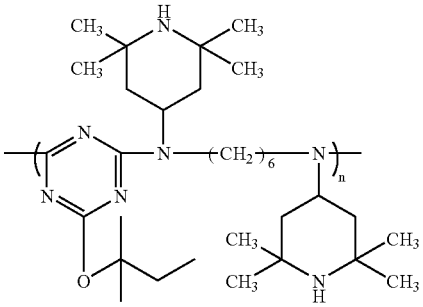

-continued
(TII-40)
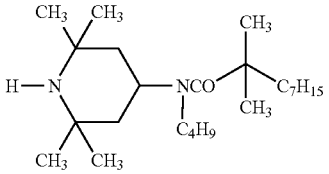
(TII-41)
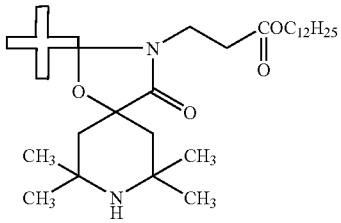
(TII-42)
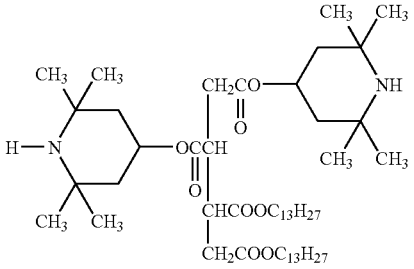
(TII-43)
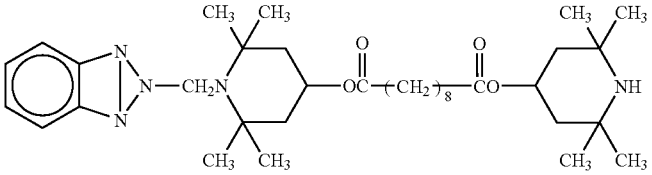
(TIII-1)
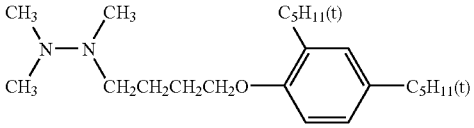
(TIII-2)
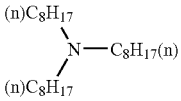
(TIII-3)
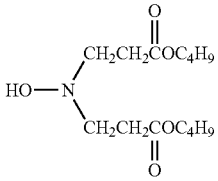
(TIII-4)
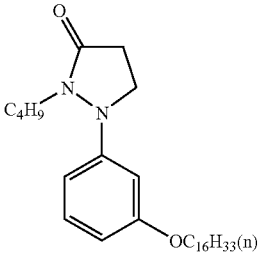
(TIII-5)
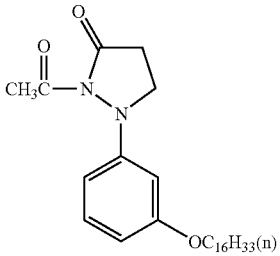
(TIII-6)
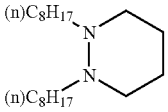
(TIII-7)
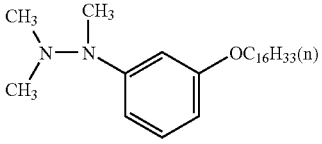
(TIII-8)
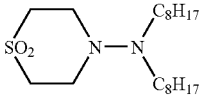

-continued
(TIII-9)
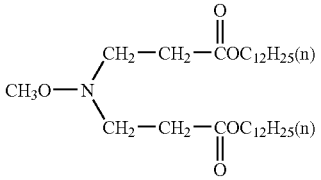
(TIII-10)
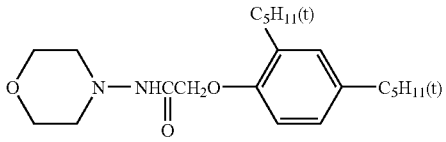
(TIII-11)
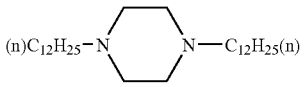
(TIII-12)
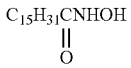
(TIII-13)
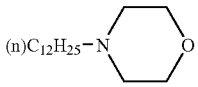
(TIII-14)
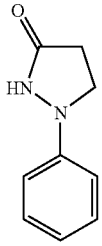
(TIII-15)
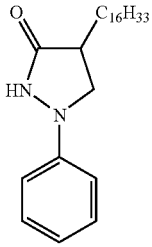
(TIII-16)
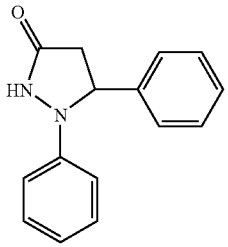
(TIII-17)
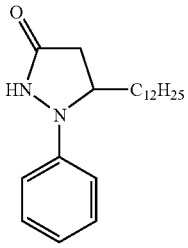
(TIII-18)
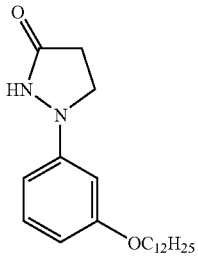
(TIII-19)
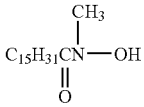
(TIII-20)
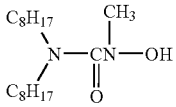
(TIII-21)
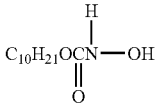
(TIV-1)
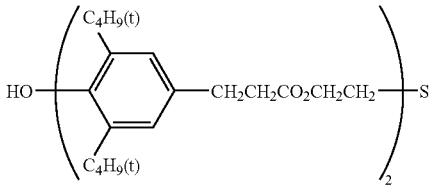
(TIV-2)
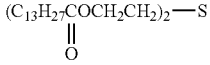
(TIV-3)
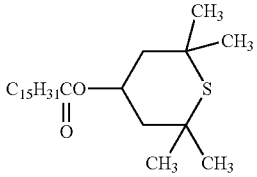

-continued
(TIV-4)
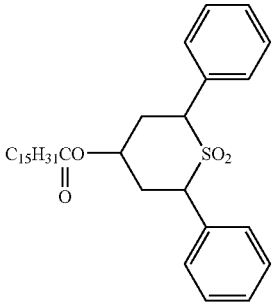
(TIV-5)
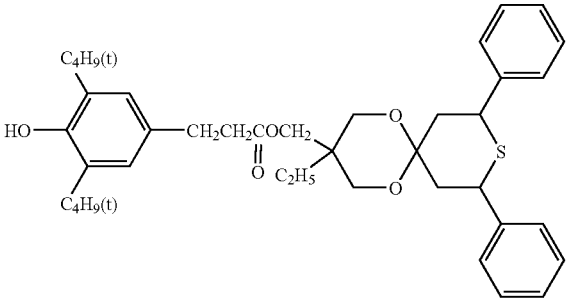
(TIV-6)
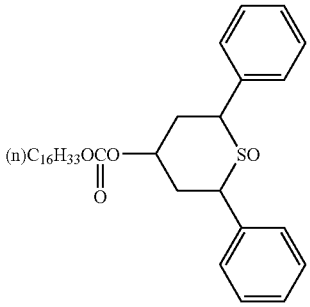
(TIV-7)
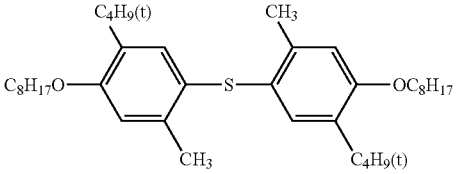
(TIV-8)
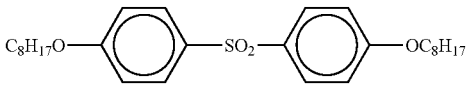
(TIV-9)
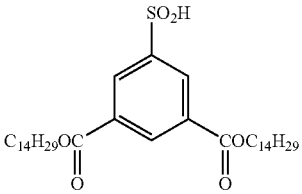
(TIV-10)
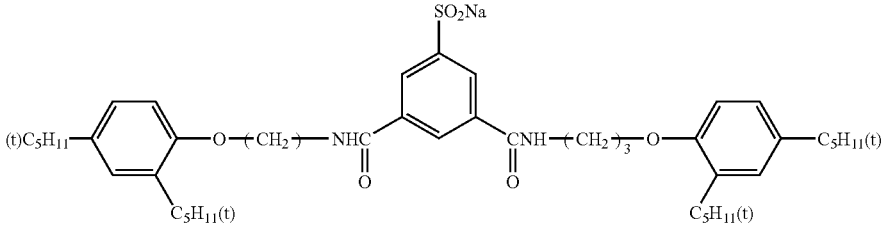
(TIV-11)
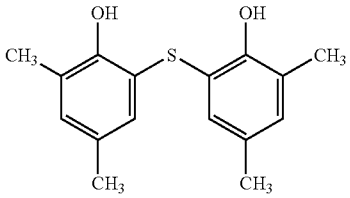
(TIV-12)
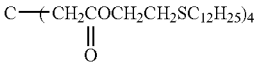
(TIV-13)
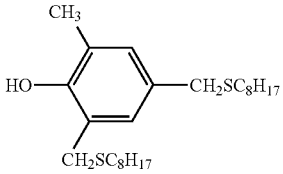
(TIV-14)
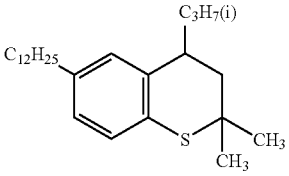

-continued
(TIV-15)
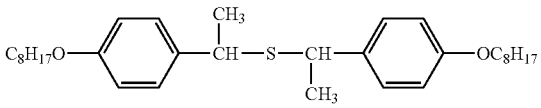
(TIV-16)
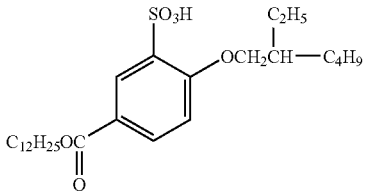
(TV-1)
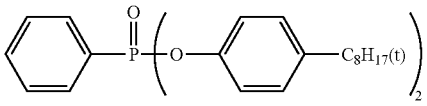
(TV-2)
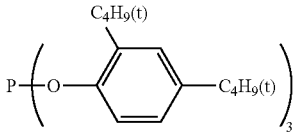
(TV-3)
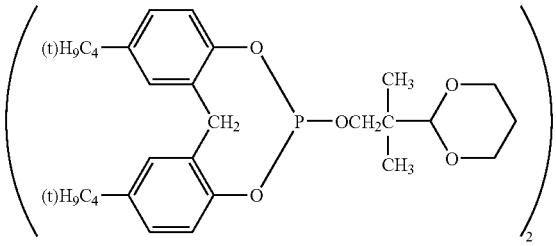
(TV-4)
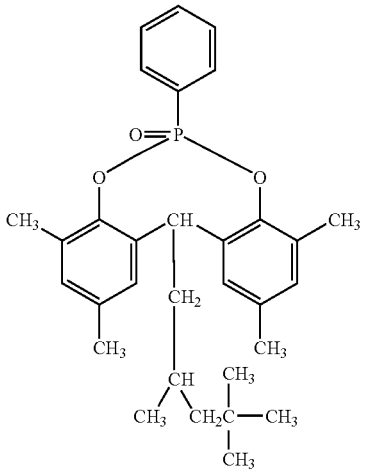
(TV-5)
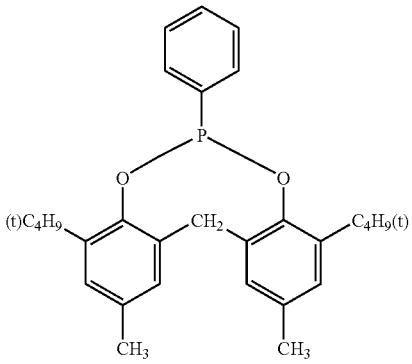
(TV-6)
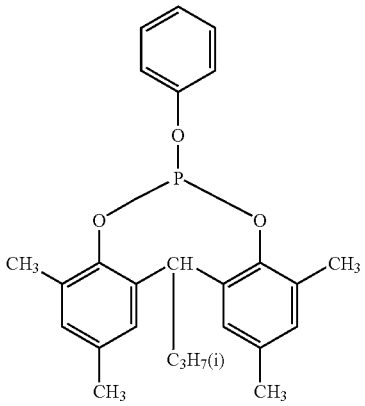
(TV-7)
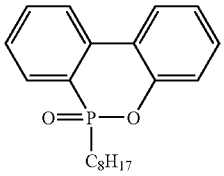
(TV-8)
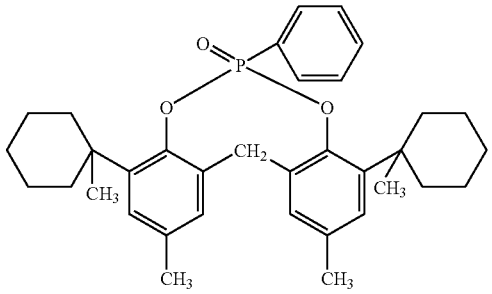

-continued
(TV-9)
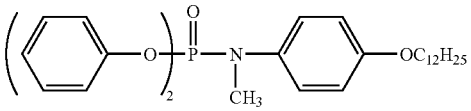
(TV-10)
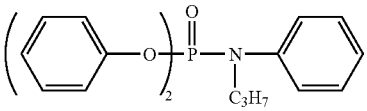
(TV-11)
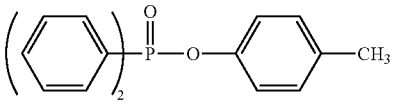
(TV-12)
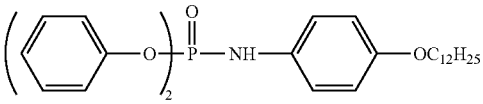
(TV-13)
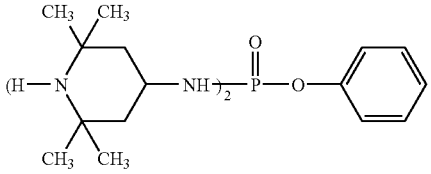
(TV-14)
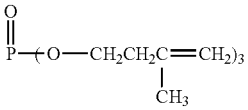
(TV-15)
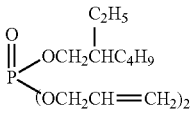
(TV-16)
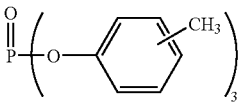
(TV-17)
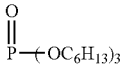
(TVI-1)
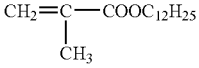
(TVI-2)
(TVI-3)
(TVI-4)
(TVI-5)
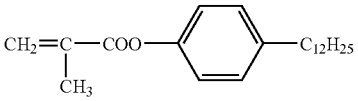
(TVI-6)
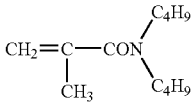
(TVI-7)
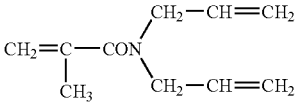
(TVI-8)
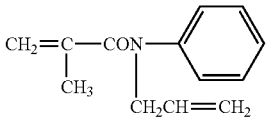
(TVI-9)
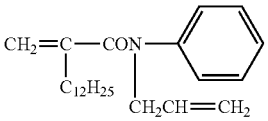
(TVI-10)
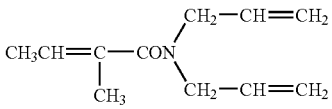
(TVI-11)
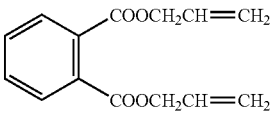
(TVI-12)
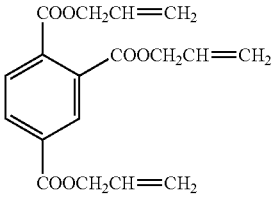
(TVI-13)
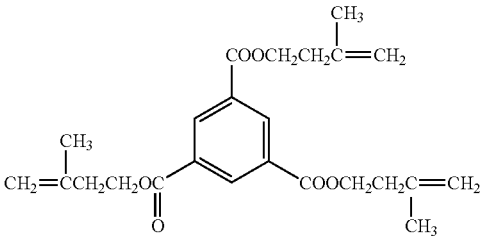
(TVI-14)
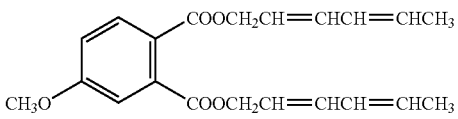
(TVI-15)
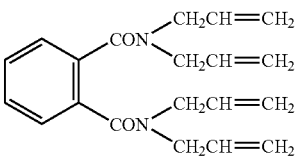

-continued
(TVI-16)
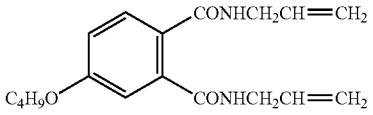
(TVI-17)
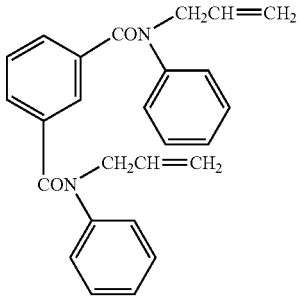
(TVI-18)
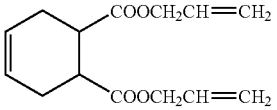
(TVI-19)
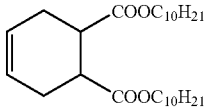
(TVI-20)
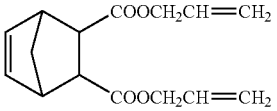
(TVI-21)
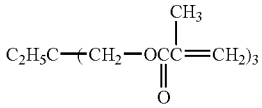
(TVI-22)
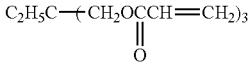
(TVI-23)
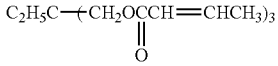
(TVI-24)
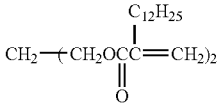
(TVI-25)
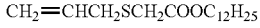
(TVI-26)
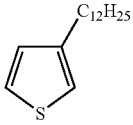
(TVI-27)
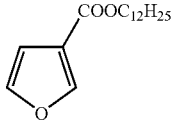
(TVI-28)
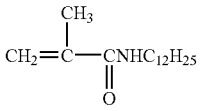
(TVI-29)
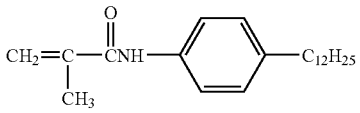
(TVI-30)
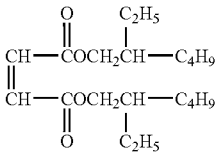
TVII-1
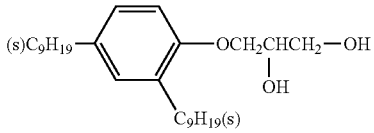
TVII-2
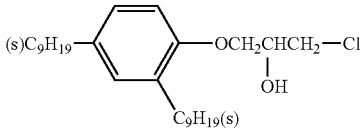
TVII-3
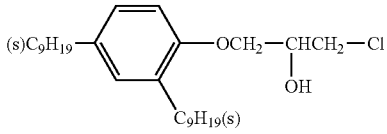
TVII-4
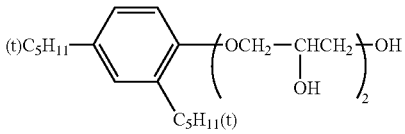
TVII-5
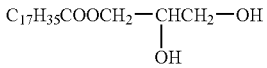
TVII-6
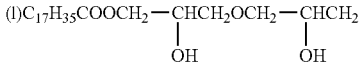
TVII-7
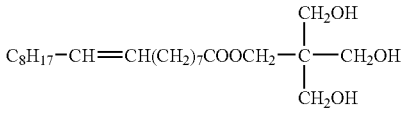

-continued

TVII-8

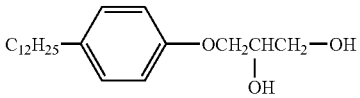

TVII-9

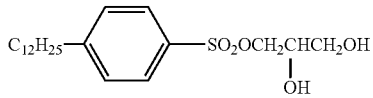

TVII-10

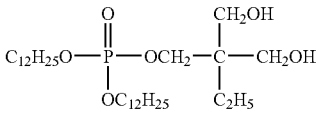

TVII-11 Diglyceryl diisostearate

TVII-12 Pentaerythritol dioleate

TVII-13 Tetraglyceryl tristearate

TVII-14 Decaglyceryl pentaoleate

TVII-15 Sorbitan monooleate

TVII-16 Sorbitan sesquioleate

TVII-17 Sorbitan trioleate

TVII-18 Sorbitan monostearate

TVII-19 $C_8H_{17}CH{=}CH(CH_2)_8OH$

TVII-20

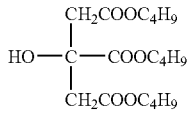

TVII-21 $C_{12}H_{25}OH$

TVII-22 $C_{14}H_{29}OH$

TVII-23 $C_{16}H_{33}OH$

TVII-24 $C_{18}H_{37}OH$

TVII-25 $C_{20}H_{41}CH$

TVIII-1

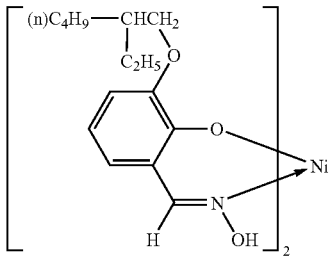

(TVIII-2)

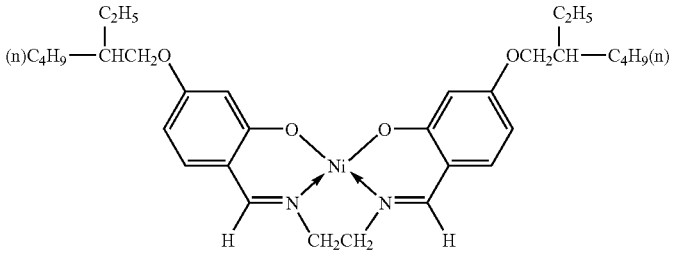

TVIII-3

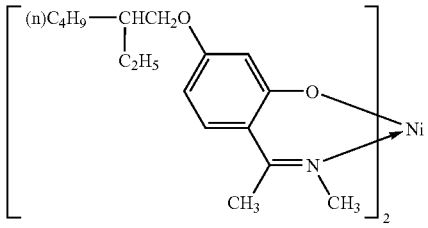

TVIII-4

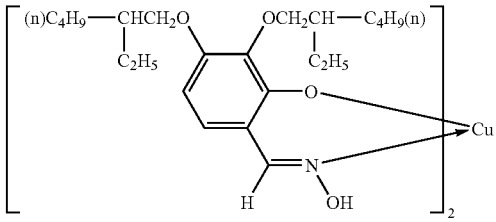

-continued
TVIII-5
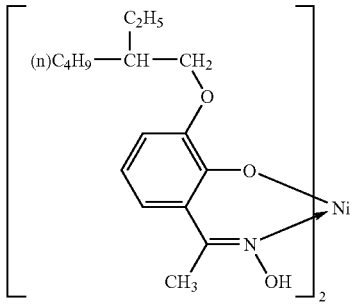
TVIII-6
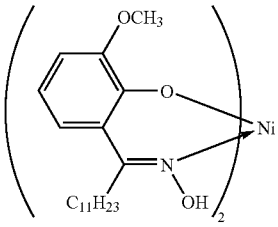
UA-1
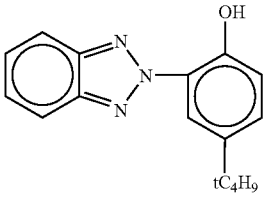
UA-2
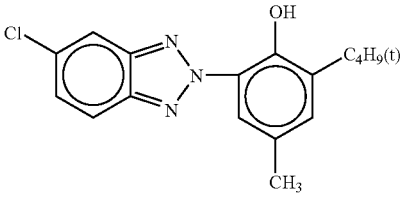
UA-3
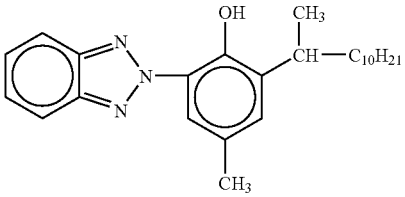
UA-4
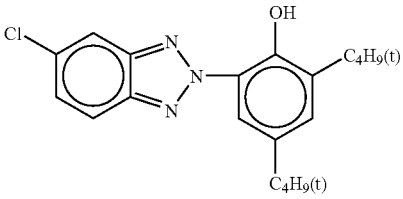
UA-5
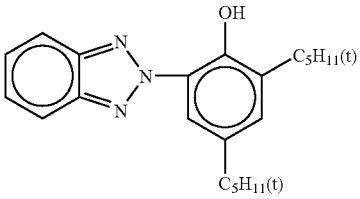
UA-6
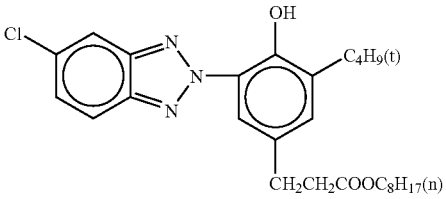
UA-7
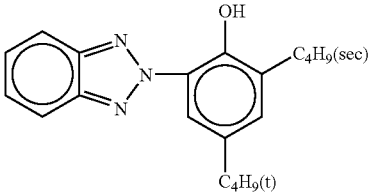
UA-8
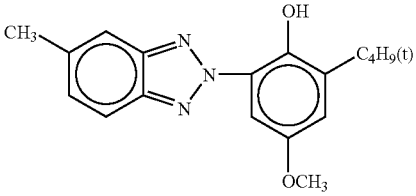
UA-9
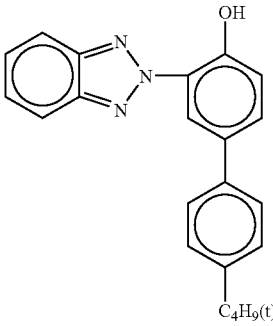
UA-10
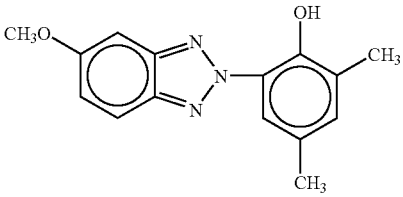

-continued
UB-1
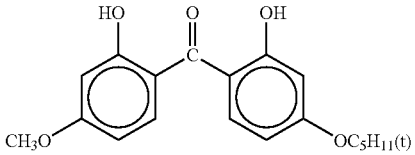
UB-2
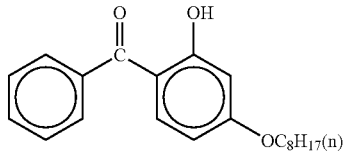
UB-3
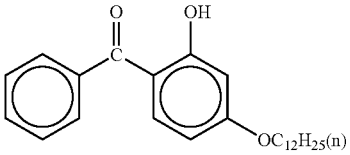
UB-4
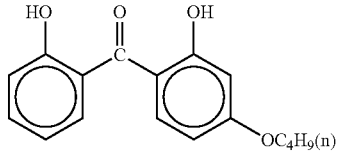
UB-5
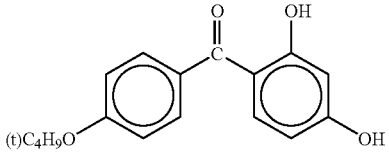
UB-6
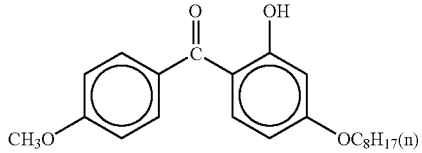
UB-7
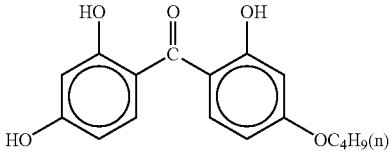
UC-1
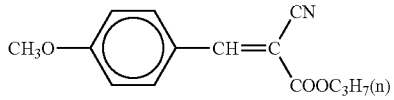
UC-2
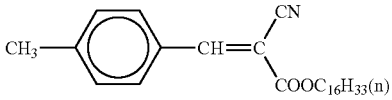
UC-3
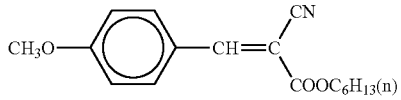
UC-4
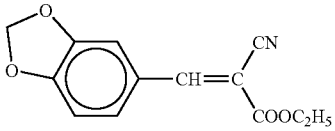
UC-5
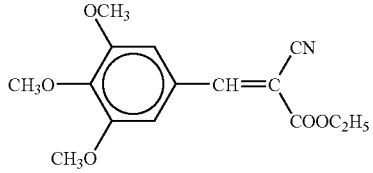
UC-6
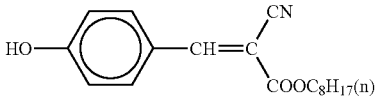
UC-7
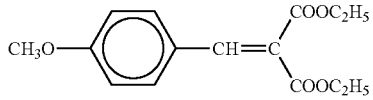
UC-8
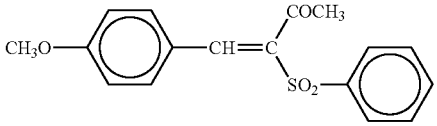
UC-9
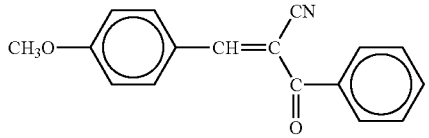
UC-10
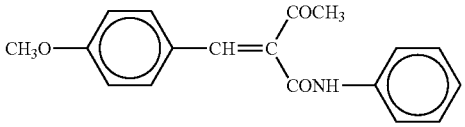
UC-11
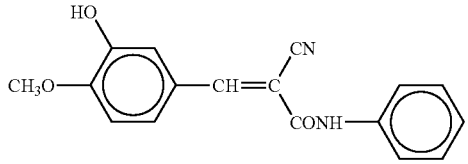
UC-12
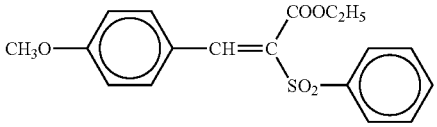
UD-1
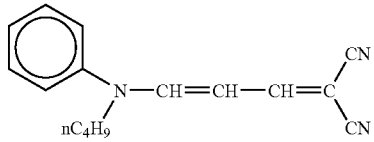

-continued
UD-2
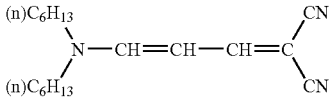
UD-3
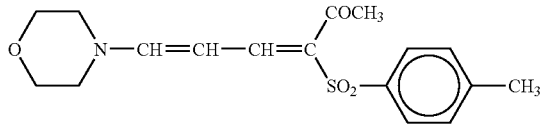
UD-4
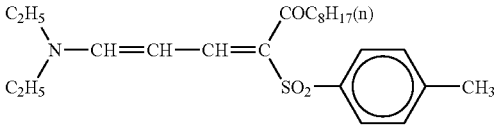
UD-5
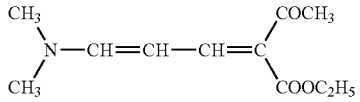
UD-6
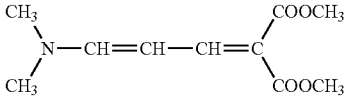
UD-7
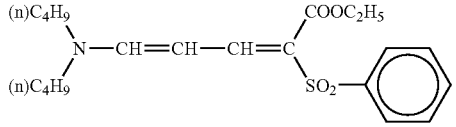
UD-8
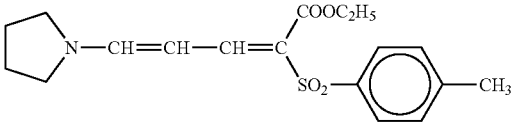
UD-9
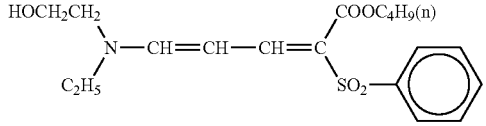
UE-1
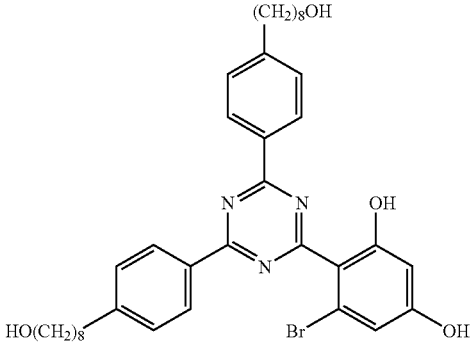
UE-2
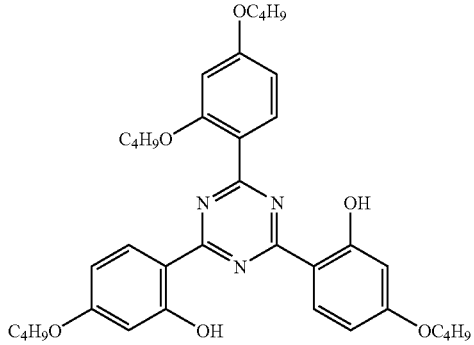
UE-3
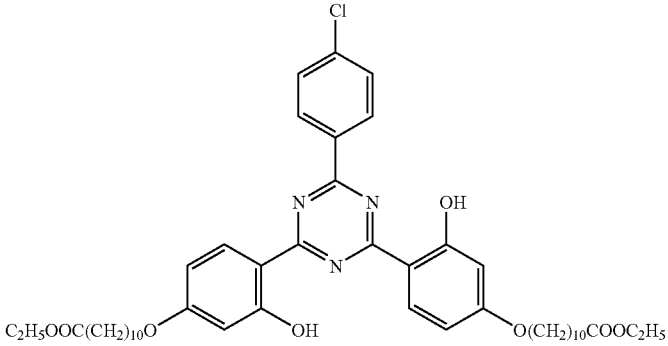
UE-4
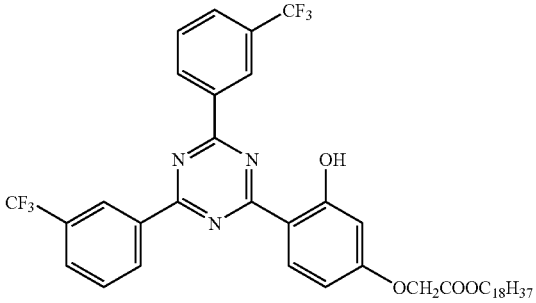

-continued
UE-5
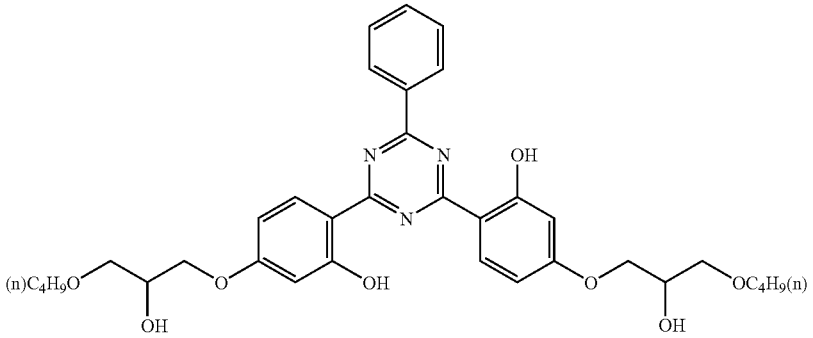
UE-6
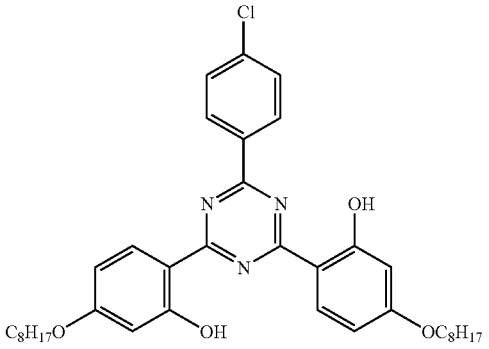
UE-7
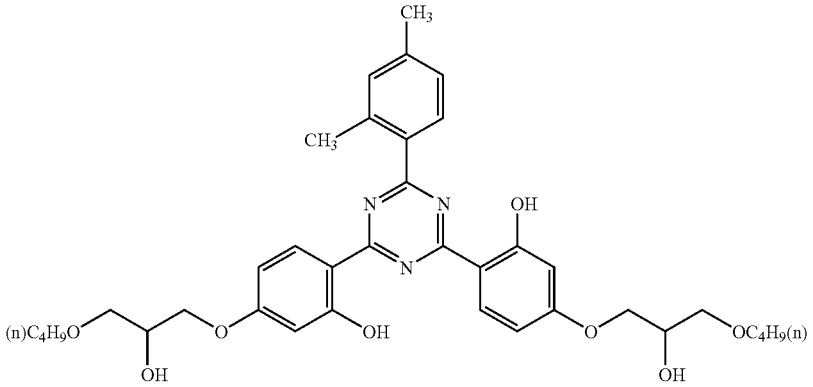
UE-8
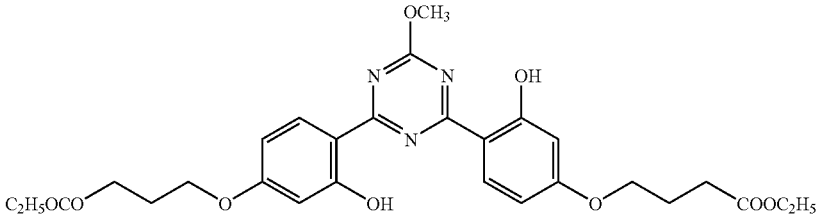

-continued

UE-9

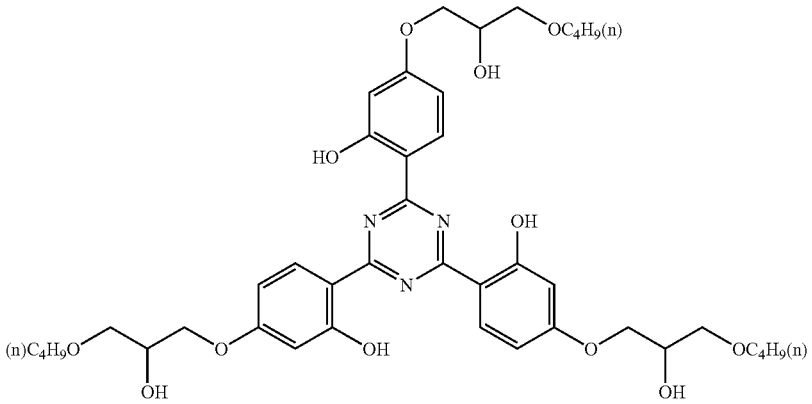

UE-10

UE-11

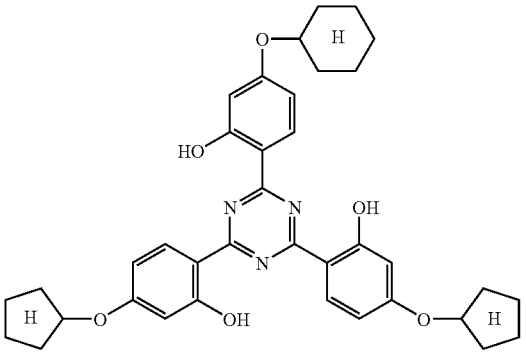

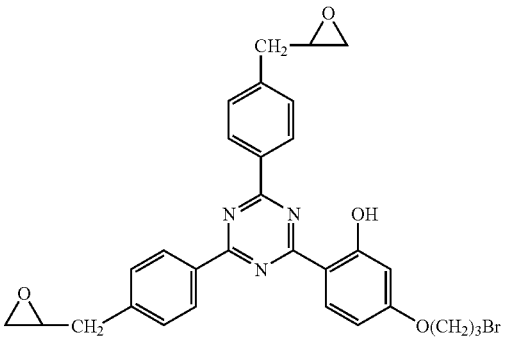

UE-12

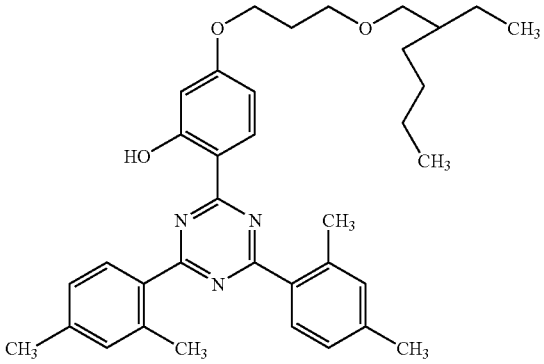

Next, water-insoluble and organic solvent-soluble homopolymers or copolymers that can be used in the present invention are explained in detail below.

In the present invention, the term "water-insoluble" is used to mean that solubility to water is 0.1% or less. As the water-insoluble and organic solvent-soluble homopolymer or copolymer (hereinafter referred to as a polymer or copolymer for use in the present invention), various kinds of polymers and copolymers can be used. For example, those set forth below can be preferably used.

(1) Vinyl-series Polymers and Copolymers

Monomers that form the vinyl-series polymers and copolymers that can be used in the present invention are more specifically set forth below.

There are illustrated, for example:

Acrylic acid esters: for example, methyl acrylate, ethyl acrylate, n-propyl acrylate, isopropyl acrylate, n-butyl acrylate, tert-butyl acrylate, isobutyl acrylate, sec-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxylpropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethyleneglycol acrylate (addition number of moles: n=9), 1-bromo-2-methoxyethyl acrylate, 1,1-dichloro-2-ethoxyethyl acrylate;

Methacrylic acid esters: for example, methyl methacrylate, ethyl methacrylate, n-propyl methacrylate, isopropyl methacrylate, n-butyl methacrylate, tert-butyl methacrylate, isobutyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy) ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (addition number of moles: n=6);

Vinyl esters: for example, vinyl acetate, vinyl propionate, vinyl butylate, vinyl isobutylate, vinyl caproate, vinyl chloroacetate, vinyl methoxyacetate, vinyl phenylacetate, vinyl benzoate, vinyl salicylate;

Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetonacrylamide;

Methacrylamides: for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide;

Olefins: for example, dicyclopentadiene, ethylene, propylene, 1-butene, 1-pentene, vinyl chloride, vinylidene chloride, isoprene, chloroprene, butadiene, 2,3-dimethylbutadiene;

Styrenes: for example, styrene, methyl styrene, dimethyl styrene, trimethyl styrene, ethyl styrene, isopropyl styrene, chloromethyl styrene, methoxystyrene, chlorostyrene, dichlorostyrene, bromostyrene, vinylbenzoate methyl ester;

Crotonic acid esters: for example, butyl crotonate, hexyl crotonate;

Itaconic acid diesters: for example, dimethyl itaconate, diethyl itaconate, dibutyl itaconate;

Maleic acid diesters: for example, diethyl maleate, dimethyl maleate, dibutyl maleate; and Fumaric acid diesters: for example, diethyl fumarate, dimethyl fumarate, dibutyl fumarate.

Examples of other monomers are set forth below.

There are illustrated, for example:

Allyl compounds: for example, allyl acetate, allyl caproate, allyl laurate, allyl benzoate;

Vinyl ethers: for example, methyl vinyl ether, butyl vinyl ether, hexyl vinyl ether, methoxyethyl vinyl ether, dimethylaminoethyl vinyl ether;

Vinyl ketones: for example, methyl vinyl ketone, phenyl vinyl ketone, methoxyethyl vinyl ketone;

Vinyl heterocyclic compounds: for example, vinyl pyridine, N-vinylimidazole, N-vinyloxazolidone, N-vinyltriazole, N-vinylpyrrolidone;

Glycidyl esters: for example, glycidyl acrylate, glycidyl methacrylate; and

Unsaturated nitrites: for example, acrylonitrile, methacrylonitrile.

The polymer for use in the present invention may be a homopolymer of any of the above-mentioned monomers, or it may be a copolymer of at least two kinds of the monomers, if necessary. Further, the polymer for use in the present invention may contain a monomer component having an acid group in such a proportion that the acid group does not render the polymer water-soluble. The proportion of the monomer component having an acid group is preferably 20% or less. It is preferred that the polymer for use in the present invention contains none of the monomer component having an acid group. Examples of the monomer having an acid group include acrylic acid; methacrylic acid; itaconic acid; maleic acid; monoalkyl itaconate (for example, monomethyl itaconate), monoalkyl maleate (for example, monomethyl maleate), citraconic acid; styrene sulfonic acid; vinylbenzylsulfonic acid; vinylbenzene sulfonic acid; acryloyloxyalkyl sulfonic acid (for example, acryloyloxymethyl sulfonic acid); methacryloyloxyalkyl sulfonic acid (for example, methacryloyloxymethyl sulfonic acid, methacryloyloxyethyl sulfonic acid, methacryloyloxypropyl sulfonic acid); acrylamidoalkyl sulfonic acid (for example, 2-acrylamido-2-methylethane sulfonic acid, 2-acrylamido-2-methylpropane sulfonic acid, 2-acrylamido-2-methylbutane sulfonic acid); methacrylamidoalkyl sulfonic acid (for example, 2-methacrylamido-2-methylethane sulfonic acid, 2-methacrylamido-2-methylpropane sulfonic acid, 2-methacrylamido-2-methylbutane sulfonic acid); acryloyloxyalkylphosphate (for example, acryloyloxyethylphosphate, 3-acryloyloxypropyl-2-phosphate); and methacryloyloxyalkylphosphate (for example, methacryloyloxyethylphosphate, 3-methacryloyloxypropyl-2-phosphate).

These monomers having an acid group may be an alkali metal salt (for example, Na, K salts), or an ammonium salt.

As the monomer that forms the polymer for use in the present invention, acrylate-series, methacrylate-series, acrylamido-series and methacrylamido-series monomers are preferred.

The polymers formed from the above-mentioned monomers can be obtained according to the processes such as solution polymerization, bulk polymerization, suspension polymerization, and latex polymerization. As the initiator that can be used for these polymerizations, use can be made of a water-soluble polymerization initiator and a lipophilic polymerization initiator.

As the water-soluble polymerization initiator, for example, use can be made of persulfate salts, such as potassium persulfate, ammonium persulfate, and sodium persulfate; water-soluble azo compounds, such as sodium 4,4'-azobis-4-cyanovalerate and 2,2'-azobis(2-amidinopropane)hydrochloride; and hydrogen peroxide.

As the lipophilic polymerization initiator, for example, mention can be made of lipophilic azo compounds, such as azobisisobutyronitrile, 2,2'-azobis(2,4-dimethylvaleronitrile), 2,2'-azobis(4-methoxy-2,4-dimethylvaleronitrile), 1,1'-azobis(cyclohexanone-1-carbonitrile), 2,2'-azobisisobutyric acid dimethyl ester, and 2,2'-azobisisobutyric acid diethyl ester; benzoyl peroxide, lauryl peroxide, diisopropylperoxy dicarbonate, and di-tert-butyl peroxide.

(2) Polyester Resins Obtained by Condensation of Polyhydric Alcohols and Polybasic Acids As the polyhydric alcohol, glycols having the structure set forth below or polyalkyleneglycols are useful.

HO—Ra—OH

In the formula, Ra represents a hydrocarbon (especially an aliphatic hydrocarbon) having 2 to about 12 carbon atoms.

As the polybasic acid, polycaboxylic acids having the structure set forth below are useful. HOOC—Rb—COOH (Rb represents a single bond or a hydrocarbon having 1 to 12 carbon atoms.) As specific examples of the polyhydric alcohol, there are illustrated ethylene glycol, diethylene glycol, triethylene glycol, 1,2-propylene glycol, 1,3-propylene glycol, trimethylolpropane, 1,4-butanediol, isobutylenediol, 1,5-pentanediol, neopentylglycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, glycerol, diglycerol, triglycerol, 1-methyl glycerol, erythritol, mannitol, and sorbitol.

As specific examples of the polybasic acid, there are illustrated oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene-anhydrous maleic acid adducts, and rosin-anhydrous maleic acid adducts.

(3) Polyesters Obtained by a Ring-opening Polymerization Process

These polyesters can be obtained from β-propiolactone, ϵ-caprolactone, dimethylpropiolactone or the like.

(4) Others

There are illustrated polycarbonate resins obtained by polycondensation of a glycol or divalent phenol and a carbonate or phosgene; polyurethane resins obtained by polyaddition of polyhydric alcohols and polyisocyanates; and polyamide resins obtained from polyamines and polybasic acids.

The number-average molecular weight of the polymer for use in the present invention is not particularly limited, but it is preferably 200,000 or less, and more preferably in the range of from 800 to 100,000.

Specific examples of the polymer for use in the present invention are shown below, but the present invention is not limited to these compounds. (The composition of a copolymer is indicated by a mass ratio.)

P-1) poly(N-sec-butylacrylamide)
P-2) poly(N-tert-butylacrylamide)
P-3) diacetoneacrylamide/methyl methacrylate copolymer (25:75)
P-4) poly(cyclohexyl methacrylate)
P-5) N-tert-butylacrylamide/methyl methacrylate copolymer (60:40)
P-6) poly(N,N-dimethylacrylamide)
P-7) poly(tert-butyl methacrylate)
P-8) poly(vinyl acetate)
P-9) poly(vinyl propionate)
P-10) poly(methyl methacrylate)
P-11) poly(ethyl methacrylate)
P-12) poly(ethyl acrylate)
P-13) vinyl acetate/vinyl alcohol copolymer (90:10)
P-14) poly(n-butyl acrylate)
P-15) poly(n-butyl methacrylate)
P-16) poly(isobutyl methacrylate)
P-17) poly(isopropyl methacrylate)
P-18) poly(octyl acrylate)
P-19) n-butyl acrylate/acrylamide copolymer (95:5)
P-20) stearyl methacrylate/acrylic acid copolymer (90:10)
P-21) methyl methacrylate/vinyl chloride copolymer (70:30)
P-22) methyl methacrylate/styrene copolymer (90:10)
P-23) methyl methacrylate/ethyl acrylate copolymer (50:50)
P-24) n-butyl methacrylate/methyl methacrylate/styrene copolymer (50:20:30)
P-25) vinyl acetate/acrylamide copolymer (85:15)
P-26) vinyl chloride/vinyl acetate copolymer (65:35)
P-27) methyl methacrylate/acrylonitrile copolymer (65:35)
P-28) n-butyl methacrylate/pentyl methacrylate/N-vinyl-2-pyrrolidone copolymer (38:38:24)
P-29) methyl methacrylate/n-butyl methacrylate/isobutyl methacrylate/acrylic acid copolymer (37:29:25:9)
P-30) n-butyl methacrylate/acrylic acid copolymer (95:5)
P-31) methyl methacrylate/acrylic acid copolymer (95:5)
P-32) benzyl methacrylate/acrylic acid copolymer (93:7)
P-33) n-butyl methacrylate/methyl methacrylate/benzyl methacrylate/acrylic acid copolymer (35:35:25:5)
P-34) n-butyl methacrylate/methyl methacrylate/benzyl methacrylate copolymer (40:30:30)
P-35) diacetoneacrylamide/methyl methacrylate copolymer (50:50)
P-36) methyl vinyl ketone/isobutyl methacrylate copolymer (55:45)
P-37) ethyl methacrylate/n-butyl acrylate copolymer (70:30)
P-38) diacetoneacrylamide/n-butyl acrylate copolymer (60:40)
P-39) methyl methacrylate/stearyl methacrylate/diacetoneacrylamide copolymer (40:40:20)
P-40) n-butyl acrylate/stearyl methacrylate/diacetoneacrylamide copolymer (70:20:10)
P-41) stearyl methacrylate/methyl methacrylate/acrylic acid copolymer (50:40:10)
P-42) methyl methacrylate/styrene/vinylsulfonamide copolymer (70:20:10)
P-43) methyl methacrylate/phenyl vinyl ketone copolymer (70:30)
P-44) n-butyl acrylate/methyl methacrylate/n-butyl methacrylate copolymer (35:35:30)
P-45) n-butyl methacrylate/N-vinyl-2-pyrrolidone copolymer (90:10)
P-46) poly(pentyl acrylate)
P-47) cyclohexyl methacrylate/methyl methacrylate/n-propyl methacrylate copolymer (37:29:34)
P-48) poly(pentyl methacrylate)
P-49) methyl methacrylate/n-butyl methacrylate copolymer (65:35)
P-50) vinyl acetate/vinyl propionate copolymer (75:25)
P-51) n-butyl methacrylate/sodium 3-acryloxybutane-1-sulfonate copolymer (97:3)
P-52) n-butyl methacrylate/methyl methacrylate/acrylamide copolymer (35:35:30)
P-53) n-butyl methacrylate/methyl methacrylate/vinyl chloride copolymer (37:36:27)
P-54) n-butyl methacrylate/styrene copolymer (82:18)
P-55) tert-butyl methacrylate/methyl methacrylate copolymer (70:30)
P-56) poly(N-tert-butylmethacrylamide)
P-57) N-tert-butylacrylamide/methylphenyl methacrylate copolymer (60:40)
P-58) methyl methacrylate/acrylonitrile copolymer (70:30)
P-59) methyl methacrylate/methyl vinyl ketone copolymer (28:72)

P-60) methyl methacrylate/styrene copolymer (75:25)
P-61) methyl methacrylate/hexyl methacrylate copolymer (70:30)
P-62) butyl methacrylate/acrylic acid copolymer (85:15)
P-63) methyl methacrylate/acrylic acid copolymer (80:20)
P-64) methyl methacrylate/acrylic acid copolymer (98:2)
P-65) methyl methacrylate/N-vinyl-2-pyrrolidone copolymer (90:10)
P-66) n-butyl methacrylate/vinyl chloride copolymer (90:10)
P-67) n-butyl methacrylate/styrene copolymer (70:30)
P-68) 1,4-butanediol/adipic acid polyester
P-69) ethylene glycol/sebacic acid polyester
P-70) poly(caprolactam)
P-71) poly(propiolactam)
P-72) poly(dimethylpropiolactone)
P-73) N-tert-butylacrylamide/dimethylaminoethylaramide copolymer (85:15)
P-74) N-tert-butylmethacrylamide/vinylpyridine copolymer (95:5)
P-75) diethyl maleate/n-butyl acrylate copolymer (65:35)
P-76) N-tert-butylacrylamide/2-methoxyethyl acrylate copolymer (55:45)

The polymer of still another preferable mode that can be used in the present invention, is a polymer substantially insoluble in water, which comprises as a constituent element thereof a monomer unit having at least one aromatic group, and which has a number average molecular weight of less than 2,000. The number average molecular weight is preferably 200 or more but less than 2,000, and more preferably 200 or more but 1,000 or less. The polymer that can be used in the present invention may be a so-called homopolymer composed of one kind of monomer unit, or a copolymer composed of two kinds or more of monomer units. In the case of a copolymer, it preferably comprises the monomer unit having the aromatic group, according to the present invention in a proportion of 20% or more of the mass composition of the copolymer. The polymer structure is not particularly limited in so far as the above-mentioned condition is fulfilled. Examples of the polymer having the preferred polymer structure include a polymer whose constituent element is styrene, α-methylstyrene, β-methylstyrene, or a monomer having a substituent on the benzene ring of such a monomer; a polymer whose constituent element is an aromatic acrylamide, an aromatic methacrylamide, an aromatic acrylic ester, or an aromatic methacrylic ester. Examples of the aromatic group include a phenyl group, a naphthyl group, a benzyl group, a biphenyl group, and the like. These aromatic groups may have a substituent(s) such as an alkyl group, a halogen atom, and the like. In the case of a copolymer, comonomers listed, for example, in JP-A-63-264748 can be used preferably. From the viewpoints of availability of raw materials and stability of an emulsion with the lapse of time, a polymer derived from styrene, α-methylstyrene or β-methylstyrene is preferable. As these polymers, P-1 to P-37 described in paragraph Nos. 0014 to 0020 of JP-A-7-140616 are preferred. The descriptions of these paragraphs in JP-A-7-140616 are herein preferably incorporated by reference.

In the present invention, preferably in the first embodiment of the present invention, it is preferred from the effects of the present invention, such as improvement in photo fading, to use the compound represented by formula (TS-II) and the compound represented by formula (Ph) in combination with the compound represented by any one of formulae (E-1) to (E-3), and more preferably in addition to this combination, in combination with at least one selected from the group consisting of: the compound represented by any one of formulae (TS-I) and (TS-III) to (TS-VII), the metal complex, the ultraviolet absorbing agent, and the water-insoluble homopolymer or copolymer. Particularly preferably, in addition to the above combination, at least one selected from the group consisting of the compound represented by any one of formulae (TS-I), (TS-V), (TS-VI) and (TS-VII), the ultraviolet absorbing agent, and the water-insoluble homopolymer or copolymer is used in combination.

With respect to the at least one compound(s) selected from the group consisting of the compound represented by any one of formulae (TS-I) to (TS-VII), the metal complex, the ultraviolet ray absorbing agent, and the water-insoluble homopolymer or copolymer, it is preferred from the viewpoint of the effects obtained by the present invention, preferably by the second and third embodiments of the present invention, to use at least one selected from the group consisting of the compound represented by any one of formulae (TS-I), (TS-II), (TS-IV), (TS-V), (TS-VI) or (TS-VII), the ultraviolet ray absorbing agent, and the water-insoluble homopolymer or copolymer, and more preferably at least one selected from the group consisting of the compound represented by any one of formulae (TS-I), (TS-II), (TS-V), (TS-VI) or (TS-VII), the ultraviolet ray absorbing agent, and the water-insoluble homopolymer or copolymer.

The compound represented by any one of formulae (TS-I) to (TS-VII), the metal complex, the ultraviolet absorbing agent, or the water-insoluble homopolymer or copolymer, each of which can be used in the present invention, each may be used singly or in combination with two or more kinds thereof. These additives may be added to the same layer as the layer containing the dye-forming coupler represented by formula (I) or the dye-forming coupler represented by any one of formulae (M-I) to (M-X), or to a separate layer from the layer containing the dye-forming coupler, with the former being preferred. Further, the ultraviolet absorbing agent is also preferably added to a layer adjacent to the layer containing a yellow dye-forming coupler, e.g. one represented by formula (I).

An addition amount of the compound represented by any one of formulae (TS-I) to (TS-VII), the metal complex, the ultraviolet absorbing agent, or the water-insoluble homopolymer or copolymer is preferably in the range of from 1 to 400 mass %, more preferably in the range of from 10 to 300 mass %, and most preferably in the range of from 15 to 200 mass %, to the dye-forming coupler represented by formula (I) or the dye-forming coupler represented by any one of formulae (M-I) to (M-X).

In combination with the compound represented by formula (Ph), the compound represented by any one of formulae (E-1) to (E-3), and at lease one selected from the group consisting of the compound represented by any one of formulae (TS-I) to (TS-VII), the metal complex, the ultraviolet absorbing agent, and the water-insoluble homopolymer or copolymer, each for use in the present invention, other compound(s) may be used additionally.

Examples of the compound that may be used in combination with the above compounds/additives, include boron compounds represented by formula (I) described in JP-A-4-174430, epoxy compounds represented by formula (II) described in U.S. Pat. No. 5,183,731 or formula (Si) described in JP-A-8-53431, disulfide-series compounds represented by formula described in European Patent Publication EP271,322 B1 or formula (I), (II), (III) or (IV) described in JP-A-4-19736, reactive compounds represented by formula (I), (II), (III) or (IV) described in U.S. Pat. No. 5,242,785, cyclic phosphorous compounds represented by formula (1) described in JP-A-8-283279, alcoholic compounds represented by formula (SO) described in JP-A-7-84350, formula (G) described in JP-A-9-114061, formula (II) described in JP-A-9-146242, formula (A) described in JP-A-9-329876, or formula (VII) described in JP-A-62-175748. If the above-mentioned publications include exemplified compounds that are embraced in any of formulae (TS-I) to (TS-VII) for use in the present invention, these compounds are also included in the examples of the compounds for use in the present invention.

The dye-forming coupler for use in the present invention, the compound represented by formula (Ph), the compound represented by any one of formulae (E-1) to (E-3), the compound represented by any one of formulae (TS-I) to (TS-VII), the metal complex, the ultraviolet absorbing agent, the water-insoluble homopolymer or copolymer, and the like additives for use in the present invention may be introduced into the photosensitive material according to known dispersion methods. It is preferable to use a water-in-oil dispersion method in which such a compound is dissolved in a high-boiling organic solvent (optionally in combination with a low-boiling organic solvent), and the solution is emulsified and dispersed in an aqueous gelatin solution, and then it is added to a silver halide emulsion. Further, it is preferable to use the metal complex for use in the present invention with dispersing it with a high-boiling organic solvent.

Examples of the high-boiling organic solvent that can be used in a water-in-oil dispersion method are described, for example, in U.S. Pat. No. 2,322,027. Further, specific examples of a latex dispersion method as one of polymer dispersion methods are described, for example, in U.S. Pat. No. 4,199,363, West German Patent (OLS) No. 2,541,274, JP-B-53-41091, European Patent Publication EP0,727,703 A1, and EP0,727,704 A1. Further, a dispersion method using a polymer that is soluble in an organic solvent is described in PCT International Publication WO88/723.

Examples of the high-boiling organic solvent that can be used in a water-in-oil dispersion method include phthalic acid esters (e.g., dibutyl phthalate, dioctyl phthalate, di-2-ethylhexyl phthalate), esters of phosphoric acid or phosphonic acid (e.g., triphenyl phosphate, tricresyl phosphate, tri-2-ethylhexyl phosphate), fatty acid esters (e.g., di-2-ethylhexyl succinate, tributyl citrate), benzoic acid esters (e.g., 2-ethylhexyl benzoate, dodecyl benzoate), amides (e.g., N,N-diethyldodecane amide, N,N-dimethylolein amide), alcohols or phenols (e.g., iso-stearyl alcohol, 2,4-di-tert-amyl phenol), anilines (e.g., N,N-dibutyl-2-butoxy-5-tert-octylaniline), chlorinated paraffins, hydrocarbons (e.g., dodecyl benzene, diisopropyl naphthalene), and carboxylic acids (e.g., 2-(2,4-di-tert-amyl phenoxy)butyric acid). Further, the high-boiling point organic solvent may be used in combination with an auxiliary solvent, which is an organic solvent having a boiling point of 30° C. or more and 160° C. or less, such as ethyl acetate, butyl acetate, methyl ethyl ketone, cyclohexanone, methylcellosolve acetate, and dimethylformamide. The high-boiling organic solvent is preferably used in an amount of 0 to 10 times (more preferably 0 to 4 times) that of a dye-forming coupler, in terms of mass ratio.

In order to emulsify and disperse the dye-forming coupler for use in the present invention and the compound for use in the present invention in a hydrophilic protective colloid to make lipophilic fine particles, dispersion is carried out using a dispersant such as a surface active agent, by means of a stirrer including an agitator, a homogenizer, a colloid mill, a flow-jet mixer (mill), a ultrasonic wave apparatus, and the like.

All or a part of the auxiliary solvent may be removed from an emulsified dispersion by means of a vacuum distillation, a noodle washing, an ultrafiltration, or the like, as occasion demands, for the purpose of improving storage stability with the lapse of time in the state of the emulsified dispersion, or inhibiting fluctuation in photographic properties or improving stability with the lapse of time of the final coating composition in which the emulsified dispersion is mixed with a silver halide emulsion.

The average particle size of the oleophilic fine particle dispersion thus obtained is preferably in the range of 0.04 to 0.50 μm, more preferably in the range of 0.05 to 0.30 μm, and most preferably in the range of 0.08 to 0.20 μm. The average particle size can be determined with a measuring device such as Coulter submicron particle analyzer model N4 (trade name, manufactured by Coulter Electronics Co., Ltd.).

The silver halide color photographic photosensitive material of the present invention, which may be referred to simply as "the photosensitive material" hereinafter, is explained in detail below.

The silver halide color photographic photosensitive material of the present invention is preferably a silver halide color photographic photosensitive material which has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler.

In the present invention, the above-said silver halide emulsion layer containing a yellow dye-forming coupler functions as a yellow color-forming layer, the above-said silver halide emulsion layer containing a magenta dye-forming coupler functions as a magenta color-forming layer, and the above-said silver halide emulsion layer containing a cyan dye-forming coupler functions as a cyan color-forming layer. The silver halide emulsions contained in the yellow color-forming layer, the magenta color-forming layer, and the cyan color-forming layer may preferably have photosensitivities to mutually different wavelength regions (such as light in a blue region, light in a green region, and light in a red region).

The photosensitive material of the present invention may, if necessary, have a hydrophilic colloid layer, an antihalation layer, an intermediate layer, and a colored layer as described below, in addition to the above-said yellow color-forming layer, magenta color-forming layer, and cyan color-forming layer.

The silver halide photographic photosensitive material of the present invention can be used for various materials, such as color negative films, color positive films, color reversal films, color reversal papers, color papers, motion-picture color negatives, motion-picture color positives, display photosensitive materials, and color proof (especially, digital color proof) photosensitive materials.

The present invention is preferably applied to a photosensitive material that is used for direct view, such as a color photographic printing paper (color paper), a display photosensitive material, a color proof, a color reversal film (color reversal), a color reversal paper, and a motion picture color positive. Of these photosensitive materials, a color paper and a color reversal film are preferred.

In the case where the present invention is applied to a color paper, for example, the photosensitive materials described in JP-A-11-7109 are preferred. Particularly the description of the paragraph Nos. 0071 to 0087 in the JP-A-11-7109 is herein incorporated by reference.

In the case where the present invention is applied to a color negative film, the description of the paragraph Nos. 0115 to 0217 in JP-A-11-305396 is preferably applied, and the description is herein incorporated by reference.

In the case where the present invention is applied to a color reversal film, the photosensitive materials described in JP-A-2001-142181 are preferred. Specifically, the description of the paragraph Nos. 0164 to 0188 in the JP-A-2001-142181 and the description of the paragraph Nos. 0018 to 0021 in JP-A-11-84601 are preferably applied, and these descriptions are herein incorporated by reference.

The preferred silver halide photosensitive materials according to the present invention are explained in detail below.

Silver halide grains in the silver halide emulsion which can be used in the present invention, are preferably cubic or tetradecahedral crystal grains substantially having {100} planes (these grains may be rounded at the apexes thereof and further may have planes of higher order), or octahedral crystal grains. Alternatively, a silver halide emulsion in which the proportion of tabular grains having an aspect ratio of 2 or more: and composed of {100} or {111} planes accounts for 50% or more in terms of the total projected area, can also be preferably used. The term "aspect ratio" refers to the value obtained by dividing the diameter of the circle having an area equivalent to the projected area of an individual grain by the thickness of the grain. In the present invention, cubic grains, or tabular grains having {100} planes as major faces, or tabular grains having {111} planes as major faces are preferably used.

As a silver halide emulsion which can be used in the present invention, for example, silver chloride, silver bromide, silver iodobromide, or silver chloro(iodo)bromide emulsions may be used. It is preferable for a rapid processing to use a silver chloride, silver chlorobromide, silver chloroiodide, or silver chlorobromoiodide emulsions having a silver chloride content of 90 mol % or greater, more preferably the silver chloride, silver chlorobromide, silver chloroiodide, or silver chlorobromoiodide emulsions having a silver chloride content of 98 mol % or greater. Preferred of these silver halide emulsions are those having in the shell parts of silver halide grains a silver iodochloride phase of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide localized phase of 0.2 to 5 mol %, more preferably 0.5 to 3 mol %, per mol of the total silver, since both high sensitivity and stabilization of photographic properties are attained.

The silver halide emulsion for use in the present invention preferably contains silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as alkali or alkali earth iodide salt. Alternatively, the iodide salt may be introduced by cleaving the iodide ions from an organic molecule, as described in U.S. Pat. No. 5,389,508. As another source of the iodide ion, fine silver iodide grains may be used.

The addition of an iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 80% or outer side. Moreover, the addition of an iodide salt solution is preferably finished at 98% or inner side of the volume of a grain, most preferably 96% or inner side. When the addition of an iodide salt solution is finished at a little inner side of the grain surface, thereby an emulsion having higher sensitivity and lower fog can be obtained.

The distribution of an iodide ion concentration in the depth direction of a grain can be measured according to an etching/TOF-SIMS (Time of Flight-Secondary Ion Mass Spectrometry) method by means of, for example, a TRIFT II Model TOF-SIMS apparatus (trade name, manufactured by Phi Evans Co.). A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection-Secondary Ion Mass Spectrometry*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. When the silver halide emulsion for use in the present invention contains silver iodide, it is preferred that the emulsion has the maximum concentration of iodide ions at the surface of the grain, and the iodide ion concentration decreases inwardly in the grain, in analysis by the etching/TOF-SIMS method.

The silver halide emulsion grains to be used in the photosensitive material of the present invention preferably have a silver bromide localized phase.

When the silver halide emulsion for use in the present invention contains a silver bromide localized phase, the silver bromide localized phase is preferably formed by epitaxial growth of the localized phase having a silver bromide content of at least 10 mol % or more on the grain surface. In addition, the emulsion grains preferably have the outermost shell portion having a silver bromide content of 0.1 mol % or more in the vicinity of the surface of the grains.

The silver bromide content of the silver bromide localized phase is preferably in the range of 1 to 80 mol %, and most preferably in the range of 5 to 70 mol %. The silver bromide localized phase is preferably composed of silver having population of 0.1 to 30 mol %, more preferably 0.3 to 20 mol %, to the molar amount of entire silver which constitutes silver halide grains for use in the present invention. The silver bromide localized phase is preferably doped with complex ions of a metal of the Group VIII, such as iridium ions. The amount of these compounds to be doped can be varied in a wide range depending on the purposes, and it is preferably in the range of $1\times10^{-9}$ to $1\times10^{-2}$ mol per mol of silver halide.

In the present invention, ions of a metal are preferably added in the course of grain formation and/or growth of the silver halide grains, to include the metal ions in the inside and/or on the surface of the silver halide grains. The metal ions to be used are preferably ions of a transition metal.

Preferable examples of the transition metal are iron, ruthenium, iridium, osmium, lead, cadmium or zinc. Further, 6-coordinated octahedral complex salts of these metal ions which have ligands are more preferably used. The ligand to be used may be an inorganic compound. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the above-mentioned iron, ruthenium, iridium, osmium, lead, cadmium and zinc. Two or more kinds of these ligands are also preferably used in one complex molecule.

Among them, the silver halide emulsion for use in the present invention particularly preferably contains an iridium ion having at least one organic ligand for the purpose of improving reciprocity failure at a high illuminance.

It is common in the case of other transition metal, when an organic compound is used as a ligand, preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Among these compounds, 5-methylthiazole among thiazole ligands is particularly preferably used as the ligand preferable for the iridium ion.

Preferable combinations of a metal ion and a ligand are those of iron and/or ruthenium ion and cyanide ion. Preferred of these compounds are those in which the number of cyanide ions accounts for the majority of the coordination sites (number) intrinsic to the iron or ruthenium that is the central metal. The remaining coordination sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver.

In case of the iridium complex, preferable ligands are fluoride, chloride, bromide and iodide ions, not only the organic ligands. Among these ligands, chloride and bromide ions are more preferably used. Specifically, preferable iridium complexes are the following compound in addition to those that have the above organic ligands: $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{2-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$.

These iridium complexes are preferably added during grain formation in an amount of $1\times10^{-10}$ mol to $1\times10^{-3}$ mol, most preferably $1\times10^{-8}$ mol to $1\times10^{-5}$ mol, per mol of silver. In case of the ruthenium complex and the osmium complex, nitrosyl ion, thionitrosyl ion, water molecule, and chloride ion ligands are preferably used singly or in combination. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver.

In the present invention, the above-mentioned complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, these methods may be combined, to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the position (portion) where the complexes are incorporated, is not particularly limited, but they are preferably incorporated in any of a silver chloride layer (phase), a silver chlorobromide layer (phase), a silver bromide layer (phase), a silver iodochloride layer (phase) and a silver iodobromide layer (phase).

The silver halide grains contained in the silver halide emulsion for use in the present invention have an average grain size (the grain size herein means the diameter of the circle equivalent to the projected area of the grain, and the number average is taken as the average grain size) of preferably from 0.01 μm to 2 μm.

With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer or to form a multilayer structure using the monodisperse emulsions.

Various compounds or precursors thereof can be included in the silver halide emulsion for use in the present invention to prevent fogging from occurring or to stabilize photographic performance, during manufacture, storage or photographic processing of the photosensitive material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0447647 can also be preferably used.

Further, in order to enhance storage stability of the silver halide emulsion for use in the present invention, it is also preferred in the present invention to use hydroxamic acid derivatives described in JP-A-11-109576; cyclic ketones having a double bond adjacent to a carbonyl group, both ends of the double bond being substituted with an amino group or a hydroxyl group, as described in JP-A-11-327094 (particularly compounds represented by formula (S1); the description at paragraph Nos. 0036 to 0071 of JP-A-11-327094 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); water-soluble reducing agents represented by formula (I), (II), or (III) of JP-A-11-102045.

Spectral sensitization can be carried out for the purpose of imparting spectral sensitivity in a desired light wavelength region to the photosensitive emulsion in each layer of the photosensitive material of the present invention.

Examples of spectral sensitizing dyes, which can be used in the photosensitive material of the present invention, for spectral sensitization of blue, green and red light regions include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that can be preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, the temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide emulsions for use in the present invention are generally chemically sensitized. Chemical sensitization can be performed by utilizing a sulfur sensitization, represented by the addition of an unstable sulfur compound, noble metal sensitization represented by gold sensitization, and reduction sensitization, each singly or in combination thereof. Compounds that are preferably used for chemical sensitization include those described in JP-A-62-215272, from page 18, right lower column to page 22, right upper column of these, gold-sensitized silver halide emulsion are particularly preferred, since a change in photographic properties which occurs when scanning exposure with laser beams or the like is conducted, can be further reduced by gold sensitization.

In order to conduct gold sensitization to the silver halide emulsion to be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand, the bis gold (I) mesoionic heterocycles described in JP-A-4-267249, for example, gold (I) tetrafluoroborate bis(1,4,5-trimethyl-1,2,4-triazolium-3-thiolate), the organic mercapto gold (I) complexes described in JP-A-11-218870, for example, potassium bis(1-[3-(2-sulfonatobenzamido)phenyl]-5-mercaptotetrazole potassium salt) aurate (I) pentahydrate, and the gold (I) compound with a nitrogen compound anion coordinated therewith described in JP-A-4-268550, for example, gold (I) bis (1-methylhydantoinate) sodium salt tetrahydrate may be used. Also, the gold (I) thiolate compound described in U.S. Pat. No. 3,503,749, the gold compounds described in JP-A-8-69074, JP-A-8-69075 and JP-A-9-269554, and the compounds described in U.S. Pat. No. 5,620,841, U.S. Pat. No. 5,912,112, U.S. Pat. No. 5,620,841, U.S. Pat. No. 5,939,245, and U.S. Pat. No. 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{-6}$ mole to $5\times10^{-4}$ mole, per mole of silver halide.

The silver halide emulsion for use in the present invention is preferably subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1996). Colloidal gold sulfide having various grain sizes are applicable, and even those having a grain diameter of 50 nm or less are also usable. The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

In the present invention, gold sensitization may be used in combination with other sensitizing methods, for example, sulfur sensitization, selenium sensitization, tellurium sensitization, reduction sensitization, or noble metal sensitization using a noble metal compound other than gold compounds.

The photosensitive material of the present invention preferably contains, in their hydrophilic colloid layers, dyes (particularly oxonole dyes and cyanine dyes) that can be discolored by processing, as described in European Patent No. 0337490 A2, pages 27 to 76, in order to prevent irradiation or halation or to enhance, for example, safelight safety (immunity). Further, dyes described in European Patent No. 0819977 are also preferably used in the present invention. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with a photosensitive emulsion layer directly, or indirectly through an interlayer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, only one layer selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is within the range of 0.2 to 3.0, more preferably 0.5 to 2.5, and particularly preferably 0.8 to 2.0.

The colored layer described above may be formed by a known method. For example, there are a method in which a dye in a state of a dispersion of solid fine-particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used as described in JP-A-1-239544. As to a method of dispersing fine-powder of a dye in solid state, for example, JP-A-2-308244, pages 4 to 13 describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the methods of incorporating fine particles of dye and of using a colloidal silver.

When the present invention is applied to a color paper, the color photographic printing paper preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer, and the cyan color-forming silver halide emulsion layer. However, another layer arrangement which is different from the above, may be adopted.

In the photosensitive material of the present invention, a yellow coupler-containing silver halide emulsion layer may be provided at any position on a support. In the case where silver halide tabular grains are contained in the yellow coupler-containing layer, it is preferable that the yellow coupler-containing layer is positioned more apart from the support than at least one of a magenta coupler-containing silver halide emulsion layer and a cyan coupler-containing silver halide emulsion layer. Further, it is preferable that the yellow coupler-containing silver halide emulsion layer is positioned most apart from the support of other silver halide emulsion layers, from the viewpoint of color-development acceleration, desilvering acceleration, and reduction in a residual color due to a sensitizing dye. Further, it is preferable that the cyan coupler-containing silver halide emulsion layer is provided in the middle of other silver halide emulsion layers, from the viewpoint of reduction in blix fading. On the other hand, it is preferable that the cyan coupler-containing silver halide emulsion layer is the lowest layer, from the viewpoint of reduction in light fading. Further, each of a yellow-color-forming layer, a magenta-color-forming layer and a cyan-color-forming layer may be composed of two or three layers. It is also preferable that a color-forming layer is formed by providing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

For example, as a photographic support (base), a transmissive type support or a reflective type support may be used. As the transmissive type support, it is preferred to use transparent supports, such as a cellulose nitrate film, and a transparent film of polyethyleneterephthalate, a cellulose triacetate film, or a polyester of 2,6-naphthalenedicarboxylic acid (NDCA) and ethylene glycol (EG), or a polyester of NDCA, terephthalic acid and EG, provided thereon with an information-recording layer such as a magnetic layer. In the present invention, a reflective support (reflective-type support) is preferable. As the reflective type support, it is especially preferable to use a reflective support having a substrate laminated thereon with a plurality of polyethylene layers or polyester layers (water-proof resin layers or laminate layers), at least one of which contains a white pigment such as titanium oxide.

Preferred examples of silver halide emulsions and other materials (additives or the like) for use in the present invention, photographic constitutional layers (arrangement of the layers or the like), and processing methods for processing the photographic materials and additives for processing are disclosed, for example, in JP-A-62-215272, JP-A-2-33144 and European Patent No. 0355660 A2. Particularly, those disclosed in European Patent No. 0355660 A2 are preferably used. Further, it is also preferred to use silver halide color photographic photosensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

As a support for use in the present invention, a reflective support, a transparent support, and the like are included.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye image stability-improving agents (stain inhibitors and discoloration inhibitors), the dyes (colored layers), the kinds of gelatin, the layer structure of the photosensitive material, and the film pH of the photosensitive material, those described in the patent publications as shown in the following table are particularly preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |

TABLE 1-continued

| Element | JP-A-7-104448 | JP-A-7-77775 | JP-A-7-301895 |
|---|---|---|---|
| Storage stabilizers or antifoggants | Column 75, lines 9 to 18 | Column 47, lines 20 to 29 | Column 18, line 11 to Column 31, line 37 (Especially, mercapto-heterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of photosensitive materials | Column 39, lines 11 to 26 | Column 44, lines 2 to 35 | Column 31, line 38 to Column 32, line 33 |
| pH of coated film of photosensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As cyan, magenta and yellow couplers which can be additionally used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred in the present invention to add compounds represented by formula (II) or (III) in WO 98/33760 and compounds represented by formula (D) described in JP-A-10-221825.

As the cyan dye-forming coupler (hereinafter also referred to as "cyan coupler") which can be used in the present invention, pyrrolotriazole-series couplers are preferably used, and more specifically, couplers represented by any of formulae (I) and (II) in JP-A-5-313324 and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. As preferable cyan couplers other than the foregoing cyan couplers, there are pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, the cyan dye-forming coupler according to the present invention can also be a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in EP 0333185 A2; a cyclic active methylene-series cyan coupler (particularly couplers 3, 8, and 34 enumerated as specific examples are particularly preferable) described in JP-A-64-32260; a pyrrolopyrozole-type cyan coupler described in European Patent No. 0456226 A1; and a pyrroloimidazole-type cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference.

The magenta dye-forming coupler (which may be referred to simply as a "magenta coupler" hereinafter) represented by any one of formulae (M-I) to (M-X) that can be used in the present invention, preferably in the third embodiment of the present invention, can be used singly or in combination with other magenta dye-forming coupler(s). As the above other magenta dye-forming coupler to be used in combination, use can be made of any of 5-pyrazolone-series magenta couplers and pyrazoloazole-series magenta couplers such as those described in the above-mentioned patent publications in the above table. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 0226849 A2 and 0294785 A, in view of the hue and stability of image to be formed therefrom and color-forming property of the couplers.

As the magenta dye-forming coupler (sometimes referred to simply as "magenta coupler") for use in the present invention, preferably in the first and second embodiments of the present invention, it is preferable to use the magenta dye-forming coupler that is described as a magenta dye-forming coupler capable of using in combination of the dye-forming coupler represented by any one of formulae (M-I) to (M-X) in the third embodiment of the present invention. Particularly as the magenta coupler, the pyrazoloazole couplers represented by formula (M-I) described in JP-A-8-122984 are preferred. The description of paragraph Nos. 0009 to 0026 of the above JP-A-8-122984 is applied to the present invention and herein incorporated by reference. In addition, the pyrazoloazole couplers having a steric hindrance group at both of the 3- and the 6-positions, as described in European Patent (EP) Nos.854,384 and 884,640 are also preferably used.

The yellow dye-forming coupler (herein also referred to simply as "yellow coupler") that can be used in the present invention, preferably the yellow dye-forming coupler represented by formula (I) for use in the first embodiment of the present invention, or the yellow dye-forming coupler represented by formula (Ia) for use in the second embodiment of the present invention, can be used singly or in combination with other yellow dye-forming coupler(s). As the above other yellow dye-forming coupler to be used in combination, use can be preferably made of acylacetamide-type yellow couplers in which the acyl group has a 3-membered to 5-membered cyclic structure, as described in European Patent No. 0 447 969 A1; malondianilide-type yellow couplers having a cyclic structure, as described in European Patent No. 0482552 A1; pyrrole-2 or 3-yl- or indole-2 or 3-yl-carbonylacetoanilide-series couplers, as described in European Patent Nos. 953 870 A1, 953 871 A1, 953 872 A1, 953 873 A1, 953 874 A1 and 953 875 A1; acylacetamide-type yellow couplers having a dioxane structure, as described in U.S. Pat. No. 5,118,599, in addition to the compounds described in the above-mentioned table. Above all, acylacetamide-type yellow couplers in which the acyl group is a 1-alkylcyclopropane-1-carbonyl group, and malondianilide-type yellow couplers in which one of the anilido groups constitutes an indoline ring are especially preferably used. These couplers may be used singly or in combination.

As the yellow dye-forming coupler (herein also referred to as "yellow coupler") that can be used in the present invention, preferably in the third embodiment of the present invention, it is preferable to use the yellow dye-forming coupler that is described as a yellow dye-forming coupler capable of using in combination with the dye-forming coupler represented by formulae (I) or (Ia) in the first or second embodiment of the present invention. In addition, use can be also made of acetate-series or acetanilide-series couplers having 1,2,4-benzothiadiazine-1,1-dioxide bonded thereto, as described in U.S. Pat. No. 3,841,880, JP-A-52-82423, JP-A-2-28645, and European Patent Publication (EP) No. 1246006.

It is preferred that couplers for use in the present invention, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic solvent-soluble polymer which can be preferably used, include the homopolymers and co-polymers as disclosed in U.S. Pat. No. 4,857,449, from column 7 to column 15 and WO 88/00723, from page 12 to page 30. The use of methacrylate-series or acrylamide-series polymers, especially acrylamide-series polymers are more preferable in view of color-image stabilization and the like.

In the present invention, known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent Publication No. 19629142 A1, may be used. Particularly, in order to accelerate developing speed by increasing the pH of a developing solution, redox compounds described in, for example, German Patent No. 19,618,786 A1, European Patent Nos. 0,839,623 A1 and 0,842,975 A1, German Patent No. 19,806,846 A1 and French Patent No. 2,760,460 A1, are also preferably used.

In the present invention, as an ultraviolet ray absorbent, it is preferred to use compounds having a high molar extinction coefficient and a triazine skeleton. For example, those described in the following patent publications can be used. These compounds are preferably added to the photosensitive layer or/and the light-nonsensitive layer. For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As the binder or protective colloid, which can be used in the photosensitive material according to the present invention, gelatin is used advantageously, but another hydrophilic colloid can be used singly or in combination with gelatin. It is preferable for the gelatin that the content of heavy metals, such as Fe, Cu, Zn and Mn, included as impurities, be reduced to 5 ppm or below, more preferably 3 ppm or below. Further, the amount of calcium contained in the photosensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of the coated film of the photosensitive material is preferably in the range of 4.0 to 7.0, more preferably in the range of 4.0 to 6.5.

In the present invention, a surface-active agent may be added to the photosensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is particularly preferred. The fluorine-containing surface-active agent may be used singly or in combination with known another surface-active agent. The fluorine-containing surfactant is preferably used in combination with known another surface-active agent. The amount of the surface-active agent to be added to the photosensitive material is not particularly limited, but generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention can form an image, by an exposure step in which the photosensitive material is irradiated with light according to image information, and a development step in which the photosensitive material irradiated with light is processed to develop an image.

The photosensitive material of the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green and blue, and fluorophoroes which can emit a light in a region of yellow, orange, purple or infrared can be used. Particularly, a cathode ray tube which emits a white light by means of a mixture of these light-emitting materials, is often used.

In the case where the photosensitive material has a plurality of photosensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred from the viewpoint of high quality enhancement, because a cathode ray tube having a high resolving power can be used.

The photosensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the photosensitive material of the present invention can be arbitrarily set up according to the wavelength of a scanning exposure light source to be used. Since oscillation wavelength of a laser can be made half, using a SHG light source (a second harmonic generation light source) obtainable by a combination of a nonlinear optical crystal with a semiconductor laser or a solid state laser using a semiconductor as an excitation light source, blue light and green light can be obtained. Accordingly, it is possible to have the spectral sensitivity maximum of a photosensitive material in normal three wavelength regions of blue, green and red. The exposure time in such a scanning exposure is defined as the time necessary to expose the size of the picture element (pixel) with the density of the picture element being 400 dpi, and preferred exposure time is $1\times10^{-4}$ sec or less and more preferably $1\times10^{-6}$ sec or less.

The silver halide color photographic photosensitive material of the present invention can be preferably used in combination with the exposure and development systems described, for example, in the following known literatures. Example of the development system include the automatic print and development system described in JP-A-10-333253, the photosensitive material conveying apparatus described in JP-A-2000-10206, a recording system including the image reading apparatus, as described in JP-A-11-215312, an exposure systems with the color image recording method, as described in JP-A-11-88619 and JP-A-10-202950, a digital photo print system including the remote diagnosis method, as described in JP-A-10-210206, and a photo print system including the image recording apparatus, as described in JP-A-2000-310822.

The preferred scanning exposure methods which can be applied to the present invention are described in detail in the publications in the above table 1.

It is preferred to use a band stop filter, as described in U.S. Pat. No. 4,880,726, when the photographic material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

Further, in order to process the photosensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied, and these are herein preferably incorporated by reference. Further, as the preservative that can be used for this developing solution, compounds described in the patent publications listed in the above Table are preferably used.

The present invention is also preferably applied to a photosensitive material having rapid processing suitability. In the case of conducting rapid processing, the color-developing time is preferably 60 sec or less, more preferably from 50 sec to 6 sec, and further preferably from 30 sec to 6 sec. Likewise, the blix time is preferably 60 sec or less, more preferably from 50 sec to 6 sec, and further preferably from 30 sec to 6 sec. Further, the washing or stabilizing time is preferably 150 sec or less, and more preferably from 130 sec to 6 sec.

Herein, the term "color-developing time" as used herein means a period of time required from the beginning of dipping a photosensitive material into a color-developing solution until the photosensitive material is dipped into a blix solution in the subsequent processing step. In the case where a processing is carried out using, for example, an autoprocessor, the color-developing time is the sum total of a time in which a photosensitive material has been dipped in a color-developing solution (so-called "time in the solution") and a time in which the photosensitive material has left the solution and been conveyed in air toward a bleach-fixing bath in the step subsequent to color development (so-called "time in the air"). Likewise, the term "blix time" as used herein means a period of time required from the beginning of dipping the photosensitive material into a blix solution until the photosensitive material is dipped into a washing bath or a stabilizing bath in the subsequent processing step. Further, the term "washing or stabilizing time" as used herein means a period of time required from the beginning of dipping the photosensitive material into a washing solution or a stabilizing solution until the end of the dipping toward a drying step (so-called "time in the solution").

Examples of a development method applicable to the photosensitive material of the present invention after exposure, include a conventional wet system, such as a development method using a developing solution containing an alkali agent and a developing agent, and a development method wherein a developing agent is incorporated in the photosensitive material and an activator solution, e.g., a developing agent-free alkaline solution is employed for the development, as well as a heat development system using no processing solution. In particular, the activator method is preferred to the other methods, because the processing solutions contain no developing agent, thereby it enables easy management and handling of the processing solutions and reduction in waste disposal load to make for environmental preservation.

The preferable developing agents or their precursors incorporated in the photosensitive materials in the case of adopting the activator method include the hydrazine-type compounds described in, for example, JP-A-8-234388, JP-A-9-152686, JP-A-9-152693, JP-A-9-211814 and JP-A-9-160193.

Further, the processing method in which the photographic material reduced in the amount of silver to be applied undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536–541 (September 1994), and JP-A-8-234388 can be used in the present invention.

The silver halide color photographic photosensitive material of the present invention is excellent in rapid processing suitability. Further, the silver halide color photographic photosensitive material of the present invention is excellent in color-forming property, color reproduction, and image fastness after processing.

In particular, the silver halide color photographic photosensitive material of the first embodiment of the present invention is also excellent in fastness to light in the dye image area (particularly the yellow dye image area) and the white background area.

Further, the silver halide color photographic photosensitive material of the second and third embodiments of the present invention is also excellent in processing stability when processed with a running solution.

The present invention will be described in more detail based on the following examples, but the present invention is not limited thereto.

EXAMPLES

Example 1

(Preparation of Emulsion B-H)

Using a usual method of mixing silver nitrate and sodium chloride added at the same time to an aqueous gelatin solution under stirring, an emulsion of cubic high silver chloride having an equivalent-sphere diameter of 0.55 μm and a variation coefficient of 10% was prepared. Herein, the term "equivalent-sphere diameter" means a diameter of a sphere whose volume is equivalent to that of an individual silver halide grain. In this preparation, potassium bromide (2 mole % per mole of the finished silver halide), $RhBr_5(H_2O)$ and $K_4[Ru(CN)_6]$ were added at the step of from 80% to 90% addition of the entire silver nitrate amount. At the completion of 90% addition of the entire silver nitrate amount, potassium iodide (0.3 mole % per mole of the finished silver halide) was added. Further, $K_2[Ir(5\text{-methylthiazole})Cl_5]$ and $K_2[Ir(H_2O)Cl_5]$ were added at the step of from 92% to 98% addition of the entire silver nitrate amount. After desalting, gelatin was added to the resulting emulsion for re-dispersion. To the emulsion, sodium thiosulfonate and the sensitizing dye A, the sensitizing dye B and the sensitizing dye C each set forth below were added, and the resulting emulsion was optimally ripened with sodium thiosulfate pentahydrate as a sulfur sensitizing agent, and gold (I) thioglucose as a gold sensitizing agent. Further, 1-phenyl-5-mercaptotetrazole and 1-(5-methylureidophenyl)-5-mercaptotetrazole were added. The thus-obtained emulsion was referred to as Emulsion B-H.

(Preparation of Emulsion B-L)

An emulsion of cubic high silver chloride having an equivalent-sphere diameter of 0.45 μm and a variation coefficient of 10% was prepared in the same manner as Emulsion B-H, except for changing only the addition rates of silver nitrate and sodium chloride. The thus-obtained emulsion was referred to as Emulsion B-L.

(Sensitizing dye A)

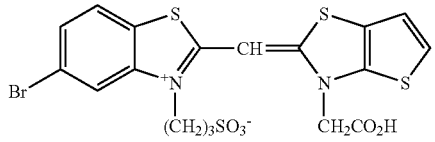

(Sensitizing dye B)

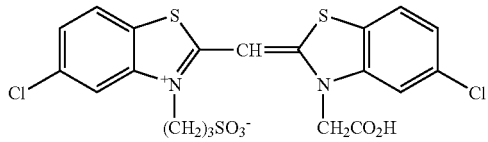

(Sensitizing dye C)

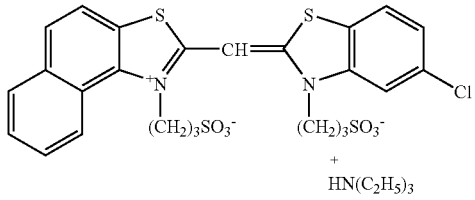

(Preparation of Emulsion G-H)

Using a usual method of mixing silver nitrate and sodium chloride added at the same time to an aqueous gelatin solution under stirring, an emulsion of cubic high silver chloride having an equivalent-sphere diameter of 0.35 μm and a variation coefficient of 10% was prepared. In this preparation, $RhBr_5(H_2O)$ and $K_4[Ru(CN)_6]$ were added at the step of from 80% to 90% addition of the entire silver nitrate amount. At the step of from 80% to 100% addition of the entire silver nitrate amount, potassium bromide (4 mole % per mole of the finished silver halide) was added. At the completion of 90% addition of the entire silver nitrate amount, potassium iodide (0.2 mole % per mole of the finished silver halide) was added. $K_2$[Ir(5-methylthiazole)$Cl_5$] was added at the step of from 92% to 95% addition of the entire silver nitrate amount. Further, $K_2[Ir(H_2O)Cl_5]$ was added at the step of from 92% to 98% addition of the entire silver nitrate amount. After desalting, gelatin was added to the resulting emulsion for re-dispersion. To the emulsion, sodium thiosulfonate was added, and the resulting emulsion was optimally ripened with sodium thiosulfate pentahydrate as a sulfur sensitizing agent, and gold (I) thioglucose as a gold sensitizing agent. Further, the sensitizing dyes D, E, F and G each set forth below, 1-phenyl-5-mercaptotetrazole, 1-(5-methylureidophenyl)-5-mercaptotetrazole and potassium bromide were added. The thus-obtained emulsion was referred to as Emulsion G-H.

(Preparation of Emulsion G-L)

An emulsion of cubic high silver chloride having an equivalent-sphere diameter of 0.28 μm and a variation coefficient of 10% was prepared in the same manner as Emulsion G-H, except for changing only the addition rates of silver nitrate and sodium chloride. The thus-obtained emulsion was referred to as Emulsion G-L.

(Sensitizing dye D)

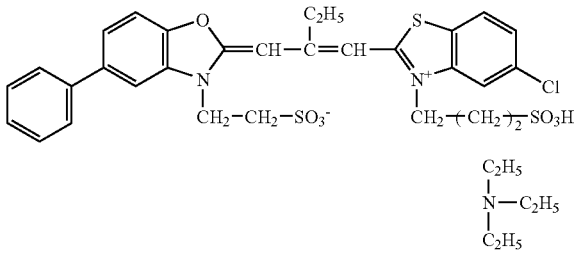

(Sensitizing dye E)

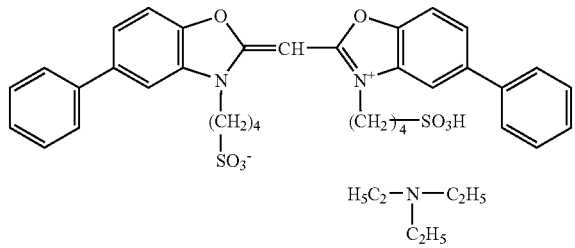

(Sensitizing dye F)

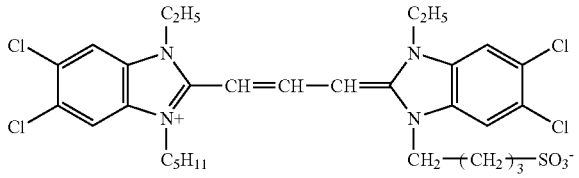

(Preparation of Emulsion R-H)

Using a usual method of mixing silver nitrate and sodium chloride added at the same time to an aqueous gelatin solution under stirring, an emulsion of cubic high silver chloride having an equivalent-sphere diameter of 0.35 μm and a variation coefficient of 10% was prepared. In this preparation, $K_4[Ru(CN)_6]$ was added at the step of from 80% to 90% addition of the entire silver nitrate amount. At the step of from 80% to 100% addition of the entire silver nitrate amount, potassium bromide (4.3 mole % per mole of the finished silver halide) was added. At the completion of 90% addition of the entire silver nitrate amount, potassium iodide (0.10 mole % per mole of the finished silver halide) was added. $K_2$[Ir(5-methylthiazole)$Cl_5$] was added at the step of from 92% to 95% addition of the entire silver nitrate amount. Further, $K_2[Ir(H_2O)Cl_5]$ was added at the step of from 92% to 98% addition of the entire silver nitrate amount. After desalting, gelatin was added to the resulting emulsion for re-dispersion. To the emulsion, sodium thiosulfonate was added, and the resulting emulsion was optimally ripened with sodium thiosulfate pentahydrate as a sulfur sensitizing agent, and gold (I) thioglucose as a gold sensitizing agent. Further, the sensitizing dye H set forth below, 1-phenyl-5-mercaptotetrazole, 1-(5-methylureidophenyl)-5-mercaptotetrazole, the compound I set forth below, and potassium bromide were added. The thus-obtained emulsion was referred to as Emulsion R-H.

(Preparation of Emulsion R-L)

An emulsion of cubic high silver chloride having an equivalent-sphere diameter of 0.28 μm and a variation coefficient of 10% was prepared in the same manner as Emulsion R-H, except for changing only the addition rates of silver nitrate and sodium chloride. The thus-obtained emulsion was referred to as Emulsion R-L.

The coating solutions for the second layer to the seventh layer were prepared in the similar manner as the first-layer (Sensitizing dye G)

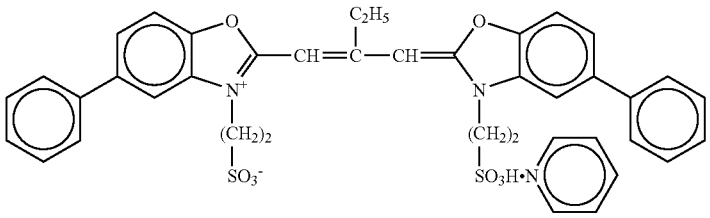

(Sensitizing dye H)

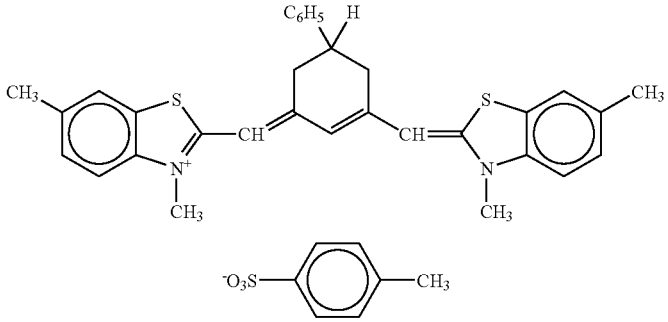

(Compound I)

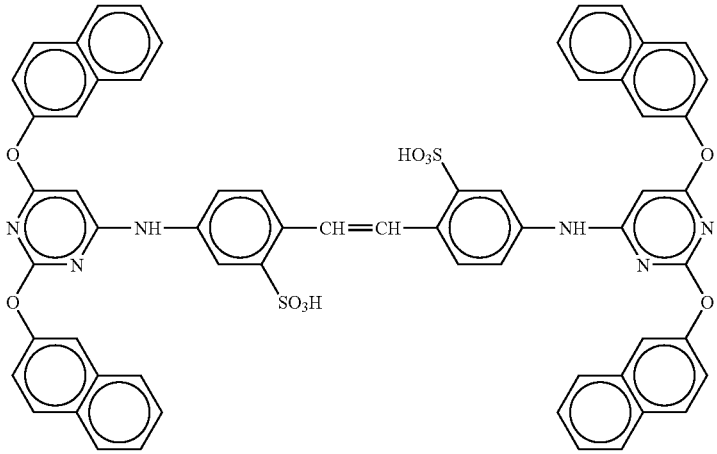

(Preparation of a Coating Solution for the First Layer)

Into 26 g of a solvent (Solv-4), 4 g of a solvent (Solv-6), 26 g of a solvent (Solv-9) and 60 ml of ethyl acetate were dissolved 31.9 g of a yellow coupler (6), 1.0 g of a color-image stabilizer (Cpd-1), 1.0 g of a color-image stabilizer (Cpd-2), 7.4 g of a color-image stabilizer (Cpd-8), 1.0 g of a color-image stabilizer (Cpd-21), 1.0 g of a color-image stabilizer (Cpd-18), 7.4 g of a color-image stabilizer (Cpd-19), 8.4 g of a color-image stabilizer (Cpd-20), 0.1 g of an additive (ExC-1), and 1.0 g of a color-image stabilizer (UV-2). This solution was emulsified and dispersed in 270 g of a 20 mass % aqueous gelatin solution containing 4 g of sodium dodecylbenzenesulfonate with a high-speed stirring emulsifier (dissolver). Water was added thereto, to prepare 900 g of an emulsified dispersion A.

Separately, the above emulsified dispersion A and the above emulsions B-H and B-L were mixed and dissolved, to prepare a coating solution for the first layer having the composition shown below. The coating amount of the emulsion is in terms of silver.

coating solution. As a gelatin hardener for each layer, 1-oxy-3,5-dichloro-s-triazine sodium salt (H-1), (H-2), and (H-3) were used. Further, to each layer, were added (Ab-1), (Ab-2), and (Ab-3), so that the total amounts would be 15.0 mg/m$^2$, 60.0 mg/m$^2$, and 5.0 mg/m$^2$, respectively.

(H-1) Hardener

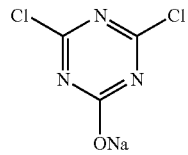

(used in an amount 1.4 mass% per gelatin)

(H-2) Hardener $CH_2{=}CHSO_2CH_2CONHCH_2$ $CH_2{=}CHSO_2CH_2CONHCH_2$

-continued (H-3) Hardener

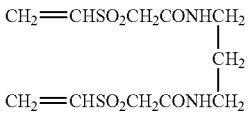

(Ab-1) Antiseptic

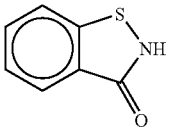

(Ab-2) Antiseptic

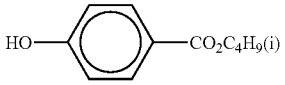

(Ab-3) Antiseptic

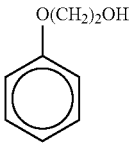

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium catecol-3,5-disulfonate was added to the second layer, the fourth layer and the sixth layer so that respective amounts would be 6 mg/m$^2$, 6 mg/m$^2$ and 18 mg/m$^2$, respectively. Further, to each layer, sodium polystyrene sulfonate was optionally added to adjust viscosity of the coating solutions. Further, in order to prevent irradiation, the following dyes (coating amounts are shown in parentheses) were added.

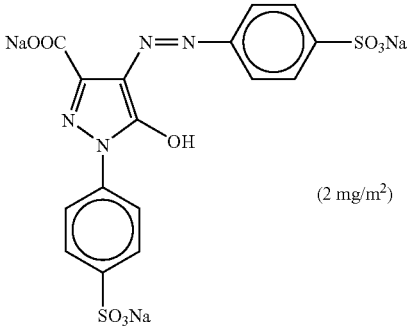

(2 mg/m$^2$)

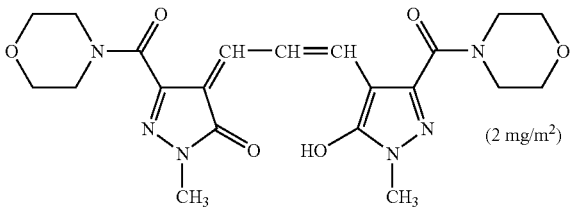

(2 mg/m$^2$)

-continued

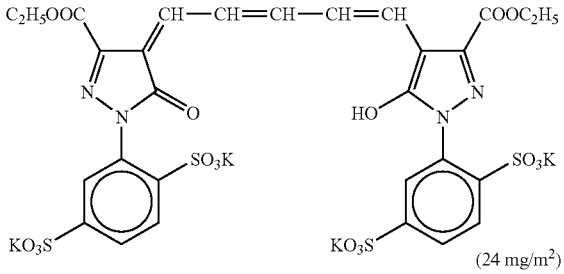

(24 mg/m$^2$)

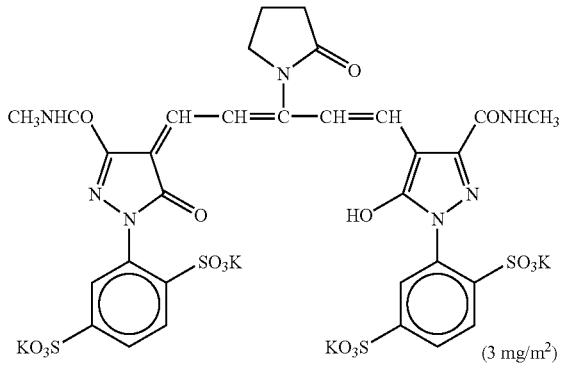

(3 mg/m$^2$)

(Layer Constitution)

The composition of each layer is shown below. The numbers show coating amounts (g/m$^2$). With respect to silver halide emulsions, the coating amount is in terms of silver.

Support

Polyethylene Resin-laminated Paper

[The polyethylene resin on the first layer side contained a white pigment ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %). The amount of the polyethylene resin was 29.2 g/m$^2$]

First Layer (Blue-sensitive Emulsion Layer)

| | |
|---|---|
| Silver chlorobromoiodide emulsion (gold-sulfur sensitized cubes, a 5:5 mixture of the large-size emulsion B-H and the small-size emulsion B-L (in terms of mol of silver)) | 0.17 |
| Gelatin | 1.43 |
| Yellow coupler (6) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.08 |
| Color-image stabilizer (Cpd-20) | 0.09 |
| Color-image stabilizer (Cpd-21) | 0.01 |
| Additive (ExC-1) | 0.001 |
| Color-image stabilizer (UV-2) | 0.01 |
| Solvent (Solv-4) | 0.27 |
| Solvent (Solv-6) | 0.04 |
| Solvent (Solv-9) | 0.27 |

Second Layer (Color-mixing Inhibiting Layer)

| | |
|---|---|
| Gelatin | 0.73 |
| Color-mixing inhibitor (Cpd-4) | 0.06 |
| Color-image stabilizer (Cpd-5) | 0.02 |
| Color-image stabilizer (Cpd-6) | 0.04 |
| Color-image stabilizer (Cpd-7) | 0.01 |
| Color-image stabilizer (UV-A) | 0.04 |
| Solvent (Solv-1) | 0.02 |
| Solvent (Solv-2) | 0.02 |
| Solvent (Solv-5) | 0.08 |
| Solvent (Solv-8) | 0.09 |

Third Layer (Green-sensitive Emulsion Layer)

| | |
|---|---|
| Silver chlorobromoiodide emulsion (gold-sulfur sensitized cubes, a 1:3 mixture of the large-size emulsion G-H and the small-size emulsion G-L (in terms of mol of silver)) | 0.12 |
| Gelatin | 0.97 |
| Magenta coupler (ExM) | 0.12 |
| Ultraviolet absorbing agent (UV-A) | 0.06 |
| Color-image stabilizer (Cpd-2) | 0.01 |
| Color-image stabilizer (Cpd-6) | 0.06 |
| Color-image stabilizer (Cpd-7) | 0.01 |
| Color-image stabilizer (Cpd-8) | 0.01 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-3) | 0.06 |
| Solvent (Solv-4) | 0.12 |
| Solvent (Solv-6) | 0.05 |
| Solvent (Solv-9) | 0.14 |

Fourth Layer (Color-mixing Inhibiting Layer)

| | |
|---|---|
| Gelatin | 0.58 |
| Color-mixing inhibitor (Cpd-4) | 0.05 |
| Color-image stabilizer (Cpd-5) | 0.02 |
| Color-image stabilizer (Cpd-6) | 0.03 |
| Color-image stabilizer (Cpd-7) | 0.02 |
| Color-image stabilizer (UV-A) | 0.03 |
| Solvent (Solv-1) | 0.02 |
| Solvent (Solv-2) | 0.06 |
| Solvent (Solv-5) | 0.07 |
| Solvent (Solv-8) | 0.07 |

Fifth Layer (Red-sensitive Emulsion Layer)

| | |
|---|---|
| Silver chlorobromoiodide emulsion (gold-sulfur sensitized cubes, a 4:6 mixture of the large-size emulsion R-H and the small-size emulsion R-L (in terms of mol of silver)) | 0.10 |
| Gelatin | 1.11 |
| Cyan coupler (ExC-1) | 0.12 |
| Cyan coupler (ExC-2) | 0.02 |
| Cyan coupler (ExC-3) | 0.03 |
| Color-image stabilizer (Cpd-1) | 0.01 |
| Color-image stabilizer (Cpd-7) | 0.01 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.17 |
| Color-image stabilizer (Cpd-16) | 0.01 |
| Color-image stabilizer (Cpd-17) | 0.01 |
| Color-image stabilizer (Cpd-18) | 0.05 |
| Color-image stabilizer (Cpd-19) | 0.03 |

-continued

| | |
|---|---|
| Color-image stabilizer (UV-4) | 0.10 |
| Solvent (Solv-5) | 0.17 |

Sixth Layer (Ultraviolet Absorbing Layer)

| | |
|---|---|
| Gelatin | 0.34 |
| Ultraviolet absorbing agent (UV-C) | 0.27 |
| Compound (S1-4) | 0.0015 |
| Solvent (Solv-7) | 0.09 |

Seventh Layer (Protective Layer)

| | |
|---|---|
| Gelatin | 0.65 |
| Additive (Cpd-22) | 0.03 |
| Liquid paraffin | 0.02 |
| Surface-active agent (Cpd-13) | 0.02 |

(ExM) Magenta coupler

A Mixture in 40:40:20 (molar ratio) of (ExM) Magenta coupler

A mixture in 40:40:20 (molar ratio) of

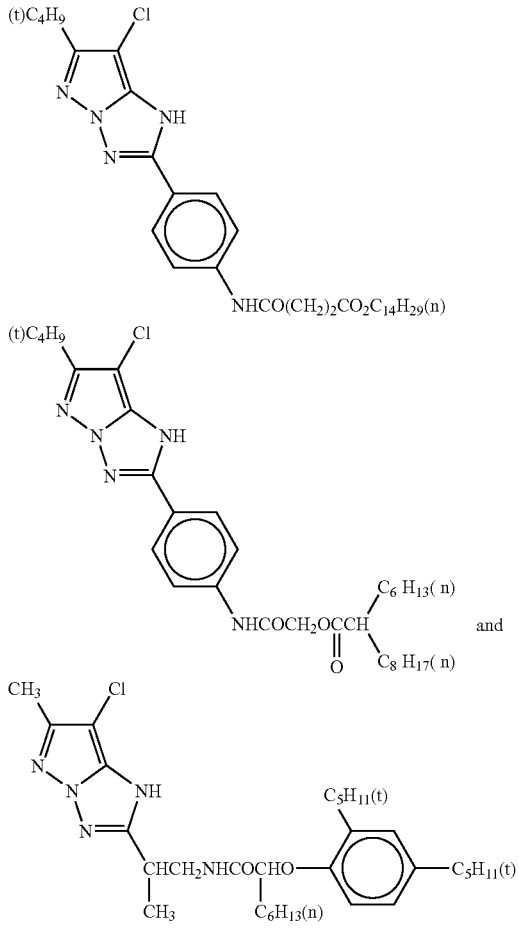

-continued (ExC–1) Cyan coupler

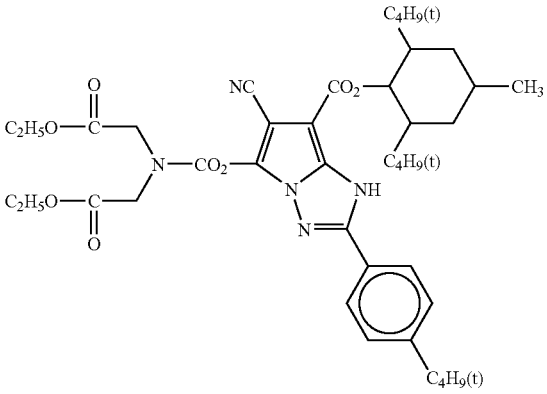

(ExC–2) Cyan coupler

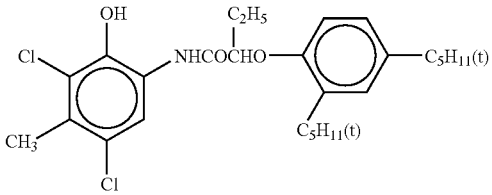

(ExC–3) Cyan coupler

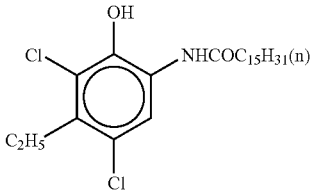

(Cpd–1) Color-image stabilizer

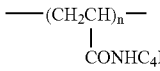

Number-average molecular weight: 60,000

(Cpd–2) Color-image stabilizer

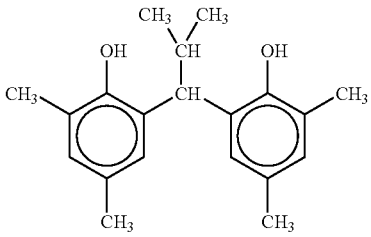

(Cpd–3) Color-image stabilizer

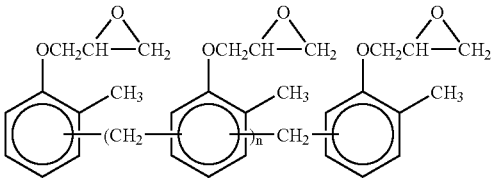

n = 7 ~ 8
(average value)

-continued (Cpd–4) Color-mixing inhibitor

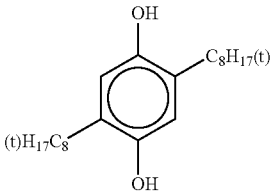

(Cpd–5) Color-image stabilizer

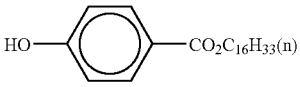

(Cpd–6) Color-image stabilizer

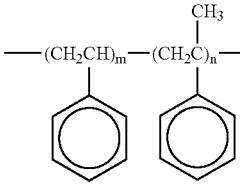

Number-average molecular weight: 600
m/n = 10/90

(Cpd–7) Color-image stabilizer

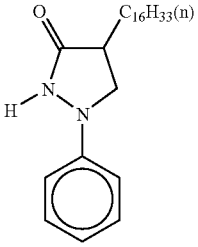

(Cpd–8) Color-image stabilizer

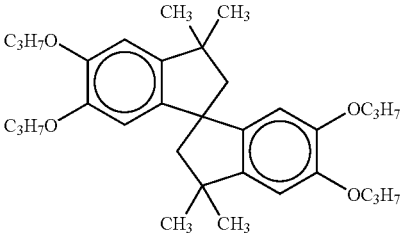

(Cpd–9) Color-image stabilizer

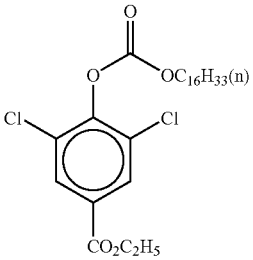

(Cpd–10) Color-image stabilizer

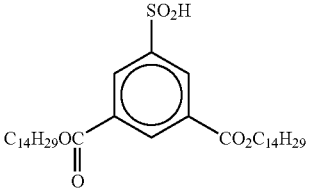

-continued
(Cpd–11)
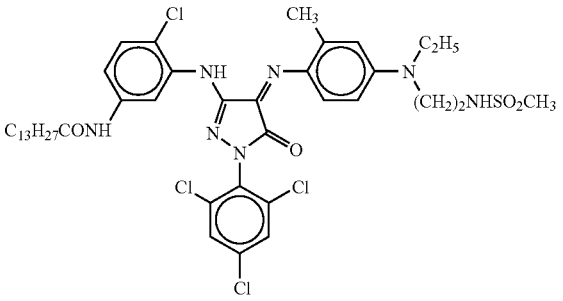
(Cpd–12)
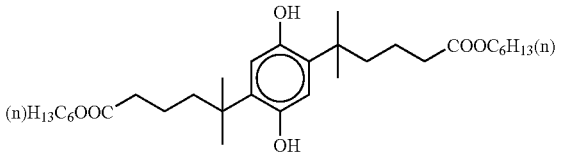
(Cpd–13) Surface-active agent
A mixture in 6:2:2 (molar ratio) of (a)/(b)/(c)
(a)
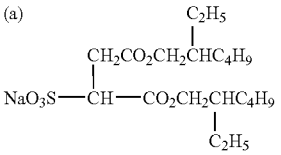
(b)
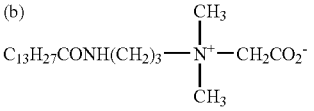
(c)
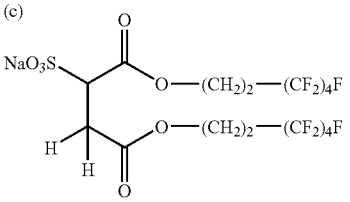
(Cpd–14)
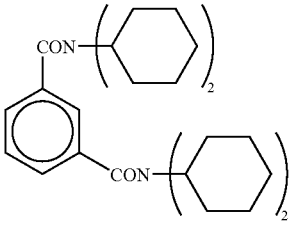
(Cpd–15)
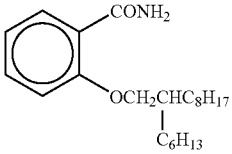
(Cpd–16)
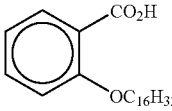
-continued
(Cpd–17)
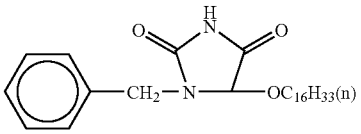
(Cpd–18)
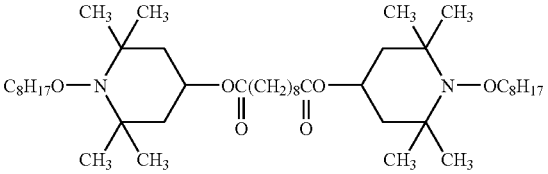
(Cpd–19)
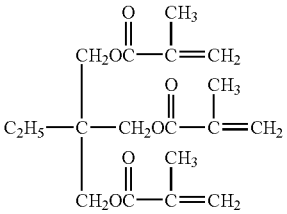
(Cpd–20)
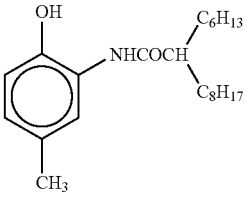
(Cpd–21)
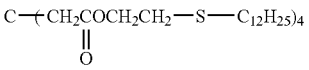
(Cpd–22)
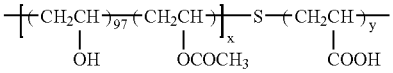
x:y = 5:1 (mass ratio)
(Solv–1)
(Solv–1)
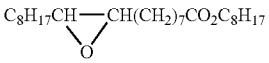
(Solv–2)
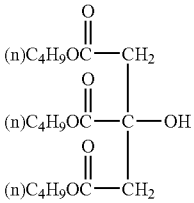
(Solv–3)
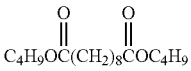
(Solv–4)
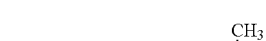
(Solv–5)
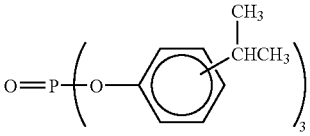
(Solv–6)

-continued (Solv–7)

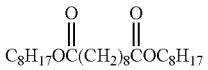

(Solv–8)

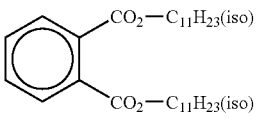

(Solv–9)

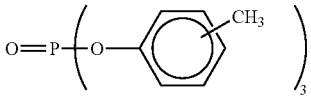

(S1–4)

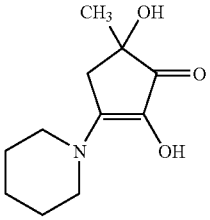

(UV–1) Ultraviolet absorbing agent

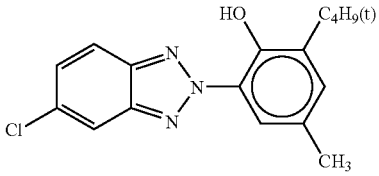

(UV–2) Ultraviolet absorbing agent

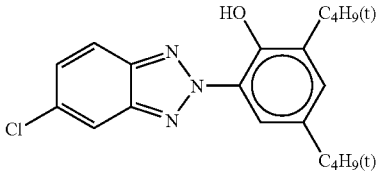

(UV–3) Ultraviolet absorbing agent

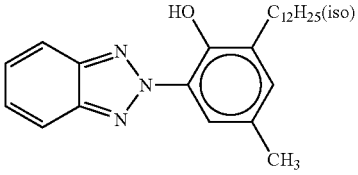

(UV–4) Ultraviolet absorbing agent

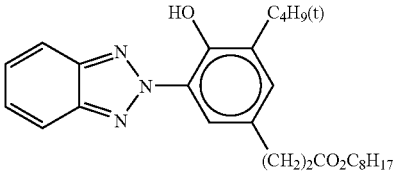

-continued (UV–5) Ultraviolet absorbing agent

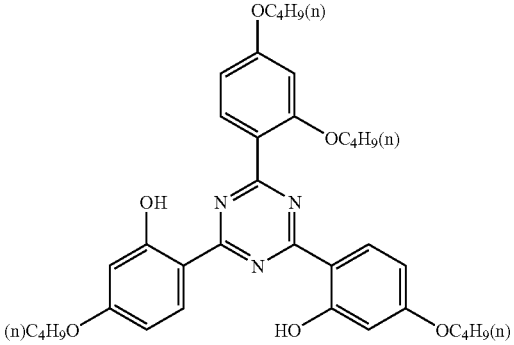

UV-A: A mixture of UV-1/UV-3=1/9 (mass ratio)

UV-B: A mixture of UV-1/UV-2=1/9 (mass ratio)

UV-C: A mixture of UV-1/UV-2/UV-3/UV-4=1/3/6/1 (mass ratio)

Sample 1101 was prepared in the same manner as in the above-mentioned preparation of Sample 001, except that the composition of the first layer was changed as shown below.

Composition of the First Layer (Blue-sensitive Emulsion Layer) of Sample 1101

First Layer (Blue-sensitive Emulsion Layer)

| | |
|---|---|
| Silver chlorobromoiodide emulsion (gold-sulfur sensitized cubes, a 5:5 mixture of the large-size emulsion B-H and the small-size emulsion B-L (in terms of mol of silver)) | 0.17 |
| Gelatin | 1.43 |
| Yellow coupler (6) (Exemplified compound (6)) | 0.34 |
| Solvent (Solv-4) | 0.46 |
| Solvent (Solv-9) | 0.46 |

Samples 1102 to 1124 were prepared in the same manner as Sample 1101, except for adding the compound represented by formula (TS-II) in an amount of 20 mole % based on the yellow coupler, and adding the compound represented by formula (Ph) in an amount of 70 mole % based on the yellow coupler. In adding these compounds, each sample was prepared in such a reduced amount of solvent that oil-soluble contents in the first layer would be a prescribed amount.

Two kinds of processing in which both the composition of processing solutions and the process time were different from each other were carried out, to evaluate photosensitive materials.

Processing Process A

The aforementioned photosensitive material 001 was processed into a roll with a width of 127 mm, and then a standard photographic image was exposed on the photosensitive material by means of a digital mini-lab FRONTIER 330 (trade name, manufactured by Fuji Photo Film Co., Ltd.). Thereafter, using the exposed photosensitive material, a continuous processing (running test) was conducted until the replenisher volume of the color developer used in the processing process set forth below became twice the volume of the color developer tank.

The processing using the following running processing solution was named Processing A.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Notes)
*Replenishment rate per $m^2$ of the photosensitive material to be processed.
**A rinse cleaning system RC50D, trade name, manufactured by Fuji Photo Film Co. Ltd., was installed in the rinse (3), and the rinse solution was taken out from the rinse (3) and sent to a reverse osmosis membrane module (RC50D) by using a pump.The permeated water obtained in that tank was supplied to the rinse (4), and the concentrated liquid was returned to the rinse (3). Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from (1) to (4).

The composition of each processing solution was as follows.

| (Color developer) | (Tank solution) | (Replenisher) |
|---|---|---|
| water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| Sodium 4,5-dihydroxybenzene-1, 3-disulfonate | 0.50 g | 0.50 g |
| Disodium-N, N-bis(sulfonatoethyl) hydroxylamine | 8.5 g | 14.0 g |
| 4-amino-3-methyl-N-ethyl-N-(β-methanesulfonamidoethyl) aniline . 3/2 sulfate . monohydrate | 4.8 g | 14.0 g |
| Potassium carbonate | 26.3 g | 26.3 g |
| Water to make | 1000 ml | 1000 ml |
| pH (25° C., adjusted using sulfuric acid and potassium hydroxide) | 10.15 | |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |

-continued

| (Bleach-fixing solution) | (Tank solution) | (Replenisher) |
|---|---|---|
| m-Carboxybenzenesulfinic acid | 8.3 g | 16.5 g |
| Ammonium iron (III) ethylenediamine tetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.5 | 6.5 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Processing Process B

The above photosensitive material Sample 001 was processed into a form of a roll with a width of 127 mm, and the photosensitive material was exposed with a standard photographic image, by using a digital Mini Lab FRONTIER 330 (trade name) manufactured by Fuji Photo Film Co., Ltd. Thereafter, a continuous processing (running test) was performed until the volume of the color-developer replenisher used in the following processing step became twice the volume of the color-developer tank. The processing using this running processing solution was named processing B.

| Processing step | Temperature | Time | Replenishment rate* |
|---|---|---|---|
| Color development | 45.0° C. | 17 sec | 45 ml |
| Bleach-fixing | 40.0° C. | 17 sec | 35 ml |
| Rinse (1) | 40.0° C. | 8 sec | — |
| Rinse (2) | 40.0° C. | 8 sec | — |
| Rinse (3)** | 40.0° C. | 8 sec | — |
| Rinse (4)** | 38.0° C. | 8 sec | 121 ml |
| Drying | 80° C. | 15 sec | |

(Notes)
*Replenishment rate per $m^2$ of the photosensitive material to be processed.
**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from (1) to (4).

The composition of each processing solution was as follows.

| (Color developer) | (Tank solution) | (Replenisher) |
|---|---|---|
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4, 5-dihydroxybenzene-1, 3-disulfonate | 0.50 g | 0.50 g |
| Disodium-N, N-bis(sulfonatoethyl) hydroxylamine | 8.5 g | 14.0 g |
| 4-amino-3-methyl-N-ethyl-N-(β-methanesulfonamidoethyl) aniline . 3/2 sulfate . monohydrate | 7.0 g | 19.0 g |
| Potassium carbonate | 26.3 g | 26.3 g |
| Water to make | 1000 ml | 1000 ml |
| pH (25° C., adjusted using sulfuric acid and potassium hydroxide) | 10.25 | 12.6 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.00 | 6.00 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

FL-1

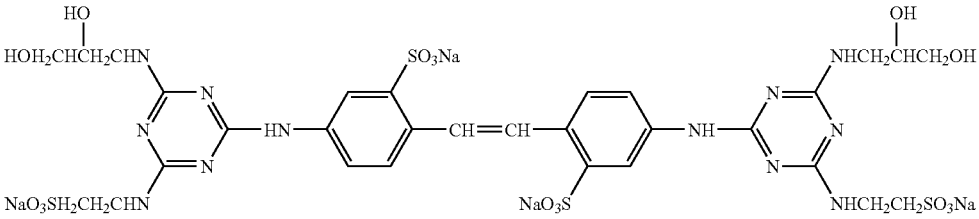

FL-2

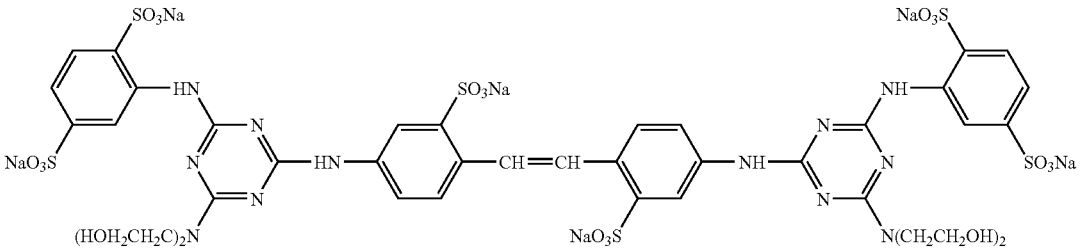

FL-3

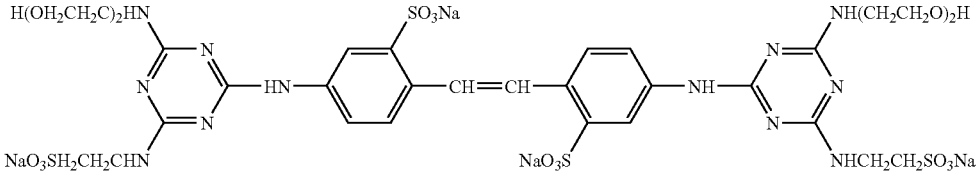

-continued

SR-1

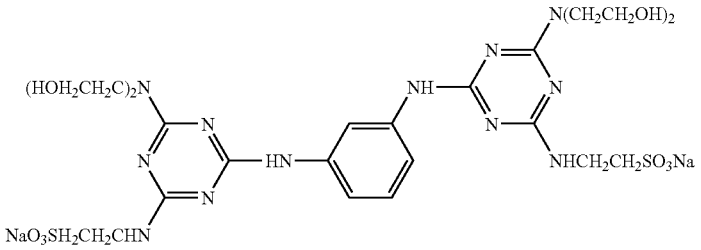

After being coated, the photosensitive material Samples 1101 to 1124 were kept for 10 days under conditions of 25° C. and 55% relative humidity, followed by the evaluation set forth below.

(Evaluation 1: Fastness to Light)

Each sample was subjected to exposure necessary to give a gray in the above-described processing process B, followed by color-development processing in the above-described processing process B.

As the light source, a semiconductor laser was used to obtain a light source at 688 nm (R light), a semiconductor laser was combined with SHG to obtain a light source at 532 nm (G light), and a light source at 473 nm (B light). The quantity of light of R light was modulated with using an outer modulator, and scanning exposure was performed to a sample moving in a direction orthogonal to the scanning direction, by reflecting these lights on a rotating polygon. The scanning exposure was performed at the density of 400 dpi and the average exposure time per 1 pixel was $8\times10^{-8}$ second. The temperature of the semiconductor lasers was kept constant, with using a Peltier element, to prevent the quantity of light from being changed by temperature.

Using the thus-prepared samples, densitometry was conducted before and after exposure to a Xenon lamp of 100,000 lux for 14 days. The surface temperature of the photosensitive materials was adjusted to become 50° C. A relative residual rate (%) after reservation was calculated for a yellow color-developing area of an initial density of 0.3. Further, the yellow density before and after irradiation of light, at an unexposed area, was also measured, to calculate the change of stain (ΔDmin).

The results obtained are shown in Table 2.

TABLE 2

| Sample No. | Coupler | Compound of formula (TS-II) | Compound of formula (Ph) | Light fastness: Relative residual rate (%) | Light fastness: ΔDmin |
|---|---|---|---|---|---|
| 1101 | 6 | — | — | 38 | 0.020 |
| 1102 | 6 | (TII-16) | — | 57 | 0.006 |
| 1103 | 6 | (TII-17) | — | 50 | 0.008 |
| 1104 | 6 | (TII-29) | — | 50 | 0.008 |
| 1105 | 6 | — | (A-101) | 57 | 0.019 |
| 1106 | 6 | — | (A-130) | 51 | 0.02 |
| 1107 | 6 | — | (A-87) | 55 | 0.02 |
| 1108 | 6 | — | (A-22) | 70 | 0.019 |

TABLE 2-continued

| Sample No. | Coupler | Compound of formula (TS-II) | Compound of formula (Ph) | Light fastness: Relative residual rate (%) | Light fastness: ΔDmin |
|---|---|---|---|---|---|
| 1109 | 6 | — | (A-12) | 68 | 0.019 |
| 1110 | 6 | (TII-16) | (A-101) | 67 | 0.004 |
| 1111 | 6 | (TII-16) | (A-130) | 62 | 0.004 |
| 1112 | 6 | (TII-16) | (A-87) | 65 | 0.004 |
| 1113 | 6 | (TII-16) | (A-22) | 85 | 0.004 |
| 1114 | 6 | (TII-16) | (A-12) | 83 | 0.004 |
| 1115 | 6 | (TII-17) | (A-101) | 63 | 0.006 |
| 1116 | 6 | (TII-17) | (A-130) | 59 | 0.006 |
| 1117 | 6 | (TII-17) | (A-87) | 61 | 0.006 |
| 1118 | 6 | (TII-17) | (A-22) | 80 | 0.006 |
| 1119 | 6 | (TII-17) | (A-12) | 77 | 0.006 |
| 1120 | 6 | (TII-29) | (A-101) | 63 | 0.006 |
| 1121 | 6 | (TII-29) | (A-130) | 59 | 0.006 |
| 1122 | 6 | (TII-29) | (A-87) | 61 | 0.006 |
| 1123 | 6 | (TII-29) | (A-22) | 80 | 0.006 |
| 1124 | 6 | (TII-29) | (A-12) | 77 | 0.006 |

It can be seen that the compounds represented by formula (Ph) exhibited effects of improving photo fading of a yellow dye, but exhibited almost no effect of improving photo stain. Further, the compounds represented by formula (TS-II) exhibited effects of improving both photo fading and photo stain. Moreover, the level of reducing photo fading and occurence of photo stain, were further improved by combined use of these two kinds of compounds, compared with single use of these compounds.

Example 2

Samples 1201 to 1232 were prepared in the same manner as samples 1113 and 1123 in Example 1, except for further adding color image-stabilizers in addition to the compounds according to the present invention, as shown in Table 3. The amount of the additional compounds was to achieve 20% of the yellow coupler respectively. In this addition of the additional compounds, each sample was prepared in such a reduced amount of solvent that oil-soluble contents in the first layer became a fixed quantity.

Similarly to Example 1, fastness to light of these samples was evaluated. The results obtained are shown in Table 3.

TABLE 3

| Sample No. | Coupler | Compound of formula (TS-II) | Compound of formula (Ph) | Other color-image stabilizer | Light fastness Relative residual rate (%) | Remarks |
|---|---|---|---|---|---|---|
| 1113 | 6 | (TII-16) | (A-22) | — | 85 | This invention |
| 1201 | 6 | (TII-16) | (A-22) | B-17 | 90 | This invention |
| 1202 | 6 | (TII-16) | (A-22) | B-21 | 88 | This invention |
| 1203 | 6 | (TII-16) | (A-22) | TI-17 | 88 | This invention |
| 1204 | 6 | (TII-16) | (A-22) | TII-16 | 88 | This invention |
| 1205 | 6 | (TII-16) | (A-22) | TIV-12 | 88 | This invention |
| 1206 | 6 | (TII-16) | (A-22) | TV-4 | 87 | This invention |
| 1207 | 6 | (TII-16) | (A-22) | TVI-23 | 89 | This invention |
| 1208 | 6 | (TII-16) | (A-22) | TVII-1 | 88 | This invention |
| 1209 | 6 | (TII-16) | (A-22) | TVII-19 | 88 | This invention |
| 1210 | 6 | (TII-16) | (A-22) | UA-5 | 88 | This invention |
| 1211 | 6 | (TII-16) | (A-22) | UB-3 | 87 | This invention |
| 1212 | 6 | (TII-16) | (A-22) | UC-2 | 87 | This invention |
| 1213 | 6 | (TII-16) | (A-22) | UD-7 | 87 | This invention |
| 1214 | 6 | (TII-16) | (A-22) | UE-2 | 88 | This invention |
| 1215 | 6 | (TII-16) | (A-22) | P-2 | 88 | This invention |
| 1216 | 6 | (TII-16) | (A-22) | TIV-12<br>TVI-23<br>TVII-19<br>UA-5 | 92 | This invention |
| 1123 | 6 | (TII-29) | (A-22) | — | 80 | This invention |
| 1217 | 6 | (TII-29) | (A-22) | B-17 | 85 | This invention |
| 1218 | 6 | (TII-29) | (A-22) | B-21 | 83 | This invention |
| 1219 | 6 | (TII-29) | (A-22) | TI-17 | 83 | This invention |
| 1220 | 6 | (TII-29) | (A-22) | TII-16 | 83 | This invention |
| 1221 | 6 | (TII-29) | (A-22) | TIV-12 | 83 | This invention |
| 1222 | 6 | (TII-29) | (A-22) | TV-4 | 82 | This invention |
| 1223 | 6 | (TII-29) | (A-22) | TVI-23 | 84 | This invention |
| 1224 | 6 | (TII-29) | (A-22) | TVII-1 | 83 | This invention |
| 1225 | 6 | (TII-29) | (A-22) | TVII-19 | 83 | This invention |
| 1226 | 6 | (TII-29) | (A-22) | UA-5 | 83 | This invention |
| 1227 | 6 | (TII-29) | (A-22) | UB-3 | 82 | This invention |
| 1228 | 6 | (TII-29) | (A-22) | UC-2 | 82 | This invention |
| 1229 | 6 | (TII-29) | (A-22) | UD-7 | 82 | This invention |
| 1230 | 6 | (TII-29) | (A-22) | UE-2 | 83 | This invention |
| 1231 | 6 | (TII-29) | (A-22) | P-2 | 83 | This invention |
| 1232 | 6 | (TII-29) | (A-22) | TIV-12<br>TVI-23<br>TVII-19<br>UA-5 | 88 | This invention |

It can be seen that fastness to light was further improved when any one or more of the following compounds: the compound represented by any one of formulae (E-1) to (E-3), the compound represented by any one of formulae (TS-I) and (TS-III) to (TS-VII), the metal complex, the ultraviolet absorbing agent, and the water-insoluble homopolymer or copolymer; was used, together with a combination of the compound represented by formula (Ph) and the compound represented by formula (TS-II).

Example 3

Samples 1301 to 1306 were prepared in the same manner as Sample 1216 in Example 2, except for replacing the yellow coupler in the first layer with the respective yellow couplers shown in Table 4. The yellow couplers were changed in an equivalent molar amount respectively. Similarly to Example 1, photo fading of these samples was evaluated. The results obtained are shown in Table 4.

TABLE 4

| Sample No. | Coupler | Light fastness Relative residual rate (%) |
|---|---|---|
| 1216 | 6 | 92 |
| 1301 | 7 | 85 |
| 1302 | 8 | 88 |
| 1303 | 17 | 83 |
| 1304 | 19 | 76 |
| 1305 | 21 | 65 |
| 1306 | 22 | 63 |

It can be seen that the samples using yellow couplers according to the present invention, in which the structure of the yellow coupler had an alkylthio group or an arylthio group at the ortho-position to the —CONH— group, were excellent in fastness to light. Among them, the samples using yellow couplers according to the present invention, in which the structure of the yellow coupler had an alkylthio group at the ortho-position to the —CONH— group, were more excellent in fastness to light. Moreover, the sample using the yellow coupler according to the present invention, in which the structure of the yellow coupler also had a t-butyl group at the para-position to the alkylthio group, was even more excellent in fastness to light.

Example 4

Samples were prepared in the same manner as Sample 001 and the samples in Examples 1 to 3, except that the amount of the solvents in the first layer was reduced so that the total amount of hydrophobic additives became 67%, and the amount of gelatin was reduced to 67%. The same evaluation as in Example 1 was conducted. The thus-obtained results demonstrate that fastness to light was improved by a combination of the yellow coupler according to the present invention and the compounds according to the present invention.

Example 5

Samples were prepared in the same manner as those in Example 3, except that the ultraviolet-absorbing agent in the second layer, the third layer and the fourth layer was changed from (UV-A) to (UV-B). The same evaluation as in Example 1 was conducted, and then essentially the same results were obtained.

Example 6

Samples were prepared in the same manner as Sample 001 and the samples in Examples 1, 2 and 4, except that the ultraviolet-absorbing agent in the second layer, the third layer and the fourth layer was changed from (UV-A) to (UV-B). The same evaluation as in Example 1 was conducted. The thus-obtained results demonstrate that fastness to light was improved by a combination of the yellow coupler according to the present invention and the compounds according to the present invention.

Example 7

Samples were prepared in the same manner as the samples in Example 3, except for replacing (Cpd-4) in the second layer and the fourth layer with (Cpd-12) in an equivalent molar amount. The same evaluation as in Example 1 was conducted. The thus-obtained results confirmed that fastness to light was improved by a combination of the yellow coupler according to the present invention and the compounds according to the present invention. In addition, the effects were particularly remarkable.

Example 8

Samples were prepared in the same manner as the samples in Example 7, except for replacing the support used in Example 7 with a 175-μm thick PET reflection-type support in which barium sulfate was added and kneaded. The same evaluation as in Example 1 was conducted and essentially the same results were obtained.

Example 9

Each sample prepared in Examples 1 to 8 was scan-exposed, by means of each exposure apparatus set forth bellow, and processed according to processing process A. The same evaluation of fastness to light as in Example 1 was conducted. The thus-obtained results demonstrate that each sample according to the present invention was excellent in fastness to light, regardless of the kind of exposure apparatus used.

Exposure Apparatus

Digital mini-lab FRONTIER 330 (trade name, manufactured by Fuji Photo Film Co., Ltd.)

Lambda 130 (trade name, manufactured by Durst Co.)

LIGHTJET 5000 (trade name, manufactured by Gretag Co.)

Example 10

Samples were prepared in the same manner as the samples in Example 3, except for changing the composition as set forth below.

Coating amount of the blue-sensitive silver halide emulsion layer: 240%

Coating amount of the green-sensitive silver halide emulsion layer: 250%

Coating amount of the red-sensitive silver halide emulsion layer: 260%

Support: 180 μm-thick polyethylene terephthalate transparent support

Each of these samples was processed according to processing process B in Example 1. However, in this processing process B, each of the processing steps was prolonged by 2.7 times. The same evaluation as in Example 1 was conducted.

The thus-obtained results demonstrate that a combination use of the yellow coupler according to the present invention and the compounds according to the present invention, was excellent in image fastness.

Example 11

Samples 2101 were prepared in the same manner as Sample 001 prepared in the above-described Example 1, except that the composition of the first layer was changed as follows.

Composition of the First Layer (Blue-sensitive Emulsion Layer) of Sample 2101

First Layer (Blue-sensitive Emulsion Layer)

| | |
|---|---|
| Silver chlorobromoiodide emulsion (gold-sulfur sensitized cubes, a 5:5 mixture of the large-size emulsion B-H and the small-size emulsion B-L (in terms of mol of silver)) | 0.17 |
| Gelatin | 1.43 |
| Yellow coupler (Coupler for comparison 1) | 0.34 |
| Solvent (Solv-4) | 0.46 |
| Solvent (Solv-9) | 0.46 |

Samples 2102 to 2167 were prepared in the same manner as Sample 2101, except for replacing the coupler with those set forth in Table 5 and adding the discoloration (fading) inhibitor to the first layer as set forth in Table 5. The coupler was replaced in an equivalent molar amount to that in Sample 2101. Further, the amount of the inhibitor to be added was set to 70 mole % of the coupler. In this connection, the samples were prepared in such a reduced amount of solvent that oil-soluble contents in the first layer became a fixed quantity.

After being coated, the photosensitive material Samples 2101 to 2167 were kept for 10 days under conditions of 25° C. and 55% RH, followed by the evaluation set forth below.

(Evaluation 2: Fastness to Light)

Each sample was subjected to exposure necessary to give a gray image in the above-described processing process B, followed by color development in the above-described processing processes A and B.

As a light source, a semiconductor laser was used to obtain a light source at 688 nm (R light), a semiconductor laser was combined with SHG to obtain a light source at 532 nm (G light) and a light source at 473 nm (B light). The quantity of R light was modulated with using an outer modulator, and scanning exposure was performed to a sample moving in a direction orthogonal to the scanning direction, by reflecting the three lights on a rotating polygon. The scanning exposure was performed at the density of 400 dpi and the average exposure time per 1 pixel was $8\times10^{-8}$ second. The temperature of the semiconductor laser was kept constant, with using a Peltier element, in order to prevent quantity of light from changing by temperature.

Using the thus-prepared samples, densitometry was conducted before and after exposure to a Xenon lamp of 100,000 lux for 14 days. The surface temperature of the photosensitive material was adjusted to become 50° C. A relative residual rate (%) after reservation was calculated for a yellow color-developing area of the initial density of 0.3.

The results obtained by evaluating the samples processed according to processing process B are shown in Table 5. Further, the samples processed according to processing process A showed essentially the same results as the samples processed according to processing process B.

TABLE 5

| Sample No. | Coupler | Inhibitor | Relative residual rate (%) |
|---|---|---|---|
| 2101 | Coupler for comparison 1 | — | 15 |
| 2102 | Coupler for comparison 1 | A-101 | 32 |
| 2103 | Coupler for comparison 1 | A-114 | 32 |
| 2104 | Coupler for comparison 1 | A-84 | 30 |
| 2105 | Coupler for comparison 1 | A-130 | 28 |
| 2106 | Coupler for comparison 1 | A-22 | 37 |
| 2107 | Coupler for comparison 1 | A-12 | 36 |
| 2108 | Coupler for comparison 2 | — | 22 |
| 2109 | Coupler for comparison 2 | A-101 | 38 |
| 2110 | Coupler for comparison 2 | A-114 | 38 |
| 2111 | Coupler for comparison 2 | A-84 | 37 |
| 2112 | Coupler for comparison 2 | A-130 | 35 |
| 2113 | Coupler for comparison 2 | A-22 | 43 |
| 2114 | Coupler for comparison 2 | A-12 | 42 |
| 2115 | Coupler for comparison 3 | — | 23 |
| 2116 | Coupler for comparison 3 | A-101 | 39 |
| 2117 | Coupler for comparison 3 | A-114 | 39 |
| 2118 | Coupler for comparison 3 | A-84 | 37 |
| 2119 | Coupler for comparison 3 | A-130 | 36 |
| 2120 | Coupler for comparison 3 | A-22 | 44 |
| 2121 | Coupler for comparison 3 | A-12 | 43 |
| 2122 | 102 | — | 38 |
| 2123 | 102 | A-101 | 57 |
| 2124 | 102 | A-114 | 57 |
| 2125 | 102 | A-125 | 57 |
| 2126 | 102 | A-129 | 51 |
| 2127 | 102 | A-130 | 52 |
| 2128 | 102 | A-83 | 55 |
| 2129 | 102 | A-84 | 55 |
| 2130 | 102 | A-85 | 55 |
| 2131 | 102 | A-90 | 55 |
| 2132 | 102 | A-22 | 70 |
| 2133 | 102 | A-40 | 69 |
| 2134 | 102 | A-21 | 60 |
| 2135 | 102 | A-12 | 68 |
| 2136 | 102 | A-4 | 59 |
| 2137 | 102 | A-3 | 63 |
| 2138 | 102 | A-7 | 65 |
| 2139 | 102 | A-35 | 62 |
| 2140 | 102 | A-44 | 61 |
| 2141 | 102 | A-55 | 61 |
| 2142 | 102 | A-30 | 61 |
| 2143 | 102 | A-28 | 61 |
| 2144 | 102 | A-58 | 61 |
| 2145 | 102 | A-60 | 61 |
| 2146 | 102 | A-61 | 61 |
| 2147 | 104 | — | 35 |
| 2148 | 104 | A-101 | 54 |
| 2149 | 104 | A-114 | 54 |
| 2150 | 104 | A-84 | 52 |
| 2151 | 104 | A-130 | 52 |
| 2152 | 104 | A-22 | 68 |
| 2153 | 104 | A-12 | 67 |
| 2154 | 113 | — | 36 |
| 2155 | 113 | A-101 | 55 |
| 2156 | 113 | A-114 | 55 |
| 2157 | 113 | A-84 | 54 |
| 2158 | 113 | A-130 | 53 |
| 2159 | 113 | A-22 | 69 |
| 2160 | 113 | A-12 | 68 |
| 2161 | 101 | — | 34 |
| 2162 | 101 | A-101 | 53 |
| 2163 | 101 | A-114 | 53 |
| 2164 | 101 | A-84 | 51 |
| 2165 | 101 | A-130 | 51 |
| 2166 | 101 | A-22 | 67 |
| 2167 | 101 | A-12 | 66 |

Coupler for comparison 1

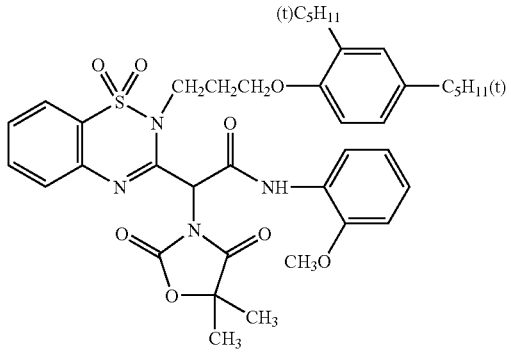

Coupler for comparison 2

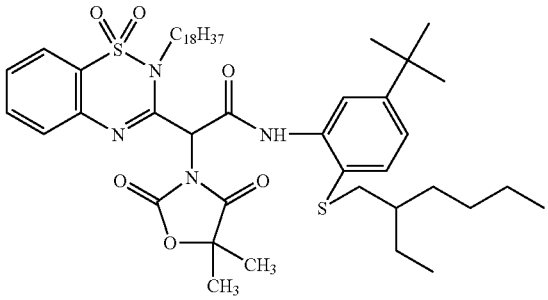

Coupler for comparison 3

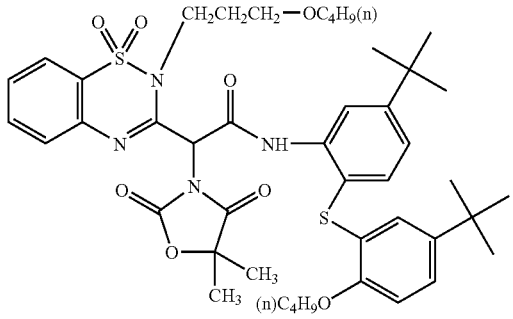

The results in Table 5 clearly show that addition of the compound represented by formula (Ph), to the samples, enabled remarkably improved fastness, compared with samples free of the said compounds. In addition, it can be seen that a combination of the coupler represented by formula (Ia) and the inhibitors for use in the present invention provided particularly excellent fastness.

Further, it can be seen from comparing, for example, Samples 2123 to 2130 with samples 2132 to 2146, that the compound represented by formula (Ph-1), in which $R_{b6}$ was an aliphatic group, among the compounds for use in the present invention, showed a particularly high relative residual rate, leading to higher image fastness. Further, it can be seen from comparing, for example, sample 2135 with sample 2137, that when the total of carbon atoms of $R_{b6}$ was 12 or more, the relative residual rate was higher, leading to higher image fastness, compared with when the total of carbon atoms of $R_{b6}$ was 11 or less. Further, it can be seen from comparing, for example, sample 2132 with sample 2136, that when $R_{b6}$ was a branched-chain group, the relative residual rate was higher, leading to higher image fastness, compared with when $R_{b6}$ was a straight chain group.

In addition, it can be seen that samples 2102, 2109, 2116, 2123, 2148, 2155, and 2162, employing A-101 as a discoloration inhibitor, were high in relative residual rate, but gave rise to cyan color turbidity (color contamination).

Example 12

Samples 2201 to 2218 were prepared in the same manner as samples 2123, 2124, 2129, 2132, 2135 and 2137 in Example 11, except that the respective compounds represented by any one of formulae (E-1) to (E-3) set forth in Table 6 were additionally incorporated in the first layer. The compound represented by any one of formulae (E-1) to (E-3) was added in an amount to be 20 mole % based on the magenta coupler. In adding these compounds, each sample was prepared using such a reduced amount of solvent that oil-soluble contents in the first layer became a fixed quantity.

TABLE 6

| Sample No. | Coupler | Inhibitor | Compound of formula (E-1), (E-2) or (E-3) | Relative residual rate (%) | Remarks |
|---|---|---|---|---|---|
| 2123 | (102) | A-101 | — | 57 | This invention |
| 2201 | (102) | A-101 | B-17 | 63 | This invention |
| 2202 | (102) | A-101 | B-13 | 62 | This invention |
| 2203 | (102) | A-101 | B-21 | 62 | This invention |
| 2124 | (102) | A-114 | — | 57 | This invention |
| 2204 | (102) | A-114 | B-17 | 63 | This invention |
| 2205 | (102) | A-114 | B-13 | 62 | This invention |
| 2206 | (102) | A-114 | B-21 | 62 | This invention |
| 2129 | (102) | A-84 | — | 55 | This invention |
| 2207 | (102) | A-84 | B-17 | 60 | This invention |
| 2208 | (102) | A-84 | B-13 | 59 | This invention |
| 2209 | (102) | A-84 | B-21 | 59 | This invention |
| 2132 | (102) | A-22 | — | 70 | This invention |
| 2210 | (102) | A-22 | B-17 | 77 | This invention |
| 2211 | (102) | A-22 | B-13 | 76 | This invention |
| 2212 | (102) | A-22 | B-21 | 76 | This invention |
| 2135 | (102) | A-12 | — | 68 | This invention |
| 2213 | (102) | A-12 | B-17 | 75 | This invention |
| 2214 | (102) | A-12 | B-13 | 74 | This invention |
| 2215 | (102) | A-12 | B-21 | 74 | This invention |
| 2137 | (102) | A-3 | — | 63 | This invention |
| 2216 | (102) | A-3 | B-17 | 69 | This invention |
| 2217 | (102) | A-3 | B-13 | 69 | This invention |

TABLE 6-continued

| Sample No. | Coupler | Inhibitor | Compound of formula (E-1), (E-2) or (E-3) | Relative residual rate (%) | Remarks |
|---|---|---|---|---|---|
| 2218 | (102) | A-3 | B-21 | 69 | This invention |

Similarly to Example 11, each sample was subjected to exposure to light, and a development processing, and fastness to light was evaluated in the same manner as in Example 11.

The results in Table 6 clearly show that supplementary addition of the compound represented by any one of formulae (E-1) to (E-3) further improved image fastness. In particular, it can be seen that a combination of the above-said compound and the compound represented by formula (Ph-1) improved image fastness more effectively.

In addition, it can be seen that Samples 2201 to 2203 employing A-101 as a discoloration inhibitor were high in image fastness, but gave rise to cyan color turbidity.

Example 13

Samples 2301 to 2374 were prepared in the same manner as samples 2201, 2204, 2207, 2210 and 2213 in Example 12, except that the respective other discoloration inhibitor set forth in Table 7 were additionally incorporated in the first layer. The amount of the other discoloration inhibitor was added so as to become 20 mole % based on the coupler. In this occasion, each sample was prepared using such a reduced amount of solvent that oil-soluble contents in the first layer became a fixed quantity.

TABLE 7

| Sample No. | Coupler | Inhibitor | Compound of formula (E-1), (E-2) or (E-3) | Other inhibitor | Relative residual rate (%) | Remarks |
|---|---|---|---|---|---|---|
| 2201 | (102) | A-101 | B-17 | — | 63 | This invention |
| 2301 | (102) | A-101 | B-17 | TI-17 | 66 | This invention |
| 2302 | (102) | A-101 | B-17 | TII-24 | 67 | This invention |
| 2303 | (102) | A-101 | B-17 | TIII-15 | 65 | This invention |
| 2304 | (102) | A-101 | B-17 | TIV-12 | 66 | This invention |
| 2305 | (102) | A-101 | B-17 | TV-4 | 65 | This invention |
| 2306 | (102) | A-101 | B-17 | TVI-23 | 66 | This invention |
| 2307 | (102) | A-101 | B-17 | TVIII-1 | 65 | This invention |
| 2308 | (102) | A-101 | B-17 | TVII-19 | 66 | This invention |
| 2309 | (102) | A-101 | B-17 | UA-5 | 66 | This invention |
| 2310 | (102) | A-101 | B-17 | UB-3 | 65 | This invention |
| 2311 | (102) | A-101 | B-17 | UC-2 | 65 | This invention |
| 2312 | (102) | A-101 | B-17 | UD-7 | 65 | This invention |
| 2313 | (102) | A-101 | B-17 | UE-2 | 66 | This invention |
| 2314 | (102) | A-101 | B-17 | P-2 | 65 | This invention |
| 2204 | (102) | A-114 | B-17 | — | 63 | This invention |
| 2315 | (102) | A-114 | B-17 | TI-17 | 66 | This invention |
| 2316 | (102) | A-114 | B-17 | TII-24 | 67 | This invention |
| 2317 | (102) | A-114 | B-17 | TIII-15 | 65 | This invention |
| 2318 | (102) | A-114 | B-17 | TIV-12 | 66 | This invention |
| 2319 | (102) | A-114 | B-17 | TV-4 | 65 | This invention |
| 2320 | (102) | A-114 | B-17 | TVI-23 | 66 | This invention |
| 2321 | (102) | A-114 | B-17 | TVIII-1 | 65 | This invention |
| 2322 | (102) | A-114 | B-17 | TVII-19 | 66 | This invention |
| 2323 | (102) | A-114 | B-17 | UA-5 | 66 | This invention |

TABLE 7-continued

| Sample No. | Coupler | Inhibitor | Compound of formula (E-1), (E-2) or (E-3) | Other inhibitor | Relative residual rate (%) | Remarks |
|---|---|---|---|---|---|---|
| 2324 | (102) | A-114 | B-17 | UB-3 | 65 | This invention |
| 2325 | (102) | A-114 | B-17 | UC-2 | 65 | This invention |
| 2326 | (102) | A-114 | B-17 | UD-7 | 65 | This invention |
| 2327 | (102) | A-114 | B-17 | UE-2 | 66 | This invention |
| 2328 | (102) | A-114 | B-17 | P-2 | 65 | This invention |
| 2207 | (102) | A-84 | B-17 | — | 60 | This invention |
| 2329 | (102) | A-84 | B-17 | TI-17 | 63 | This invention |
| 2330 | (102) | A-84 | B-17 | TII-24 | 64 | This invention |
| 2331 | (102) | A-84 | B-17 | TIII-15 | 62 | This invention |
| 2332 | (102) | A-84 | B-17 | TIV-12 | 63 | This invention |
| 2333 | (102) | A-84 | B-17 | TV-4 | 62 | This invention |
| 2334 | (102) | A-84 | B-17 | TVI-23 | 63 | This invention |
| 2335 | (102) | A-84 | B-17 | TVIII-1 | 62 | This invention |
| 2336 | (102) | A-84 | B-17 | TVII-19 | 63 | This invention |
| 2337 | (102) | A-84 | B-17 | UA-5 | 62 | This invention |
| 2338 | (102) | A-84 | B-17 | UB-3 | 62 | This invention |
| 2339 | (102) | A-84 | B-17 | UC-2 | 62 | This invention |
| 2340 | (102) | A-84 | B-17 | UD-7 | 62 | This invention |
| 2341 | (102) | A-84 | B-17 | UE-2 | 63 | This invention |
| 2342 | (102) | A-84 | B-17 | P-2 | 62 | This invention |
| 2210 | (102) | A-22 | B-17 | — | 77 | This invention |
| 2343 | (102) | A-22 | B-17 | TI-17 | 82 | This invention |
| 2344 | (102) | A-22 | B-17 | TII-24 | 85 | This invention |
| 2345 | (102) | A-22 | B-17 | TIII-15 | 82 | This invention |
| 2346 | (102) | A-22 | B-17 | TIV-12 | 83 | This invention |
| 2347 | (102) | A-22 | B-17 | TV-4 | 82 | This invention |
| 2348 | (102) | A-22 | B-17 | TVI-23 | 83 | This invention |
| 2349 | (102) | A-22 | B-17 | TVIII-1 | 82 | This invention |
| 2350 | (102) | A-22 | B-17 | TVII-19 | 83 | This invention |
| 2351 | (102) | A-22 | B-17 | UA-5 | 83 | This invention |
| 2352 | (102) | A-22 | B-17 | UB-3 | 82 | This invention |
| 2353 | (102) | A-22 | B-17 | UC-2 | 82 | This invention |
| 2354 | (102) | A-22 | B-17 | UD-7 | 82 | This invention |
| 2355 | (102) | A-22 | B-17 | UE-2 | 83 | This invention |
| 2356 | (102) | A-22 | B-17 | P-2 | 82 | This invention |
| 2357 | (102) | A-22 | B-17 | TIV-12<br>TVI-23<br>TVII-19<br>UA-5 | 87 | This invention |

TABLE 7-continued

| Sample No. | Coupler | Inhibitor | Compound of formula (E-1), (E-2) or (E-3) | Other inhibitor | Relative residual rate (%) | Remarks |
|---|---|---|---|---|---|---|
| 2358 | (102) | A-22 | B-17 | TIV-12<br>TVI-23<br>TVII-19<br>UA-5<br>TII-24 | 92 | This invention |
| 2213 | (102) | A-12 | B-17 | — | 75 | This invention |
| 2359 | (102) | A-12 | B-17 | TI-17 | 80 | This invention |
| 2360 | (102) | A-12 | B-17 | TII-24 | 83 | This invention |
| 2361 | (102) | A-12 | B-17 | TIII-15 | 80 | This invention |
| 2362 | (102) | A-12 | B-17 | TIV-12 | 81 | This invention |
| 2363 | (102) | A-12 | B-17 | TV-4 | 80 | This invention |
| 2364 | (102) | A-12 | B-17 | TVI-23 | 81 | This invention |
| 2365 | (102) | A-12 | B-17 | TVIII-1 | 80 | This invention |
| 2366 | (102) | A-12 | B-17 | TVII-19 | 81 | This invention |
| 2367 | (102) | A-12 | B-17 | UA-5 | 81 | This invention |
| 2368 | (102) | A-12 | B-17 | UB-3 | 80 | This invention |
| 2369 | (102) | A-12 | B-17 | UC-2 | 80 | This invention |
| 2370 | (102) | A-12 | B-17 | UD-7 | 80 | This invention |
| 2371 | (102) | A-12 | B-17 | UE-2 | 81 | This invention |
| 2372 | (102) | A-12 | B-17 | P-2 | 80 | This invention |
| 2373 | (102) | A-12 | B-17 | TIV-12<br>TVI-23<br>TVII-19<br>UA-5 | 85 | This invention |
| 2374 | (102) | A-12 | B-17 | TIV-12<br>TVI-23<br>TVII-19<br>UA-5<br>TII-24 | 90 | This invention |

Similarly to Example 11, each sample was subjected to exposure to light, and a development processing, and fastness to light was evaluated in the same manner as in Example 11.

The results in Table 7 clearly show that supplementary addition of one or more of: the compound represented by any one of formulae (TS-I) to (TS-VII), the metal complex, the ultraviolet absorbing agent, and the water-insoluble homopolymer or copolymer, further improved image fastness. In particular, it can be seen that a combination use of at least one of the above compounds and the compound represented by formula (Ph) for use in the present invention enabled more effectively improved image fastness.

Example 14

Samples were prepared in the same manner as samples 2101 to 2167 of Example 11, samples 2201 to 2218 of Example 12, and samples 2301 to 2374 of Example 13, except that the kind of the ultraviolet-ray absorbing agent in the second layer, the third layer and the forth layer was changed from (UV-A) to (UV-B). The same evaluation as in Example 11 was carried out, and essentially the same results were obtained.

Example 15

Samples were prepared in the same manner as samples 2101 to 2167 of Example 11, samples 2201 to 2218 of Example 12, and samples 2301 to 2374 of Example 13, except that (Cpd-4) of the second layer and the forth layer was replaced with an equivalent molar amount of (Cpd-12) respectively. The same evaluation as in Example 11 was carried out, and improvement of fastness to light, owing to combined use of the coupler and the additive(s) for use in the present invention, was confirmed. The resulted effects were particularly remarkable.

Example 16

Samples were prepared in the same manner as samples in Example 15, except that the support was replaced with a PET reflection support of 175 μm thickness, in which PET was kneaded with barium sulfate. An evaluation according to Example 11 was carried out, and essentially the same results were obtained.

Example 17

Samples 2101 to 2167 of Example 11, samples 2201 to 2218 of Example 12, and samples 2301 to 2374 of Example 13 were scan-exposed by means of each exposure apparatus set forth bellow. An evaluation according to Example 11 was conducted. The thus-obtained results demonstrate that each sample according to the present invention exhibited the effects of the invention of excellent fastness to light and processing stability, regardless of the kind of exposure apparatus used.

Exposure Apparatus

Digital mini-lab FRONTIER 330 (trade name, manufactured by Fuji Photo Film Co., Ltd.)

Lambda 130 (trade name, manufactured by Durst Co.)

LIGHTJET 5000 (trade name, manufactured by Gretag Co.)

Example 18

Samples were prepared in the same manner as the samples in Example 11, except for changing the composition as set forth below.

Coating amount of the blue-sensitive silver halide emulsion layer: 240%

Coating amount of the green-sensitive silver halide emulsion layer: 250%

Coating amount of the red-sensitive silver halide emulsion layer: 260%

Support: 180 μm thick polyethylene terephthalate transparent support

Each of these samples was processed according to processing process B in Example 1. However, in this processing process B, each of the processing steps was prolonged by 2.7 times. The same evaluation as in Example 11 was conducted. The thus-obtained results demonstrate that use of the yellow coupler according to the present invention, and the additive(s) according to the present invention, in combination, gave photosensitive materials excellent in image fastness.

Example 19

(Preparation of a Coating Solution for the Third Layer)

Into 13 g of a solvent (Solv-3), 25.9 g of a solvent (Solv-4), 10.8 g of a solvent (Solv-6), 30.2 g of a solvent (Solv-9) and 60 ml of ethyl acetate were dissolved 25.9 g of a magenta coupler (ExM), 13.0 g of a ultraviolet absorbing agent (UV-A), 2.2 g of a color-image stabilizer (Cpd-2), 13.0 g of a color-image stabilizer (Cpd-6), 2.2 g of a color-image stabilizer (Cpd-7), 2.2 g of a color-image stabilizer (Cpd-8), 2.2 g of a color-image stabilizer (Cpd-9), 2.2 g of a color-image stabilizer (Cpd-10), 0.02 g of a color-image stabilizer (Cpd-11), and 2.2 g of a color-image stabilizer (Cpd-20). This solution was emulsified and dispersed in 345 g of a 20 mass % aqueous gelatin solution containing 7.5 g of sodium dodecylbenzenesulfonate with a high-speed stirring emulsifier (dissolver). Water was added thereto, to prepare 900 g of an emulsified dispersion A1.

Separately, the above emulsified dispersion A1 and the above emulsions G-H and G-L were mixed and dissolved, and the third-layer coating solution was prepared so that it would have the composition shown below. The coating amount of the emulsion is in terms of silver.

The coating solutions for the first layer, the second layer, and the fourth to the seventh layer were prepared in the similar manner as that for the third-layer coating solution. As a gelatin hardener for each layer, 1-oxy-3,5-dichloro-s-triazine sodium salt (H-1), (H-2), and (H-3) were used. Further, to each layer, were added (Ab-1), (Ab-2), and (Ab-3), so that the total amounts would be 15.0 mg/m$^2$, 60.0 mg/m$^2$, and 5.0 mg/m$^2$ respectively.

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium catecol-3,5-disulfonate was added to the second layer, the fourth layer and the sixth layer so that coating amounts would be 6 mg/m$^2$, 6 mg/m$^2$ and 18 mg/m$^2$, respectively. Further, to each layer, sodium polystyrene sulfonate was optionally added to adjust viscosity of the coating liquid. Further, in order to prevent irradiation, the following dyes (coating amounts are shown in parentheses) were added.

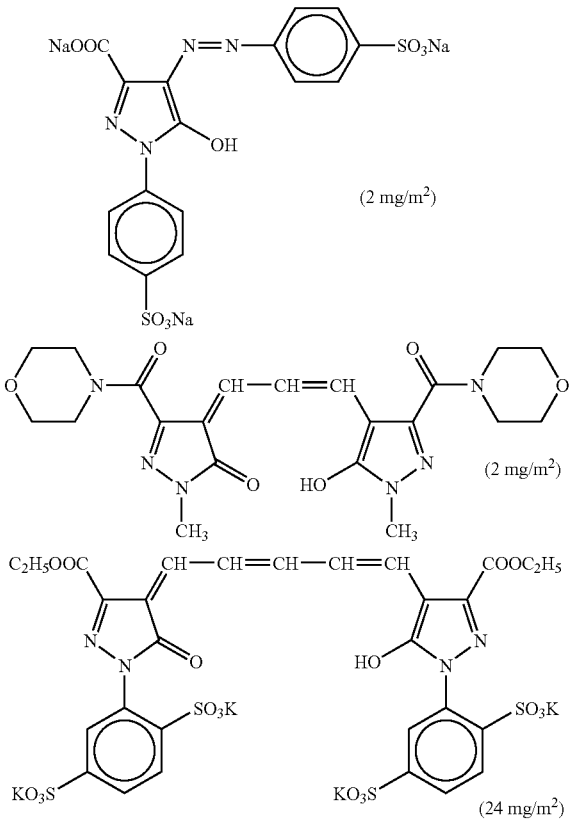

-continued

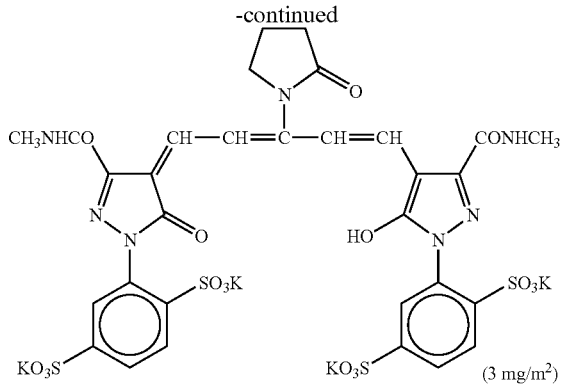

(Layer Constitution)

The composition of each layer is shown below. The numbers show coating amounts (g/m$^2$). With respect to silver halide emulsions, the coating amount is in terms of silver.

Support

Polyethylene Resin-laminated Paper

[The polyethylene resin on the first layer side contained a white pigment ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %). The amount of the polyethylene resin was 29.2 g/m$^2$]

First Layer (Blue-sensitive Emulsion Layer)

| | |
|---|---|
| Silver chlorobromoiodide emulsion (gold-sulfur sensitized cubes, a 5:5 mixture of the large-size emulsion B-H and the small-size emulsion B-L (in terms of mol of silver)) | 0.17 |
| Gelatin | 1.43 |
| Yellow coupler (ExY) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.08 |
| Color-image stabilizer (Cpd-20) | 0.09 |
| Color-image stabilizer (Cpd-21) | 0.01 |
| Additive (ExC-1) | 0.001 |
| Color-image stabilizer (UV-2) | 0.01 |
| Solvent (Solv-4) | 0.27 |
| Solvent (Solv-6) | 0.04 |
| Solvent (Solv-9) | 0.27 |

Second Layer (Color-mixing Inhibiting Layer)

| | |
|---|---|
| Gelatin | 0.73 |
| Color-mixing inhibitor (Cpd-4) | 0.06 |
| Color-image stabilizer (Cpd-5) | 0.02 |
| Color-image stabilizer (Cpd-6) | 0.04 |
| Color-image stabilizer (Cpd-7) | 0.01 |
| Color-image stabilizer (UV-A) | 0.04 |
| Solvent (Solv-1) | 0.02 |
| Solvent (Solv-2) | 0.02 |
| Solvent (Solv-5) | 0.08 |
| Solvent (Solv-8) | 0.09 |

Third Layer (Green-sensitive Emulsion Layer)

| | |
|---|---|
| Silver chlorobromoiodide emulsion (gold-sulfur sensitized cubes, a 1:3 mixture of the large-size emulsion G-H and the small-size emulsion G-L (in terms of mol of silver)) | 0.12 |
| Gelatin | 0.97 |
| Magenta coupler (ExM) | 0.12 |
| Ultraviolet absorbing agent (UV-A) | 0.06 |
| Color-image stabilizer (Cpd-2) | 0.01 |
| Color-image stabilizer (Cpd-6) | 0.06 |
| Color-image stabilizer (Cpd-7) | 0.01 |
| Color-image stabilizer (Cpd-8) | 0.01 |
| Color-image stabilizer (Cpd-9) | 0.01 |
| Color-image stabilizer (Cpd-10) | 0.01 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.14 |

Fourth Layer (Color-mixing Inhibiting Layer)

| | |
|---|---|
| Gelatin | 0.58 |
| Color-mixing inhibitor (Cpd-4) | 0.05 |
| Color-image stabilizer (Cpd-5) | 0.02 |
| Color-image stabilizer (Cpd-6) | 0.03 |
| Color-image stabilizer (Cpd-7) | 0.02 |
| Color-image stabilizer (UV-A) | 0.03 |
| Solvent (Solv-1) | 0.02 |
| Solvent (Solv-2) | 0.06 |
| Solvent (Solv-5) | 0.07 |
| Solvent (Solv-8) | 0.07 |

Fifth Layer (Red-sensitive Emulsion Layer)

| | |
|---|---|
| Silver chlorobromoiodide emulsion (gold-sulfur sensitized cubes, a 4:6 mixture of the large-size emulsion R-H and the small-size emulsion R-L (in terms of mol of silver)) | 0.10 |
| Gelatin | 1.11 |
| Cyan coupler (ExC-1) | 0.12 |
| Cyan coupler (ExC-2) | 0.02 |
| Cyan coupler (ExC-3) | 0.03 |
| Color-image stabilizer (Cpd-1) | 0.01 |
| Color-image stabilizer (Cpd-7) | 0.01 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.17 |
| Color-image stabilizer (Cpd-16) | 0.01 |
| Color-image stabilizer (Cpd-17) | 0.01 |
| Color-image stabilizer (Cpd-18) | 0.05 |
| Color-image stabilizer (Cpd-19) | 0.03 |
| Color-image stabilizer (UV-4) | 0.10 |
| Solvent (Solv-5) | 0.17 |

Sixth Layer (Ultraviolet Absorbing Layer)

| | |
|---|---|
| Gelatin | 0.34 |
| Ultraviolet absorbing agent (UV-C) | 0.27 |
| Compound (S1-4) | 0.0015 |
| Solvent (Solv-7) | 0.09 |

Seventh Layer (Protective Layer)

| | |
|---|---|
| Gelatin | 0.65 |
| Additive (Cpd-22) | 0.03 |
| Liquid paraffin | 0.02 |
| Surface-active agent (Cpd-13) | 0.02 |

(ExY) Yellow Coupler

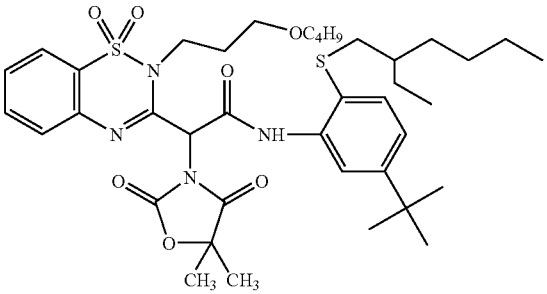

Sample 3101 was prepared in the same manner as in the above-mentioned preparation of the sample 001A, except that the composition of the third layer was changed as follows.

Composition of the Third Layer (Green-sensitive Emulsion Layer) of Sample 3101

Third Layer (Green-sensitive Emulsion Layer)

| | |
|---|---|
| Silver chlorobromoiodide emulsion (gold-sulfur sensitized cubes, a 1:3 mixture of the large-size emulsion G-H and the small-size emulsion G-L (in terms of mol of silver)) | 0.12 |
| Gelatin | 0.97 |
| Magenta coupler (Exemplified compound (M-10-98)) | 0.12 |
| Solvent (Solv-3) | 0.06 |
| Solvent (Solv-4) | 0.12 |
| Solvent (Solv-6) | 0.05 |
| Solvent (Solv-9) | 0.14 |

Samples 3102 to 3188 were prepared in the same manner as sample 3101, except that the magenta coupler was replaced with the respective couplers, as set forth in Table 8, in an equivalent molar amount, and that the compound represented by any one of formulae (Ph-1), (Ph-3), and (Ph-4) for use in the present invention, as set forth in Table 8, was added. The compounds represented by any one of formulae (Ph-1), (Ph-3), and (Ph-4) for use in the present invention were added in the proportion of 70 mole % based on the magenta coupler. In adding the compounds, each sample was prepared using such a reduced amount of solvent that oil-soluble contents in the third layer became a fixed quantity.

After being coated, the photosensitive material samples 3101 to 3188 were kept for 10 days under conditions of 25° C. and 55% RH, followed by the evaluation set forth below.

(Evaluation 3: Fastness to Light)

Each sample was subjected to exposure necessary to give a gray in the above-described processing process A, followed by color development in the above-described processing process A.

As the light source, a semiconductor laser was used to obtain a light source at 688 nm (R light), a semiconductor laser was combined with SHG to obtain a light source at 532 nm (G light) and a light source at 473 nm (B light). The quantity of the R light was modulated with using an outer modulator, and scanning exposure was performed to a sample moving in a direction orthogonal to the scanning direction, by reflecting these lights on a rotating polygon. The scanning exposure was performed at the density of 400 dpi and the average exposure time per 1 pixel was $8\times10^{-8}$ second. The temperature of the semiconductor laser was kept constant, with using a Peltier element, in order to prevent the change in quantity of light due to change in temperature.

Using the thus-prepared samples, densitometry was conducted before and after exposure to a Xenon lamp of 100000 lux for 21 days. The surface temperature of the photosensitive material was adjusted to become 50° C. A relative residual rate (%) after reservation was calculated for a magenta color-developing area of an initial density of 0.3.

(Evaluation 4: Processing Stability in Rapid Processing)

An exposure condition to give a gray gradation in processing process B was determined for each sample, using the same exposure apparatus as in Evaluation 3. The thus-exposed samples were processed according to process C, which was the same as process B, except that the conveying rate was 1.5 times that of process B. The density of each sample obtained by processing process C was measured at an exposed area that would give a density of 2.0 if processed according to processing process B. The change in magenta density (ΔM) of processing process C compared with processing process B, was calculated.

The results of evaluation are shown in Table 8. The above ΔM values are shown under "ΔDmax" in the table.

TABLE 8

| Sample No. | Coupler | Inhibitor | Relative residual rate (%) | ΔDmax |
|---|---|---|---|---|
| 3101 | M-10-98 | — | 32 | 0.1 |
| 3102 | M-10-98 | Inhibitor for comparison 1 | 45 | 0.4 |
| 3103 | M-10-98 | A-22 | 63 | 0.1 |
| 3104 | M-10-98 | A-12 | 60 | 0.1 |
| 3105 | M-10-98 | A-3 | 55 | 0.1 |
| 3106 | M-10-98 | A-4 | 57 | 0.1 |
| 3107 | M-10-98 | A-35 | 53 | 0.1 |
| 3108 | M-10-98 | A-44 | 53 | 0.1 |
| 3109 | M-10-98 | A-55 | 53 | 0.1 |
| 3110 | M-10-98 | A-28 | 53 | 0.1 |
| 3111 | M-10-98 | A-84 | 50 | 0.2 |
| 3112 | M-10-98 | A-90 | 48 | 0.2 |
| 3113 | M-10-98 | A-129 | 48 | 0.2 |
| 3114 | M-10-98 | A-130 | 48 | 0.2 |
| 3115 | M-10-98 | A-134 | 48 | 0.2 |
| 3116 | M-10-98 | A-132 | 48 | 0.2 |
| 3117 | M-1-1 | — | 26 | 0.1 |
| 3118 | M-1-1 | Inhibitor for comparison 1 | 39 | 0.4 |
| 3119 | M-1-1 | A-22 | 57 | 0.1 |
| 3120 | M-1-1 | A-12 | 54 | 0.1 |
| 3121 | M-1-1 | A-44 | 47 | 0.1 |
| 3122 | M-1-1 | A-84 | 44 | 0.2 |
| 3123 | M-1-1 | A-90 | 42 | 0.2 |
| 3124 | M-1-1 | A-129 | 42 | 0.2 |
| 3125 | M-2-2 | — | 29 | 0.1 |
| 3126 | M-2-2 | Inhibitor for comparison 1 | 42 | 0.4 |
| 3127 | M-2-2 | A-22 | 60 | 0.1 |
| 3128 | M-2-2 | A-12 | 57 | 0.1 |

TABLE 8-continued

| Sample No. | Coupler | Inhibitor | Relative residual rate (%) | ΔDmax |
|---|---|---|---|---|
| 3129 | M-2-2 | A-44 | 50 | 0.1 |
| 3130 | M-2-2 | A-84 | 47 | 0.2 |
| 3131 | M-2-2 | A-90 | 45 | 0.2 |
| 3132 | M-2-2 | A-129 | 45 | 0.2 |
| 3133 | M-3-15 | — | 25 | 0.1 |
| 3134 | M-3-15 | Inhibitor for comparison 1 | 38 | 0.4 |
| 3135 | M-3-15 | A-22 | 56 | 0.1 |
| 3136 | M-3-15 | A-12 | 53 | 0.1 |
| 3137 | M-3-15 | A-44 | 46 | 0.1 |
| 3138 | M-3-15 | A-84 | 43 | 0.2 |
| 3139 | M-3-15 | A-90 | 41 | 0.2 |
| 3140 | M-3-15 | A-129 | 41 | 0.2 |
| 3141 | M-4-7 | — | 27 | 0.1 |
| 3142 | M-4-7 | Inhibitor for comparison 1 | 40 | 0.4 |
| 3143 | M-4-7 | A-22 | 58 | 0.1 |
| 3144 | M-4-7 | A-12 | 55 | 0.1 |
| 3145 | M-4-7 | A-44 | 48 | 0.1 |
| 3146 | M-4-7 | A-84 | 45 | 0.2 |
| 3147 | M-4-7 | A-90 | 43 | 0.2 |
| 3148 | M-4-7 | A-129 | 43 | 0.2 |
| 3149 | M-5-23 | — | 28 | 0.1 |
| 3150 | M-5-23 | Inhibitor for comparison 1 | 41 | 0.4 |
| 3151 | M-5-23 | A-22 | 59 | 0.1 |
| 3152 | M-5-23 | A-12 | 56 | 0.1 |
| 3153 | M-5-23 | A-44 | 49 | 0.1 |
| 3154 | M-5-23 | A-84 | 46 | 0.2 |
| 3155 | M-5-23 | A-90 | 44 | 0.2 |
| 3156 | M-5-23 | A-129 | 44 | 0.2 |
| 3157 | M-6-1 | — | 30 | 0.1 |
| 3158 | M-6-1 | Inhibitor for comparison 1 | 43 | 0.4 |
| 3159 | M-6-1 | A-22 | 61 | 0.1 |
| 3160 | M-6-1 | A-12 | 58 | 0.1 |
| 3161 | M-6-1 | A-44 | 51 | 0.1 |
| 3162 | M-6-1 | A-84 | 48 | 0.2 |
| 3163 | M-6-1 | A-90 | 46 | 0.2 |
| 3164 | M-6-1 | A-129 | 46 | 0.2 |
| 3165 | M-7-1 | — | 30 | 0.1 |
| 3166 | M-7-1 | Inhibitor for comparison 1 | 43 | 0.4 |
| 3167 | M-7-1 | A-22 | 61 | 0.1 |
| 3168 | M-7-1 | A-12 | 58 | 0.1 |
| 3169 | M-7-1 | A-44 | 51 | 0.1 |
| 3170 | M-7-1 | A-84 | 48 | 0.2 |
| 3171 | M-7-1 | A-90 | 46 | 0.2 |
| 3172 | M-7-1 | A-129 | 46 | 0.2 |
| 3173 | M-8-12 | — | 27 | 0.1 |
| 3174 | M-8-12 | Inhibitor for comparison 1 | 40 | 0.4 |
| 3175 | M-8-12 | A-22 | 58 | 0.1 |
| 3176 | M-8-12 | A-12 | 55 | 0.1 |
| 3177 | M-8-12 | A-44 | 48 | 0.1 |
| 3178 | M-8-12 | A-84 | 45 | 0.2 |
| 3179 | M-8-12 | A-90 | 43 | 0.2 |
| 3180 | M-8-12 | A-129 | 43 | 0.2 |
| 3181 | M-9-1 | — | 28 | 0.1 |
| 3182 | M-9-1 | Inhibitor for comparison 1 | 41 | 0.4 |
| 3183 | M-9-1 | A-22 | 59 | 0.1 |
| 3184 | M-9-1 | A-12 | 56 | 0.1 |
| 3185 | M-9-1 | A-44 | 49 | 0.1 |
| 3186 | M-9-1 | A-84 | 46 | 0.2 |
| 3187 | M-9-1 | A-90 | 44 | 0.2 |
| 3188 | M-9-1 | A-129 | 44 | 0.2 |

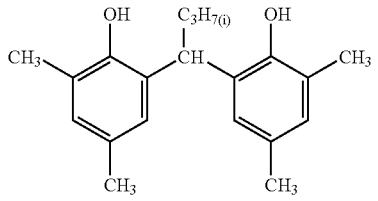

Inhibitor for Comparison 1

The results in Table 8 clearly show that the samples to which the compounds represented by any one of formulae (Ph-1), (Ph-3), and (Ph-4) were added were high in relative residual rate and excellent in processing stability, compared with the samples to which Inhibitor for comparison 1 was added. Further, comparing samples 3103 to 3111 and the like with samples 3112 to 3116 and the like, it can be seen that, in particular, the compounds represented by formula (Ph-4) exerted outstanding effects. Further, comparing samples 3103 to 3106 and the like with samples 3108 to 3111 and the like, it can be seen that the compounds represented by formula (Ph-4), in which $R_{b21}$ was an unsubstituted aliphatic group, had much stronger effects. Further, comparing sample 3104 and the like with sample 3105 and the like, it can be seen that the compounds represented by formula (Ph-4), in which the total carbon number of $R_{b21}$ was 12 or more, exerted stronger effects than the compounds in which the total carbon number of $R_{b21}$ was 11 or less. Further, comparing sample 3103 and the like with sample 3106 and the like, it can be seen that the compounds represented by formula (Ph-4), in which the $R_{b21}$ was a straight-chain group, were superior in effects to the corresponding compounds, in which the $R_{b21}$ was branched.

Example 20

Samples 3201 to 3274 were prepared in the same manner as samples 3102, 3103, 3104, 3108, 3111, 3112, 3113, 3118, 3119, 3126, 3127, 3134, 3135, 3142, 3143, 3150, 3151, 3158, 3159, 3166, 3167, 3174, 3175, 3182 and 3183 prepared in Example 19, except that the compounds represented by any one of formulae (E-1) to (E-3) set forth in Table 9 were additionally incorporated therein. The compounds represented by any one of formulae (E-1) to (E-3) were added in an amount of 20 mole % based on the magenta coupler. In adding these compounds, each sample was prepared using such a reduced amount of solvent that oil-soluble contents in the third layer became a fixed quantity. Similarly to Example 19, each sample was subjected to exposure to light, and a development processing, and fastness to light was evaluated in the same manner as in Example 19.

The results obtained are shown in Table 9.

TABLE 9

| Sample No. | Coupler | Inhibitor | Compound of formula (E-1), (E-2) or (E-3) | Relative residual rate (%) |
|---|---|---|---|---|
| 3102 | M-10-98 | Inhibitor for comparison 1 | — | 45 |
| 3201 | M-10-98 | Inhibitor for comparison 1 | B-17 | 60 |
| 3202 | M-10-98 | Inhibitor for comparison 1 | B-13 | 57 |

TABLE 9-continued

| Sample No. | Coupler | Inhibitor | Compound of formula (E-1), (E-2) or (E-3) | Relative residual rate (%) |
|---|---|---|---|---|
| 3203 | M-10-98 | Inhibitor for comparison 1 | B-21 | 57 |
| 3103 | M-10-98 | A-22 | — | 63 |
| 3204 | M-10-98 | A-22 | B-17 | 82 |
| 3205 | M-10-98 | A-22 | B-13 | 78 |
| 3206 | M-10-98 | A-22 | B-21 | 78 |
| 3104 | M-10-98 | A-12 | — | 60 |
| 3207 | M-10-98 | A-12 | B-17 | 79 |
| 3208 | M-10-98 | A-12 | B-13 | 75 |
| 3209 | M-10-98 | A-12 | B-21 | 75 |
| 3108 | M-10-98 | A-44 | — | 53 |
| 3210 | M-10-98 | A-44 | B-17 | 72 |
| 3211 | M-10-98 | A-44 | B-13 | 68 |
| 3212 | M-10-98 | A-44 | B-21 | 68 |
| 3111 | M-10-98 | A-84 | — | 50 |
| 3213 | M-10-98 | A-84 | B-17 | 69 |
| 3214 | M-10-98 | A-84 | B-13 | 65 |
| 3215 | M-10-98 | A-84 | B-21 | 65 |
| 3112 | M-10-98 | A-90 | — | 48 |
| 3216 | M-10-98 | A-90 | B-17 | 67 |
| 3217 | M-10-98 | A-90 | B-13 | 63 |
| 3218 | M-10-98 | A-90 | B-21 | 63 |
| 3113 | M-10-98 | A-129 | — | 48 |
| 3219 | M-10-98 | A-129 | B-17 | 67 |
| 3220 | M-10-98 | A-129 | B-13 | 63 |
| 3221 | M-10-98 | A-129 | B-21 | 63 |
| 3118 | M-1-1 | Inhibitor for comparison 1 | — | 39 |
| 3222 | M-1-1 | Inhibitor for comparison 1 | B-17 | 54 |
| 3223 | M-1-1 | Inhibitor for comparison 1 | B-13 | 51 |
| 3224 | M-1-1 | Inhibitor for comparison 1 | B-21 | 51 |
| 3119 | M-1-1 | A-22 | — | 57 |
| 3225 | M-1-1 | A-22 | B-17 | 76 |
| 3226 | M-1-1 | A-22 | B-13 | 72 |
| 3227 | M-1-1 | A-22 | B-21 | 72 |
| 3126 | M-2-2 | Inhibitor for comparison 1 | — | 42 |
| 3228 | M-2-2 | Inhibitor for comparison 1 | B-17 | 57 |
| 3229 | M-2-2 | Inhibitor for comparison 1 | B-13 | 54 |
| 3230 | M-2-2 | Inhibitor for comparison 1 | B-21 | 54 |
| 3127 | M-2-2 | A-22 | — | 60 |
| 3230 | M-2-2 | A-22 | B-17 | 79 |
| 3231 | M-2-2 | A-22 | B-13 | 75 |
| 3232 | M-2-2 | A-22 | B-21 | 75 |
| 3134 | M-3-15 | Inhibitor for comparison 1 | — | 38 |
| 3233 | M-3-15 | Inhibitor for comparison 1 | B-17 | 53 |
| 3234 | M-3-15 | Inhibitor for comparison 1 | B-13 | 50 |
| 3235 | M-3-15 | Inhibitor for comparison 1 | B-21 | 50 |
| 3135 | M-3-15 | A-22 | — | 56 |
| 3236 | M-3-15 | A-22 | B-17 | 75 |
| 3237 | M-3-15 | A-22 | B-13 | 71 |
| 3238 | M-3-15 | A-22 | B-21 | 71 |
| 3142 | M-4-7 | Inhibitor for comparison 1 | — | 40 |
| 3239 | M-4-7 | Inhibitor for comparison 1 | B-17 | 55 |
| 3240 | M-4-7 | Inhibitor for comparison 1 | B-13 | 52 |
| 3241 | M-4-7 | Inhibitor for comparison 1 | B-21 | 52 |
| 3143 | M-4-7 | A-22 | — | 58 |
| 3242 | M-4-7 | A-22 | B-17 | 77 |
| 3243 | M-4-7 | A-22 | B-13 | 73 |
| 3244 | M-4-7 | A-22 | B-21 | 73 |

TABLE 9-continued

| Sample No. | Coupler | Inhibitor | Compound of formula (E-1), (E-2) or (E-3) | Relative residual rate (%) |
|---|---|---|---|---|
| 3150 | M-5-23 | Inhibitor for comparison 1 | — | 41 |
| 3245 | M-5-23 | Inhibitor for comparison 1 | B-17 | 56 |
| 3246 | M-5-23 | Inhibitor for comparison 1 | B-13 | 53 |
| 3247 | M-5-23 | Inhibitor for comparison 1 | B-21 | 53 |
| 3151 | M-5-23 | A-22 | — | 59 |
| 3248 | M-5-23 | A-22 | B-17 | 78 |
| 3249 | M-5-23 | A-22 | B-13 | 74 |
| 3250 | M-5-23 | A-22 | B-21 | 74 |
| 3158 | M-6-1 | Inhibitor for comparison 1 | — | 43 |
| 3251 | M-6-1 | Inhibitor for comparison 1 | B-17 | 58 |
| 3252 | M-6-1 | Inhibitor for comparison 1 | B-13 | 55 |
| 3253 | M-6-1 | Inhibitor for comparison 1 | B-21 | 55 |
| 3159 | M-6-1 | A-22 | — | 61 |
| 3254 | M-6-1 | A-22 | B-17 | 80 |
| 3255 | M-6-1 | A-22 | B-13 | 76 |
| 3256 | M-6-1 | A-22 | B-21 | 76 |
| 3166 | M-7-1 | Inhibitor for comparison 1 | — | 43 |
| 3257 | M-7-1 | Inhibitor for comparison 1 | B-17 | 58 |
| 3258 | M-7-1 | Inhibitor for comparison 1 | B-13 | 55 |
| 3259 | M-7-1 | Inhibitor for comparison 1 | B-21 | 55 |
| 3167 | M-7-1 | A-22 | — | 61 |
| 3260 | M-7-1 | A-22 | B-17 | 80 |
| 3261 | M-7-1 | A-22 | B-13 | 76 |
| 3262 | M-7-1 | A-22 | B-21 | 76 |
| 3174 | M-8-12 | Inhibitor for comparison 1 | — | 40 |
| 3263 | M-8-12 | Inhibitor for comparison 1 | B-17 | 55 |
| 3264 | M-8-12 | Inhibitor for comparison 1 | B-13 | 52 |
| 3265 | M-8-12 | Inhibitor for comparison 1 | B-21 | 52 |
| 3175 | M-8-12 | A-22 | — | 58 |
| 3266 | M-8-12 | A-22 | B-17 | 77 |
| 3267 | M-8-12 | A-22 | B-13 | 73 |
| 3268 | M-8-12 | A-22 | B-21 | 73 |
| 3182 | M-9-1 | Inhibitor for comparison 1 | — | 41 |
| 3269 | M-9-1 | Inhibitor for comparison 1 | B-17 | 56 |
| 3270 | M-9-1 | Inhibitor for comparison 1 | B-13 | 53 |
| 3271 | M-9-1 | Inhibitor for comparison 1 | B-21 | 53 |
| 3183 | M-9-1 | A-22 | — | 59 |
| 3272 | M-9-1 | A-22 | B-17 | 78 |
| 3273 | M-9-1 | A-22 | B-13 | 74 |
| 3274 | M-9-1 | A-22 | B-21 | 74 |

The results in Table 9 clearly show that image fastness was further improved by adding the compounds represented by any one of formulae (E-1) to (E-3). The degree of improvement was more outstanding in the samples to which the compound represented by formula (Ph-1) or (Ph-3) was added, compared with the samples free of the said compound.

Example 21

Samples 3301 to 3454 were prepared in the same manner as samples 3201, 3204, 3225, 3230, 3236, 3242, 3248, 3254, 3260, 3266 and 3272 in Example 20, except that other inhibitor compounds set forth in Table 10 were additionally incorporated therein. The other inhibitor compounds were added in an amount 20 mole % based on the magenta coupler. In this adding of the other inhibitor compounds, each sample was prepared using such a reduced amount of solvent that oil-soluble contents in the third layer became a fixed quantity. Similarly to Example 19, each sample was subjected to exposure to light, and a development processing, and fastness to light was evaluated in the same manner as in Example 19.

The results obtained are shown in Table 10.

TABLE 10

| Sample No. | Coupler | Inhibitor | Compound of formula (E-1), (E-2) or (E-3) | Other Inhibitor | Relative residual rate (%) |
|---|---|---|---|---|---|
| 3201 | M-10-98 | Inhibitor for comparison 1 | B-17 | — | 60 |
| 3301 | M-10-98 | Inhibitor for comparison 1 | B-17 | TI-17 | 63 |
| 3302 | M-10-98 | Inhibitor for comparison 1 | B-17 | TII-16 | 63 |
| 3303 | M-10-98 | Inhibitor for comparison 1 | B-17 | TIII-15 | 62 |
| 3304 | M-10-98 | Inhibitor for comparison 1 | B-17 | TIV-12 | 62 |
| 3305 | M-10-98 | Inhibitor for comparison 1 | B-17 | TV-4 | 62 |
| 3306 | M-10-98 | Inhibitor for comparison 1 | B-17 | TVI-23 | 62 |
| 3307 | M-10-98 | Inhibitor for comparison 1 | B-17 | TVII-1 | 62 |
| 3308 | M-10-98 | Inhibitor for comparison 1 | B-17 | TVII-19 | 63 |
| 3309 | M-10-98 | Inhibitor for comparison 1 | B-17 | UA-5 | 63 |
| 3310 | M-10-98 | Inhibitor for comparison 1 | B-17 | UB-3 | 62 |
| 3311 | M-10-98 | Inhibitor for comparison 1 | B-17 | UC-2 | 62 |
| 3312 | M-10-98 | Inhibitor for comparison 1 | B-17 | UD-7 | 62 |
| 3313 | M-10-98 | Inhibitor for comparison 1 | B-17 | UE-2 | 63 |
| 3314 | M-10-98 | Inhibitor for comparison 1 | B-17 | P-2 | 63 |
| 3204 | M-10-98 | A-22 | B-17 | — | 82 |
| 3315 | M-10-98 | A-22 | B-17 | TI-17 | 87 |
| 3316 | M-10-98 | A-22 | B-17 | TII-16 | 87 |
| 3317 | M-10-98 | A-22 | B-17 | TIII-15 | 85 |
| 3318 | M-10-98 | A-22 | B-17 | TIV-12 | 85 |
| 3319 | M-10-98 | A-22 | B-17 | TV-4 | 85 |
| 3320 | M-10-98 | A-22 | B-17 | TVI-23 | 85 |
| 3321 | M-10-98 | A-22 | B-17 | TVII-1 | 85 |
| 3322 | M-10-98 | A-22 | B-17 | TVII-19 | 87 |
| 3323 | M-10-98 | A-22 | B-17 | UA-5 | 87 |
| 3324 | M-10-98 | A-22 | B-17 | UB-3 | 85 |
| 3325 | M-10-98 | A-22 | B-17 | UC-2 | 85 |
| 3326 | M-10-98 | A-22 | B-17 | UD-7 | 85 |
| 3327 | M-10-98 | A-22 | B-17 | UE-2 | 87 |
| 3328 | M-10-98 | A-22 | B-17 | P-2 | 87 |
| 3225 | M-1-1 | A-22 | B-17 | — | 76 |
| 3329 | M-1-1 | A-22 | B-17 | TI-17 | 81 |
| 3330 | M-1-1 | A-22 | B-17 | TII-16 | 81 |
| 3331 | M-1-1 | A-22 | B-17 | TIII-15 | 79 |
| 3332 | M-1-1 | A-22 | B-17 | TIV-12 | 79 |
| 3333 | M-1-1 | A-22 | B-17 | TV-4 | 79 |
| 3334 | M-1-1 | A-22 | B-17 | TVI-23 | 79 |
| 3335 | M-1-1 | A-22 | B-17 | TVII-1 | 79 |
| 3336 | M-1-1 | A-22 | B-17 | TVII-19 | 81 |
| 3337 | M-1-1 | A-22 | B-17 | UA-5 | 81 |
| 3338 | M-1-1 | A-22 | B-17 | UB-3 | 79 |
| 3339 | M-1-1 | A-22 | B-17 | UC-2 | 79 |
| 3340 | M-1-1 | A-22 | B-17 | UD-7 | 79 |
| 3341 | M-1-1 | A-22 | B-17 | UE-2 | 81 |

TABLE 10-continued

| Sample No. | Coupler | Inhibitor | Compound of formula (E-1), (E-2) or (E-3) | Other Inhibitor | Relative residual rate (%) |
|---|---|---|---|---|---|
| 3342 | M-1-1 | A-22 | B-17 | P-2 | 81 |
| 3230 | M-2-2 | A-22 | B-17 | — | 79 |
| 3343 | M-2-2 | A-22 | B-17 | TI-17 | 84 |
| 3344 | M-2-2 | A-22 | B-17 | TII-16 | 84 |
| 3345 | M-2-2 | A-22 | B-17 | TIII-15 | 82 |
| 3346 | M-2-2 | A-22 | B-17 | TIV-12 | 82 |
| 3347 | M-2-2 | A-22 | B-17 | TV-4 | 82 |
| 3348 | M-2-2 | A-22 | B-17 | TVI-23 | 82 |
| 3349 | M-2-2 | A-22 | B-17 | TVII-1 | 82 |
| 3350 | M-2-2 | A-22 | B-17 | TVII-19 | 84 |
| 3351 | M-2-2 | A-22 | B-17 | UA-5 | 84 |
| 3352 | M-2-2 | A-22 | B-17 | UB-3 | 82 |
| 3353 | M-2-2 | A-22 | B-17 | UC-2 | 82 |
| 3354 | M-2-2 | A-22 | B-17 | UD-7 | 82 |
| 3355 | M-2-2 | A-22 | B-17 | UE-2 | 84 |
| 3356 | M-2-2 | A-22 | B-17 | P-2 | 84 |
| 3236 | M-3-15 | A-22 | B-17 | — | 75 |
| 3357 | M-3-15 | A-22 | B-17 | TI-17 | 80 |
| 3358 | M-3-15 | A-22 | B-17 | TII-16 | 80 |
| 3359 | M-3-15 | A-22 | B-17 | TIII-15 | 78 |
| 3360 | M-3-15 | A-22 | B-17 | TIV-12 | 78 |
| 3361 | M-3-15 | A-22 | B-17 | TV-4 | 78 |
| 3362 | M-3-15 | A-22 | B-17 | TVI-23 | 78 |
| 3363 | M-3-15 | A-22 | B-17 | TVII-1 | 78 |
| 3364 | M-3-15 | A-22 | B-17 | TVII-19 | 80 |
| 3365 | M-3-15 | A-22 | B-17 | UA-5 | 80 |
| 3366 | M-3-15 | A-22 | B-17 | UB-3 | 78 |
| 3367 | M-3-15 | A-22 | B-17 | UC-2 | 78 |
| 3368 | M-3-15 | A-22 | B-17 | UD-7 | 78 |
| 3369 | M-3-15 | A-22 | B-17 | UE-2 | 80 |
| 3370 | M-3-15 | A-22 | B-17 | P-2 | 80 |
| 3242 | M-4-7 | A-22 | B-17 | — | 77 |
| 3371 | M-4-7 | A-22 | B-17 | TI-17 | 82 |
| 3372 | M-4-7 | A-22 | B-17 | TII-16 | 82 |
| 3373 | M-4-7 | A-22 | B-17 | TIII-15 | 80 |
| 3374 | M-4-7 | A-22 | B-17 | TIV-12 | 80 |
| 3375 | M-4-7 | A-22 | B-17 | TV-4 | 80 |
| 3376 | M-4-7 | A-22 | B-17 | TVI-23 | 80 |
| 3377 | M-4-7 | A-22 | B-17 | TVII-1 | 80 |
| 3378 | M-4-7 | A-22 | B-17 | TVII-19 | 82 |
| 3379 | M-4-7 | A-22 | B-17 | UA-5 | 82 |
| 3380 | M-4-7 | A-22 | B-17 | UB-3 | 80 |
| 3381 | M-4-7 | A-22 | B-17 | UC-2 | 80 |
| 3382 | M-4-7 | A-22 | B-17 | UD-7 | 80 |
| 3383 | M-4-7 | A-22 | B-17 | UE-2 | 82 |
| 3384 | M-4-7 | A-22 | B-17 | P-2 | 82 |
| 3248 | M-5-23 | A-22 | B-17 | — | 78 |
| 3385 | M-5-23 | A-22 | B-17 | TI-17 | 83 |
| 3386 | M-5-23 | A-22 | B-17 | TII-16 | 83 |
| 3387 | M-5-23 | A-22 | B-17 | TIII-15 | 81 |
| 3388 | M-5-23 | A-22 | B-17 | TIV-12 | 81 |
| 3389 | M-5-23 | A-22 | B-17 | TV-4 | 81 |
| 3390 | M-5-23 | A-22 | B-17 | TVI-23 | 81 |
| 3391 | M-5-23 | A-22 | B-17 | TVII-1 | 81 |
| 3392 | M-5-23 | A-22 | B-17 | TVII-19 | 83 |
| 3393 | M-5-23 | A-22 | B-17 | UA-5 | 83 |
| 3394 | M-5-23 | A-22 | B-17 | UB-3 | 81 |
| 3395 | M-5-23 | A-22 | B-17 | UC-2 | 81 |
| 3396 | M-5-23 | A-22 | B-17 | UD-7 | 81 |
| 3397 | M-5-23 | A-22 | B-17 | UE-2 | 83 |
| 3398 | M-5-23 | A-22 | B-17 | P-2 | 83 |
| 3254 | M-6-1 | A-22 | B-17 | — | 80 |
| 3399 | M-6-1 | A-22 | B-17 | TI-17 | 85 |
| 3400 | M-6-1 | A-22 | B-17 | TII-16 | 85 |
| 3401 | M-6-1 | A-22 | B-17 | TIII-15 | 83 |
| 3402 | M-6-1 | A-22 | B-17 | TIV-12 | 83 |
| 3403 | M-6-1 | A-22 | B-17 | TV-4 | 83 |
| 3404 | M-6-1 | A-22 | B-17 | TVI-23 | 83 |
| 3405 | M-6-1 | A-22 | B-17 | TVII-1 | 83 |
| 3406 | M-6-1 | A-22 | B-17 | TVII-19 | 85 |
| 3407 | M-6-1 | A-22 | B-17 | UA-5 | 85 |
| 3408 | M-6-1 | A-22 | B-17 | UB-3 | 83 |
| 3409 | M-6-1 | A-22 | B-17 | UC-2 | 83 |
| 3410 | M-6-1 | A-22 | B-17 | UD-7 | 83 |

TABLE 10-continued

| Sample No. | Coupler | Inhibitor | Compound of formula (E-1), (E-2) or (E-3) | Other Inhibitor | Relative residual rate (%) |
|---|---|---|---|---|---|
| 3411 | M-6-1 | A-22 | B-17 | UE-2 | 85 |
| 3412 | M-6-1 | A-22 | B-17 | P-2 | 85 |
| 3260 | M-7-1 | A-22 | B-17 | — | 80 |
| 3413 | M-7-1 | A-22 | B-17 | TI-17 | 85 |
| 3414 | M-7-1 | A-22 | B-17 | TII-16 | 85 |
| 3415 | M-7-1 | A-22 | B-17 | TIII-15 | 83 |
| 3416 | M-7-1 | A-22 | B-17 | TIV-12 | 83 |
| 3417 | M-7-1 | A-22 | B-17 | TV-4 | 83 |
| 3418 | M-7-1 | A-22 | B-17 | TVI-23 | 83 |
| 3419 | M-7-1 | A-22 | B-17 | TVII-1 | 83 |
| 3420 | M-7-1 | A-22 | B-17 | TVII-19 | 85 |
| 3421 | M-7-1 | A-22 | B-17 | UA-5 | 85 |
| 3422 | M-7-1 | A-22 | B-17 | UB-3 | 83 |
| 3423 | M-7-1 | A-22 | B-17 | UC-2 | 83 |
| 3424 | M-7-1 | A-22 | B-17 | UD-7 | 83 |
| 3425 | M-7-1 | A-22 | B-17 | UE-2 | 85 |
| 3426 | M-7-1 | A-22 | B-17 | P-2 | 85 |
| 3266 | M-8-12 | A-22 | B-17 | — | 77 |
| 3427 | M-8-12 | A-22 | B-17 | TI-17 | 82 |
| 3428 | M-8-12 | A-22 | B-17 | TII-16 | 82 |
| 3429 | M-8-12 | A-22 | B-17 | TIII-15 | 80 |
| 3430 | M-8-12 | A-22 | B-17 | TIV-12 | 80 |
| 3431 | M-8-12 | A-22 | B-17 | TV-4 | 80 |
| 3432 | M-8-12 | A-22 | B-17 | TVI-23 | 80 |
| 3433 | M-8-12 | A-22 | B-17 | TVII-1 | 80 |
| 3434 | M-8-12 | A-22 | B-17 | TVII-19 | 82 |
| 3435 | M-8-12 | A-22 | B-17 | UA-5 | 82 |
| 3436 | M-8-12 | A-22 | B-17 | UB-3 | 80 |
| 3437 | M-8-12 | A-22 | B-17 | UC-2 | 80 |
| 3438 | M-8-12 | A-22 | B-17 | UD-7 | 80 |
| 3439 | M-8-12 | A-22 | B-17 | UE-2 | 82 |
| 3440 | M-8-12 | A-22 | B-17 | P-2 | 82 |
| 3272 | M-9-1 | A-22 | B-17 | — | 78 |
| 3441 | M-9-1 | A-22 | B-17 | T1-17 | 83 |
| 3442 | M-9-1 | A-22 | B-17 | TII-16 | 83 |
| 3443 | M-9-1 | A-22 | B-17 | TIII-15 | 81 |
| 3444 | M-9-1 | A-22 | B-17 | TIV-12 | 81 |
| 3445 | M-9-1 | A-22 | B-17 | TV-4 | 81 |
| 3446 | M-9-1 | A-22 | B-17 | TVI-23 | 81 |
| 3447 | M-9-1 | A-22 | B-17 | TVII-1 | 81 |
| 3448 | M-9-1 | A-22 | B-17 | TVII-19 | 83 |
| 3449 | M-9-1 | A-22 | B-17 | UA-5 | 83 |
| 3450 | M-9-1 | A-22 | B-17 | UB-3 | 81 |
| 3451 | M-9-1 | A-22 | B-17 | UC-2 | 81 |
| 3452 | M-9-1 | A-22 | B-17 | UD-7 | 81 |
| 3453 | M-9-1 | A-22 | B-17 | UE-2 | 83 |
| 3454 | M-9-1 | A-22 | B-17 | P-2 | 83 |

The results in Table 10 clearly show that the image fastness was further improved by adding any one of the following compounds: the compound represented by any one of formulae (TS-I) to (TS-VII), the metal complex, the ultraviolet-ray absorbing agent, and the water-insoluble homoplymer or copolymer. The degree of improvement was more outstanding in the samples to which the compound represented by formula (Ph-1) or (Ph-3) was added compared with the samples free of the compound.

Example 22

Samples were prepared in the same manner as samples 3101 to 3188 of Example 19, samples 3201 to 3274 of Example 20, and samples 3301 to 3454 of Example 21, except that the kind of the ultraviolet-ray absorbing agent in the second layer, the third layer and the forth layer was changed from (UV-A) to (UV-B). The same evaluations as in Example 19 were carried out, and essentially the same results were obtained.

Example 23

Samples were prepared in the same manner as samples 3101 to 3188 of Example 19, samples 3201 to 3274 of Example 20, and samples 3301 to 3454 of Example 21, except that (Cpd-4) of the second layer and the fourth layer was replaced with an equivalent molar amount of (Cpd-12) respectively. The same evaluations as in Example 19 were carried out, and improvement of fastness to light, owing to combined use of the coupler and additive(s) for use in the present invention, was confirmed. The resulted effects were particularly remarkable.

Example 24

Samples were prepared in the same manner as samples in Example 23, except that the support was replaced with a PET reflection support of 175 μm thickness, in which PET was kneaded with barium sulfate. The evaluations according to Example 19 were carried out, and essentially the same results were obtained.

Example 25

Each samples 3101 to 3188 of Example 19, samples 3201 to 3274 of Example 20, and samples 3301 to 3454 of Example 21 were scan-exposed by means of each exposure apparatus set forth bellow, and evaluated according to Example 19. The thus-obtained results demonstrate that use of samples having constitutions according to the present invention exhibited the effects of the present invention: they were excellent in fastness to light and processing stability.

Exposure apparatus to be used

Digital mini-lab FRONTIER 330 (trade name, manufactured by Fuji Photo Film Co., Ltd.)

Lambda 130. (trade name, manufactured by Durst Co.)

LIGHTJET 5000 (trade name, manufactured by Gretag Co.)

Example 26

Samples were prepared in the same manner as the samples in Example 19, except for changing the composition as set forth below.

Coating amount of the blue-sensitive silver halide emulsion layer: 240%

Coating amount of the green-sensitive silver halide emulsion layer: 250%

Coating amount of the red-sensitive silver halide emulsion layer: 260%

Support: 180 μm thick polyethylene terephthalate transparent support

Each of these samples was processed according to processing process B in Example 1. However, in this processing process B, each of the processing steps was prolonged by 2.7 times. The same evaluations as in Example 19 were conducted. The thus-obtained results demonstrate that use of a combination of the magenta coupler for use in the present invention, and the compound(s) according to the present invention, gave photosensitive materials excellent in image fastness.

Having described our invention as related to the present embodiments, it is our intention that the invention not be limited by any of the details of the description, unless otherwise specified, but rather be construed broadly within its spirit and scope as set out in the accompanying claims.

This nonprovisional application claims priority under 35 U.S.C. § 119 (a) on Patent Application No. 2002-382505 filed in Japan on Dec. 27, 2002, on Patent Application No. 2003-97156 filed in Japan on Mar. 31, 2003, and on Patent Application No. 2003-97255 filed in Japan on Mar. 31, 2003, which are herein incorporated by reference.

What we claim is:

1. A silver halide color photographic photosensitive material comprising, on a support, at least one yellow color-forming photosensitive silver halide emulsion layer, at least one magenta color-forming photosensitive silver halide emulsion layer, and at least one cyan color-forming photosensitive silver halide emulsion layer, wherein at least one dye-forming coupler is contained in the same layer as at least one compound represented by formula (Ph), and wherein the at least one dye-forming coupler is a yellow dye-forming coupler represented by formula (Ia) set forth below or a magenta dye-forming coupler, represented by any one of formulae (M-I) to (M-X) set forth below:

Formula (Ia)

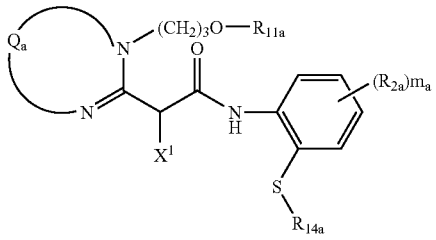

wherein, in formula (Ia), Qa represents a group of non-metal atoms that forms a 5- to 7-membered ring in combination with the —N=C—N((CH$_2$)$_3$O—R$_{11a}$)—; R$_{11a}$ represents an alkyl group having carbon atoms of 4 or more and 8 or less; R$_{2a}$ represents a substituent: R$_{14a}$ represents a primary alkyl group; m$_a$ represents an integer of 0 or more and 4 or less; when m$_a$ is 2 or more, R$_{2a}$s may be the same or different, and they may combine together to form a ring; and X$_1$ represents a hydrogen atom, or a group capable of being spilt-off upon a coupling reaction with an oxidized product of a developing agent;

Formula (M-I)

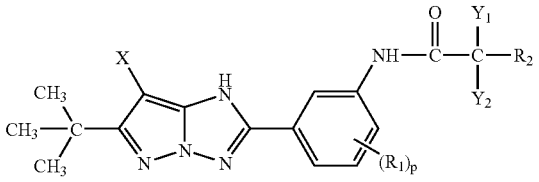

wherein, in formula (M-I), Y$_1$ and Y$_2$ each independently represent a hydrogen atom, an alkyl group, a cycloalkyl group, an aryl group, a heterocyclic group, an alkoxy group, a cycloalkoxy group, or a heterocyclic oxy group; R$_1$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, a ureido group, an acyl group, an acyloxy group, an amido group, a carbamoyl group, a sulfinyl group, a sulfonyl group, an amino group, a cyano group, a nitro group, or a hydroxyl group; R$_2$ represents a substituted or unsubstituted, alkyl group, alkenyl group, cycloalkyl group, aryl group, or heterocyclic group; when R$_2$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, an amido group, a sulfinyl group, a sulfonyl group, an amino group and a hydroxyl group, each of which may be further substituted; X represents a halogen atom; p represents 0, 1, or 2; and when p is 2, a plurality of R$_1$s may be the same or different;

Formula (M-II)

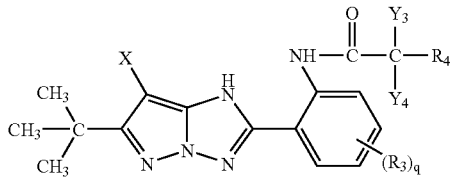

wherein, in formula (M-II), Y$_3$ and Y$_4$ each independently represent a hydrogen atom, an alkyl group, a cycloalkyl group, an aryl group, a heterocyclic group, an alkoxy group, a cycloalkoxy group, an aryloxy group, or a heterocyclic oxy group; R$_3$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; R$_4$ represents a substituted or unsubstituted, alkyl group, alkenyl group, cycloalkyl group, aryl group, or heterocyclic group; when R$_4$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; q represents 0, 1, or 2; and when q is 2, a plurality of R$_3$s may be the same or different;

Formula (M-III)

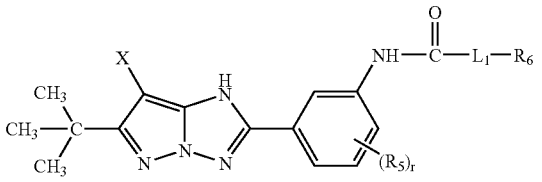

wherein, in formula (M-III), $L_1$ represents —$NR_7$— or —O—; $R_5$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_6$ represents a substituted or unsubstituted, alkyl group, alkenyl group, cycloalkyl group, aryl group, or heterocyclic group; $R_7$ represents a hydrogen atom, or a substituted or unsubstituted, alkyl group, alkenyl group, cycloalkyl group, aryl group, or heterocyclic group; when $R_6$ and $R_7$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; r represents 0, 1, or 2; and when r is 2, a plurality of $R_5$s may be the same or different;

Formula (M-IV)

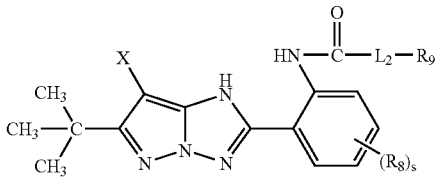

wherein, in formula (M-IV), $L_2$ represents —$NR_{10}$- or —O—; $R_8$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_9$ represents a substituted or unsubstituted, alkyl group, alkenyl group, cycloalkyl group, aryl group, or heterocyclic group; $R_{10}$ represents a hydrogen atom, or a substituted or unsubstituted, alkyl group, alkenyl group, cycloalkyl group, aryl group, or heterocyclic group; when $R_9$ and $R_{10}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; X represents a halogen atom; s represents 0, 1, or 2; and when s is 2, a plurality of $R_8$s may be the same or different;

Formula (M-V)

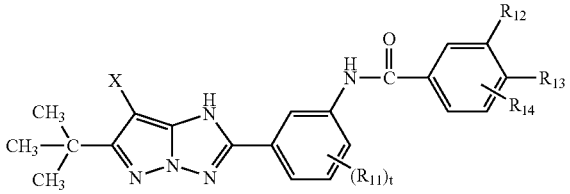

wherein, in formula (M-V), $R_{11}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{12}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; $R_{13}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfonyl group, an amino group, a sulfinyl group, or a hydroxyl group; $R_{14}$ represents a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; t represents 0, 1, or 2; and when t is 2, a plurality of $R_{11}$s may be the same or different;

Formula (M-VI)

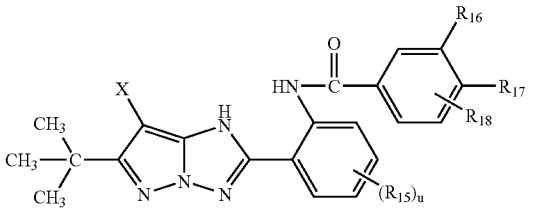

wherein, in formula (M-VI), $R_{15}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; $R_{16}$, $R_{17}$, and $R_{18}$ each independently represent a hydrogen atom, an alkyl group, a cycloalkyl group, an alkenyl group, an alkynyl group, an aryl group, a heterocyclic group, a halogen atom, an alkoxy group, a cycloalkoxy group, an aryloxy group, a heterocyclic oxy group, an alkylthio group, a cycloalkylthio group, an arylthio group, an alkoxycarbonyl group, a cycloalkoxycarbonyl group, an aryloxycarbonyl group, a heterocyclic oxycarbonyl group, a sulfonamido group, a sulfamoyl group, a ureido group, an acyl group, an acyloxy group, a carbamoyl group, an amido group, a sulfinyl group, a sulfonyl group, an amino group, or a hydroxyl group; X represents a halogen atom; u represents 0, 1, or 2; and when u is 2, a plurality of $R_{15}$s may be the same or different;

Formula (M-VII)

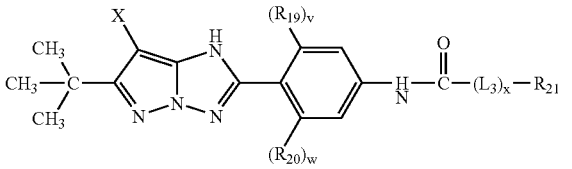

wherein, in formula (M-VII), $R_{19}$ and $R_{20}$ each independently represent an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; v and w each independently represent 0 or 1, but both v and w are not 0s at the same time; $L_3$ represents —$NR_{22}$— or —O—; x represents 0 or 1; $R_{21}$ represents a substituted or unsubstituted, alkyl group, alkenyl group, cycloalkyl group, aryl group, or heterocyclic group; $R_{22}$ represents a hydrogen atom, or a substituted or unsubstituted, alkyl group, alkenyl group, cycloalkyl group, aryl group, or heterocyclic group; when $R_{21}$ and $R_{22}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-VIII)

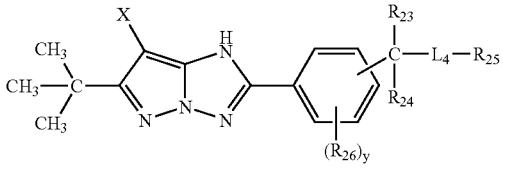

wherein, in formula (M-VIII), $R_{23}$ and $R_{24}$ each independently represent a hydrogen atom, an alkyl group, a cycloalkyl group, an aryl group, or a heterocyclic group; $R_{25}$ represents a substituted or unsubstituted, alkyl group, alkenyl group, cycloalkyl group, aryl group, or heterocyclic group; $R_{26}$ represents an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group a sulfonyl group, an amino group, a cyano group, a nitro group, or a hydroxyl group; y represents 0, 1, or 2; when y is 2, a plurality of $R_{26}$s may be the same or different; $L_4$ represents a divalent linking group selected from —(C═O)—, —(C═O)—O—, —O—(C═O)—, —(C═O)—$NR_{27}$—, —$NR_{27}$—(C═O)—, —$NR_{27}$—(C═O)—$NR_{27}$—, —O—(C═O)—$NR_{27}$—, —$NR_{27}$—(C═O)—O—, —O—, —S—, —SO—, —$SO_2$—, and —$NR_{27}$—; $R_{27}$ represents a hydrogen atom, or a substituted or unsubstituted, alkyl group, alkenyl group, cycloalkyl group, aryl group, or heterocyclic group; when $R_{25}$ and $R_{27}$ have a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; and X represents a halogen atom;

Formula (M-IX)

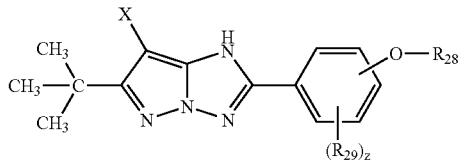

wherein, in formula (M-IX), $R_{28}$ represents a substituted or unsubstituted, alkyl group, alkenyl group, cycloalkyl group, aryl group, or heterocyclic group; when $R_{28}$ has a substituent, the substituent is selected from an alkyl group, a cycloalkyl group, an alkenyl group, an alkynyl group, an aryl group, a heterocyclic group, a halogen atom, an alkoxy group, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group and a hydroxyl group, each of which may be further substituted; $R_{29}$ represents an alkyl group, a cycloalkyl group, an alkenyl group, an alkynyl group, an aryl group, a heterocyclic group, a halogen atom, a cycloalkoxy group, an aryloxy group, an alkylthio group, a cycloalkylthio group, an arylthio group, an alkoxycarbonyl group, an aryloxycarbonyl group, a sulfonamido group, a sulfamoyl group, a ureido group, an acyl group, an acyloxy group, a carbamoyl group, an amido group, a sulfinyl group, a sulfonyl group, an amino group, a cyano group, a nitro group, or a hydroxyl group; X represents a halogen atom; z represents 0, 1, or 2; and when z is 2, a plurality of $R_{29}$s may be the same or different;

Formula (M-X)

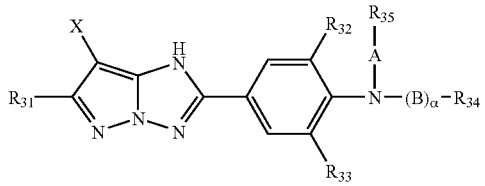

wherein, in formula (M-X), $R_{31}$ represents a tertiary alkyl group; $R_{32}$ and $R_{33}$ each independently represent a hydrogen atom or a substituent; X represents a hydrogen atom, a halogen atom, or an aryloxy group; A and B each independently represent —CO— or —$SO_2$—; α represents 0 or 1; $R_{34}$ represents a hydrogen atom, an alkyl group or an aryl group; $R_{35}$ represents an alkyl group, an aryl group, an alkoxy group, an alkylamino group or an arylamino group; and $R_{34}$ and $R_{35}$ may bond with each other to form a 5- to 7-membered ring;

Formula (Ph)

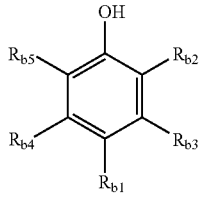

wherein, in formula (Ph), $R_{b1}$ represents an aliphatic group, an aryl group, a carbamoyl group, an acylamino group, a carbonyl group, or a sulfonyl group; and $R_{b2}$ to $R_{b5}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group.

2. The silver halide color photographic photosensitive material as claimed in claim 1, wherein the layer containing the at least one dye-forming coupler and the compound represented by formula (Ph) is a yellow color-forming photosensitive silver halide emulsion layer, in which the dye-forming coupler comprises the yellow dye-forming coupler represented formula (Ia), and wherein said layer further contains at least one compound represented by formula (TS-II) set forth below:

Formula (TS-11)

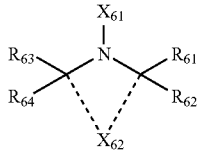

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may bond to each other to form a 5- to 7-membered ring; $X_{61}$ represents a hydrogen atom, an aliphatic group, an aliphatic oxy group, an aliphatic oxycarbonyl group, an aryloxycarbonyl group, an acyl group, an acyloxy group, an aliphatic oxycarbonyloxy group, an aryloxycarbonyloxy group, an aliphatic sulfonyl group, an aryl sulfonyl group, an aliphatic sulfinyl group, an arylsulfinyl group, a sulfamoyl group, a carbamoyl group, a hydroxyl group, or an oxy radical group; $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—.

3. The silver halide color photographic photosensitive material as claimed in claim 2, further containing at least one compound selected from the group consisting of compounds represented by any one of formulae (E-1) to (E-3) set forth below:

Formula (E-1)

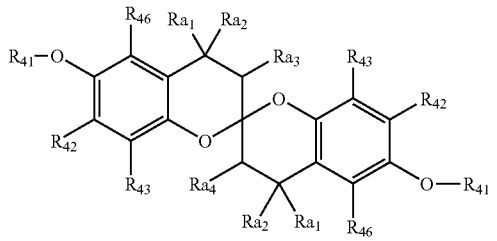

Formula (E-2)

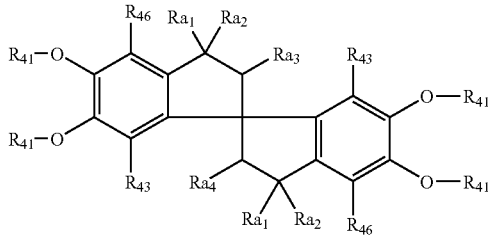

Formula (E-3)

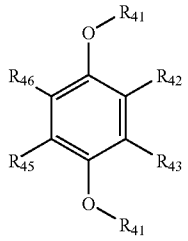

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and $R_{a1}$ to $R_{a4}$ each independently represent a hydrogen atom, or an aliphatic group.

4. The silver halide color photographic photosensitive material as claimed in claim 2, further containing at least one compound selected from the group consisting of a metal complex, a ultraviolet absorbing agent, a water-insoluble homopolymer or copolymer, and a compound represented by any one of formulae (TS-I), (TS-III), (TS-IV), (TS-V), (TS-VI), and (TS-VII) set forth below:

Formula (TS-I)

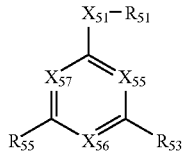

Formula (TS-III)

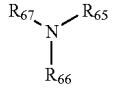

-continued

Formula (TS-IV)

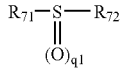

Formula (TS-V)

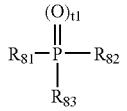

Formula (TS-VI)

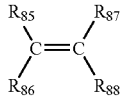

Formula (TS-VII)

$R_{91}$—$Y_{91}$ wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$)($R_{60}$), in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or —C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total number of carbon atoms of the compound represented by formula (TS-I) is 10 or more; and the compound represented by formula (TS-I) is neither identical to the compound represented by formula (Ph) nor the compound represented by any one of formulae (E-1) to (E-3);

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and both $R_{65}$ and $R_{66}$ are not hydrogen atoms at the same time;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q1 represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t1 represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and each of $R_{85}$ to $R_{88}$ cannot simultaneously represent a hydrogen atom; and wherein, in formula (TS-VII), $R_{91}$ represents an hydrophobic group having total carbon atoms of 10 or more; and $Y_{91}$ represents a monovalent organic group containing an alcoholic hydroxyl group.

5. The silver halide color photographic photosensitive material as claimed in claim 1, wherein the at least one dye-forming coupler comprises a yellow dye-forming coupler represented by formula (Ia).

6. The silver halide color photographic photosensitive material as claimed in claim 5, wherein the compound represented by formula (Ph) is a compound represented by any one of formulae (Ph-1), (Ph-2) and (Ph-3):

Formula (Ph-1)

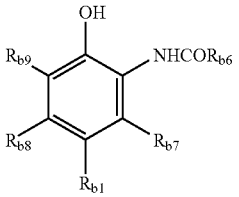

Formula (Ph-2)

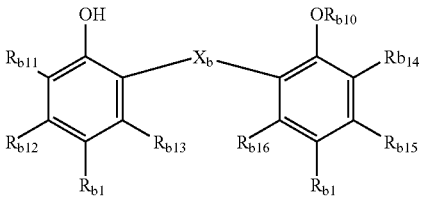

Formula (Ph-3)

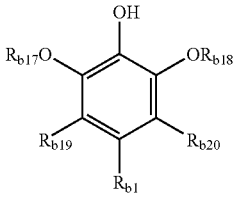

wherein, in formulae (Ph-1), (Ph-2) and (Ph-3), $R_{b1}$ represents an aliphatic group, an aryl group, a carbamoyl group, an acylamino group, a carbonyl group, or a sulfonyl group; $R_{b6}$ represents an aliphatic group, an aryl group, an amino group, or an acyl group; $R_{b7}$ to $R_{b9}$, $R_{b11}$ to $R_{b16}$, $R_{b19}$, and $R_{b20}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; $R_{b10}$ represents a hydrogen atom, an aliphatic group, an acyl group, an oxycarbonyl group, a silyl group, or a phosphoryl group; and $X_b$ represents an alkylene-linking group, a phenylene-linking group, an —O— linking group, or a —S— linking group; $R_{b17}$ and $R_{b18}$ each independently represent an aliphatic group, or an aryl group.

7. The silver halide color photographic photosensitive material as claimed in claim 6, further containing at least one compound selected from the group consisting of compounds represented by any one of formulae (E-1) to (E-3) set forth below:

Formula (E-1)

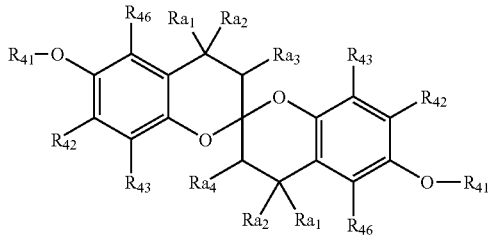

Formula (E-2)

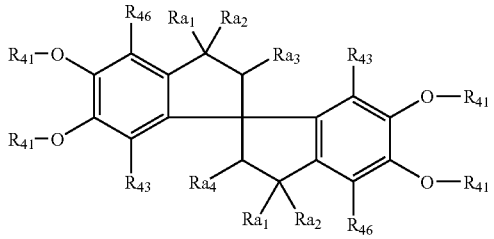

Formula (E-3)

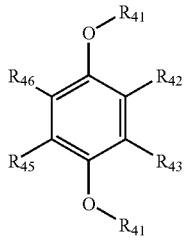

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and $R_{a1}$ to $R_{a4}$ each independently represent a hydrogen atom, or an aliphatic group.

8. The silver halide color photographic photosensitive material as claimed in claim 5, further containing at least one compound selected from the group consisting of a metal complex, a ultraviolet absorbing agent, a water-insoluble homopolymer or copolymer, and a compound represented by any one of formulae (TS-I) to (TS-VII) set forth below:

Formula (TS-I)

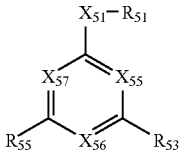

Formula (TS-II)

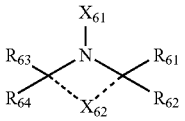

Formula (TS-III)

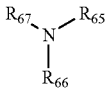

Formula (TS-IV)

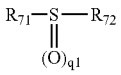

Formula (TS-V)

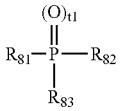

Formula (TS-VI)

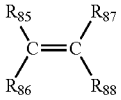

wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$)($R_{60}$) in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or —C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total of carbon atoms of the compound represented by formula (TS-I) is 10 or more; and the compound represented by formulae (TS-I) is neither identical to the compound represented by formula (Ph) nor the compound represented by any one of formulae (E-1) to (E-3);

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, a carbamoyl group, a hydroxy group, or an oxy radical group; $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—; and the total of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total of carbon atoms of $R_{65}$ and $R_{66}$ is 7 or more; and each of $R_{65}$ and $R_{66}$ cannot simultaneously represent a hydrogen atom;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q1 represents 0, 1 or 2; and the total of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t1 represents 0 or 1; each combination of $R_{81}$ and $R_{82}$, and $R_{81}$ and $R_{83}$ may combine together to form a 5- to 8-membered ring; and the total of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and any two of $R_{85}$, $R_{86}$, $R_{87}$ and $R_{88}$ may combine together to form a 5- to 7-membered ring except an aromatic ring only consisting of carbon atoms as a skeleton atom; the total of carbon atoms of the compound represented by formula (TS-VI) is 10 or more; and each of $R_{85}$ to $R_{88}$ cannot simultaneously represent a hydrogen atom; and wherein, in formula (TS-VII), $R_{91}$ represents an hydrophobic group having total carbon atoms of 10 or more; and $Y_{91}$ represents a monovalent organic group containing an alcoholic hydroxyl group.

9. The silver halide color photographic photosensitive material as claimed in claim 1, wherein the compound represented by formula (Ph) is a compound represented by formula (Ph-1) or (Ph-3) set forth below, and wherein the at least one dye-forming coupler is the magenta dye-forming coupler, represented by any one of formulae (M-I) to (M-X):

Formula Ph-1

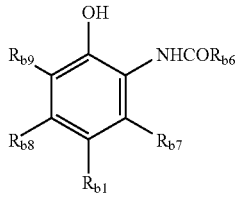

Formula Ph-3

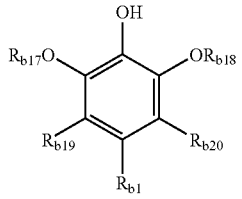

wherein, in formulae (Ph-1) and (Ph-3), $R_{b1}$ represents an aliphatic group, an aryl group, a carbamoyl group, an acylamino group, a carbonyl group, or a sulfonyl group; $R_{b6}$ represents an aliphatic group, an aryl group, an amino group, or an acyl group; $R_{b7}$ to $R_{b9}$, $Rb_{19}$, and $R_{b20}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; and $R_{b17}$ and $R_{b18}$ each independently represent an aliphatic group or an aryl group.

10. The silver halide color photographic photosensitive as claimed in claim 9, wherein the compound represented by formula (Ph-1) or (Ph-3) is a compound represented by formula (Ph-4):

Formula Ph-4

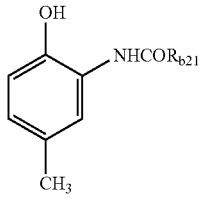

wherein, in formula (Ph-4), $R_{b21}$ represents a straight-chain, branched or cyclic, saturated or unsaturated, and unsubstituted aliphatic group, or a straight-chain, branched or cyclic, and saturated or unsaturated aliphatic group substituted with a halogen atom, a hydroxyl group, —$SR_{b30}$, —$CONR_{b30}R_{b31}$, —$CO_2R_{b30}$, or —OC(=O)$R_{b30}$, in which $R_{b30}$ and $R_{b31}$ each independently represent a hydrogen atom, or a straight-chain, branched, or cyclic, unsubstituted aliphatic group.

11. The silver halide color photographic photosensitive material as claimed in claim 10, wherein, in the compound represented by formula (Ph-4), $R_{b21}$ is a straight-chain, branched, or cyclic, saturated or unsaturated, and unsubstituted aliphatic group.

12. The silver halide color photographic photosensitive material as claimed in claim 10, wherein, in the compound represented by formula (Ph-4), the sum total of carbon atoms in $R_{b21}$ is at least 12.

13. The silver halide color photographic photosensitive material as claimed in claim 9, further containing at least one compound selected from the group consisting of compounds represented by any one of formulae (E-1) to (E-3) set forth below:

Formula (E-1)

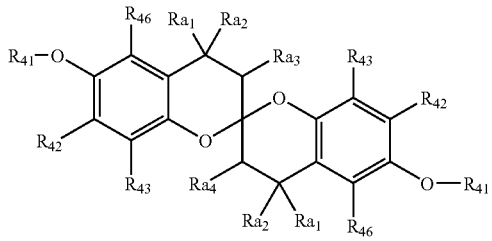

Formula (E-2)

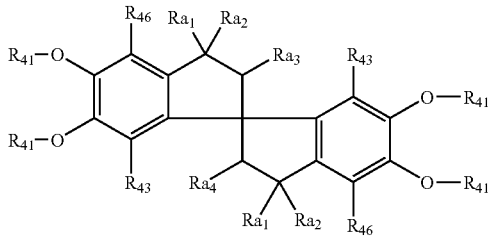

Formula (E-3)

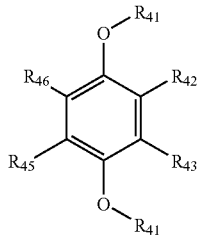

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and $R_{a1}$ to $R_{a4}$ each independently represent a hydrogen atom, or an aliphatic group.

14. The silver halide color photographic photosensitive material as claimed in claim 9, further containing at least one compound selected from the group consisting of a metal complex, a ultraviolet absorbing agent, a water-insoluble homopolymer or copolymer, and a compound represented by any one of formulae (TS-I) to (TS-VII) set forth below:

Formula (TS-I)

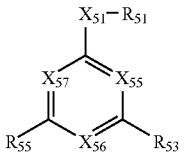

Formula (TS-II)

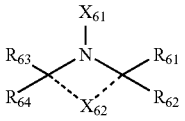

Formula (TS-III)

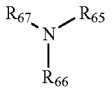

Formula (TS-IV)

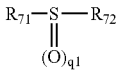

Formula (TS-V)

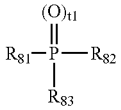

Formula (TS-VI)

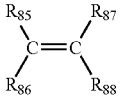

Formula (TS-VII)

$R_{91}—Y_{91}$ wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$)($R_{60}$) in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or —C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; the total number of carbon atoms of the compound represented by formula (TS-I) is 10 or more; the compound represented by formulae (TS-I) is neither identical to the compound represented by any one of formulae (Ph-1), (Ph-3) and (Ph-4) nor the compound represented by any one of formulae (E-1) to (E-3); and each of $R_{51}$ to $R_{57}$ cannot simultaneously represent a hydrogen atom;

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, a carbamoyl group, a hydroxy group, or an oxy radical group; and $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—; and the total number of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and each of $R_{65}$ and $R_{66}$ cannot simultaneously represent a hydrogen atom;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q1 represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t1 represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and each of $R_{85}$ to $R_{88}$ cannot simultaneously represent a hydrogen atom; and wherein, in formula (TS-VII), $R_{91}$ represents an hydrophobic group having total carbon atoms of 10 or more; and $Y_{91}$ represents a monovalent organic group containing an alcoholic hydroxyl group.

15. A silver halide color photographic photosensitive material comprising, on a support, at least one yellow color-forming photosensitive silver halide emulsion layer, at least one magenta color-forming photosensitive silver halide emulsion layer, and at least one cyan color-forming photosensitive silver halide emulsion layer, wherein at least one yellow dye-forming coupler represented by formula (I) is contained in the same layer as at least one compound represented by formula (Ph) and at least one compound represented by formula (TS-II):

Formula (I)

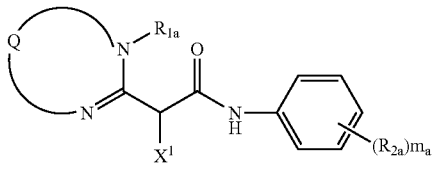

wherein, in formula (I), Q represents a group of non-metal atoms that forms a 5- to 7-membered ring in combination with the —N═C—N($R_{1a}$); $R_{1a}$ represents a substituent; $R_{2a}$ represents a substituent; m represents an integer of 0 or more and 5 or less; when m is 2 or more, $R_{2a}$s may be the same or different, and they may combine together to form a ring; and $X_1$ represents a hydrogen atom, or a group capable of being split-off upon a coupling reaction with an oxidized product of a developing agent;

Formula (Ph)

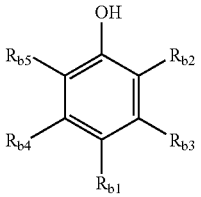

wherein, in formula (Ph), $R_{b1}$ represents an aliphatic group, an aryl group, a carbamoyl group, an acylamino group, a carbonyl group, or a sulfonyl group; and $R_{b2}$ to $R_{b5}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; and Formula (TS-II)

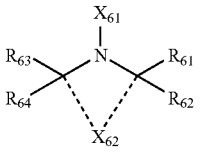

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may bond to each other to form a 5- to 7-membered ring; $X_{61}$ represents a hydrogen atom, an aliphatic group, an aliphatic oxy group, an aliphatic oxycarbonyl group, an aryloxycarbonyl group, an acyl group, an acyloxy group, an aliphatic oxycarbonyloxy group, an aryloxycarbonyloxy group, an aliphatic sulfonyl group, an aryl sulfonyl group, an aliphatic sulfinyl group, an arylsulfinyl group, a sulfamoyl group, a carbamoyl group, a hydroxyl group, or an oxy radical group; $X_{62}$ represents a group of non-metal atoms necessary to form a 5- to 7-membered ring together with the —C(—$R_{61}$)(—$R_{62}$)—N(—$X_{61}$)—C(—$R_{63}$)(—$R_{64}$)—.

16. The silver halide color photographic photosensitive material as claimed claim 15, wherein the yellow dye-forming coupler represented by formula (I) is a yellow dye-forming coupler represented by formula (II):

Formula (II)

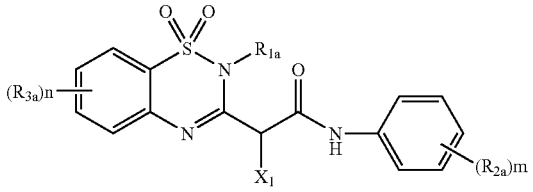

wherein, in formula (II), $R_{1a}$ represents a substituent; $R_{2a}$ represents a substituent; m represents an integer of 0 to 5; when m is 2 or more, a plurality of $R_{2a}$s may be the same or different, and the $R_{2a}$s may bond each other to form a ring; $R_{3a}$ represents a substituent; n represents an integer of 0 to 4; when n is 2 or more, a plurality of $R_{3a}$s may be the same or different, and the $R_{3a}$ may bond each other to form a ring; and $X_1$ represents a hydrogen atom, or a group capable of being split-off upon a coupling reaction with an oxidized product of a developing agent.

17. The silver halide color photographic photosensitive material as claimed in claim 16, wherein, in the yellow dye-forming coupler represented by formula (II), $R_{1a}$ is a substituted or unsubstituted alkyl group.

18. The silver halide color photographic photosensitive material as claimed in claim 17, wherein, in the yellow dye-forming coupler represented by formula (II), $R_{1a}$ represents a substituted or unsubstituted alkyl group having at least 2 carbon atoms; m is an integer of from 1 to 5; at least one $R_{2a}$ is located in an ortho-position to the —CONIH— group, and is a group or atom selected from a halogen atom, an alkoxy group, an aryloxy group, an alkyl group, an alkylthio group and an arylthio group; and $X_1$ is a group capable of being split-off upon a coupling reaction with an oxidation product of a developing agent.

19. The silver halide color photographic photosensitive material as claimed in claim 18, wherein, in the yellow dye-forming coupler represented by formula (II), $R_{1a}$ is an alkoxypropyl group; and at least one $R_{2a}$ is an alkylthio group located in an ortho-position to the —CONH— group.

20. The silver halide color photographic photosensitive material as claimed in claim 19, wherein, in the yellow dye-forming coupler represented by formula (II), at least one $R_{2a}$ is an alkylthio group located in an ortho-position to the —CONH— group, and another $R_{2a}$ is a t-butyl group located in the para-position to the alkylthio group.

21. The silver halide color photographic photosensitive material as claimed in claim 16, wherein, in the yellow dye-forming coupler represented by formula (II), $X_1$ is a 5,5-dimethyloxazolidine-2,4-dione-3-yl group.

22. A silver halide color photographic photosensitive material comprising, on a support, at least one yellow color-forming photosensitive silver halide emulsion layer, at least one magenta color-forming photosensitive silver halide emulsion layer, and at least one cyan color-forming photosensitive silver halide emulsion layer, wherein at least one yellow dye-forming coupler represented by formula (I) is contained in the same layer as at least one compound represented by any one of formulae (Ph-1), (Ph-2') and (Ph-3):

Formula (I)

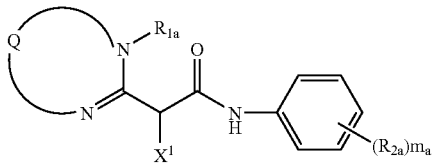

wherein, in formula (I), Q represents a group of non-metal atoms that forms a 5- to 7-membered ring in combination with the —N═C—N($R_{1a}$); $R_{1a}$ represents a substituent; $R_{2a}$ represents a substituent; m represents an integer of 0 or more and 5 or less; when m is 2 or more, $R_{2a}$s may be the same or different, and they may combine together to form a ring; and $X_1$ represents a hydrogen atom, or a group capable of being split-off upon a coupling reaction with an oxidized product of a developing agent;

Formula (Ph-1)

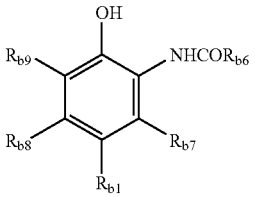

wherein in formula (Ph-1), $R_{b1}$ represents an aliphatic group, an aryl group, a carbamoyl group, an acylamino group, a carbonyl group, or a sulfonyl group; $R_{b6}$ represents an aliphatic group, an aryl group, an amino group, or an acyl group; $R_{b7}$ to $R_{b9}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group;

Formula (Ph-2')

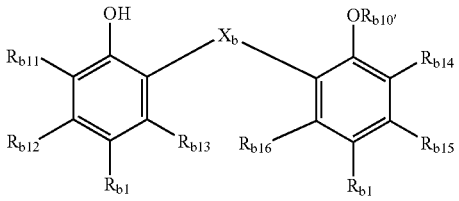

wherein in formula (Ph-2'), $R_{b10}$' represents an aliphatic group, an acyl group, an oxycarbonyl group, a silyl group, or a phosphoryl group; $R_{b1}$ represents an aliphatic group, an aryl group, a carbamoyl group, an acylamino group, a carbonyl group, or a sulfonyl group; $R_{b11}$ to $R_{b16}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; and $X_b$ represents an alkylene-linking group, a phenylene-linking group, an —O— linking group, or a —S— linking group;

Formula (Ph-3)

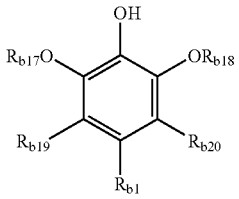

wherein in formula (Ph-3), $R_{b1}$ represents an aliphatic group, an aryl group, a carbamoyl group, an acylamino group, a carbonyl group, or a sulfonyl group; $R_{b19}$ and $R_{b20}$ each independently represent a hydrogen atom, a halogen atom, a hydroxyl group, an aliphatic group, an aryl group, a heterocyclic group, an alkyloxy group, an aryloxy group, a heterocyclic oxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group, or an arylthio group; and $R_{b17}$ and $R_{b18}$ each independently represent an aliphatic group, or an aryl group.

23. The silver halide color photographic photosensitive material as claimed in claim 22, wherein the layer containing the at least one yellow dye-forming coupler represented by formula (I) contains at least one compound represented by formula (Ph-1) or (Ph-3).

* * * * *